US012115421B2

(12) United States Patent
Greensmith et al.

(10) Patent No.: US 12,115,421 B2
(45) **Date of Patent: *Oct. 15, 2024**

(54) GOLF CLUB HEADS

(71) Applicant: Taylor Made Golf Company, Inc., Carlsbad, CA (US)

(72) Inventors: Matthew Greensmith, Vista, CA (US); Bing-Ling Chao, San Diego, CA (US); Matthew David Johnson, Encinitas, CA (US); Christopher John Harbert, Carlsbad, CA (US); Todd P. Beach, Encinitas, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/202,040

(22) Filed: May 25, 2023

(65) Prior Publication Data

US 2024/0001204 A1 Jan. 4, 2024

Related U.S. Application Data

(63) Continuation of application No. 17/132,645, filed on Dec. 23, 2020, now Pat. No. 11,701,557, which is a (Continued)

(51) Int. Cl.
*A63B 53/04* (2015.01)
*A63B 53/06* (2015.01)
(Continued)

(52) U.S. Cl.
CPC ..... *A63B 53/0466* (2013.01); *A63B 53/0412* (2020.08); *A63B 53/0416* (2020.08); (Continued)

(58) Field of Classification Search
CPC ..... A63B 53/0408; A63B 53/0466; A63B 53/0412; A63B 53/0416; A63B 53/0433; (Continued)

(56) References Cited

U.S. PATENT DOCUMENTS 727,819 A 5/1903 Mattern
1,337,958 A 4/1920 Reach
(Continued)

FOREIGN PATENT DOCUMENTS

CN 201299943 Y 9/2002
CN 1395495 2/2003
(Continued)

OTHER PUBLICATIONS

Office Action (with English translation) for related Taiwanese Application No. 108136509, mailed May 9, 2023, 29 pages.

*Primary Examiner* — John E Simms, Jr.
(74) *Attorney, Agent, or Firm* — Klarquist Sparkman, LLP

(57) ABSTRACT

A cast cup can include a forward portion of a golf club head, including a hosel, forward portions of a crown, sole, heel, and toe, and a face portion or an opening to receive a face insert. A rear ring can be formed separately from the cast cup and coupled to heel and toe portions of the cast cup to form a rigid club head body, such that the club head body defines a hollow interior region, a crown opening, a sole opening, and/or face opening. The cast cup and rear ring can be made of different materials, including various metals, composites, and polymers. Composite crown, sole, and/or face inserts can be coupled to the crown, sole, and/or face openings. Weights can be coupled to the cast cup and to the rear ring. The face can have a complex variable thickness geometry.

26 Claims, 91 Drawing Sheets

Related U.S. Application Data continuation-in-part of application No. 16/161,337, filed on Oct. 16, 2018, now Pat. No. 10,874,915, which is a continuation-in-part of application No. 16/059,801, filed on Aug. 9, 2018, now Pat. No. 10,780,327.

(60) Provisional application No. 62/955,727, filed on Dec. 31, 2019, provisional application No. 62/543,778, filed on Aug. 10, 2017.

(51) Int. Cl.

| | |
|---|---|
| ***A63B 60/02*** | (2015.01) |
| ***A63B 60/04*** | (2015.01) |
| ***A63B 60/52*** | (2015.01) |
| *A63B 102/32* | (2015.01) |

(52) U.S. Cl.

CPC ..... *A63B 53/0433* (2020.08); *A63B 53/0437* (2020.08); *A63B 53/0454* (2020.08); *A63B 53/0462* (2020.08); *A63B 53/06* (2013.01); *A63B 60/04* (2015.10); *A63B 60/52* (2015.10); *A63B 2053/0491* (2013.01); *A63B 60/02* (2015.10); *A63B 2102/32* (2015.10); *A63B 2209/00* (2013.01)

(58) Field of Classification Search

CPC ... A63B 53/0437; A63B 53/042; A63B 53/06; A63B 60/02; A63B 2053/0491

See application file for complete search history.

(56) References Cited

U.S. PATENT DOCUMENTS

| | | | |
|---|---|---|---|
| 1,396,470 | A | 2/1921 | Taylor |
| 1,509,429 | A | 1/1924 | Hillerich |
| 1,526,438 | A | 2/1925 | Scott |
| 1,965,954 | A | 4/1930 | Davis |
| 2,005,401 | A | 6/1935 | Storz |
| 2,460,435 | A | 2/1949 | Schaffer |
| 3,637,218 | A | 1/1972 | Carlino |
| 3,941,390 | A | 3/1976 | Hussey |
| 4,753,440 | A | 6/1988 | Chorne |
| 4,811,950 | A | 3/1989 | Kobayashi |
| 5,193,811 | A | 3/1993 | Okumoto et al. |
| 5,219,408 | A | 6/1993 | Sun |
| 5,282,624 | A | 2/1994 | Viste |
| 5,344,140 | A | 9/1994 | Anderson |
| 5,437,088 | A | 8/1995 | Igarashi |
| 5,499,814 | A | 3/1996 | Lu |
| 5,527,034 | A | 6/1996 | Ashcraft et al. |
| 5,547,427 | A | 8/1996 | Rigal et al. |
| 5,676,606 | A | 10/1997 | Schaeffer et al. |
| 5,720,674 | A | 2/1998 | Galy |
| 5,785,610 | A | 7/1998 | Birmingham |
| 5,930,887 | A | 8/1999 | Tomita et al. |
| 5,993,329 | A | 11/1999 | Shieh |
| 6,001,032 | A | 12/1999 | Onuki et al. |
| 6,001,495 | A | 12/1999 | Bristow et al. |
| 6,117,023 | A | 9/2000 | Onuki et al. |
| 6,224,497 | B1 | 5/2001 | Antonious |
| 6,248,025 | B1 | 6/2001 | Murphy et al. |
| 6,305,063 | B1 | 10/2001 | Ashcraft et al. |
| 6,309,310 | B1 | 10/2001 | Shira |
| 6,319,148 | B1 | 11/2001 | Tom |
| 6,332,848 | B1 | 12/2001 | Long et al. |
| 6,348,013 | B1 | 2/2002 | Kosmatka |
| 6,364,789 | B1 | 4/2002 | Kosmatka |
| 6,398,665 | B1 | 6/2002 | Antonious |
| 6,428,426 | B1 | 8/2002 | Helmstetter et al. |
| 6,471,604 | B2 | 10/2002 | Hocknell et al. |
| 6,491,592 | B2 | 12/2002 | Cackett et al. |
| 6,497,629 | B2 | 12/2002 | Takeda |
| 6,565,452 | B2 | 5/2003 | Helmstetter et al. |
| 6,575,845 | B2 | 6/2003 | Galloway et al. |
| 6,582,323 | B2 | 6/2003 | Soracco et al. |
| 6,592,466 | B2 | 7/2003 | Helmstetter et al. |
| 6,604,568 | B2 | 8/2003 | Bliss et al. |
| 6,607,452 | B2 | 8/2003 | Helmstetter et al. |
| 6,623,376 | B2 | 9/2003 | Poyner |
| 6,645,086 | B1 | 11/2003 | Chen |
| 6,648,773 | B1 | 11/2003 | Evans |
| 6,652,391 | B1 | 11/2003 | Kubica et al. |
| 6,663,504 | B2 | 12/2003 | Hocknell et al. |
| 6,669,578 | B1 | 12/2003 | Evans |
| 6,676,536 | B1 | 1/2004 | Jacobson |
| 6,710,287 | B2 | 3/2004 | Lu |
| 6,713,717 | B2 | 3/2004 | Takeda |
| 6,719,644 | B2 | 4/2004 | Beach |
| 6,739,376 | B1 | 5/2004 | Cheng et al. |
| 6,739,982 | B2 | 5/2004 | Murphy et al. |
| 6,739,983 | B2 | 5/2004 | Helmstetter et al. |
| 6,758,763 | B2 | 7/2004 | Murphy et al. |
| 6,789,304 | B2 | 9/2004 | Kouno |
| 6,800,038 | B2 | 10/2004 | Willett et al. |
| 6,860,818 | B2 | 3/2005 | Mahaffey et al. |
| 6,860,824 | B2 | 3/2005 | Evans |
| 6,875,129 | B2 | 4/2005 | Erickson et al. |
| 6,881,159 | B2 | 4/2005 | Galloway et al. |
| 6,890,267 | B2 | 5/2005 | Mahaffey et al. |
| 6,904,663 | B2 | 6/2005 | Willett et al. |
| 6,926,619 | B2 | 8/2005 | Helmstetter et al. |
| 6,929,565 | B2 | 8/2005 | Nakahara et al. |
| 6,929,566 | B2 | 8/2005 | Sano |
| 6,955,612 | B2 | 10/2005 | Lu |
| 6,966,848 | B2 | 11/2005 | Kusumoto |
| 6,971,436 | B2 | 12/2005 | Huang |
| 6,988,960 | B2 | 1/2006 | Mahaffey et al. |
| 6,991,558 | B2 | 1/2006 | Beach et al. |
| 6,994,635 | B2 | 2/2006 | Poyner |
| 6,994,637 | B2 | 2/2006 | Murphy et al. |
| 7,025,692 | B2 | 4/2006 | Erickson et al. |
| 7,066,833 | B2 | 6/2006 | Yamamoto |
| 7,066,835 | B2 | 6/2006 | Evans et al. |
| 7,070,517 | B2 | 7/2006 | Cackett et al. |
| 7,086,962 | B2 | 8/2006 | Galloway et al. |
| 7,097,573 | B2 | 8/2006 | Erickson et al. |
| 7,118,493 | B2 | 10/2006 | Galloway |
| 7,121,957 | B2 | 10/2006 | Hocknell et al. |
| 7,125,344 | B2 | 10/2006 | Hocknell et al. |
| 7,128,661 | B2 | 10/2006 | Soracco et al. |
| 7,128,664 | B2 | 10/2006 | Onoda et al. |
| 7,144,333 | B2 | 12/2006 | Murphy et al. |
| 7,152,656 | B2 | 12/2006 | Huang et al. |
| 7,166,038 | B2 | 1/2007 | Williams et al. |
| 7,166,039 | B2 | 1/2007 | Hettinger et al. |
| 7,189,165 | B2 | 3/2007 | Yamamoto |
| 7,229,362 | B2 | 6/2007 | Tavares |
| 7,258,630 | B2 | 8/2007 | Erickson et al. |
| 7,258,631 | B2 | 8/2007 | Galloway et al. |
| 7,291,074 | B2 | 11/2007 | Kouno et al. |
| 7,291,075 | B2 | 11/2007 | Williams et al. |
| 7,306,527 | B2 | 12/2007 | Williams et al. |
| 7,338,388 | B2 | 3/2008 | Schweigert et al. |
| 7,338,390 | B2 | 3/2008 | Lindsay |
| 7,344,452 | B2 | 3/2008 | Imamoto et al. |
| 7,360,578 | B2 | 4/2008 | Tseng |
| 7,371,191 | B2 | 5/2008 | Sugimoto |
| 7,402,113 | B2 | 7/2008 | Mori et al. |
| 7,413,520 | B1 | 8/2008 | Hocknell et al. |
| 7,416,496 | B2 | 8/2008 | Galloway et al. |
| 7,431,667 | B2 | 10/2008 | Vincent et al. |
| 7,435,190 | B2 | 10/2008 | Sugimoto |
| 7,448,961 | B2 | 11/2008 | Lin |
| 7,452,286 | B2 | 11/2008 | Lin et al. |
| 7,462,109 | B2 | 12/2008 | Erickson et al. |
| 7,470,201 | B2 | 12/2008 | Nakahara et al. |
| 7,476,161 | B2 | 1/2009 | Williams et al. |
| 7,481,720 | B2 | 1/2009 | Tavares |
| 7,497,789 | B2 | 3/2009 | Burnett et al. |
| 7,503,854 | B2 | 3/2009 | Galloway et al. |
| 7,513,296 | B1 | 4/2009 | Yu et al. |
| 7,524,249 | B2 | 4/2009 | Breier et al. |

(56) References Cited

U.S. PATENT DOCUMENTS 7,540,810 B2 6/2009 Hettinger et al.
7,549,935 B2 6/2009 Foster et al.
7,584,531 B2 9/2009 Schweigert et al.
7,594,863 B2 9/2009 Ban
7,607,991 B2 10/2009 Sorenson
7,628,713 B2 12/2009 Tavares
7,632,193 B2 12/2009 Thielen
7,637,822 B2 12/2009 Foster et al.
7,658,686 B2 2/2010 Soracco
7,674,188 B2 3/2010 Ban
7,674,190 B2 3/2010 Galloway et al.
7,677,990 B2 3/2010 Ban
7,690,098 B2 4/2010 Chen
7,691,008 B2 4/2010 Oyama
7,695,377 B2 4/2010 Yamagishi et al.
7,749,097 B2 7/2010 Foster et al.
7,758,449 B2 7/2010 Gilbert et al.
7,758,454 B2 7/2010 Burnett et al.
7,785,212 B2 8/2010 Lukasiewicz, Jr. et al.
7,803,065 B2 9/2010 Breier et al.
7,811,178 B2 10/2010 Davis
7,815,521 B2 10/2010 Ban et al.
7,819,756 B2 10/2010 Ban et al.
7,828,671 B2 11/2010 Ban
7,846,038 B2 12/2010 Foster et al.
7,846,040 B2 12/2010 Ban
7,878,923 B2 2/2011 Yamagishi et al.
7,901,297 B2 3/2011 Ban et al.
7,905,798 B2 3/2011 Petersen et al.
7,918,747 B2 4/2011 Johnson et al.
7,931,546 B2 4/2011 Bennett et al.
7,934,998 B2 5/2011 Yakota
7,976,404 B2 7/2011 Golden et al.
7,976,406 B2 7/2011 Gilbert et al.
7,980,964 B2 7/2011 Soracco
7,993,216 B2 * 8/2011 Lee ..... A63B 53/0466 473/345
8,012,036 B2 9/2011 Nakamura
8,020,606 B2 9/2011 Chao et al.
8,033,929 B2 10/2011 Yamagishi et al.
8,038,545 B2 10/2011 Soracco
8,043,167 B2 10/2011 Boyd et al.
8,062,151 B2 11/2011 Boyd et al.
8,092,320 B2 1/2012 Yamagishi et al.
8,100,781 B2 1/2012 Burnett et al.
8,128,511 B2 3/2012 Golden et al.
8,128,513 B2 3/2012 Gilbert et al.
8,133,135 B2 3/2012 Stites et al.
8,147,354 B2 4/2012 Hartwell et al.
8,167,739 B2 5/2012 Lukasiewicz, Jr. et al.
8,172,699 B2 5/2012 Nakamura
8,187,119 B2 5/2012 Rae et al.
8,214,992 B2 7/2012 Hirano
8,216,087 B2 7/2012 Breier et al.
8,221,260 B2 7/2012 Stites et al.
8,226,499 B2 7/2012 Soracco
8,277,336 B2 10/2012 Hirano
8,337,324 B2 12/2012 Sander et al.
8,337,326 B2 12/2012 Lukasiewicz, Jr. et al.
8,342,981 B2 1/2013 Johnson et al.
8,376,877 B1 2/2013 Galloway
8,419,569 B2 * 4/2013 Bennett ..... A63B 53/04 473/345
8,475,292 B2 7/2013 Rahrig et al.
8,506,420 B2 8/2013 Hocknell et al.
8,506,421 B2 8/2013 Stites et al.
8,517,861 B2 8/2013 Golden et al.
8,523,703 B2 9/2013 Rife
8,523,705 B2 9/2013 Breier et al.
8,550,935 B2 10/2013 Stites et al.
8,585,513 B2 11/2013 Ban
8,684,861 B2 4/2014 Carlyle et al.
8,696,490 B2 4/2014 Ban
8,715,109 B2 5/2014 Bennett et al.
8,727,908 B2 5/2014 Goto
8,747,252 B2 6/2014 Lukasiewicz, Jr. et al.
8,758,162 B2 6/2014 Ban
8,827,832 B2 9/2014 Breier et al.
8,827,833 B2 9/2014 Amano et al.
8,834,291 B2 9/2014 Ban
8,845,453 B1 9/2014 Ehlers
8,858,361 B2 10/2014 Ripp et al.
8,864,601 B1 10/2014 Ehlers
8,938,871 B2 1/2015 Roach et al.
8,939,192 B2 1/2015 Solesbee et al.
8,979,670 B2 3/2015 Aguayo et al.
9,028,340 B2 5/2015 Ban
9,033,820 B2 5/2015 Kato
9,079,079 B2 7/2015 Fossum et al.
9,089,746 B2 7/2015 Schweigert
9,149,692 B2 10/2015 Shimahara
9,162,116 B2 10/2015 Carlyle et al.
9,162,117 B2 10/2015 Ehlers
9,308,421 B2 4/2016 Ban et al.
9,308,422 B2 4/2016 Ripp et al.
9,320,949 B2 4/2016 Golden et al.
9,403,068 B2 8/2016 Golden et al.
9,457,245 B2 10/2016 Lee
9,474,946 B2 10/2016 Bennett et al.
9,480,887 B2 11/2016 Myrhum et al.
9,486,676 B1 11/2016 Thall et al.
9,504,885 B2 11/2016 Ban
9,504,889 B2 11/2016 Mitzel et al.
9,539,477 B2 1/2017 Ripp et al.
9,545,545 B2 1/2017 Li
9,545,546 B2 1/2017 Li
9,545,661 B2 1/2017 Li
9,555,298 B2 1/2017 Carlyle et al.
9,566,480 B2 2/2017 Voges
9,579,550 B2 2/2017 Aguayo et al.
9,636,559 B2 5/2017 de la Cruz et al.
9,636,757 B1 5/2017 Rice et al.
9,687,703 B2 6/2017 Li
9,687,704 B2 6/2017 Li
9,782,642 B1 * 10/2017 DeMille ..... A63B 60/42
9,814,944 B1 11/2017 Greaney et al.
9,814,951 B2 11/2017 Ripp et al.
9,844,709 B2 12/2017 Tassistro
9,868,036 B1 * 1/2018 Kleinert ..... A63B 53/06
9,868,037 B1 1/2018 Ripp et al.
9,901,789 B2 2/2018 Kitagawa et al.
9,908,013 B2 3/2018 Hettinger et al.
9,914,027 B1 * 3/2018 Harbert ..... A63B 60/00
9,931,550 B1 4/2018 Seluga et al.
9,937,389 B2 4/2018 Kitagawa et al.
9,950,225 B2 4/2018 Aguayo et al.
9,975,014 B2 5/2018 Carlyle et al.
9,975,015 B2 5/2018 Ripp et al.
10,004,958 B2 6/2018 Tang et al.
10,076,689 B2 9/2018 de la Cruz et al.
10,130,855 B2 11/2018 Stokke
10,155,144 B2 12/2018 Lee
10,183,201 B2 1/2019 Schweigert
10,195,502 B2 2/2019 Ripp et al.
10,213,660 B1 2/2019 Beno et al.
10,213,663 B2 2/2019 Goudarzi et al.
10,238,926 B2 3/2019 Carlyle et al.
10,874,915 B2 12/2020 Greensmith et al.
10,881,917 B2 1/2021 Greensmith et al.
11,110,325 B2 9/2021 Spackman et al.
2002/0091014 A1 7/2002 Aldrich
2002/0183134 A1 12/2002 Allen et al.
2002/0187853 A1 12/2002 Beach et al.
2002/0193175 A1 12/2002 Soracco et al.
2002/0193177 A1 12/2002 Poyner
2003/0017886 A1 1/2003 Hitoshi et al.
2003/0060306 A1 3/2003 Aldrich
2003/0064823 A1 4/2003 Yamamoto
2003/0083151 A1 5/2003 Nakahara et al.
2003/0092506 A1 5/2003 Matsunaga
2004/0083596 A1 5/2004 Willett et al.
2004/0099538 A1 5/2004 Chao et al.
2004/0116208 A1 6/2004 De Shiell et al.
2005/0032586 A1 2/2005 Willett et al.

(56) References Cited

U.S. PATENT DOCUMENTS

2005/0034834 A1 2/2005 Huang
2005/0181310 A1 8/2005 Yang et al.
2005/0209019 A1 9/2005 Schweigert
2005/0221915 A1 10/2005 De Shiell et al.
2005/0224207 A1 10/2005 Huang
2006/0019770 A1 1/2006 Meyer et al.
2006/0025233 A1 2/2006 Lin
2006/0052177 A1 3/2006 Norihiko et al.
2006/0100028 A1 5/2006 Kuo
2007/0049410 A1 3/2007 Matsunaga
2007/0049415 A1 3/2007 Shear
2007/0078028 A1 4/2007 Huang
2007/0079946 A1 4/2007 Lin
2007/0173346 A1 7/2007 Chiang et al.
2007/0202963 A1 8/2007 Oyama
2007/0219018 A1 9/2007 Hirano
2008/0139339 A1 6/2008 Cheng
2008/0171610 A1 7/2008 Shin
2009/0209364 A1 8/2009 Lukasiewicz, Jr. et al.
2009/0286615 A1* 11/2009 De La Cruz ..... A63B 53/0466 473/282
2009/0293259 A1 12/2009 Rice
2010/0105499 A1 4/2010 Roach et al.
2010/0125000 A1 5/2010 Lee
2010/0203983 A1* 8/2010 Stites ..... A63B 60/02 473/345
2010/0248860 A1 9/2010 Guerrette et al.
2010/0290944 A1 11/2010 Lin et al.
2011/0009211 A1 1/2011 Chao et al.
2011/0092311 A1 4/2011 DeShiell et al.
2011/0159986 A1 6/2011 Chao et al.
2012/0225735 A1 9/2012 Honea et al.
2013/0123040 A1 5/2013 Willett et al.
2013/0172103 A1 7/2013 Greensmith et al.
2013/0210542 A1* 8/2013 Harbert ..... A63B 53/06 473/338
2013/0252755 A1 9/2013 Soracco
2014/0011605 A1* 1/2014 Lee ..... A63B 60/00 473/335
2014/0080632 A1 3/2014 Deshmukh et al.
2014/0080633 A1 3/2014 Bezilla et al.
2014/0256464 A1 9/2014 Chao et al.
2014/0283364 A1 9/2014 Chiang et al.
2014/0349780 A1 11/2014 Fossum
2015/0000366 A1 1/2015 Lo
2015/0018119 A1 1/2015 Breier et al.
2015/0072801 A1 3/2015 Chang
2015/0148149 A1 5/2015 Beach et al.
2015/0190687 A1 7/2015 Clausen et al.
2016/0001140 A1 1/2016 Lo et al.
2016/0067563 A1 3/2016 Murphy et al.
2016/0175666 A1 6/2016 Chao et al.
2016/0279489 A1 9/2016 Seluga et al.
2016/0361607 A1 12/2016 Huang et al.
2016/0375326 A1 12/2016 Nunez et al.
2017/0043222 A1 2/2017 Stokke et al.
2017/0095711 A1 4/2017 Ferguson et al.
2017/0246518 A1 8/2017 Tang et al.
2018/0001158 A1 1/2018 Mizutani
2018/0056147 A1 3/2018 Ripp et al.
2018/0104548 A1 4/2018 Ripp et al.
2018/0111027 A1 4/2018 Funaki et al.
2018/0126228 A1 5/2018 Penney et al.
2018/0133566 A1 5/2018 Kitagawa et al.
2018/0169485 A1 6/2018 Henrikson et al.
2018/0236315 A1 8/2018 Aguayo et al.
2018/0243616 A1 8/2018 Carlyle et al.
2018/0311545 A1 11/2018 Lambeth et al.
2018/0369657 A1 12/2018 Ban
2019/0009138 A1 1/2019 Aguayo et al.
2019/0022472 A1 1/2019 Del Rosario et al.
2019/0046844 A1 2/2019 Chao et al.
2019/0046845 A1* 2/2019 Greensmith ..... C22C 14/00
2019/0046847 A1 2/2019 Stokke
2020/0038721 A1 2/2020 Greensmith et al.
2021/0069558 A1 3/2021 Greensmith et al.
2021/0113896 A1 4/2021 Greensmith et al.

FOREIGN PATENT DOCUMENTS

CN 1439439 9/2003
CN 1248752 C 4/2006
CN 1958106 5/2007
CN 101018589 8/2007
CN 102209579 10/2011
CN 103386184 11/2013
CN 103842111 6/2014
CN 103877712 6/2014
CN 104043235 9/2014
CN 104645569 5/2015
CN 106457394 2/2017
CN 211836196 U 11/2020
JP 2000365908 11/2000
JP 2000371391 12/2000
JP 2001221915 7/2001
JP 2001229753 7/2001
JP 2002079191 3/2002
JP 2002165903 6/2002
JP 2002172187 6/2002
JP 2002306805 10/2002
JP 2003038690 2/2003
JP 2003275343 9/2003
JP 2005137940 6/2005
JP 2006006975 1/2006
JP 3762906 4/2006
TW 200806359 2/2008

* cited by examiner

| | Caster 1 | Caster 2 | Caster 3 | Caster 4 | Caster 5 | Caster 6 |
|---|---|---|---|---|---|---|
| Degree of complexity of cluster | 1 | 3 | 2 | 2 | 2 | 5 |
| A max (m) | 0.15 | 0.38 | 0.42 | 0.42 | 0.42 | 0.6 |
| A min (m) | NA | 0.28 | 0.24 | 0.24 | 0.24 | 0.3 |
| Major runner cross section | 21 mm, 23 mm | 22 mm, 30 mm | 22 mm, 22 mm | 26 mm | 33 mm, 33 mm | 20 mm, 45 mm |
| Main gate cross section | 22 mm, 21 mm | 23 mm, 20 mm | 23 mm, 20 mm | 23 mm, 20 mm | 23 mm, 20 mm | 22 mm, 30 mm |
| Runner cross sectional area ($m^2$) | 0.000483 | 0.00066 | 0.000209 | 0.000616 | 0.000471 | 0.0009 |
| Wet perimeter (m) | 0.088 | 0.104 | 0.066 | 0.067962 | 0.999000 | 0.13 |
| Gate cross sectional area ($m^2$)[02] | 0.000462 | 0.00092 | 0.00092 | 0.00092 | 0.00092 | 0.00132 |
| Interface getting ratio (%) runner-to-gate[03] | 104.55% | 71.74% | 22.72% | 86.93% | 51.24% | 68.16% |
| R (flow radius) of runner (m) | 0.0054 | 0.0063 | 0.0032 | 0.0070 | 0.0048 | 0.0059 |
| Sharp turn | 1 | 2 | 2 | 2 | 2 | 3 |
| Rotation (mm) | 505 | 370 | 380 | 380 | 380 | 340 |
| Shell preheat temp($^0$C) | 900 | 750 | 750 | 750 | 750 | 500 |
| Angular speed ω (rad/sec) | 52.88 | 36.75 | 39.79 | 39.79 | 35.79 | 35.60 |
| Pouring material (kg) | 9.3 | 39.2 | 35 | 32 | 32 | 72.2 |
| Casting pieces | 14 | 48 | 48 | 48 | 48 | 96 |
| Process loss(kg) | 3.9 | 6 | 7.5 | 7.5 | 7.5 | 10 |

FIG. 16

| | | | | | | |
|---|---|---|---|---|---|---|
| Actual available filling material (kg) | 5.4 | 33.2 | 27.5 | 24.5 | 24.5 | 62.2 |
| Material usage (kg/pc) (w/o process loss) | 0.664 | 0.817 | 0.729 | 0.667 | 0.667 | 0.752 |
| Material usage (kg/pc) (w/ process loss) | 0.386 | 0.692 | 0.573 | 0.510 | 0.510 | 0.648 |
| Process loss ratio | 41.9% | 15.3% | 21.4% | 23.4% | 23.4% | 13.9% |
| Velocity max (m/s) | 7.93 | 14.72 | 16.71 | 16.71 | 16.71 | 14.24 |
| Velocity min (m/s) | NA | 10.85 | 9.55 | 9.55 | 9.55 | 9.61 |
| Acceleration max ($m/s^2$) | 419.47 | 570.45 | 665.04 | 655.04 | 665.04 | 507.05 |
| Acceleration min ($m/s^3$) | NA | 420.33 | 380.02 | 380.02 | 380.02 | 342.26 |
| Force max (N1) | 161.80 | 394.56 | 381.01 | 339.45 | 339.45 | 328.53 |
| Force min (N1) | NA | 290.73 | 217.72 | 193.97 | 193.97 | 221.75 |
| Pressure max (Pa) | 334984.13 | 597821.56 | 1823027.72 | 551289.62 | 720076.71 | 365027.92 |
| Pressure min (Pa) | NA | 316010.94 | 236653.91 | 210837.12 | 210637.12 | 157995.81 |
| Kinetic energy max (J) | 12.13 | 74.97 | 80.01 | 71.28 | 71.23 | 65.71 |
| Density (MP) ($g/cm^2$) | 4.11 | 4.11 | 4.11 | 4.11 | 4.11 | 4.11 |
| Viscosity (MP) ($g/cm^2sec$) | 0.033 | 0.033 | 0.033 | 0.033 | 0.033 | 0.033 |
| Renumber max | 212075.72 | 455478.47 | 263556.77 | 582820.22 | 395456.52 | 491181.21 |
| Renumber min | NA | 342884.14 | 150681.01 | 333040.13 | 226548.68 | 331547.32 |
| Casting yield | 94% | 93% | 78% | 94% | 94% | 89% |

FIG. 17

GOLF CLUB HEADS

CROSS-REFERENCE TO RELATED APPLICATIONS

This application is a continuation of U.S. patent application Ser. No. 17/132,645 filed Dec. 23, 2020, now U.S. Pat. No. 11,701,557, which is a continuation-in-part of U.S. patent application Ser. No. 16/161,337 filed Oct. 16, 2018, now U.S. Pat. No. 10,874,915, which is a continuation-in-part of U.S. patent application Ser. No. 16/059,801 filed Aug. 9, 2018, now U.S. Pat. No. 10,780,327, which claims the benefit of U.S. Provisional Patent Application No. 62/543,778, filed Aug. 10, 2017, all of which are incorporated by reference herein in their entirety.

This application also claims priority, through U.S. patent application Ser. No. 17/132,645, to U.S. Provisional Patent Application No. 62/955,727 filed Dec. 31, 2019, which is incorporated by reference herein in its entirety.

FIELD

This disclosure relates to golf club heads, such as heads having cast components, and related methods for manufacturing such golf club heads.

BACKGROUND

With the ever-increasing popularity and competitiveness of golf, substantial effort and resources are currently being expended to improve golf clubs. Much of the recent improvement activity has involved the combination of the use of new and increasingly more sophisticated materials in concert with advanced club-head engineering. For example, modern "wood-type" golf clubs (e.g., "drivers," "fairway woods," "rescues," and "utility or hybrid clubs"), with their sophisticated shafts and non-wooden club-heads, bear little resemblance to the "wood" drivers, low-loft long-irons, and higher numbered fairway woods used years ago. These modern wood-type clubs are generally called "metalwoods" or simply "woods."

The current ability to fashion metalwood club-heads of strong, light-weight metals and other materials has allowed the club-heads to be made hollow. Use of materials of high strength and high fracture toughness has also allowed club-head walls to be made thinner, which reduces total weight and allows increases in club-head size, compared to earlier club-heads without the swing speed penalty resulting from increased weight. Larger club-heads tend to have a larger face plate area and can also be made with high club-head inertia, thereby making the club-heads more "forgiving" than smaller club-heads. Characteristics such as size of the optimum impact location (also known as the "sweet spot") are determined by many variables including the shape, profile, size and thickness of the face plate as well as the location of the center of gravity (CG) of the club-head.

An exemplary metalwood golf club typically includes a shaft having a lower end to which the club-head is attached. Most modern versions of these club-heads are made, at least in part, of a light-weight but strong metal such as titanium alloy. In some cases, the club-head comprises a body to which a face plate (used interchangeably herein with the terms "face" or "face insert" or "striking plate" or "strike plate") is later attached, while in other cases the body and face place are cast together as a unitary structure, such that the face plate does not have to be later attached to the body.

The face plate defines a front surface or strike face that actually contacts the golf ball.

Regarding the total mass of the metalwood club-head as the club-head's mass budget, at least some of the mass budget must be dedicated to providing adequate strength and structural support for the club-head. This is termed "structural" mass. Any mass remaining in the budget is called "discretionary" or "performance" mass, which can be distributed within the metalwood club-head to address performance issues, for example. Thus, the ability to reduce the structural mass of the metalwood club-head without compromising strength and structural support provides the potential for increasing discretionary mass and hence improved club performance.

One opportunity to reduce the total mass of the club head is to lower the mass of the face plate by reducing its thickness; however, opportunities to do this are somewhat limited given that the face absorbs the initial impact of the ball and thus has quite rigorous requirements on its physical and mechanical properties. Club manufacturers have used titanium and titanium alloys for face plate manufacture as well as whole club head manufacture, given their lightness and high strength. Typically for the club head given its relatively complex 3-D structure, casting processes have been used for its manufacture. Many such face plates are made by the investment casting process wherein an appropriate metal melt is cast into a preheated ceramic investment mold formed by the lost wax process. Investment casting has also been used to prepare the face plate either as a unitary structure cast with the rest of the club head body or as separately formed face plate which is then attached to the front of the club head body, usually by welding. Although widely used, investment casting of complex shaped components of such reactive materials can be characterized by relatively high costs and low yields. Low casting yields are attributable to several factors including surface or surface-connected void type defects and/or inadequate filling of certain mold cavity regions, especially thin mold cavity regions, and associated internal void, shrinkage and like defects.

To further compound the deficiencies of investment casting the face plate, club head manufacturers often also introduce curvature onto the face of the club to help compensate for directional problems caused by shots hit other than where the center of gravity is located. Thus, rather than a planar face plate, manufacturers may wish to form the face with both a heel-to –toe convex curvature (referred to as "bulge") and a crown-to –sole convex curvature (referred to as "roll"). In addition, manufacturers may also introduce variable face thickness profiles across the face plate. Varying the thickness of a faceplate may increase the size of a club head COR zone, commonly called the sweet spot of the golf club head, which, when striking a golf ball with the golf club head, allows a larger area of the face plate to deliver consistently high golf ball velocity and shot forgiveness. Also, varying the thickness of a faceplate can be advantageous in reducing the weight in the face region for reallocation to another area of the club head.

In order to make up for the deficiencies of investment casting these more complex face plate structures, manufacturers have turned to alternative methods of forming the face plate including laser cutting the face plate shape from a rolled titanium sheet followed by subsequent forging to impart any desired bulge and roll followed by a machining step on a lathe to introduce any desired face thickness profile. Disadvantages of these steps include the fact that three separate forming steps are needed and the machining process on a lathe to form variable thickness profiles is not only wasteful but also limits the profiles to circular shaped areas as a result of the circular motion of the lathe.

Thus, it would be highly desirable to have club head face plates with sufficient physical properties to allow reduction in thickness to result in more available discretionary weight in a club head. It would also be desirable if the face plates were also able to exhibit any desired bulge and roll curvature in addition to any variable thickness profile having any shape-circular, oval, asymmetrical or otherwise. It would also be desirable if a simplified process for manufacture of such face plates could be employed which would result in face plate with the required thickness and physical strength properties which process would also result in a face plate with any desired bulge and roll and variable thickness profile while requiring a minimum of processing steps and minimizing any waste produced in the process. It would also be desirable if the club head body and the face could be cast at the same time from the same material as a single unitary body, rather than two pieces that must be later attached together. It would also be desirable if the cast face plate did not require chemical etching to remove or reduce the thickness of the alpha case to provide adequate durability properties for the face plate.

SUMMARY

Golf club heads disclosed herein can comprise a cast cup component, which can include a forward portion of a golf club head, including a hosel, forward portions of a crown, sole, heel, and toe, and a face portion or an opening to receive a face insert. The club heads can also comprise a rear ring component, which can be formed separately from the cast cup and coupled to heel and toe portions of the cast cup to form a rigid club head body, such that the club head body defines a hollow interior region, a crown opening, a sole opening, and/or face opening. The cast cup and rear ring can be made of different materials, including various metals, composites, and polymers. Composite crown, sole, and/or face inserts can be coupled to the crown, sole, and/or face openings to enclose the hollow internal cavity of the club head. Various forms of adjustable or fixed weights can be coupled to the sole portion of the cast cup and to the rear end of the rear ring. In addition, the face can have a complex variable thickness geometry.

Some golf club head bodies disclosed herein can be cast of 9-1-1 titanium with the face plate being cast as a unitary part of the body along the with crown, sole, skirt and hosel. Due to the 9-1-1 titanium material, the face plate and other portions of the body acquire less oxygen from the mold and can have a reduced alpha case thickness, resulting in greater ductility and durability. This can eliminate the need to reduce the alpha case thickness after casting using hydrofluoric acid or other dangerous chemical etchants. Casting methods can include preheating the casting mold to a lower than normal temperature and/or coating an inner surface of the mold, to further reduce the amount of oxygen transferred from the mold to the 9-1-1 titanium during casting.

In some embodiments, a wood-type golf club head body comprises a crown, a sole, skirt, a face plate, and a hosel; the body defines a hollow interior region; the body is cast substantially entirely of 9-1-1 titanium; and the body is cast as a single unitary casting, with the face plate being formed integrally with the crown, sole, skirt, and hosel. The body may comprise trace fluorine atoms as alloying impurities found in the titanium alloy, but due to the absence of etching the face with hydrofluoric acid after casting, the content of fluorine present in the body can be very low. In some embodiments, the face plate can have substantially no fluorine atoms, such as less than 1000 ppm, less than 500 ppm, less than 200 ppm, and or less than 100 ppm. In some embodiments, the body can have an alpha case thickness of 0.150 mm or less, 0.100 mm or less, and/or 0.070 mm or less.

Some exemplary methods comprise preparing a mold for casting and then casting a golf club head body substantially entirely of 9-1-1 titanium using the mold, wherein the cast body includes a crown, a sole, skirt, a face plate, and a hosel, wherein the cast body defines a hollow interior region; and wherein the body is cast as a single unitary casting, with the face plate being formed integrally with the crown, sole, skirt, and hosel during the casting. Some such methods do not include etching the face plate after the casting. In some methods, preparing the mold comprises preheating the mold such that the mold is at a temperature of 800 C or less, 700 C or less, 600 C or less, and/or 500 C or less, when the casting occurs.

Also disclosed herein are golf club head embodiments comprising a metallic cast cup forming a forward portion of the club head, including a hosel, a face portion, a forward portion of a crown, and a forward portion of a sole. A metallic rear ring can be formed separately from the cast cup and coupled to heel and toe portions of the cast cup to form a club head body, such that the metallic club head body defines a hollow interior region, a crown opening, and a sole opening. A composite crown insert can then be coupled to the crown opening. A sole insert made of composite, metal, or other material can be coupled to the sole opening. In some embodiments, there is no sole opening or sole insert. The cast cup and rear ring can be cast of the same titanium alloy, or two different materials, and can be welded, brazed, bonded, or mechanically interlocked together to form the club head body. In some embodiments, the ring and cup are comprised of different metallic materials, such as two different titanium alloys, or a titanium allow and steel. The cast cup can include a face portion that has an intricate geometry to provide desirable performance properties. The face portion can have a twisted front surface and/or the rear surface of the face can have a geometry that provides an asymmetric variable thickness profile across the face. The rear surface of the face portion of the cast cup can be machined and/or otherwise modified before the rear ring is attached such that there is increased room to access the entire rear surface of the face with tools. A front weight can be attached to the heel side of the sole of the cast cup, either on the inside or the exterior. A rear weight can be attached to a rear portion of the ring, either on the inside or the exterior of the ring. Weights can be one piece screw-in or bonded/welded in, or can be multi-piece, such as using a screw to attach a separate weight to the cup/ring.

Also disclosed are methods of forming a wax cup from a wax cup frame and a separately formed wax face, using a wax welding process. Such a wax cup can then be used to create a mold for casting the metallic cup that forms the front portion of a golf club head. The two piece wax welding process can provide manufacturing, prototyping, and testing advantages.

Also disclosed are cast face plates, such as comprising titanium alloys, which have novel geometries.

Some embodiments comprise composite face inserts that can be attached to a front opening of the cast cup.

Some embodiments disclosed herein comprise a rear ring that comprises anodized aluminum, which can provide various coloring options for the ring.

Some embodiments disclosed herein comprise a rear ring that is molded of polymeric materials, rather than cast of metallic material. Such polymer based rear rings can include fibers or other additives, and can also comprise various coatings and finishes. In some embodiments, the rear weight can be co-molded with the polymeric rear ring, such that the rear weight is partially or fully enclosed by the rear ring.

In some embodiments, the club head can comprise a weight track on the sole of the cast cup, and a sliding weight assembly that can be adjustably positioned along the track.

The foregoing and other objects, features, and advantages of the disclosed technology will become more apparent from the following detailed description, which proceeds with reference to the accompanying figures.

BRIEF DESCRIPTION OF THE DRAWINGS

FIG. 16 is a table for casting data for titanium alloy obtained for six different casters.

FIG. 17 a continuation of the table of FIG. 16.

FIG. 124 is a view of a portion of a golf club head in accord with one embodiment of the current disclosure.

FIG. 125 is a view of a portion of a golf club head in accord with one embodiment of the current disclosure.

FIG. 126 is a view of a portion of a golf club head in accord with one embodiment of the current disclosure.

FIG. 127 is a view of a portion of a golf club head in accord with one embodiment of the current disclosure.

FIG. 128 is a view of a portion of a golf club head in accord with one embodiment of the current disclosure.

FIG. 129 shows a toe side view of two golf club heads, one golf club head in accord with one embodiment of the current disclosure and one golf club head in accord with a prior art club head.

FIG. 130 is a is a front elevation view of a face insert according to an embodiment.

FIG. 131 is a is a bottom perspective view of a face insert according to an embodiment.

FIG. 132A is a section view of a heel portion of a face insert according to an embodiment.

FIG. 132B is a section view of a toe portion of a face insert according to an embodiment.

FIG. 133 is a section view of a polymer layer of a face insert according to an embodiment.

FIG. 134 is a top view of another exemplary golf club head.

Figure 134:
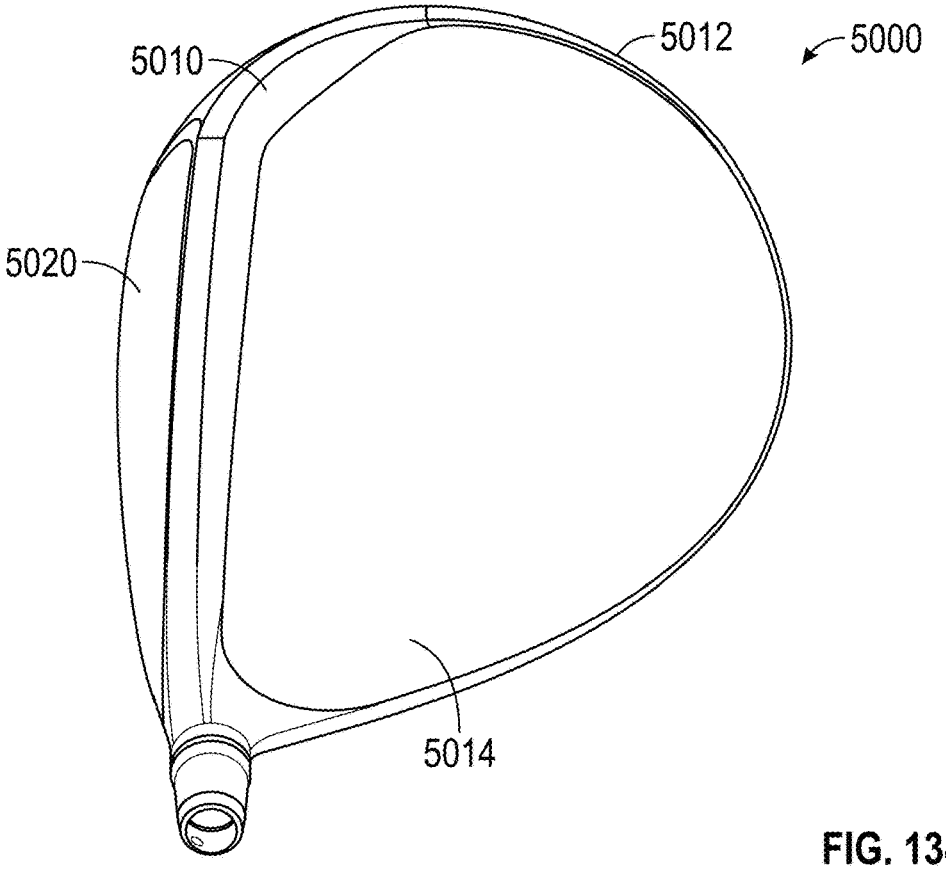
Figure 135:
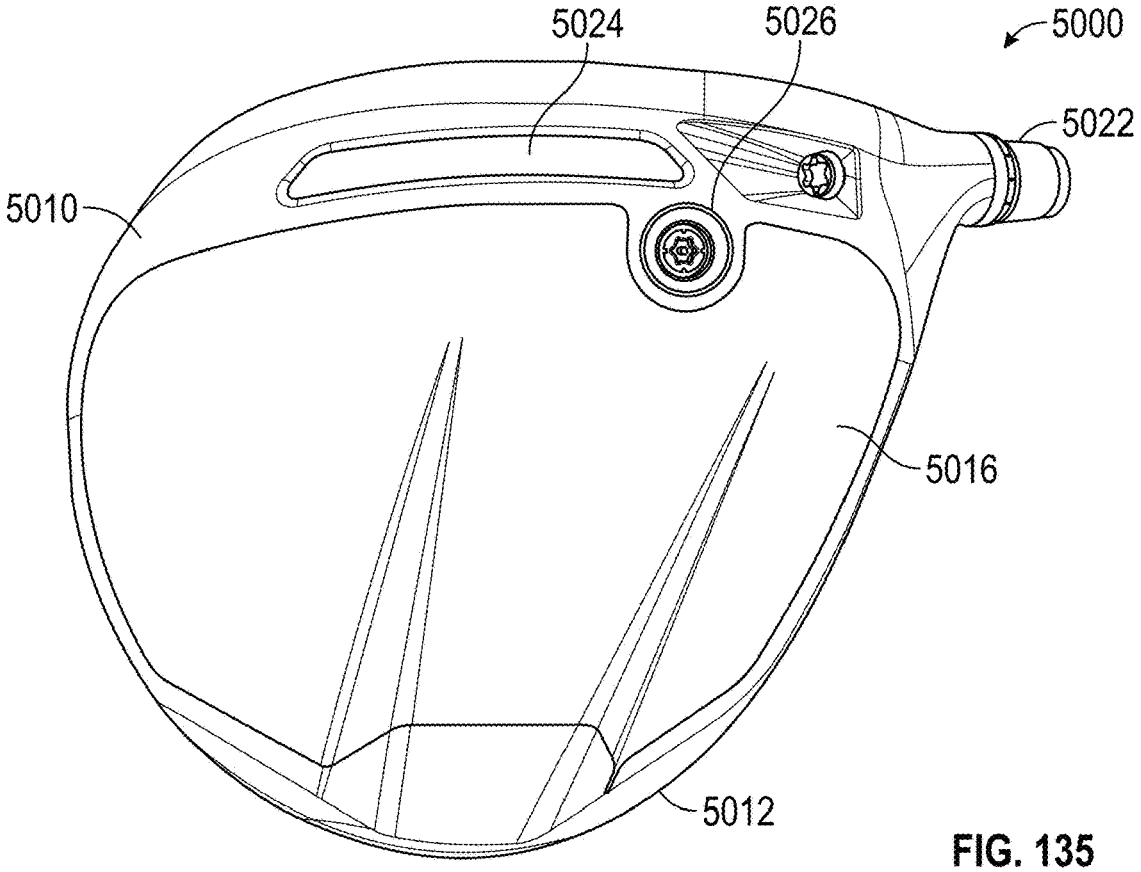

FIG. 135 is a bottom view of the club head of FIG. 134.

Figure 136:
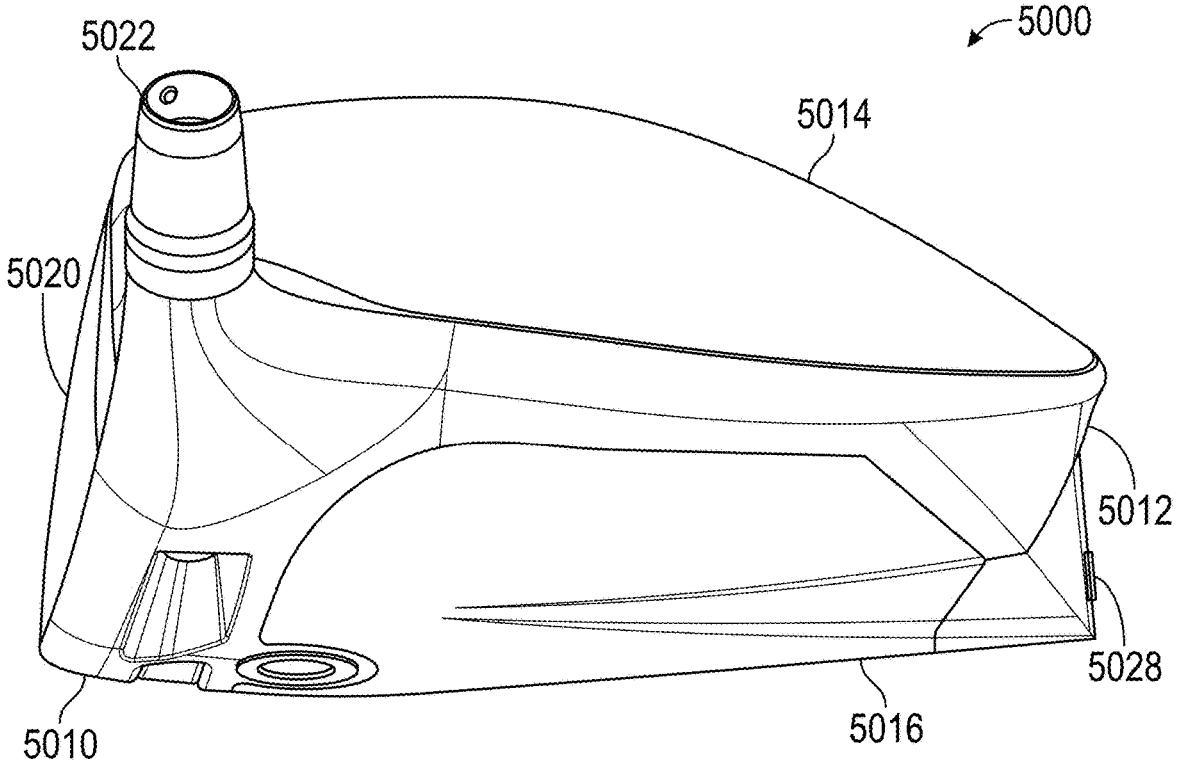

FIG. 136 is a heel side view of the club head of FIG. 134.

Figure 137:
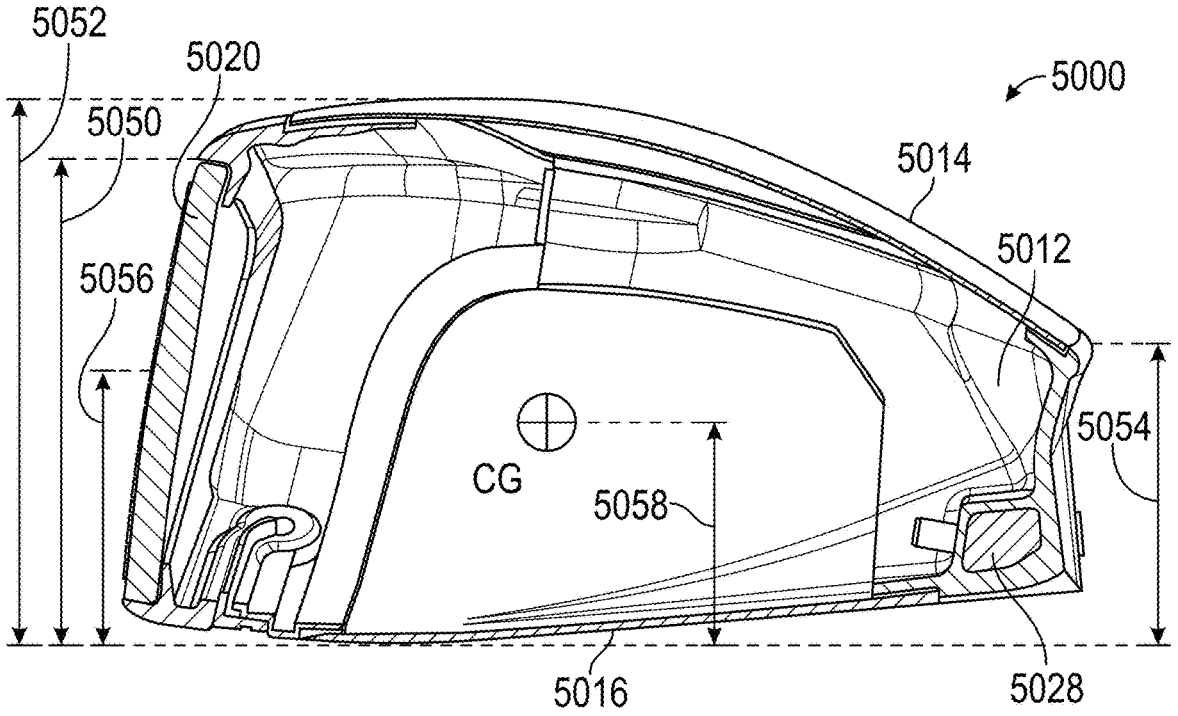

FIG. 137 is a cross-sectional side view of a toe side of the club head of FIG. 134.

Figure 138:
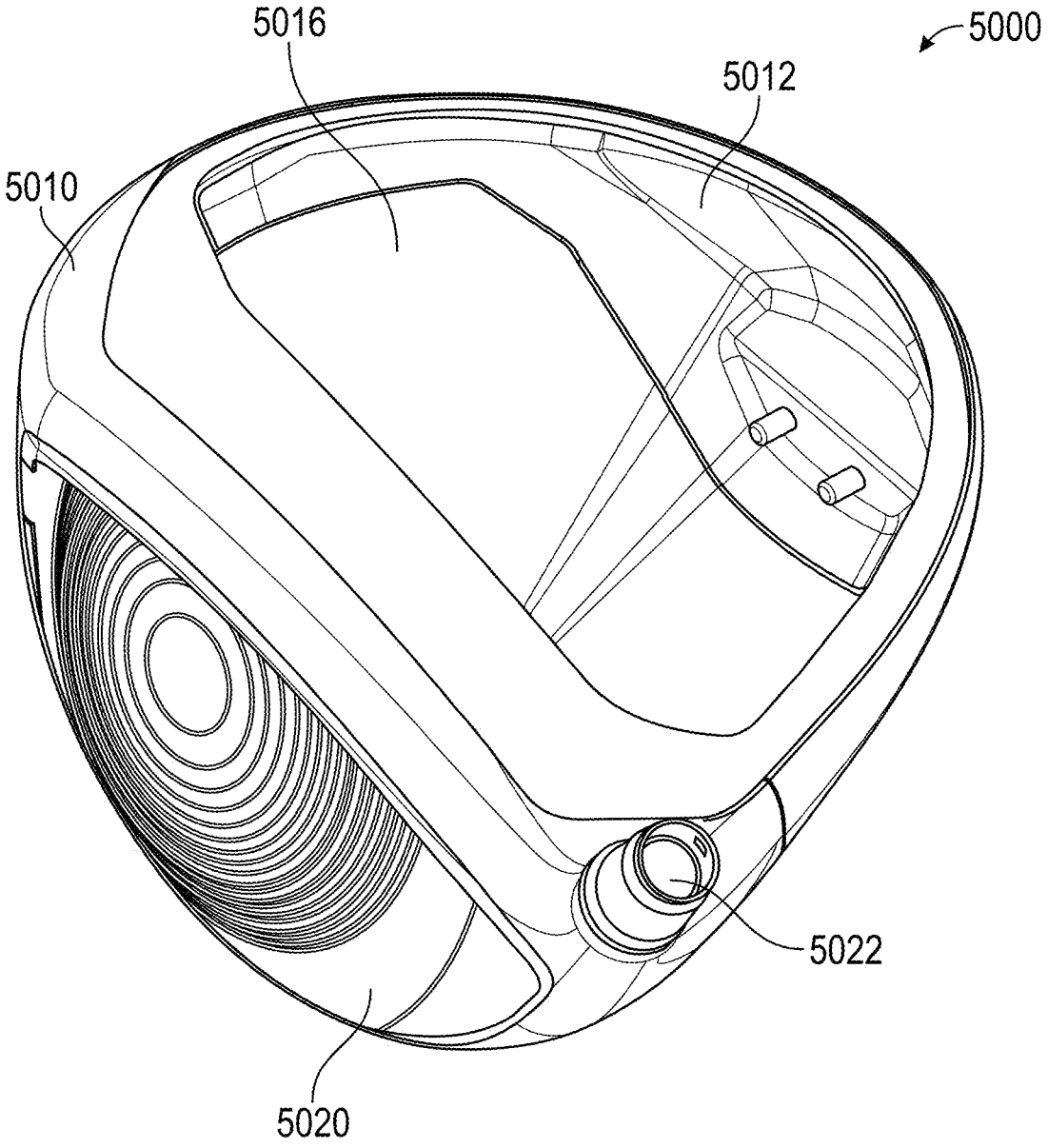
Figure 139:
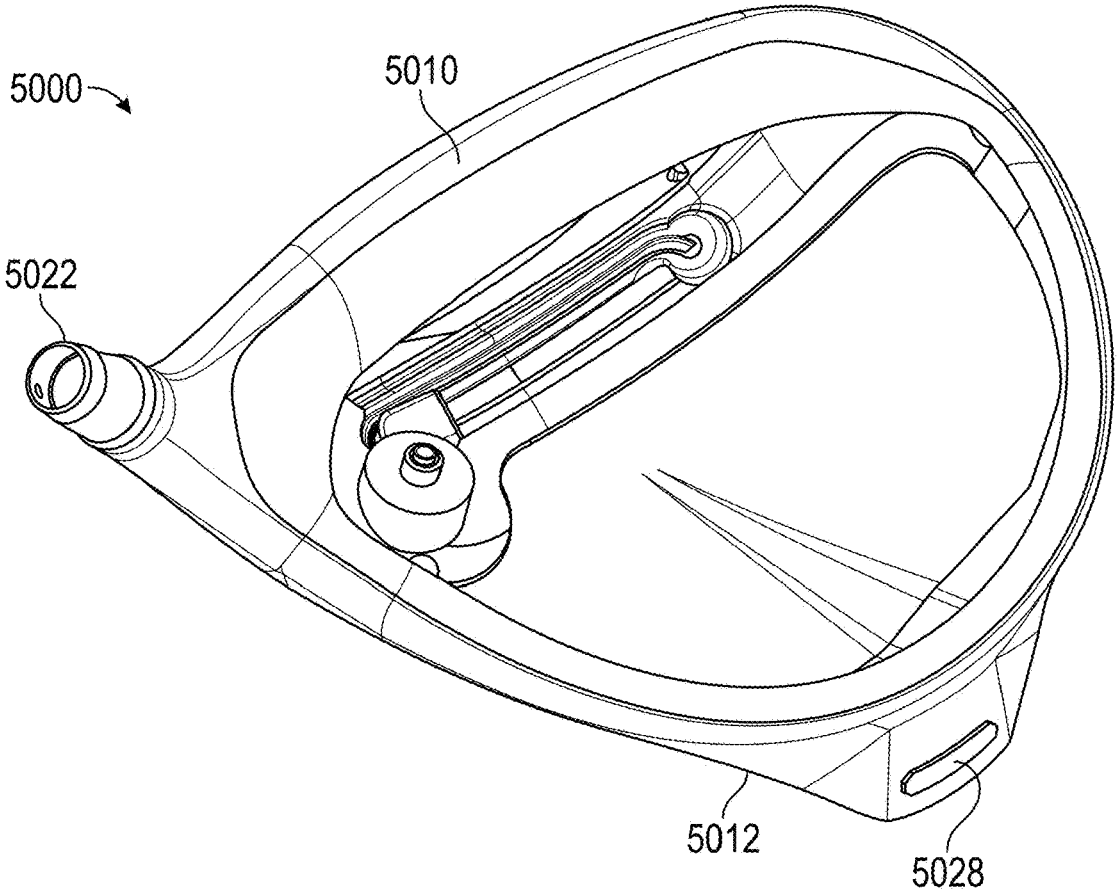

FIGS. 138 and 139 are top perspective views of the club head of FIG. 134 without the crown insert.

Figure 140:
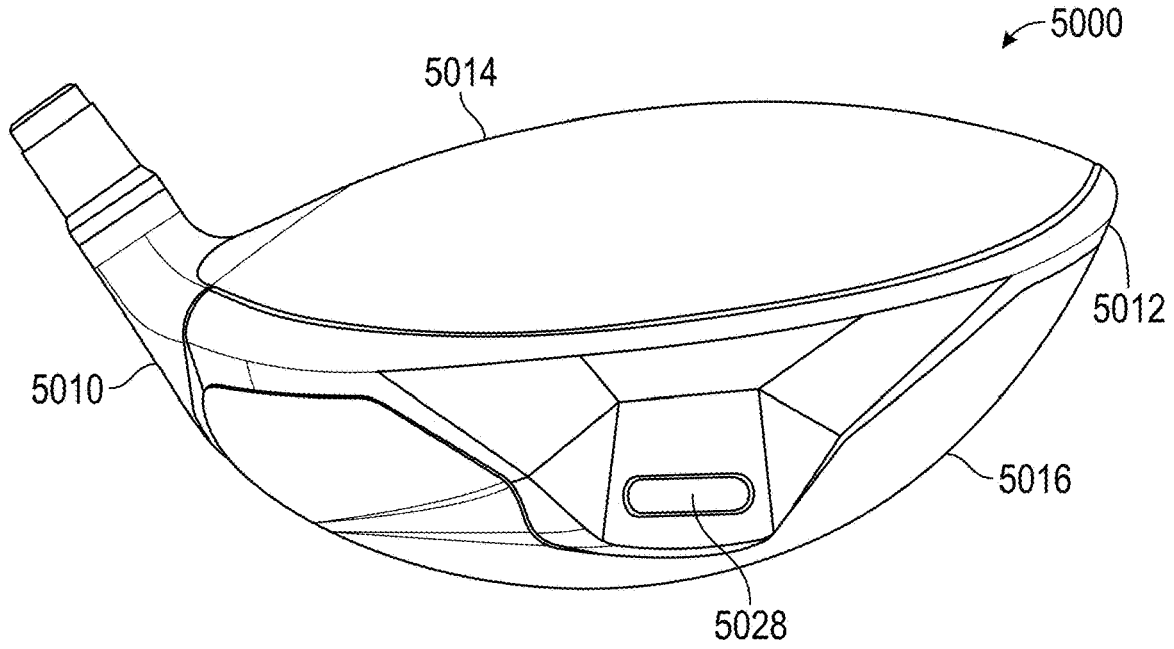

FIG. 140 is a rear view of the club head of FIG. 134.

Figure 141:
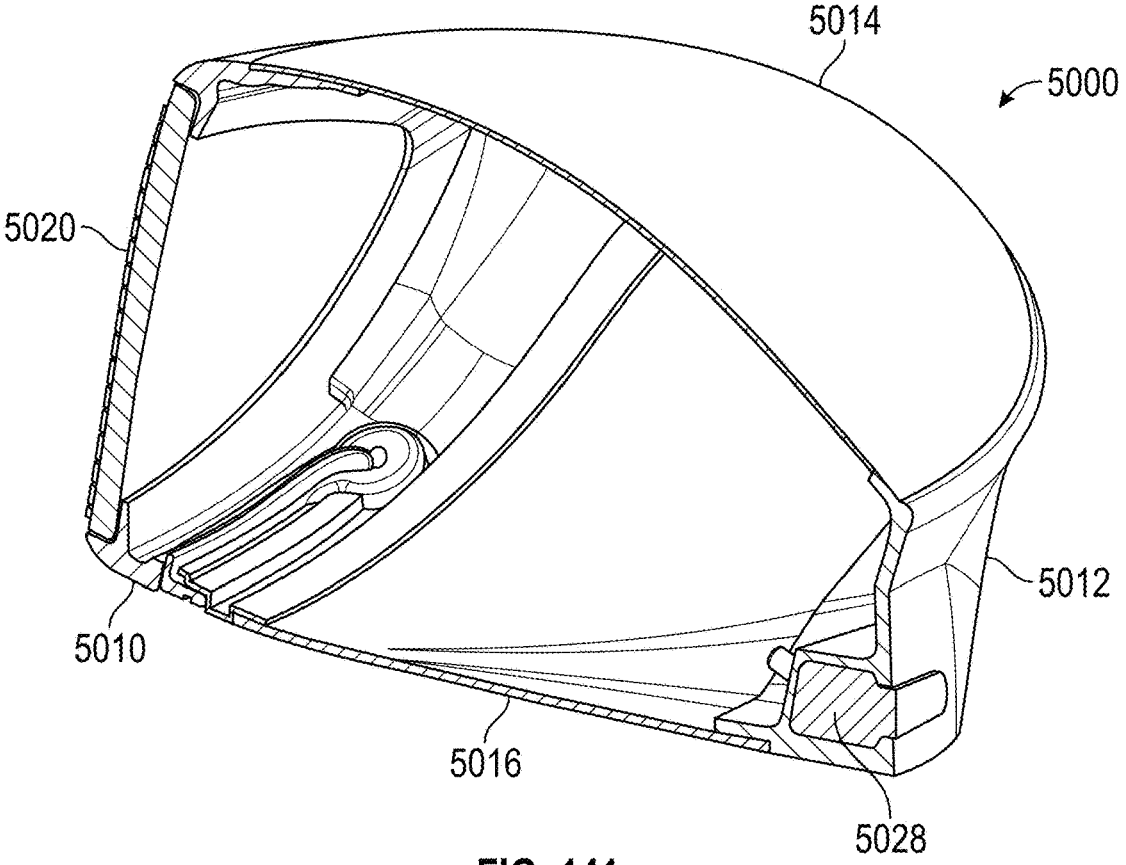

FIG. 141 is a cross-sectional view of the toe side of the club head of FIG. 134.

Figure 142:
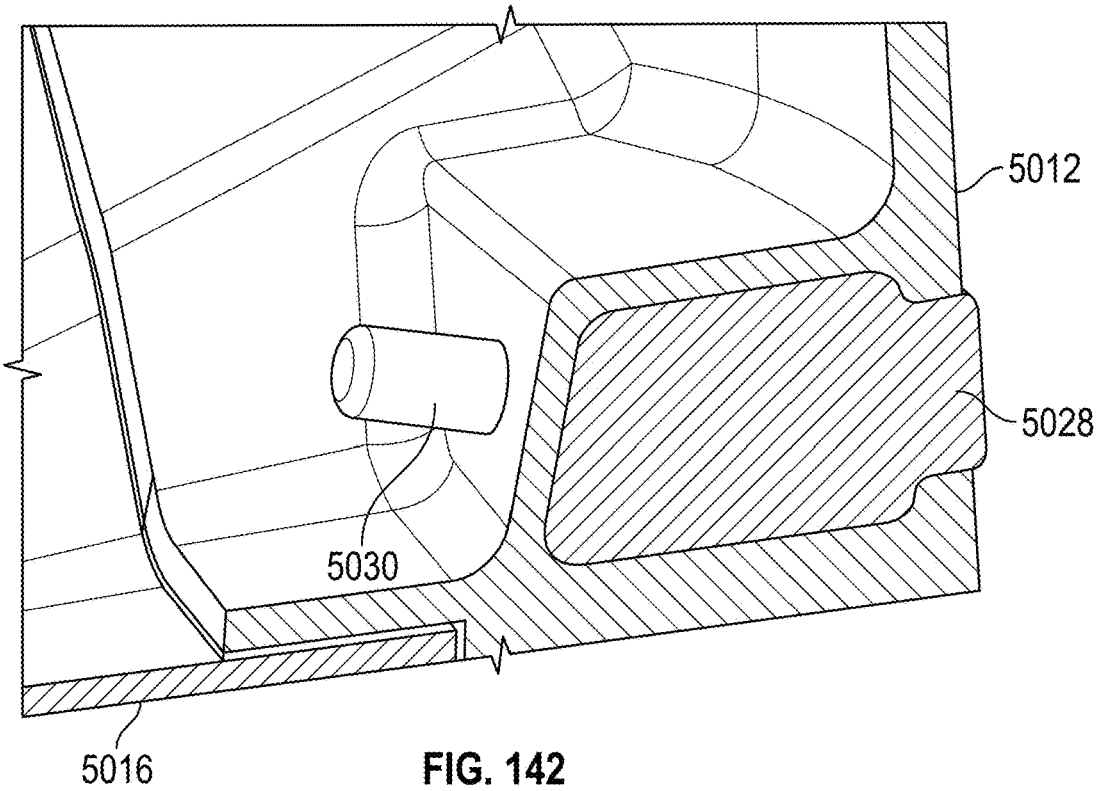

FIG. 142 is an enlarged view of the rear weight portion of FIG. 141.

Figure 143:
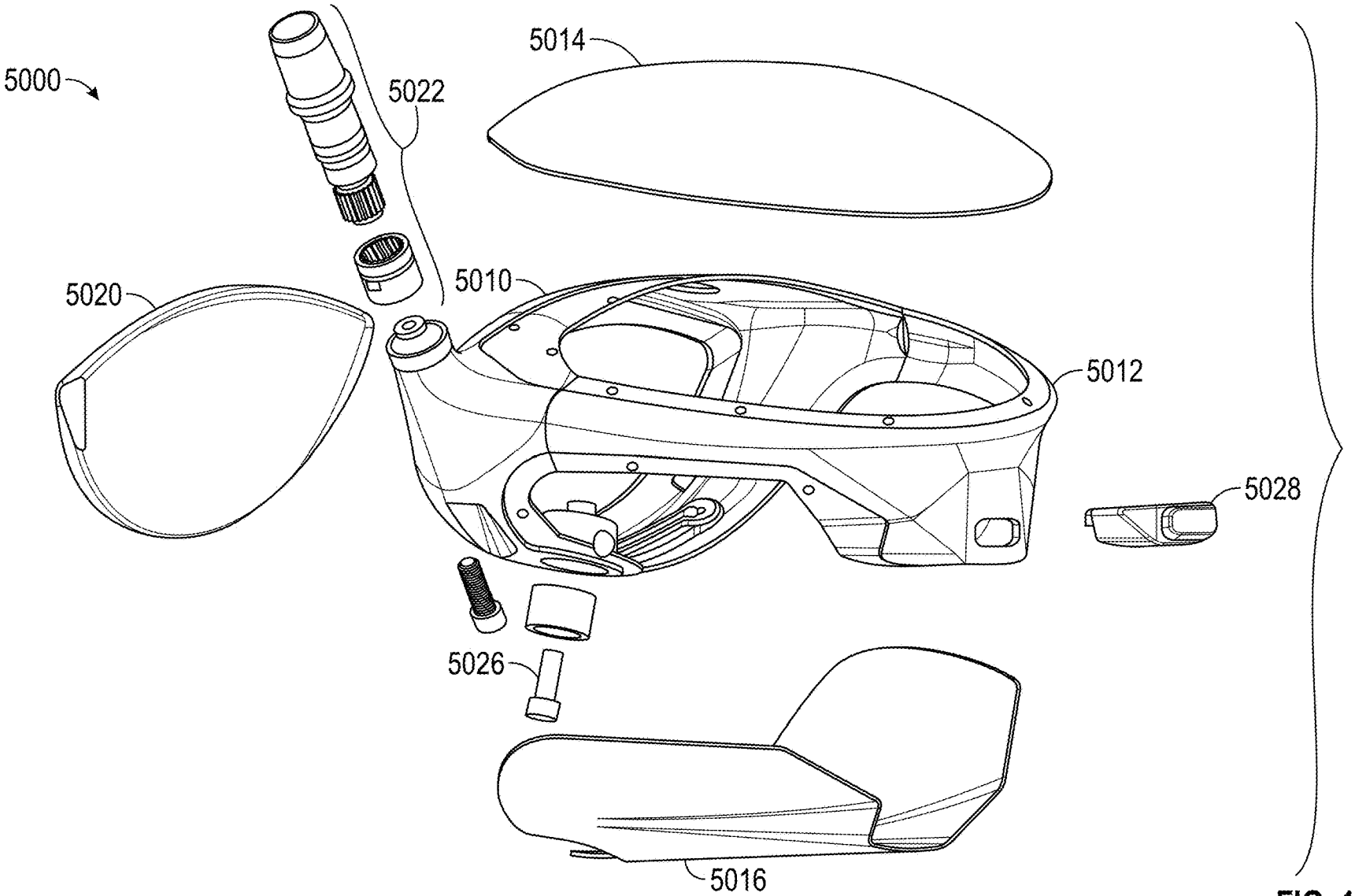
Figure 144:
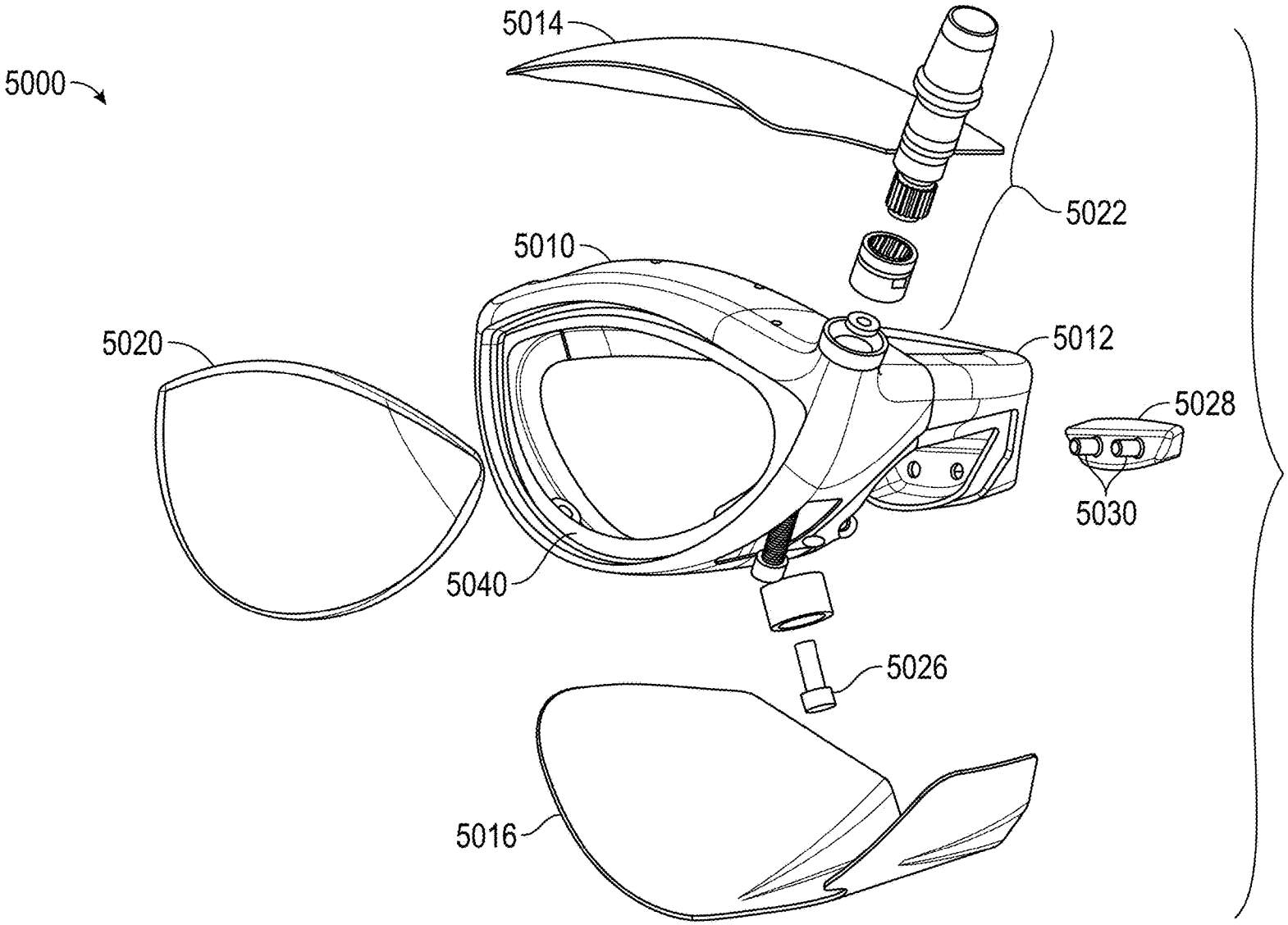

FIGS. 143 and 144 are exploded views of the club head of FIG. 134.

Figure 145:
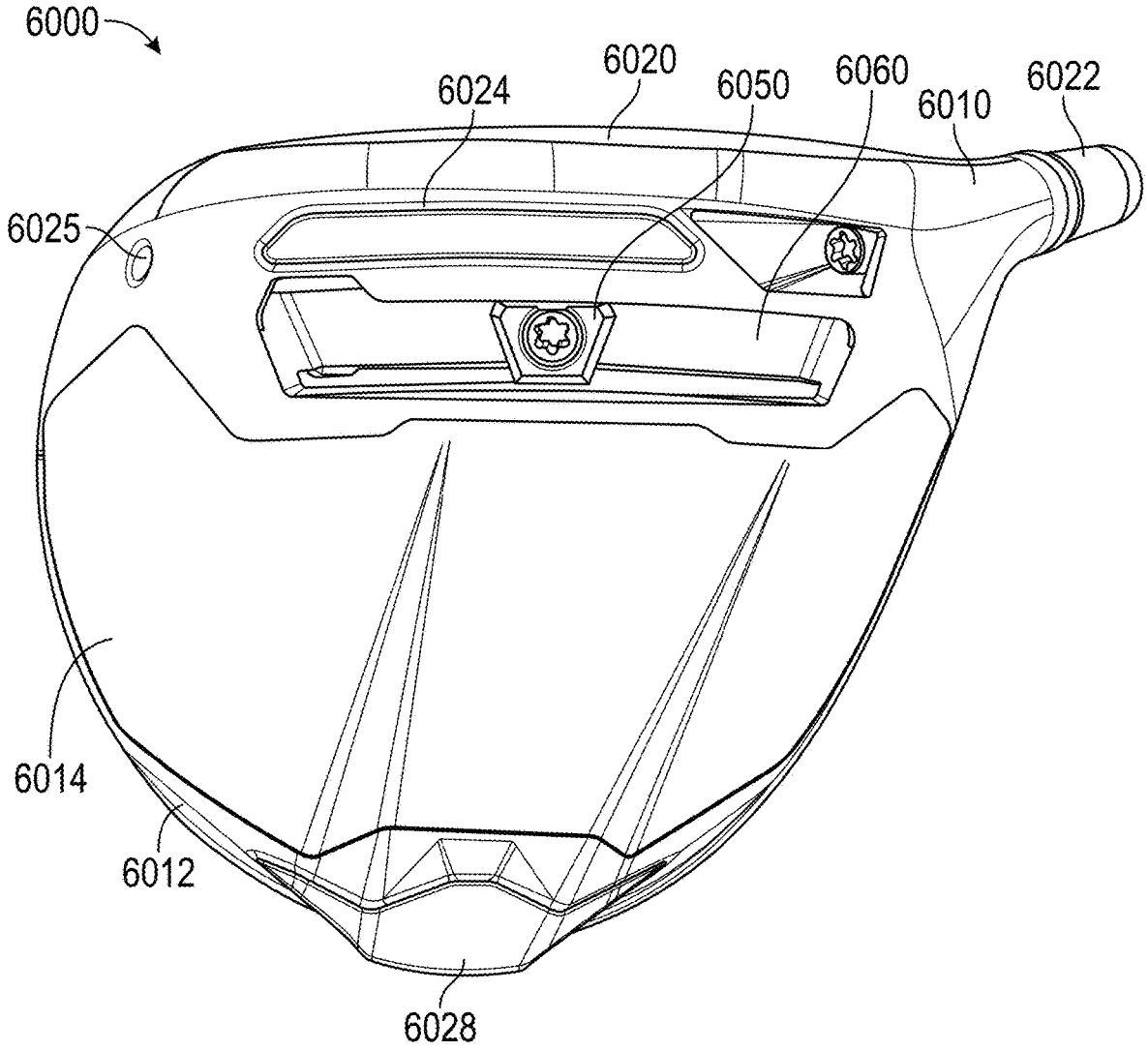

FIG. 145 is a bottom view of another exemplary golf club head.

Figure 146:
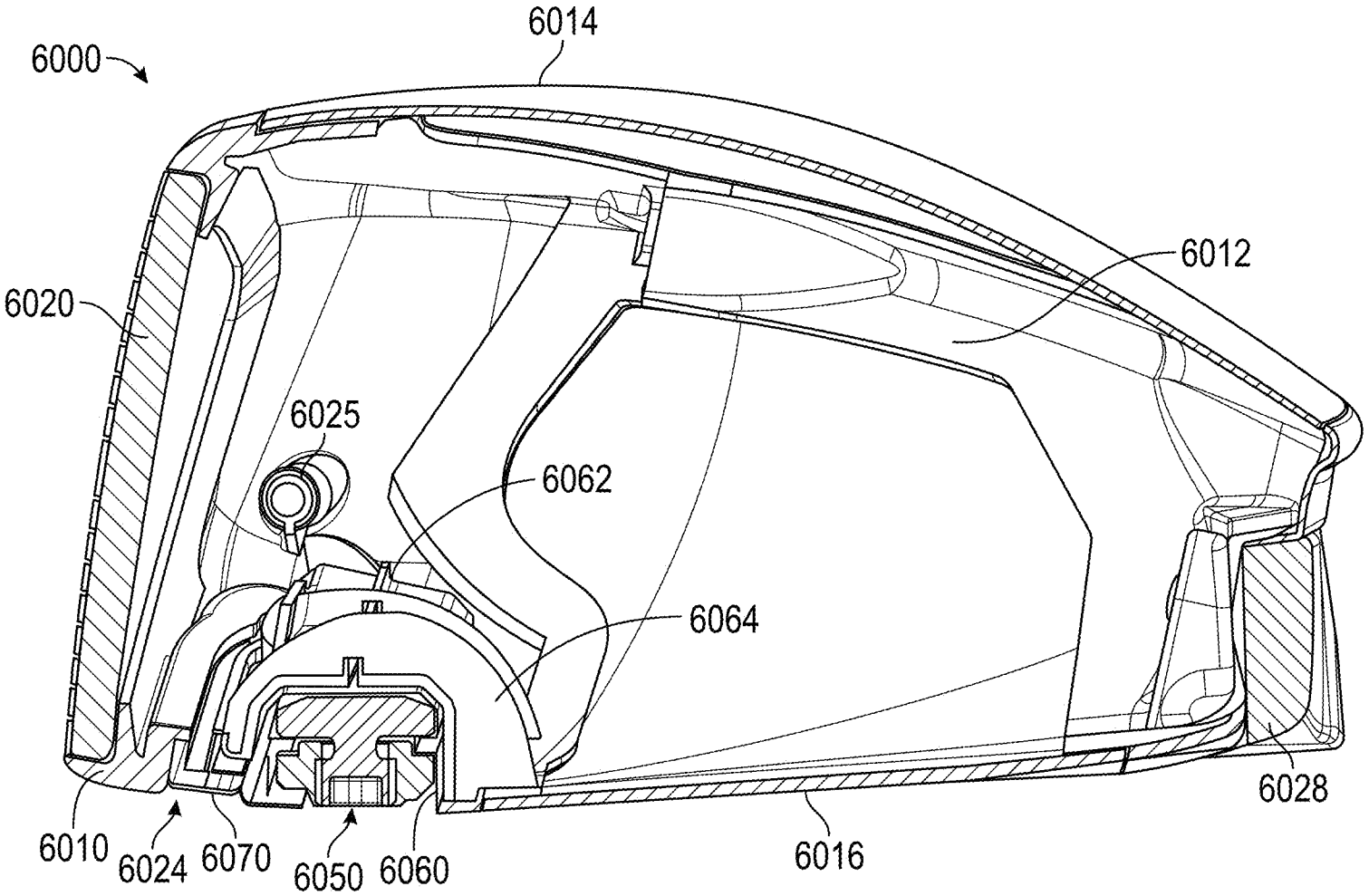

FIG. 146 is a cross-sectional side view of a toe side of the club head of FIG. 145.

Figure 147:
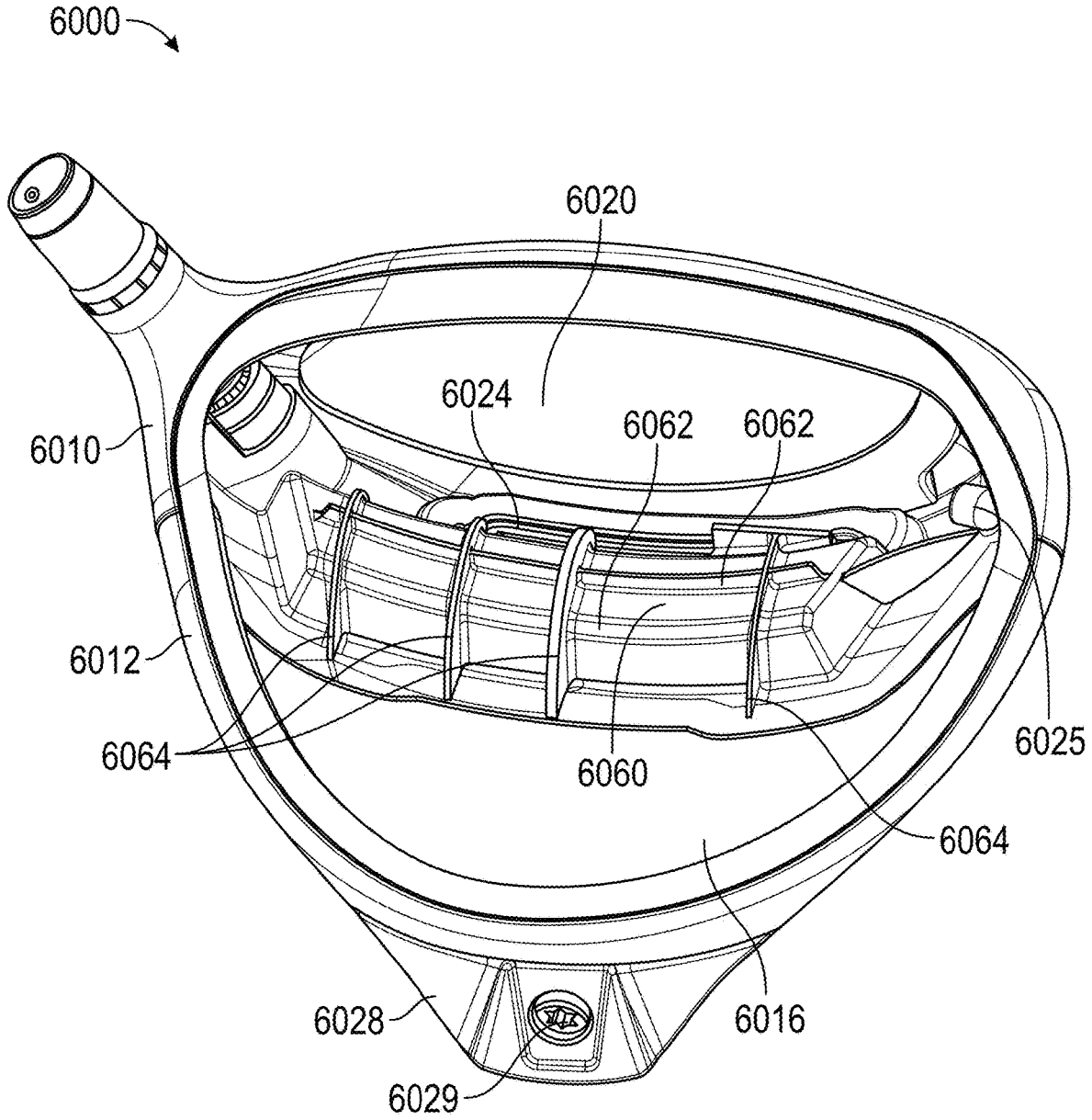

FIG. 147 is a top perspective view of the club head of FIG. 145 without the crown insert.

Figure 148:
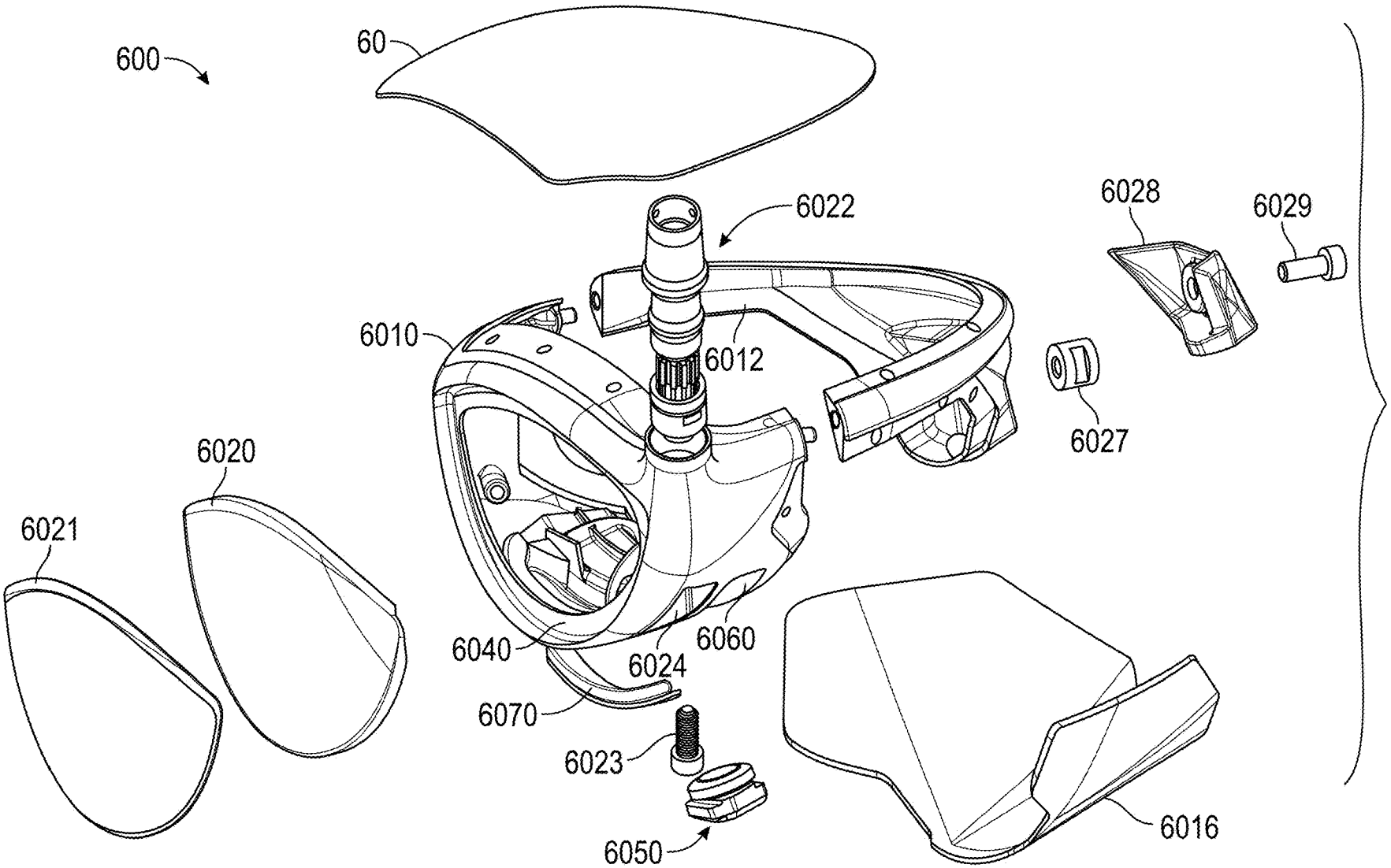

FIG. 148 is an exploded view of the club head of FIG. 145.

Figure 149:
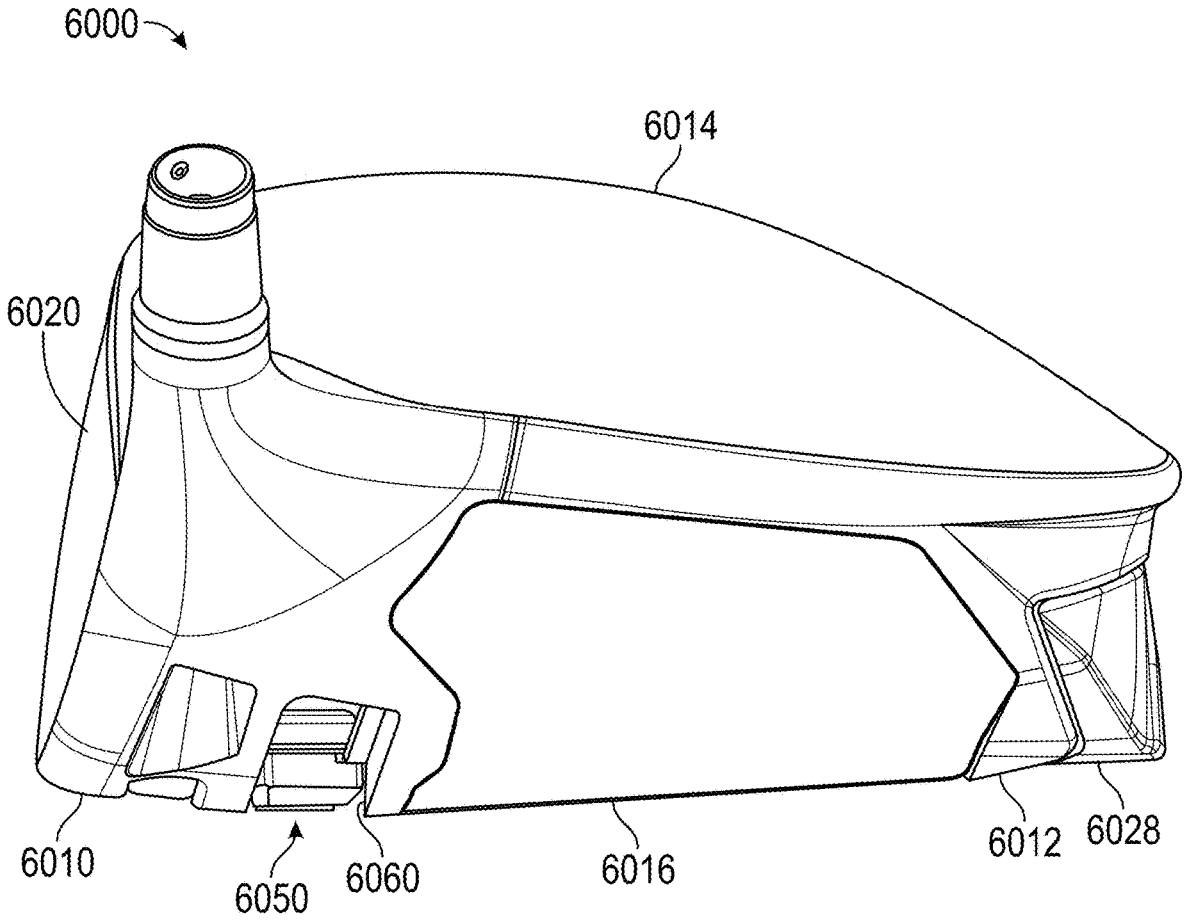

FIG. 149 is a heel side view of the club head of FIG. 145.

DETAILED DESCRIPTION

The following describes embodiments of golf club heads for metalwood type golf clubs, including drivers, fairway woods, rescue clubs, utility clubs, hybrid clubs, and the like. However, the herein disclosed technology can be implemented for any type of golf club head, not just the examples disclosed, including drivers, fairways, rescues, hybrids, utility clubs, irons, wedges, and putters.

For reference, within this disclosure, reference to a "driver type golf club head" means any metalwood type golf club head intended to be used primarily with a tee. In general, driver type golf club heads have lofts of 15 degrees or less, and, more usually, of 12 degrees or less. Reference to a "fairway wood type golf club head" means any wood type golf club head intended to be used to strike a ball off the ground, while also being usable to strike a ball off a tee as well. In general, fairway wood type golf club heads have lofts of 15 degrees or greater, and, more usually, 16 degrees or greater. In general, fairway wood type golf club heads have a length from leading edge to trailing edge of 73-97 mm. Various definitions distinguish a fairway wood type golf club head from a hybrid type golf club head, which tends to resemble a fairway wood type golf club head but be of smaller length from leading edge to trailing edge. In general, hybrid type golf club heads are 38-73 mm in length from leading edge to trailing edge. Hybrid type golf club heads may also be distinguished from fairway wood type golf club heads by weight, by lie angle, by volume, and/or by shaft length. Driver type golf club heads of the current disclosure may be 15 degrees or less in various embodiments or 10.5 degrees or less in various embodiments. In various embodiments, fairway wood type golf club heads of the current disclosure may be from 13-26 degrees.

As illustrated in FIGS. 1-6, a wood-type (e.g., driver or fairway wood) golf club head, such as golf club head 2, can include a hollow body 10. The body 10 can include a crown 12, a sole 14, a skirt 16, and a face plate 18 (also referred to as a face or face portion) defining striking surface 22, while defining an interior cavity. The face plate 18 may be formed separately from the body and attached to an opening at the front of the body, or may be integrally formed as a unitary part of the body 10. The body 10 can include a hosel 20, which defines a hosel bore 24 adapted to receive a golf club shaft (see FIG. 6). The body 10 further includes a heel portion 26, a toe portion 28, a front portion 30, and a rear portion 32.

Figure 1:
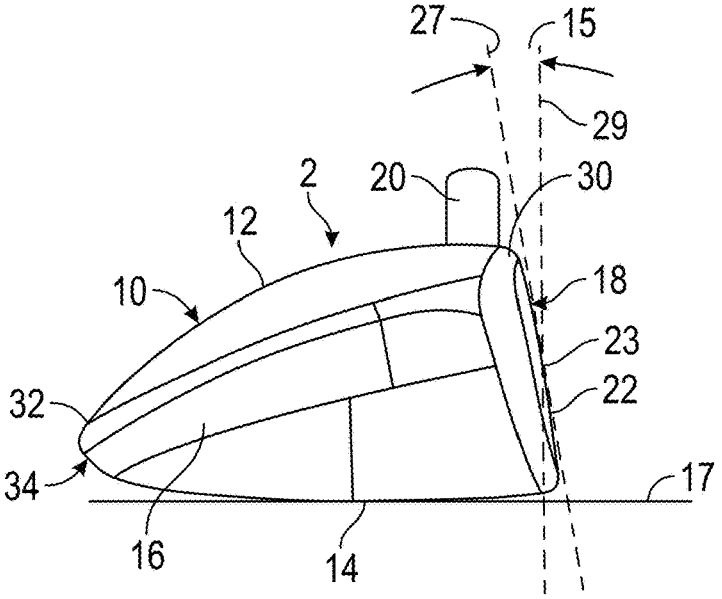
FIG. 1 is a side elevation view of a golf club head.
Figure 2:
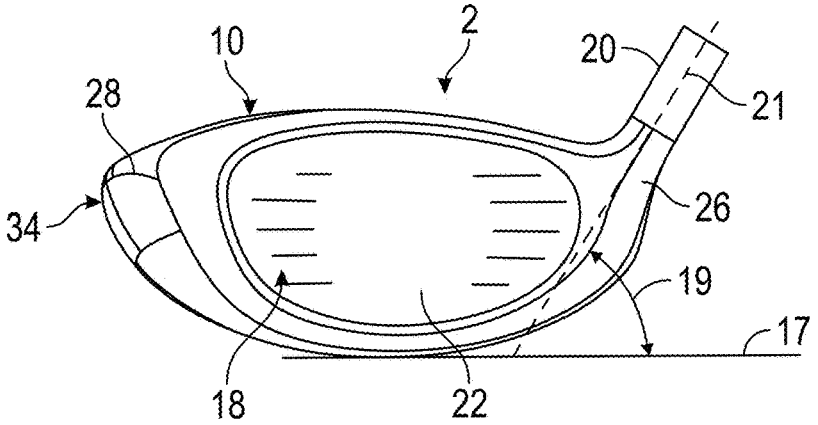
FIG. 2 is a front elevation view of the golf club head of FIG. 1.
Figure 3:
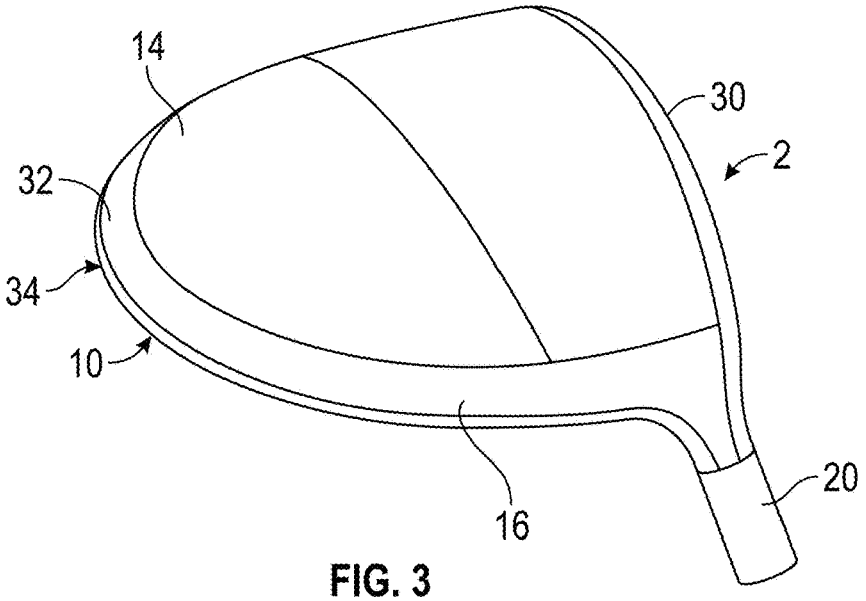
FIG. 3 is a bottom perspective view of the golf club head of FIG. 1.
Figure 4:
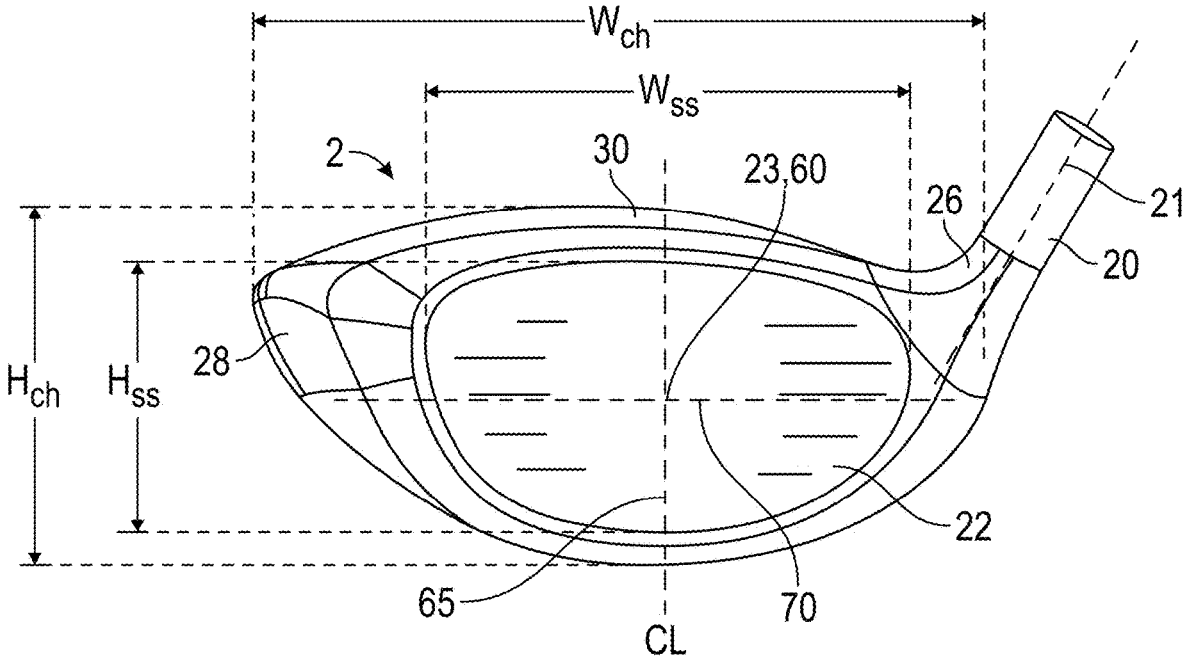
FIG. 4 is a front elevation view of the golf club head of FIG. 1 showing a golf club head origin coordinate system.
Figure 5:
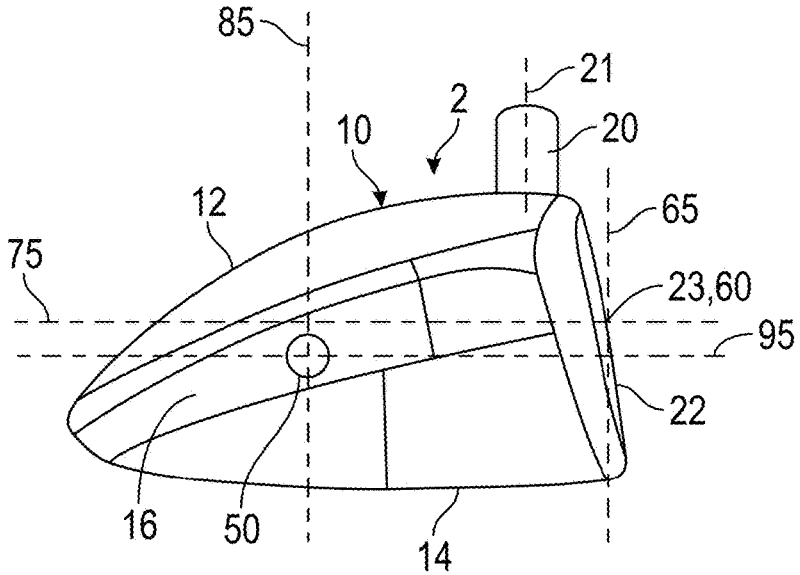
FIG. 5 is a side elevation view of the golf club head of FIG. 1 showing a center of gravity coordinate system.
Figure 6:
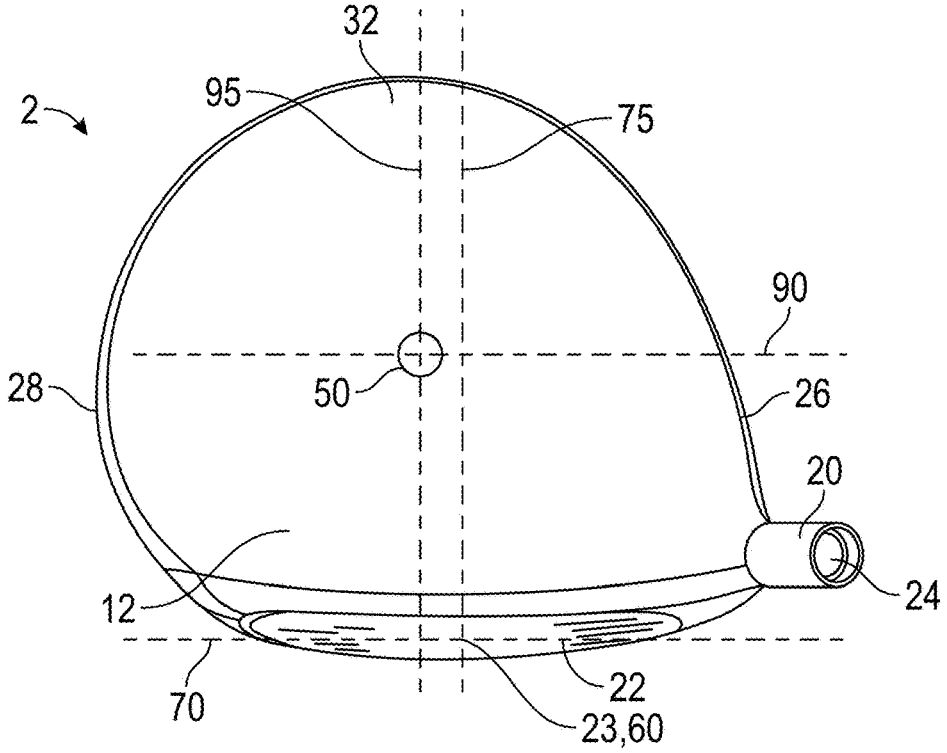
FIG. 6 is a top plan view of the golf club head of FIG. 1.

FIGS. 4-6 illustrate an origin 60, an origin x axis 70, an origin y axis 75, and origin z axis 65, a center of gravity 50 of the club head, a CG x axis 90, a CG y axis 95, and a CG z axis 85. The origin axes pass through the origin 60, and the CG axes pass through the CG 50. The origin 60 is defined as the geometric center of the face as measured per USGA protocol (e.g., the geometric center is equidistant vertically from the top and bottom edges of the face, and equidistant horizontally from the toe and heel side edges of the face, when the head is in the normal address position. The normal address position of the club head is where the sole of the club head is touching a horizontal ground plane with a 60 degree USGA lie angle (i.e., the hosel axis forms a 60 degree angle relative to the ground plane) and at a 0 degree face angle (square face). The origin axes and CG axes are horizontal or vertical (e.g., parallel or perpendicular to the ground plane) while the club head is in the normal address position, as illustrated. The origin x axis, origin y axis, and origin z axis are sometimes referred to in shorthand as simply the x axis, the y axis, and the z axis, and together they are referred to as the club head origin coordinate system. Similarly, the CG x axis, CG y axis, and CG z axis are referred to as the club head CG coordinate system, while the CG x axis coordinate is referred to as CGx, the CG y axis coordinate is referred to as CGy, and the CG z axis coordinate is referred to as CGz. The origin 60 can also be at the same point as the ideal impact location 23, as is illustrated, or the two points can be spaced apart.

The body may further include openings in the crown and/or sole that are overlaid or covered by inserts formed of lighter-weight material, such as composite materials. For example, the crown of the body can comprise a composite crown insert that covers a large portion of the area of the crown and has a lower density that the metal the body is made out of, thereby saving weight in the crown. Similarly, the sole can include one or more openings in the body that are covered by sole inserts. The sole insert can be made of composite material, metallic material, or other material. In embodiments where the body includes openings in the crown or sole, such openings can provide access to the inner cavity of the club head during manufacturing, especially where the face plate is formed as an integral part of the body during casting (and there is not a face opening in the body to provide access during manufacturing). The club heads disclosed herein in relation to FIGS. 20-36 provide examples of openings in the crown and sole that are overlaid or covered by inserts formed of lighter-weight material (e.g., composite materials). More information regarding openings in the body and related inserts can be found in U.S. Patent Publication 2018/0185719, published Jul. 5, 2018, and in U.S. Provisional Application No. 62/515,401, filed Jun. 5, 2017, both of which are incorporated by reference herein in their entireties.

In some embodiments, the club head can comprise adjustable weights, such as one or more weights movable along weight tracks formed in the sole and/or perimeter of the club head. Other exemplary weights can be adjusted by rotating the weights within threaded weight ports. Various ribs, struts, mass pads, and other structures can be included inside the body to provide reinforcement, adjust mass distribution and MOI properties, adjust acoustic properties, and/or for other reasons.

Wood-type club heads, such as the club head 2, have a volume, typically measured in cubic-centimeters ($cm^3$), equal to the volumetric displacement of the club head, assuming any apertures are sealed by a substantially planar surface. (See United States Golf Association "Procedure for Measuring the Club Head Size of Wood Clubs," Revision 1.0, Nov. 21, 2003). In the case of a driver, the golf club head can have a volume between approximately 250 $cm^3$ and approximately 600 $cm^3$, such as between approximately 300 $cm^3$ and approximately 500 $cm^3$, and can have a total mass between approximately 145 g and approximately 260 g. In the case of a fairway wood, the golf club head can have a volume between approximately 120 $cm^3$ and approximately 300 $cm^3$, and can have a total mass between approximately 115 g and approximately 260 g. In the case of a utility or hybrid club, the golf club head can have a volume between approximately 80 $cm^3$ and approximately 140 $cm^3$, and can have a total mass between approximately 105 g and approximately 280 g.

The sole 14 is defined as a lower portion of the club head 2 extending upwards from a lowest point of the club head when the club head is ideally positioned, i.e., at a proper address position relative to a golf ball on a level surface. In some implementations, the sole 14 extends approximately 50% to 60% of the distance from the lowest point of the club head to the crown 12, which in some instances, can be approximately 15 mm for a driver and between approximately 10 mm and 12 mm for a fairway wood.

Materials which may be used to construct the body 10, including the face plate 18, can include composite materials (e.g., carbon fiber reinforced polymeric materials), titanium or titanium alloys, steels or alloys of steel, magnesium alloys, copper alloys, nickel alloys, and/or any other metals or metal alloys suitable for golf club head construction. Other materials, such as paint, polymeric materials, ceramic materials, etc., can also be included in the body. In some embodiments, the body including the face plate can be made of a metallic material such as titanium or titanium alloys (including but not limited to 9-1-1 titanium, 6-4 titanium, 3-2.5, 6-4, SP700, 15-3-3-3, 10-2-3, or other alpha/near alpha, alpha-beta, and beta/near beta titanium alloys), or aluminum and aluminum alloys (including but not limited to 3000 series alloys, 5000 series alloys, 6000 series alloys, such as 6061-T6, and 7000 series alloys, such as 7075), Ti Grade 9 (Ti-3Al-2.5V) having a chemical composition of ≤3.5-2.5% Al; ≤3.0-2.0% V; ≤0.02% N; ≤0.013% H; ≤0.12 Fe.

Aspects of Investment Casting

Injection molding is used to form sacrificial "initial" patterns (e.g., made of casting "wax") of the desired castings. A suitable injection die can be made of aluminum, or other suitable metal or metal alloy, or other material, e.g., by a computer-controlled machining process using a casting master. CNC (computer numerical control) machining can be used to form the intricacies of the mold cavity in the die. The cavity dimensions are established so as to compensate for linear and volumetric shrinkage of the casting wax encountered during casting of the initial pattern and also to compensate for any similar shrinkage phenomena expected to be encountered during actual metal casting performed later using an investment-casting "shell" formed from the initial pattern.

Usually, a group of initial patterns is assembled together and attached to a central wax sprue to form a casting "cluster." Each initial pattern in the cluster forms a respective mold cavity in the casting shell formed later around the cluster. The central wax sprue defines the locations and configurations of runner channels and gates for routing molten metal, introduced into the sprue, to the mold cavities in the casting shell. The runner channels can include one or more filters (made, e.g., of ceramic) for enhancing smooth laminar flow of molten metal into and in the casting shell and for preventing entry of any dross, that may be trapped in the mold, into the shell cavities.

The casting shell is constructed by immersing the casting cluster into a liquid ceramic slurry, followed by immersion in a bed of refractory particles. This immersion sequence is repeated as required to build up a sufficient wall thickness of ceramic material around the casting cluster, thereby forming an investment-casting shell. An exemplary immersion sequence includes six dips of the casting cluster in liquid ceramic slurry and five dips in the bed of refractory particles, yielding an investment-casting shell comprising alternating layers of ceramic slurry and refractory material. The first two layers of refractory material desirably comprise fine (300 mesh) zirconium oxide particles, and the third to fifth layers of refractory material can comprise coarser (200 mesh to 35 mesh) aluminum oxide particles. Each layer is dried under controlled temperature (25±5° C.) and relative humidity (50±5%) before applying the subsequent layer.

The investment-casting shell is placed in a sealed steam autoclave in which the pressure is rapidly increased to 7-10 $kg/cm^2$. Under such a condition, the wax in the shell is melted out using injected steam. The shell is then baked in an oven in which the temperature is ramped up to 1000-1300° C. to remove residual wax and to increase the strength of the shell. The shell is now ready for use in investment casting.

After the club-head is designed and the initial pattern is made, the manufacturing effort is shifted to a metal caster. To make the investment-casting shell, the metal caster first configures the cluster comprising multiple initial patterns for individual club-heads. Configuring the cluster also involves configuring the metal-delivery system (gates and runners for later delivery of molten metal). After completing these tasks, the caster tools up to fabricate the casting shells.

Figure 12:
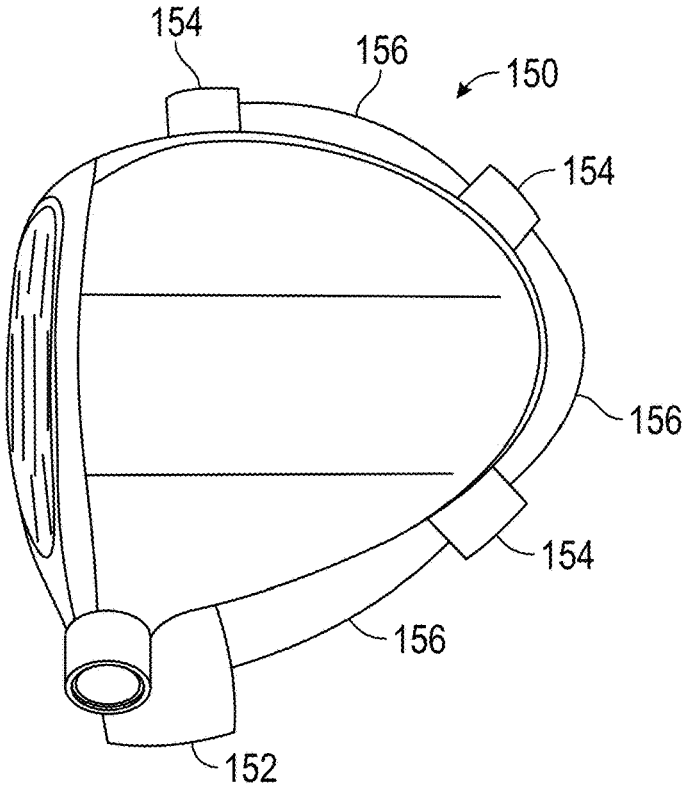
FIG. 12 is a top view of an exemplary initial pattern for a wood-type club head, showing a main gate, assistant gates, and flow channels.

An important aspect of configuring the cluster is determining the locations at which to place the gates. A mold cavity for an individual club-head usually has one main gate, through which molten metal flows into the mold cavity. Additional auxiliary ("assistant") gates can be connected to the main gate by flow channels. During investment casting using such a shell, the molten metal flows into each of the mold cavities through the respective main gates, through the flow channels, and through the auxiliary gates. This manner of flow requires that the mold for forming the initial pattern of a club-head also define the main gate and any assistant gates. After molding the wax initial pattern of the club-head, the initial pattern is removed from the mold, and the locations of flow channels are defined by "gluing" (using the same wax) pieces of wax between the gates. Reference is made to FIG. 12, which depicts an initial pattern 150 for a metal-wood clubhead. Shown are the main gate 152 and three assistant gates 154. Flow channels 156 interconnect the assistant gates 154 and main gate 152 to one another.

Multiple initial patterns for respective club-heads are then assembled into the cluster, which includes attaching the individual main gates to "ligaments." The ligaments include the sprue and runners of the cluster. A "receptor," usually made of graphite or the like, is placed at the center of the cluster where it later will be used to receive the molten metal and direct the metal to the runners. The receptor desirably has a "funnel" configuration to aid entry-flow of molten metal. Additional braces (made of, e.g., graphite) may be added to reinforce the cluster structure.

Usually, the overall wax-cluster is sufficiently large (especially if the furnace chamber that will be used for forming the shell is large) to allow pieces of wax to be "glued" to individual branches of the cluster first, followed by ceramic coating of the individual branches separately before the branches are assembled together into the cluster. Then, after assembling together the branches, the cluster is transferred to the shell-casting chamber.

Figure 13:
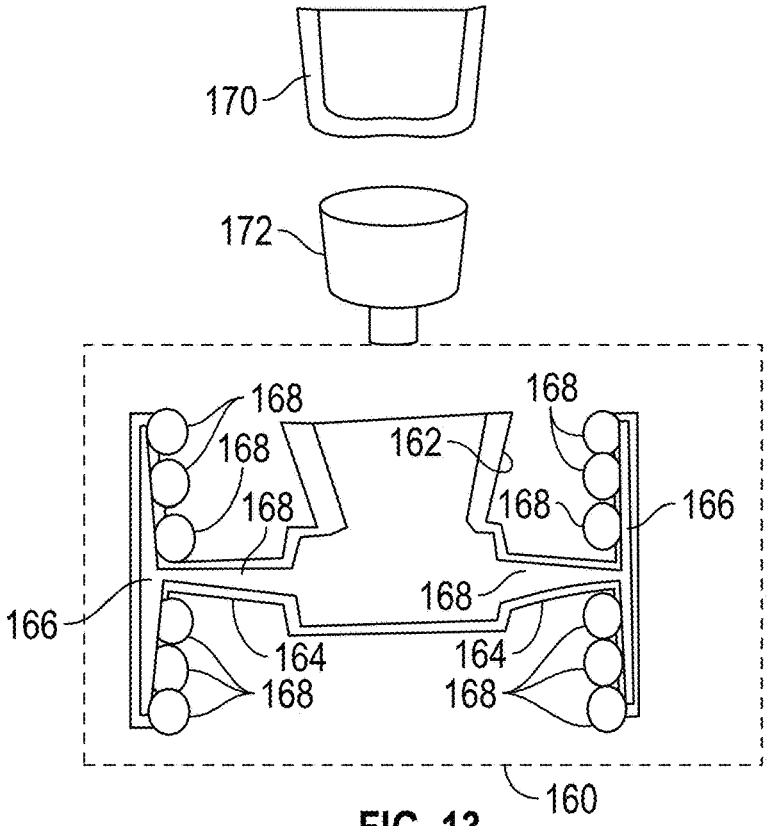
FIG. 13 is a schematic depiction of a casting cluster comprising multiple mold cavities.
Figure 14:
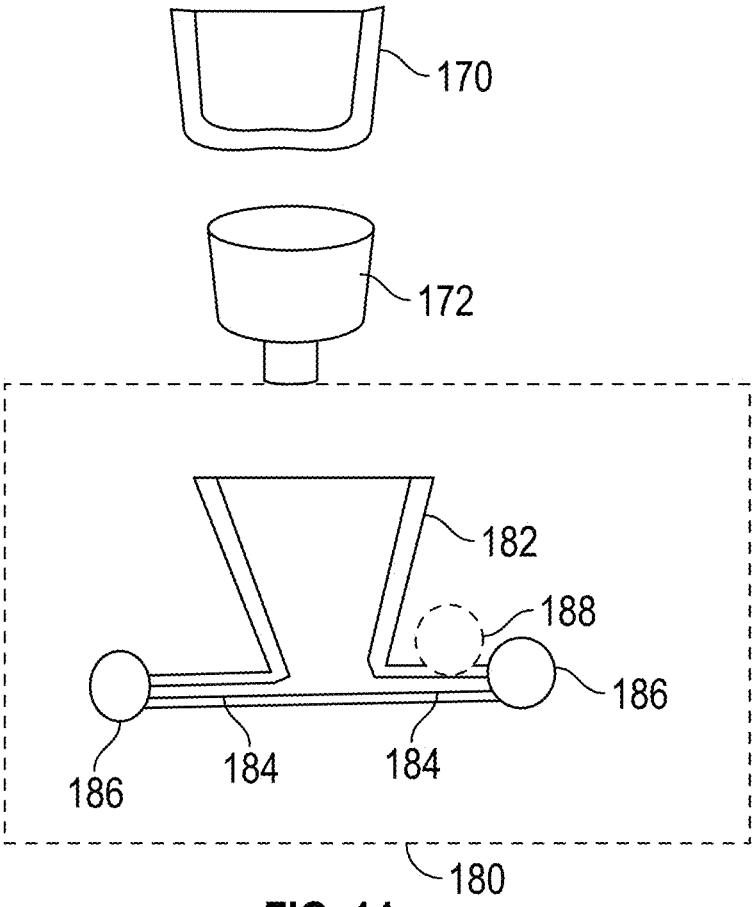
FIG. 14 is a schematic depiction of another casting cluster comprising multiple mold cavities.

Two exemplary clusters are shown in FIGS. 13 and 14, respectively. In FIG. 13, the depicted cluster 160 comprises a graphite receptor 162, a graphite cross-spoke 164, runners 166, and mold cavities 168. Each mold cavity 168 is for a respective club-head. Molten metal in a crucible 170 is poured into the cluster 160 using a pouring cup 172, which directs the molten metal into the receptor 162, into the branches 166, and then into the mold cavities 168. In FIG. 14, the depicted cluster 80 comprises a receptor 182 coupled to shell runners 184. Mold cavities are of two types in this configuration, "straight-feed" cavities 186 and "side feed" cavities 188. Molten metal in a crucible 170 is poured into the cluster 180 using a pouring cup 172, which directs the molten metal into the receptor 182, into the shell runners 184, and then into the mold cavities 186, 188.

The reinforced wax cluster is then coated with multiple layers of slurry and ceramic powders, with drying being performed between coats. After forming all the layers, the resulting investment-casting shell is autoclaved to melt the wax inside it (the ceramic and graphite portions are not melted). After removing the wax from the shell, the shell is sintered (fired), which substantially increases its mechanical strength. If the shell will be used in a relatively small metalcasting furnace (e.g., capable of holding a cluster of only one branch), the shell can now be used for investment casting. If the shell will be used in a relatively large metal-casting furnace, the shell can be assembled with other shell branches to form a large, multi-branched cluster.

Modern investment casting of metal alloys is usually performed while rotating the casting shell in a centrifugal manner to harness and exploit the force generated by the $\omega^2 r$ acceleration of the shell undergoing such motion, where $\omega$ is the angular velocity of the shell and r is the radius of the angular motion. This rotation is performed using a turntable situated inside a casting chamber under a sub atmospheric pressure. The force generated by the $\omega^2 r$ acceleration of the shell urges flow of the molten metal into the mold cavities without leaving voids. The investment-casting shell (including its constituent clusters and runners) is generally assembled outside the casting chamber and heated to a pre-set temperature before being placed as an integral unit on the turntable in the chamber. After mounting the shell to the turntable, the casting chamber is sealed and evacuated to a pre-set sub atmospheric-pressure ("vacuum") level. As the chamber is being evacuated, the molten alloy for casting is prepared, and the turntable commences rotating. When the molten metal is ready for pouring into the shell, the casting chamber is at the proper vacuum level, the casting shell is at a suitable temperature, and the turntable is spinning at the desired angular velocity. Thus, the molten metal is poured into the receptor of the casting shell and flows throughout the shell to fill the mold cavities in the shell.

As molten metal flows into the shell cavity and makes contact with the cavity surface, the high temperature environment (from both the molten metal and the preheated shell) encourages diffusion of elements, such as oxygen, in the shell material. Although titanium casting is always carried out under the sub atmospheric-pressure (vacuum) and oxygen is not available in the ambient environment, oxygen can still be found in the shell (as the shell consists of multiple layers of "oxides"). Introducing oxygen to the molten titanium causes the formation of an oxygen-rich layer, the alpha-case, on the surface of the titanium object to be cast. Typically, the thickness of the alpha-case is on the order of 1-4% of the thickness of the object.

As the alpha-case is "enriched" with oxygen, it is brittle (oxygen is one of the most effective elements of increasing the strength of titanium alloys, but while the strength is increased the ductility is greatly reduced) and can easily crack upon loading. To reduce the propensity of forming alpha-case the diffusion rate of oxygen needs to be reduced, and to reduce the diffusion rate the temperature needs to be reduced. However, it is impossible to reduce the temperature of the molten titanium. Therefore, reducing the temperature of the pre-heated shell is one way of reducing the diffusion rate of oxygen, thus reducing the formation of the alpha-case.

Typically, before transferring to the casting furnace a casting shell will be heated (called pre-heating) to aid the flow of molten titanium. The higher the pre-heat temperature of the shell, the easier the flow of titanium. This is essential for thin-wall titanium casting and the pre-heat temperature can be as high as 1100-1200 C. On the other hand, such high temperatures tend to produce thick alpha-case layers (towards the higher end of the 1-4% wall thickness range). Therefore, the pre-heat temperature of a casting shell can be lowered if the formation of alpha-case is a concern. Typically, the pre-heat temperature of a casting shell is lower than 1000 C or, preferably, lower than 900 C for non-flow-critical titanium castings where formation of alpha-case is undesirable.

Cluster Casting Methods

Figure 15:
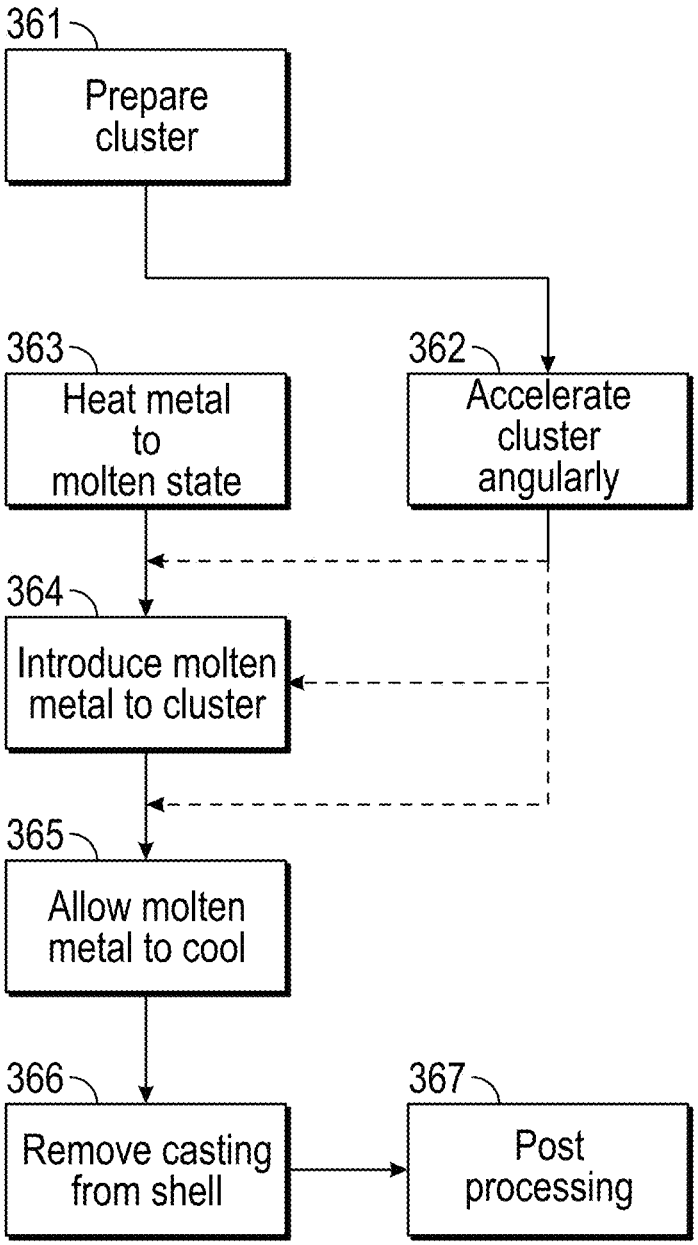
FIG. 15 is a work flow diagram indicating a method for casting golf club heads.

As seen with reference to FIG. 15, a method of manufacturing golf club heads involves preparing a cluster as disclosed elsewhere in this disclosure as shown with reference to step 361. In various embodiments, the step of preparing a cluster may include a preheat step as disclosed elsewhere herein. One aspect of the current disclosure is that cluster preheat may be lower than needed for traditional investment casting techniques. For example, with traditional investment casting techniques, preheat may be on the order of 1000 C-1400 C; with centrifugal casting of the current disclosure, temperatures of preheat may be less than 1,000 C in some embodiments; less than 800 C in some embodiments; or about 500 C or less in some embodiments. In some embodiments, no preheat is needed, and casting may occur with the shell at room temperature. When the cluster is prepared, it may be accelerated angularly in accord with step 362. Metal may be by heated to molten state concurrent with cluster preparation and/or cluster acceleration, or may be an intermediate step. However, metal may be heated to molten state in accord with step 363. Molten metal is introduced to the cluster in accord with step 364. As indicated by the broken line leading from step 362 to step 364, the cluster may be angularly accelerated before, after, or concurrently with the introduction of molten metal to the cluster. Molten metal is allowed to cool in accord with step 365. The cluster casting is removed from the cluster shell in step 366, and post-processing occurs in accord with step 367 and beyond.

In some embodiments, step 363 includes heating metal to molten state. In various embodiments, heating temperatures may be higher or lower depending on application. In some embodiments, step 362 includes accelerating the cluster angularly to an angular velocity, e.g., about 360 revolutions per minute. In various embodiments, angular speeds may range from 250-450 revolutions per minute. In various embodiments, angular speeds as low as 150 rpm and as high as 600 rpm may be suitable.

Because of lower casting temperatures, the step of allowing molten metal to cool in the mold cluster includes a reduced waiting time as compared to traditional investment-casting processes. The result is improved yield and better cycle times. In various traditional investment casting methods that rely on gravity, casting of only 6-8 maximum parts was possible. Using centrifugal casting, 18-25 parts or more may be cast in one cycle, thereby increasing production capacity for a single casting cycle. Additionally, yield per gram of pour is also increased. For traditional investment casting methods, a certain mass of metal is used to cast a certain number golf club heads. With spin casting techniques of the current disclosure, the same mass of metal can be used to produce more golf club heads. Improvements and honing of the techniques in the current disclosure can reduce this mass of metal/per head even further. Reduced cycle times can also be present depending on particular methodology. Additionally, the methods described herein lead to reduced tooling and capital expenditure required for the same production demand. As such, methods described herein reduce cost and improve production quality.

Additionally, casting according to the method described herein leads to a savings in material and achieve greater throughput because material can be more easily flowed to a greater number of heads given the increased acceleration and, thereby, force applied to the casting. Finally, alloys that typically are manufactured using other methods may be more easily cast to similar geometries.

Gating and Cluster Configurations

Configuring the gates and the cluster(s) involves consideration of multiple factors. These include (but are not necessarily limited to): (a) the dimensional limitations of the casting chamber of the metal-casting furnace, (b) handling requirements, particularly during the slurry-dipping steps that form the investment-casting shell, (c) achieving an optimal flow pattern of the molten metal in the investment-casting shell, (d) providing the cluster(s) of the investment-casting shell with at least minimum strength required for them to withstand rotational motion during metal casting, (e) achieving a balance of minimum resistance to flow of molten metal into the mold cavities (by providing the runners with sufficiently large cross-sections) versus achieving minimum waste of metal (e.g., by providing the runners with small cross-sections), and (f) achieving a mechanical balance of the cluster(s) about a central axis of the casting shell. Item (e) can be important because, after casting, any metal remaining in the runners does not form product but rather may be "contaminated" (a portion of which is usually recycled). These configurational factors are coupled with metal-casting parameters such as shell-preheat temperature and time, vacuum level in the metal-casting chamber, and the angular velocity of the turntable to produce actual casting results. As club-head walls are made increasingly thinner, careful selection and balance of these parameters are essential to produce adequate investment-casting results.

Details of investment casting as performed at metal casters tend to be proprietary. But, experiments at various titanium casters have in the past revealed some consistencies and some general trends. For example, a particular club-head (having a volume of 460 $cm^3$, a crown thickness of 0.6 mm, and a sole thickness of 0.8 mm) was fabricated at each of six titanium casters (having respective metal-casting furnaces ranging from 10 kg to 80 kg capacity), producing the data tabulated in FIGS. 16 and 17. The parameters listed in FIGS. 16 and 17 include the following:

"R max" is the maximum radius of the cluster

"R min" is the minimum radius of the cluster

"Wet perimeter" is the total perimeter of the runner

"R (flow radius)" is the cross-sectional area/wet perimeter of the runner

"Sharp turn" is a 90-degree or greater turn in the runner system

"Process loss ratio" is the ratio of process loss to pouring material

"Velocity max" is the velocity at the maximum radius

"Velocity min" is the velocity at the minimum radius

"Acceleration max" is the acceleration at the maximum radius

"Acceleration min" is the acceleration at the minimum radius

"Force max" is the force at the maximum radius (note that this is an approximation of the magnitude of force being applied to the molten metal at a gate. Due to each particular cluster design, the true force is almost always lower than the calculated value, with more complex clusters exhibiting greater reduction of the force.)

"Force min" is the force at the minimum radius (note that this is an approximation of the magnitude of force being applied to the molten metal at the gate. Due to each particular cluster design, the true force is almost always lower than the calculated value, with more complex clusters exhibiting greater reduction of the force.)

"Pressure max" is the pressure of molten metal in the runner at maximum radius (=Force max/Runner cross-sectional area)

"Pressure min" is the pressure of molten metal in the runner at minimum radius (=Force min/Runner cross-sectional area)

"Kinetic energy max" is the kinetic energy of molten metal at the maximum radius "Density" is the density of molten metal (titanium alloy) at the melting point of 1650 C.

"Viscosity" is the viscosity of molten titanium at 1650 C

"Re number max" is the Reynolds number for pipe flow at maximum radius

"Re number min" is defined consistently as Re number max, but at a minimum radius.

Minimum Force Requirement

FIGS. 16 and 17 provide a table of data that indicates that at least a minimum force (and thus at least a minimum pressure) should be applied to the molten metal entering the casting shell for each cluster to achieve a good casting yield. The force applied to the molten metal is generated in part by the mass of actual molten metal entering the mold cavities in the cluster and by the centrifugal force produced by the rotating turntable of the casting furnace. A reduced minimum force is desirable because a lower force generally allows a reduction in the amount, per club-head, of molten metal necessary for casting. However, other factors tend to indicate increasing this force, including: thinner wall sections in the item being cast, more complex clusters (and thus more complex flow patterns of the molten metal), reduced shell-preheat temperatures (resulting in a greater loss of thermal energy from the molten metal as it flows into the investment-casting shell), and substandard shell qualities such as rough mold-cavity walls and the like. The data in FIGS. 16 and 17 indicate that the minimum force required for casting a titanium-alloy club-head, of which at least a portion of the wall is 0.6 mm thick, is approximately 160 Nt. Caster 1 achieved this minimum force.

From the minimum-force requirement can be derived a lower threshold of the amount of molten metal necessary for pouring into the shell. Excluding unavoidable pouring losses, the best metal usage (as achieved by caster 1) was 386 g (0.386 kg) for club-heads each having a mass of approximately 200 g (including gate and some runner). This is equivalent to a material-usage ratio of 200/386=52 percent. The accelerations (max) applied to the investment-casting shell by the casters 2-6 were all higher than the acceleration applied by caster 1, but more molten metal was needed by each of casters 2-6 to produce respective casting yields that were equivalent to that achieved by caster 1.

Figure 18:
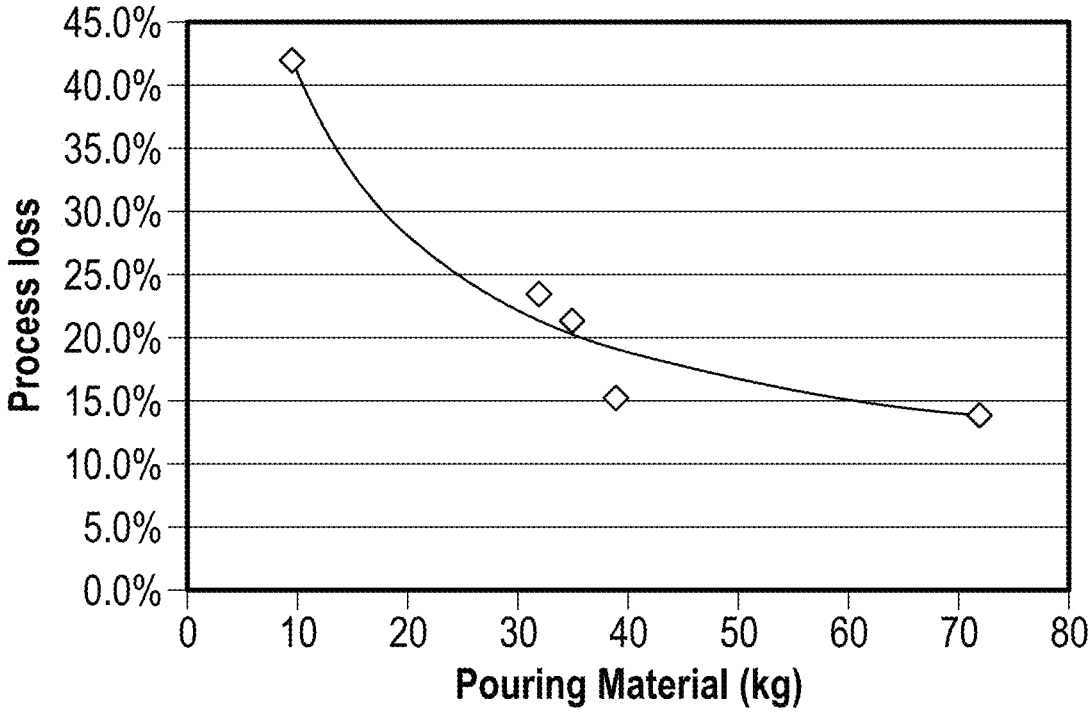
FIG. 18 is a plot of process loss versus mass of pouring material (molten metal), for titanium alloy the latter being indicative of casting-furnace size for the various casters.

Some process loss (splashing, cooled metal adhering to side walls of the crucible and coup supplying the liquid titanium alloy, revert cleaning loss, and the like) is unavoidable. Process loss imposes an upper limit to the efficiency that can be achieved by smaller casting furnaces. i.e., the percentage of process loss increases rapidly with decreases in furnace size, as illustrated in FIG. 18.

On the other hand, smaller casting furnaces advantageously have simpler operation and maintenance requirements. Other advantages of smaller furnaces are: (a) they tend to process smaller and simpler clusters of mold cavities, (b) smaller clusters tend to have separate respective runners feeding each mold cavity, which provides better interface-gating ratios for entry of molten metal into the mold cavities, (c) the furnaces are more easily and more rapidly preheated prior to casting, (d) the furnaces offer a potentially higher achievable shell-preheat temperature, and (e) smaller clusters tend to have shorter runners, which have lower Reynolds numbers and thus pose reduced potentials for disruptive turbulent flow. While larger casting furnaces tend not to have these advantages, smaller casting furnaces tend to have more unavoidable process loss of molten metal per mold cavity than do larger furnaces.

In view of the above, the cost-effective casting systems (furnaces, clusters, yields, net material costs) appear to include medium-sized systems, so long as appropriate cluster- and gate-design considerations are incorporated into configurations of the investment-casting shells used in such furnaces. This can be seen from comparing casters 1, 4, and 5. The overall usages of material (without considering process losses) by these three casters are very close (664-667 g/cavity). Material usage (considering process loss) by caster 1 is 386 g, while that of casters 4 and 5 is 510 g. Thus, whereas casters 4 and 5 could still improve, it appears that caster 1 has reached its limit in this regard.

Flow-Field Considerations

At least the minimum threshold force applied to molten metal entering the investment-casting shell can be achieved by either changing the mass or increasing the velocity of the molten metal entering the shell, typically by decreasing one and increasing the other. There is a realistic limit to the degree to which the mass of "pour material" (molten metal) can be reduced. As the mass of pour material is reduced, correspondingly more acceleration is necessary to generate sufficient force to move the molten metal effectively into the investment-casting shell. But, increasing the acceleration increases the probability of creating turbulent flow of the molten metal entering the shell. Turbulent flow is undesirable because it disrupts the flow pattern of the molten metal. A disrupted flow pattern can require even greater force to "push" the metal though the main gate into the mold cavities.

The Reynolds number can be easily modified by changing the shape and/or dimensions of the runner(s). For example, changing R (flow radius) will affect the Reynolds number directly. The smaller R (flow radius) will result in less minimum force (the two almost having a reciprocal relationship). Hence, an advantageous consideration is first to reduce the Reynolds number to maintain a steady flow field of the molten metal, and then satisfy the requirement of minimum force by adjusting the amount of pour material.

Other Factors

One additional factors is preheating the investment-casting shell before introducing the molten metal to it. Caster 1 achieved 94% yield with the smallest Reynolds number and the minimum amount of pour material (and thus the lowest force) in part because caster 1 had the highest shell-preheat temperature. Another factor is the complexity of the cluster(s). Evaluating a complex cluster is very difficult, and the high Reynolds numbers usually exhibited by such clusters are not the only variable to be controlled to reduce disruptive turbulent flow of molten metal in such clusters. For example, the number of "sharp" turns (90-degree turns or greater) in runners and mold cavities of the cluster is also a factor. In regard to FIGS. 16 and 17, the investment-casting shell used by caster 1 has one sharp turn (and another less-sharp turn), whereas the shell used by caster 6 has three sharp turns. It is possible that caster 6 needs to rotate its shell at a higher angular velocity just to overcome the flow resistance posed by these sharp turns. But, this would not alleviate disrupted flow patterns posed by the sharp turns. Hence, investment-casting shells comprising simpler cluster(s) (with fewer sharp turns to allow more "natural" flow routes of molten metal) are desired.

Another factor is matching the runner and gates. The interface gating ratio for caster 1 is the closest to 100% (indicating optimal gating), compared to the substantially inferior data from the other casters. The "worst" was caster 3, whose investment-casting shell had a Reynolds number almost as low as that of caster 1, but caster 3 achieved a yield of only 78%, due to a poor interface gating ratio (approximately 23%). The low interface gating ratio exhibited by the shell of caster 3 increased the difficulty of determining whether the cause of caster 3's low yield was insufficient pour material to fill the gates or the occurrence of "two-phase flow-liquid and vacancy." In any event, the overall cross-sectional areas of runners and gates may be kept as nearly equal (and constant) to each other as possible to achieve constant flow velocity of liquid metal throughout the shell at any moment during pouring. For thin-walled titanium alloy castings, this principle applies especially to the interfaces between the runner and the main gates, where the interface gating ratio should be no less than unity (1.0).

Yet another factor is the cross-sectional shape of the runner. Comparing casters 4 and 5, and casters 2 and 5, triangular-section runners appeared to produce lower Reynolds numbers than rounded or rectangular runners. Although using triangular-section runners can cause problems with interface gating ratio (as metal flows from such a runner into a rectilinear-section or round-section gate), the significant reduction in Reynolds numbers achieved using triangular-section runners is worth pursuing as the difference in pour material used by casters 2 and 5 indicates (39 kg versus 32 kg).

Figure 19:
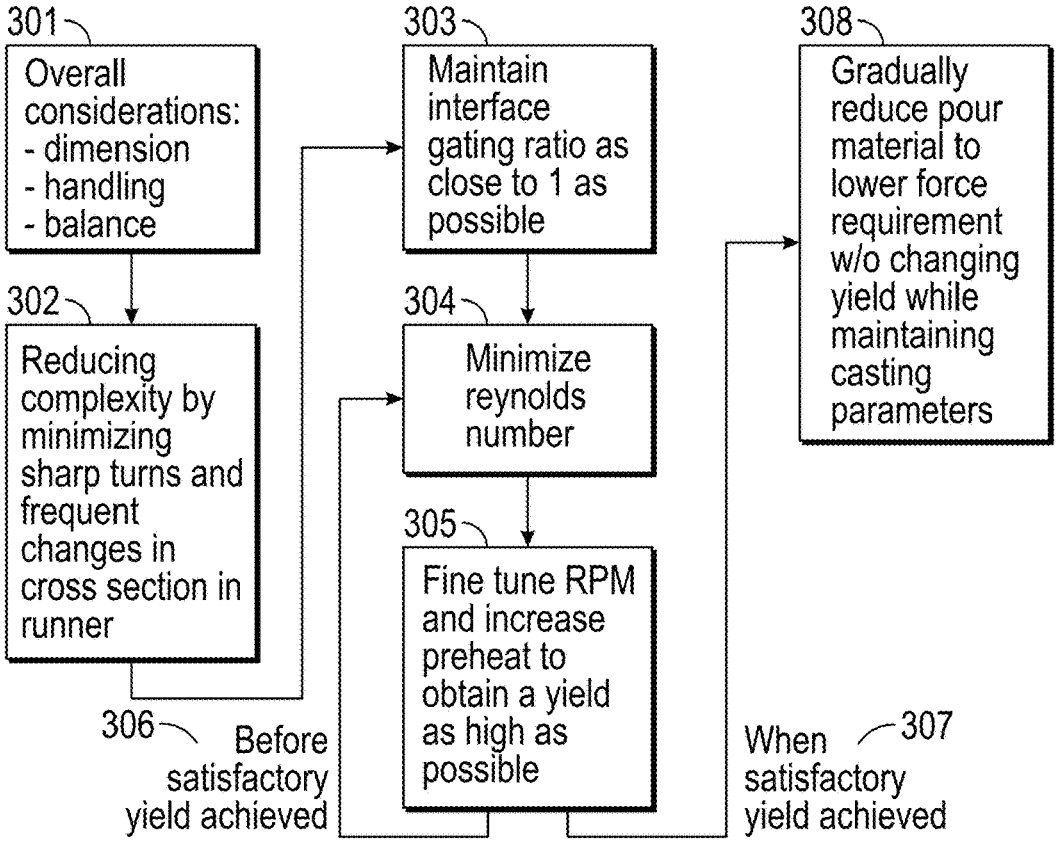
FIG. 19 is a flow chart of an embodiment of a method for configuring a casting cluster.

A flow-chart for configuring a cluster of an investment-casting shell is shown in FIG. 19. In a first step 301, overall considerations of the intended cluster are made such as dimensions, handling, and balance. Next, the complexity of the cluster is reduced by minimizing sharp turns and any unnecessary (certainly any frequent) changes in runner cross-section (step 302). The interface gating ratio is maintained as close as possible to unity (step 303). Also, the Reynolds number is minimized as much as practicable (step 304). The angular velocity (RPM) of the turntable is fine-tuned and the shell pre-heat temperature is increased to produce the highest possible product yield (step 305). Iteration (306) of steps 304, 305 is usually required to achieve a satisfactory yield. In step 308, after a satisfactory yield is achieved (307), the mass of pour material (molten metal) is gradually reduced to reduce the force required to urge flow of molten metal throughout the cluster, but without decreasing product yield and while maintaining other casting parameters.

More information regarding investment casting methods and devices for casting thin-walled club heads using titanium alloys and other materials can be found in U.S. Pat. No. 7,513,296, issued Apr. 7, 2009, and in U.S. Publication No. 2016/0175666, published Jun. 23, 2016, both of which are incorporated by reference herein in their entireties. While these incorporated references disclose methods and systems for casting club head bodies without the face plate included (face plate is later attached to body), the same or similar methods and systems can be used, with the same or similar benefits and advantages, to cast the herein disclosed club head bodies where the face in an integrally cast part of the body, not formed separately and later attached to the body.

More information regarding coatings on molds for casting titanium alloys, and methods for producing molds having a calcium oxide face coat for use in casting titanium alloys, can be found in U.S. Pat. No. 5,766,329, issued Jun. 16, 1998, which is incorporated by reference herein in its entirety.

Club Heads Comprising Cast Titanium Alloy Body/Face

Compared to titanium golf club faces formed for sheet machining or forging processes, cast faces can have the advantage of lower cost and complete freedom of design. However, golf club faces cast from conventional titanium alloys, such as 6-4 Ti, need to be chemically etched to remove the alpha case on one or both sides so that the faces are durable. Such etching requires application of hydrofluoric (HF) acid, a chemical etchant that is difficult to handle, extremely harmful to humans and other materials, an environmental contaminant, and expensive.

Faces cast from titanium alloys comprising aluminum (e.g., 8.5-9.5% Al), vanadium (e.g., 0.9-1.3% V), and molybdenum (e.g., 0.8-1.1% Mo), optionally with other minor alloying elements and impurities, herein collectively referred to a "9-1-1 Ti", can have less significant alpha case, which renders HF acid etching unnecessary or at least less necessary compared to faces made from conventional 6-4 Ti and other titanium alloys.

Further, 9-1-1 Ti can have minimum mechanical properties of 820 MPa yield strength, 958 MPa tensile strength, and 10.2% elongation. These minimum properties can be significantly superior to typical cast titanium alloys, such as 6-4 Ti, which can have minimum mechanical properties of 812 MPa yield strength, 936 MPa tensile strength, and ~6% elongation.

Golf club heads that are cast including the face as an integral part of the body (e.g., cast at the same time as a single cast object) can provide superior structural properties compared to club heads where the face is formed separately and later attached (e.g., welded or bolted) to a front opening in the club head body. However, the advantages of having an integrally cast Ti face are mitigated by the need to remove the alpha case on the surface of cast Ti faces.

With the herein disclosed club heads comprising an integrally cast 9-1-1 Ti face and body unit, the drawback of having to remove the alpha case can be eliminated, or at least substantially reduced. For a cast 9-1-1 Ti face, using a conventional mold pre-heat temperature of 1000 C or more, the thickness of the alpha case can be about 0.15 mm or less, or about 0.20 mm or less, or about 0.30 mm or less, such as between 0.10 mm and 0.30 mm in some embodiments, whereas for a cast 6-4 Ti face the thickness of the alpha case can be greater than 0.15 mm, or greater than 0.20 mm, or greater than 0.30 mm, such as from about 0.25 mm to about 0.30 mm in some examples.

In some cases, the reduced thickness of the alpha case for 9-1-1 Ti face plates (e.g., 0.15 mm or less) may not be thin enough to provide sufficient durability needed for a face plate and to avoid needing to etch away some of the alpha case with a harsh chemical etchant, such as HF acid. In such cases, the pre-heat temperature of the mold can be lowered (such as to less than 800 C, less than 700 C, less than 600 C, and/or less than or equal to 500 C) prior to pouring the molten titanium alloy into the mold. This can further reduce the amount of oxygen transferred from the mold to the cast titanium alloy, resulting in a thinner alpha case (e.g., less than 0.15 mm, less than 0.10 mm, and/or less than 0.07 mm). This provides better ductility and durability for the cast body/face unit, which is especially important for the face plate.

The thinner alpha case in cast 9-1-1 Ti faces helps provide enhanced durability, such that the face is durable enough that the removal of part of the alpha case from the face via chemical etching is not needed. Thus, hydrofluoric acid etching can be eliminated from the manufacturing process when the body and face are unitarily cast using 9-1-1 Ti, especially when using molds with lower pre-heat temperatures. This can simplify the manufacturing process, reduce cost, reduce safety risks and operation hazards, and eliminate the possibility of environmental contamination by HF acid. Further, because HF acid is not introduced to the metal, the body/face, or even the whole club head, can comprise very little or substantially no fluorine atoms, which can be defined as less than 1000 ppm, less than 500 ppm, less than 200 ppm, and or less than 100 ppm, wherein the fluorine atoms present are due to impurities in the metal material used to cast the body.

Variable Face Thickness and Bulge & Roll Properties of Faces

In certain embodiments, a variable thickness face profile may be implemented on the face plate, for example as is described in U.S. patent application Ser. No. 12/006,060 and U.S. Pat. Nos. 6,997,820; 6,800,038; 6,824,475; 7,731,603; and 8,801,541; the entire contents of each of which are incorporated herein by reference. Varying the thickness of a face plate may increase the size of a club head COR zone, commonly called the sweet spot of the golf club head, which, when striking a golf ball with the golf club head, allows a larger area of the face plate to deliver consistently high golf ball velocity and shot forgiveness. Also, varying the thickness of a faceplate can be advantageous in reducing the weight in the face region for re-allocation to another area of the club head. For example, as shown in FIG. 9 face plate 18 has a thickness t defined between the exterior surface 22 and the interior surface 40 facing the interior cavity of the golf club head. The face plate 18 can include a central portion 42 positioned adjacent the ideal impact location 23 on the external surface 22. The central portion 42 can have thickness that is similar to the thickness at the perimeter of the face plate, or slightly greater or less. The face plate 18 also can include a diverging portion 44 extending radially outward from the central portion 42, which may be elliptical. The interior surface 40 may be symmetrical about one or more axes and/or may be unsymmetrical about one or more axes. The thickness t of the diverging portion 44 increases in a direction radially outward from the central portion 42. The face plate 18 includes a converging portion 46 extending from the diverging portion 44 via a transition portion 48. The thickness t of the converging portion 46 substantially decreases with radially outward position from the transition portion 48. In certain instances, the transition portion 48 is an apex between the diverging and converging portions 44, 46. In other implementations, the transition portion 48 extends radially outward from the diverging portion 44 and has a substantially constant thickness t (see FIGS. 7-9).

Figure 7:
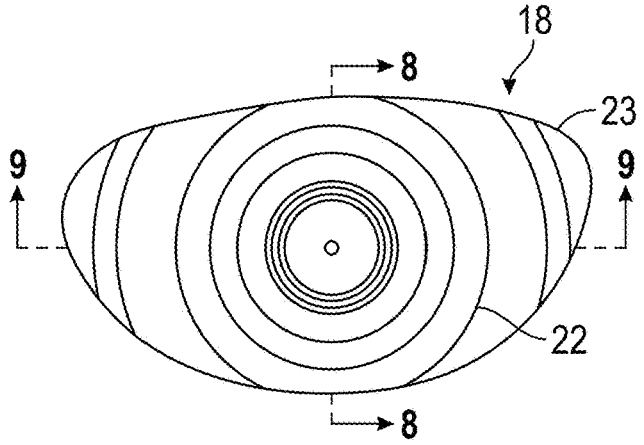
FIG. 7 is a rear elevation view of an exemplary face plate having variable thickness.
Figure 8:
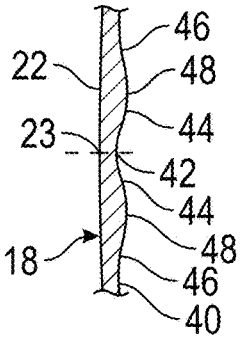
FIG. 8 is a cross-sectional side view of the face plate of FIG. 7 taken along the line 8-8 of FIG. 7.
Figure 9:
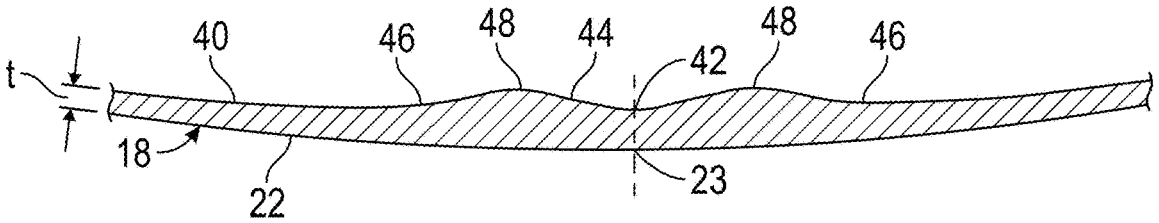
FIG. 9 is a cross-sectional side view of the face plate of FIG. 7 taken along the line 9-9 of FIG. 7.

In some embodiments, the cross-sectional profile of the face plate 18 along any axes extending perpendicular to the face plate at the ideal impact location 23 is substantially similar as in FIGS. 7-9. In other embodiments, the cross-sectional profile can vary, e.g., is non-symmetric. For example, in certain implementations, the cross-sectional profile of the face plate 18 along the head origin z-axis might include central, transition, diverging and converging portions as described above (see FIGS. 7-9). However, the cross-sectional profile of the face plate 18 along the head origin x-axis can include a second diverging portion extending radially from the converging portion 46 and coupled to the converging portion via a transition portion. In alternative embodiments, the cross-sectional profile of the face plate 18 along the head origin z-axis can include a second diverging portion extending radially from the converging portion and coupled to the converging portion, as described above with regard to variation along the head origin x-axis.

In some embodiments of a golf club head having a face plate with a protrusion, the maximum face plate thickness is greater than about 4.8 mm, and the minimum face plate thickness is less than about 2.3 mm. In certain embodiments, the maximum face plate thickness is between about 5 mm and about 5.4 mm and the minimum face plate thickness is between about 1.8 mm and about 2.2 mm. In yet more particular embodiments, the maximum face plate thickness is about 5.2 mm and the minimum face plate thickness is about 2 mm. The face thickness should have a thickness change of at least 25% over the face (thickest portion compared to thinnest) in order to save weight and achieve a higher ball speed on off-center hits.

In some embodiments of a golf club head having a face plate with a protrusion and a thin sole construction or a thin skirt construction, the maximum face plate thickness is greater than about 3.0 mm and the minimum face plate thickness is less than about 3.0 mm. In certain embodiments, the maximum face plate thickness is between about 3.0 mm and about 4.0 mm, between about 4.0 mm and about 5.0 mm, between about 5.0 mm and about 6.0 mm or greater than about 6.0 mm, and the minimum face plate thickness is between about 2.5 mm and about 3.0 mm, between about 2.0 mm and about 2.5 mm, between about 1.5 mm and about 2.0 mm or less than about 1.5 mm.

Figure 10:
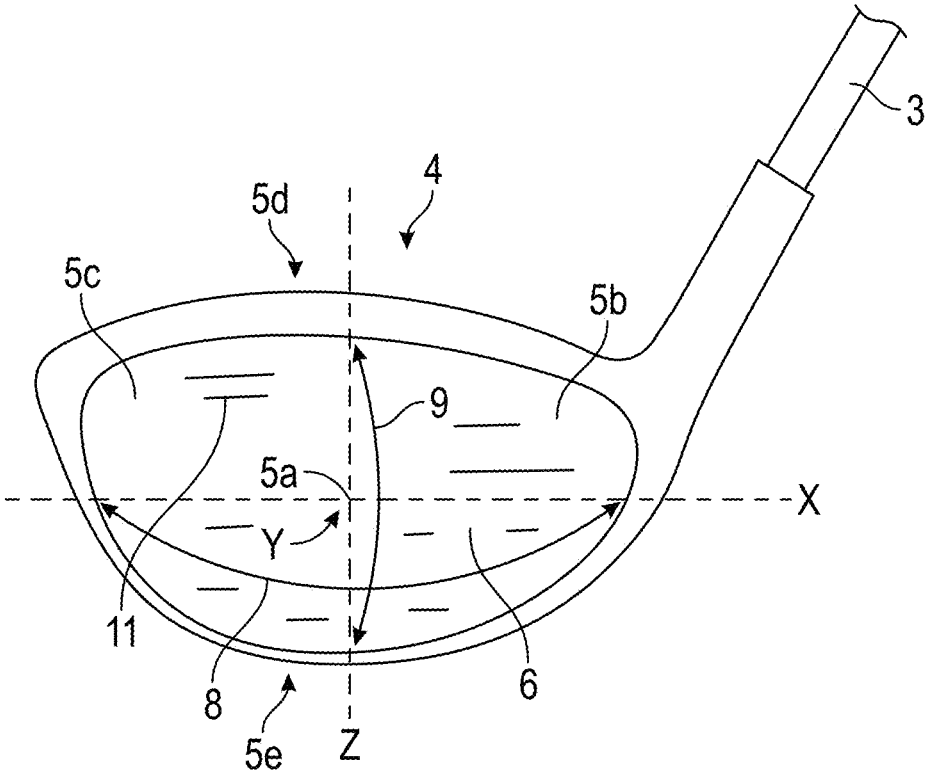
FIG. 10 is a front elevation view of the golf club heads of the present invention showing the bulge and roll measurement system.
Figure 11:
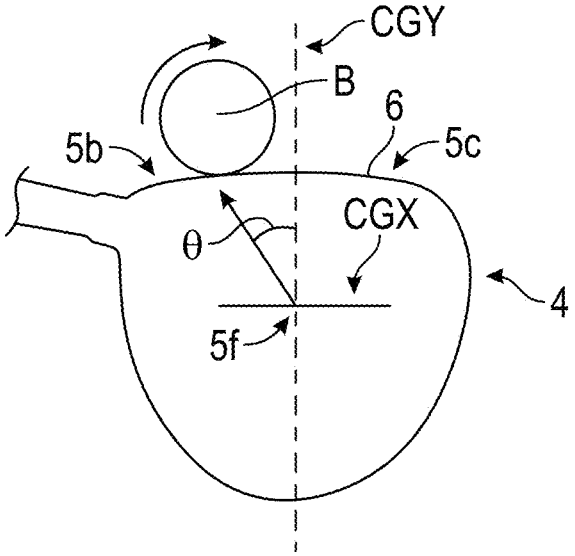
FIG. 11 is an illustration of the golf club head striking a golf ball on the heelward side of the golf club head.

FIGS. 10 and 11 show a golf club head 4 with a shaft 3. The club head 4 includes a center face 5*a*, a heel 5*b*, a toe 5*c*, a crown 5*d*, and a sole 5*e*. The club head 4 further comprises a club face 6 including a curvature from the heel 5*b* to the toe 5*c* commonly called a bulge 8. The club face 6 also includes a curvature from the crown 5*d* to the sole 5*e* commonly called a roll 9. In at least one embodiment, the combination of curvatures may provide a club face 6 with a substantially toroidal shape, or a shape similar to a section of a toroid. The club face 6 further includes an X-axis X which extends horizontally through the center face 5*a* from the heel 5*b* to the toe 5*c*, a Z-axis Z which extends vertically through the center face 5*a* from the crown 5*d* to the sole 5*e*, and a Y-axis Y which extends horizontally through the center face and into the page in FIG. 10. The X-axis X, Y-axis Y, and Z-axis Z are mutually orthogonal to one another.

As shown in FIG. 11, the club head 4 additionally has a center of gravity (CG) 5*f* which is internal to the club head. The club head 4 has a CG X-axis, a CG Y-axis, and a CG Z-axis which are mutually orthogonal to one another and pass through the CG 5*f* to define a CG coordinate system. The CG X-axis and CG Y-axis lie in a horizontal plane parallel to a flat ground surface when the club head is in the normal address position. The CG Z-axis lies in a vertical plane orthogonal to a flat ground surface when the club head is in the normal address position. In one embodiment the CG Y-axis may coincide with the Y-axis Y, but in most embodiments the axes do not coincide.

FIG. 11 is an exaggerated depiction of the club head 4 striking a golf ball B on the heel 5*b* of the club head. This imparts a clockwise spin to the golf ball B which causes the golf ball to curve to the right during flight. As discussed above, striking the golf ball B on the heel 5*b* of the club head 4 will cause the golf ball to leave the club head 4 at an angle Θ relative to the CG Y-axis of the club head 4. It will be understood that the angle Θ merely depicts a general angle at which the ball will leave the club head and is not intended to depict or imply the actual angle relative to the centerline, or the point from which that angle would be measured. Angle Θ further illustrates that a ball struck on the heel of the club will initially travel on a flight path to the left of the centerline.

The method used to obtain the values in the present disclosure is the optical comparator method. Referring back to FIG. 10, the club face 6 includes a series of score lines 11 which traverse the width of the club face generally along the X-axis X of the club head 4. In the optical comparator method, the club head 4 is mounted face down and generally horizontal on a V-block mounted on an optical comparator. The club head 4 is oriented such that the score lines 11 are generally parallel with the X-axis of the optical comparator. More precise orientation steps may also be used. Measurements are then taken at the geometric center point 5*a* on the club face. Further measurements are then taken 20 millimeters away from the geometric center point 5*a* of the club face 6 on either side of the geometric center point 5*a* and along the X-axis X of the club head, and 30 millimeters away from the geometric center point of the club face on either side of the center point and along the X-axis X of the club head. An arc is fit through these five measure points, for example by using the radius function on the machine. This arc corresponds to the circumference of a circle with a given radius. This measurement of radius is what is meant by the bulge radius.

To measure the roll, the club head 4 is rotated by 90 degrees such that the Z-axis Z of the club head is generally parallel to the X-axis of the machine. Measurements are taken at the geometric center point 5*a* of the club face. Further measurements are then taken 15 millimeters away from the geometric center point 5*a* and along the Z-axis Z of the club face 6 on either side of the center point 5*a*, and 20 millimeters away from the geometric center point and along the Z-axis of the club face on either side of the center point. An arc is fit through these five measurement points. This arc corresponds to the circumference of a circle with a given radius. This measurement of radius is what is meant by the roll radius.

Curvature is defined as 1/R wherein R is the radius of the circle which corresponds to the measurement arc of the bulge or the roll. As an example, a bulge with a curvature of 0.020 $cm^{-1}$ corresponds to a bulge measured by a bulge measurement arc which is part of a circle with a radius of 50 cm. A roll with a curvature of 0.050 $cm^{-1}$ corresponds to a roll measured by a roll measurement arc which is part of a circle with a radius of 20 cm.

In some embodiments, the face plates of the disclosed club heads can have the following properties:

i) the roll curvature is between about 0.033 $cm^{-1}$ and about 0.066 $cm^{-1}$, and the bulge curvature is greater than 0 $cm^{-1}$ and less than about 0.027 $cm^{-1}$;

ii) the inverse of the bulge curvature is greater than the inverse of the roll curvature by at least 7.62 cm; and/or iii) the ratio of the bulge curvature divided by the roll curvature, Ro is greater than about 0.28 and less than about 0.75.

Use of vacuum die casting to produce the club heads described herein results in improved quality and reduced scrap. In addition, rejections due to high porosity are virtually eliminated as are rejections after any secondary processing. An excellent surface quality is produced while increasing product density and strength are increased and thus making possible larger, thinner, and more complex, castings. From a processing standpoint, less casting pressure is required, and tool life and mold life are extended. Also waste of the metal or alloy due to flash is reduced or eliminated.

By utilizing a vacuum die casting process, it has been surprisingly found that the titanium bodies and face plates of the disclosed club heads exhibit much smaller grain size than is typically observed for analogous titanium objects made by investment casting, with grains of about 100 μm (micrometers) in size versus about 750 μm grain size for investment cast titanium face plates. More specifically, the titanium bodies/face plates disclosed herein can have a grain size of less than about 400 μm, preferably less than about 300 μm, more preferably less than about 200 μm and even more preferably less than about 150 μm, and most preferably less than about 120 μm.

The titanium bodies/face plates disclosed herein can also exhibit much lower porosity than is typically observed for an analogous separately formed titanium face plate made by investment casting. More specifically, the titanium face plates disclosed herein can have a porosity of less than 1% preferably less than 0.5% more preferably less than 0.1%.

The titanium bodies/face plates disclosed herein can also exhibit much higher yield strength, as measured by ASTM E8, than is typically observed for an analogous titanium face plate made by investment casting.

The titanium face plates disclosed here can also exhibit similar fracture toughness to that typically observed for an analogous titanium face plates made by investment casting, and higher than an analogous face plate made from a wrought mill-annealed product.

The titanium face plates disclosed herein can also exhibit ductility as measured by the percent elongation reported in a tensile test which is defined as the maximum elongation of the gage length divided by the original gage length of from about 10% to about 15%.

The titanium face plates disclosed herein can also exhibit a Young's Modulus of 100 GPa+/−10%, preferably +/−5% and more preferably +/−2% as measured by ASTM E-111.

The titanium face plates disclosed herein can also exhibit an Ultimate Tensile Strength of 970 MPa+/−10%, preferably +/−5% and more preferably +/−2% as measured by ASTM E8.

Combination of the various properties described above allows fabrication of metalwood titanium club heads having titanium face plates that can be 10% thinner than the analogous face plates made by conventional investment casting while maintaining as good if not better strength properties.

In addition to the strength properties of the golf club heads of the present invention, in certain embodiments, the shape and dimensions of the golf club head may be formed so as to produce an aerodynamic shape as according to U.S. Patent Publication No. 2013/0123040 A1, filed on Dec. 18, 2012 to Willett et al., the entire contents of which are incorporated by reference herein. The aerodynamics of golf club heads are also discussed in detail in U.S. Pat. Nos. 8,777,773; 8,088,021; 8,540,586; 8,858,359; 8,597,137; 8,771,101; 8,083,609; 8,550,936; 8,602,909; and 8,734,269; the teachings of which are incorporated by reference herein in their entirety.

In addition to the strength properties of the aft body, and the aerodynamic properties of the club head, another set of properties of the club head which must be controlled are the acoustical properties or the sound that a golf club head emits when it strikes a golf ball. At club head/golf ball impact, a club striking face is deformed so that vibrational modes of the club head associated with the club crown, sole, or striking face are excited. The geometry of most golf clubs is complex, consisting of surfaces having a variety of curvatures, thicknesses, and materials, and precise calculation of club head modes may be difficult. Club head modes can be calculated using computer-aided simulation tools. For the club heads of the present invention the acoustic signal produced with ball/club impact can be evaluated as described in in copending U.S. application Ser. No. 13/842,011 filed on Mar. 15, 2013, the entire contents of which are incorporated by reference herein.

In certain embodiments of the present invention the golf club head may be attached to the shaft via a removable head-shaft connection assembly as described in more detail in U.S. Pat. No. 8,303,431 issued on Nov. 6, 2012, the entire contents of which are incorporated by reference herein. Further in certain embodiments, the golf club head may also incorporate features that provide the golf club heads and/or golf clubs with the ability not only to replaceably connect the shaft to the head but also to adjust the loft and/or the lie angle of the club by employing a removable head-shaft connection assembly. Such an adjustable lie/loft connection assembly is described in more detail in U.S. Pat. No. 8,025,587 issuing on Sep. 27, 2011, U.S. Pat. No. 8,235,831 issued on Aug. 7, 2012, U.S. Pat. No. 8,337,319 issued on Dec. 25, 2012, as well as copending US Publication No. 2011/0312437A1 filed on Jun. 22, 2011, US Publication No. 2012/0258818 A1 filed on Jun. 20, 2012, US Publication No. 2012/0122601A1 filed on Dec. 29, 2011, US Publication No.

2012/0071264 A1 filed on Mar. 22, 2011 as well as copending U.S. application Ser. No. 13/686,677 filed on Nov. 27, 2012, the entire contents of which patents, publications and applications are incorporated in their entirety by reference herein.

In certain embodiments the golf club head may feature an adjustable mechanism provided on the sole portion to "decouple" the relationship between face angle and hosel/shaft loft, to allow for separate adjustment of square loft and face angle of a golf club. For example, some embodiments of the golf club head may include an adjustable sole portion that can be adjusted relative to the club head body to raise and lower the rear end of the club head relative to the ground. Further detail concerning the adjustable sole portion is provided in U.S. Pat. No. 8,337,319 issued on Dec. 25, 2012, U.S. Patent Publication Nos. US2011/0152000 A1 filed on Dec. 23, 2009, US2011/0312437 filed on Jun. 22, 2011, US2012/0122601A1 filed on Dec. 29, 2011 and copending U.S. application Ser. No. 13/686,677 filed on Nov. 27, 2012, the entire contents of each of which are incorporated herein by reference.

In some embodiments movable weights can be adjusted by the manufacturer and/or the user to adjust the position of the center of gravity of the club to give the desired performance characteristics can be used in the golf club head. This feature is described in more detail in the following U.S. Pat. Nos. 6,773,360; 7,166,040; 7,452,285; 7,628,707; 7,186,190; 7,591,738; 7,963,861; 7,621,823; 7,448,963; 7,568,985; 7,578,753; 7,717,804; 7,717,805; 7,530,904; 7,540,811; 7,407,447; 7,632,194; 7,846,041; 7,419,441; 7,713,142; 7,744,484; 7,223,180; and 7,410,425; the entire contents of each of which are incorporated by reference in their entirety herein.

According to some embodiments of the golf club heads described herein, the golf club head may also include a slidably repositionable weight positioned in the sole and/or skirt portion of the club head. Among other advantages, a slidably repositionable weight facilitates the ability of the end user of the golf club to adjust the location of the CG of the club head over a range of locations relating to the position of the repositionable weight. Further detail concerning the slidably repositionable weight feature is provided in more detail in U.S. Pat. Nos. 7,775,905 and 8,444,505 and U.S. patent application Ser. No. 13/898,313 filed on May 20, 2013 and U.S. patent application Ser. No. 14/047,880 filed on Oct. 7, 2013, the entire contents of each of which are hereby incorporated by reference herein as well the contents of paragraphs [430] to [470] and FIGS. 93-101 of US Patent Publication No. 2014/0080622 corresponding to U.S. patent application Ser. No. 13/956,046 filed on Jul. 31, 2013 as well as copending U.S. patent application Ser. Nos. 62/020,972 filed on Jul. 3, 2014 and 62/065,552 filed on Oct. 17, 2014, the contents of each of which are hereby incorporated by reference herein.

According to some embodiments of the golf club heads described herein, the golf club head may also include a coefficient of restitution feature which defines a gap in the body of the club, for example located on the sole portion and proximate the face. Such coefficient of restitution features are described more fully in U.S. patent application Ser. No. 12/791,025, filed Jun. 1, 2010, and Ser. No. 13/338,197, filed Dec. 27, 2011 and Ser. No. 13/839,727, filed Mar. 15, 2013 (US Publication No. 2014/0274457A1) and Ser. No. 14/457,883 filed Aug. 12, 2014 and Ser. No. 14/573,701 filed Dec. 17, 2014, the entire contents of each of which are incorporated by reference herein in their entirety.

Additional Exemplary Club Heads

FIGS. 20-36D illustrate another exemplary wood-type golf club head 200, which can include any combination of the features disclosed herein. For example, the club head body 202 and face 270 can be cast as a unitary structure from titanium alloys, as discussed herein. The head 200 includes a raised sole construction (see benefits discussed in US 2018/0185719), and also includes two weight tracks 214, 216 with slidably adjustable weights assemblies 210, 212. The head 200 further comprises both a crown insert 206 and a sole insert 208 (see exploded views in FIGS. 21 and 22), which inserts can be constructed from various lightweight materials having multiple layers of fiber reinforcement arranged in desired orientation patters (see further details in US 2018/0185719).

The head 200 comprises a body 202, an adjustable head-shaft connection assembly 204, the crown insert 206 attached to the upper portion of the body, the sole insert 208 mounted inside the body on top of the lower portion of the body, the front weight assembly 210 slidably mounted in the front weight track 214, and the rear weight assembly 212 slidably mounted in the rear weight track 216. The head 200 includes a front sit pad, or ground contact surface, 226 between the front track 214 and the face 270, and a rear sit pad, or ground contact surface, 224 at the rear of the body to the heel side of the rear track 216, with the rest of the sole elevated above the ground when in the normal address position.

Figure 22:
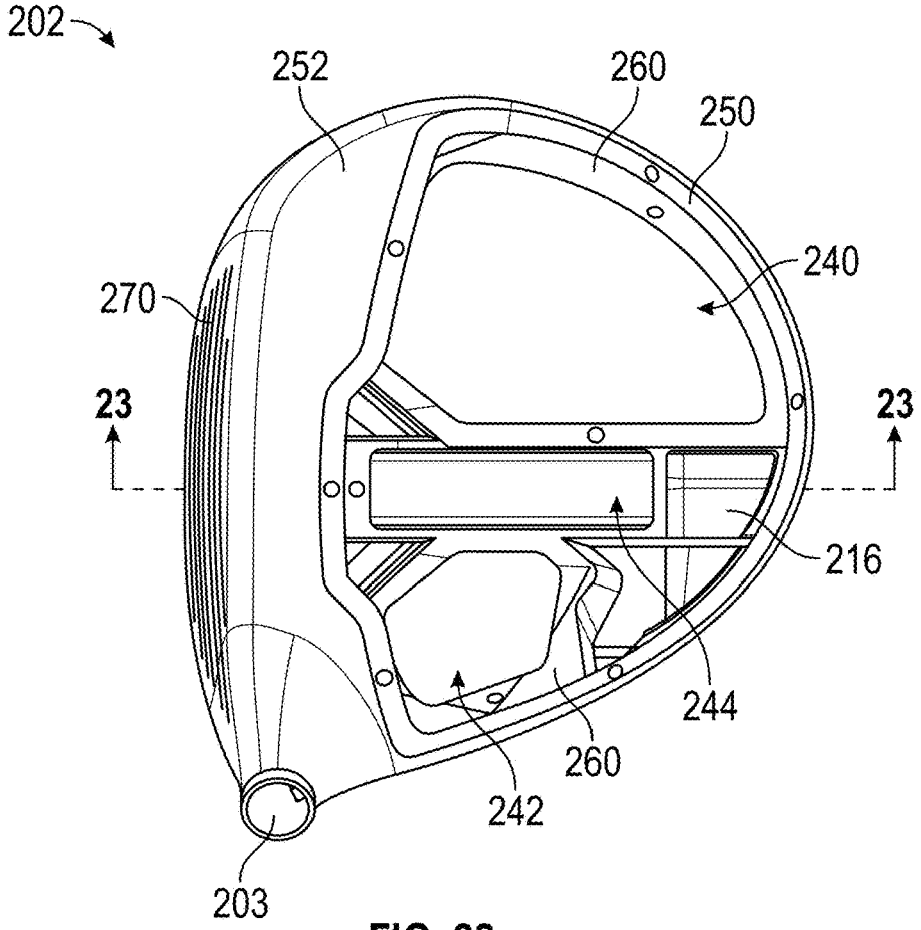
FIG. 22 is a top view of the body of the golf club head of FIG. 20.
Figure 23:
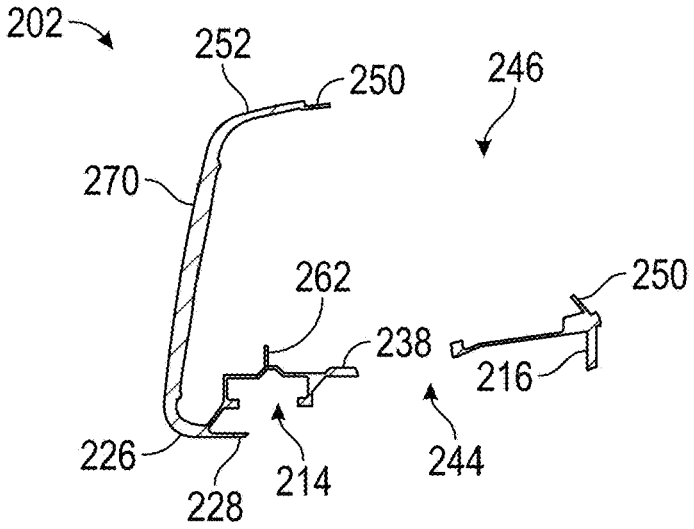
FIG. 23 is a cross-sectional view of the body taken along line 23-23 in FIG. 22.
Figure 24:
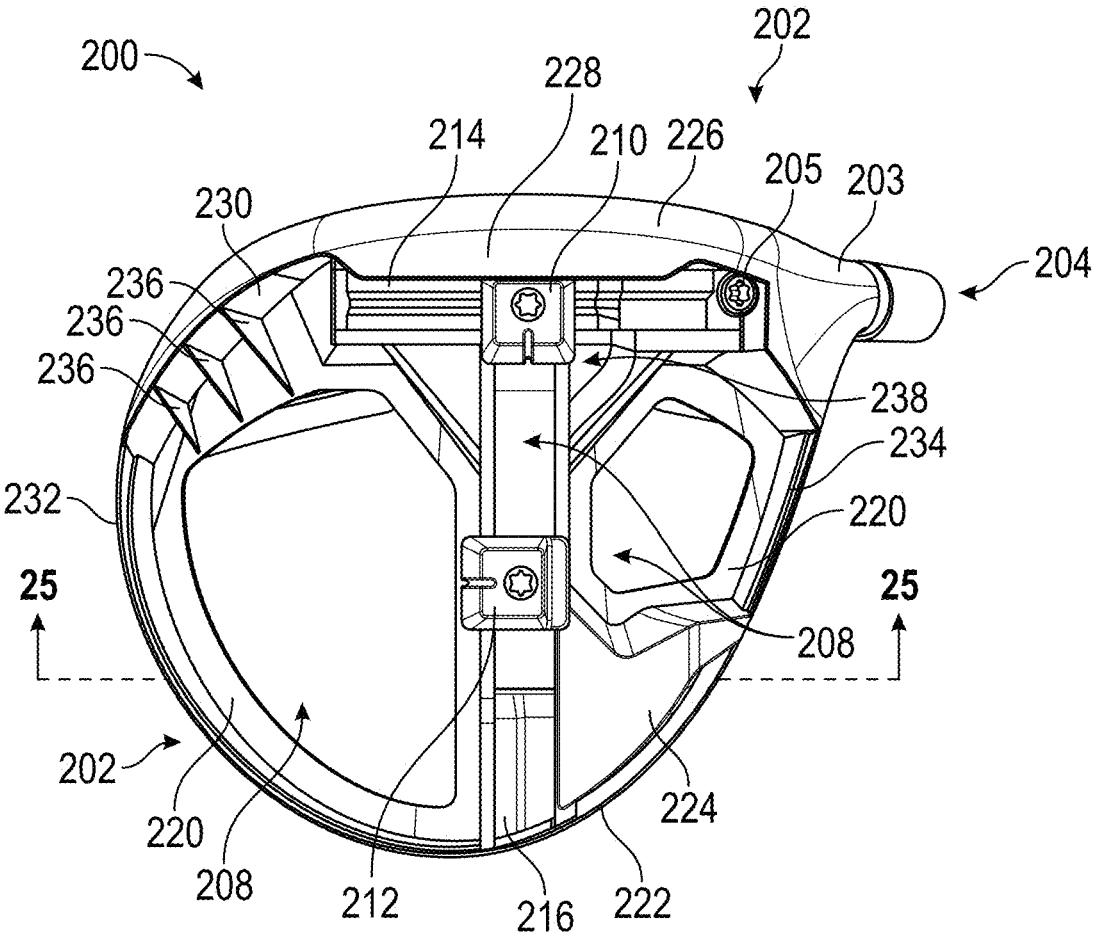
FIG. 24 is a bottom view of the golf club head of FIG. 20.
Figure 25:
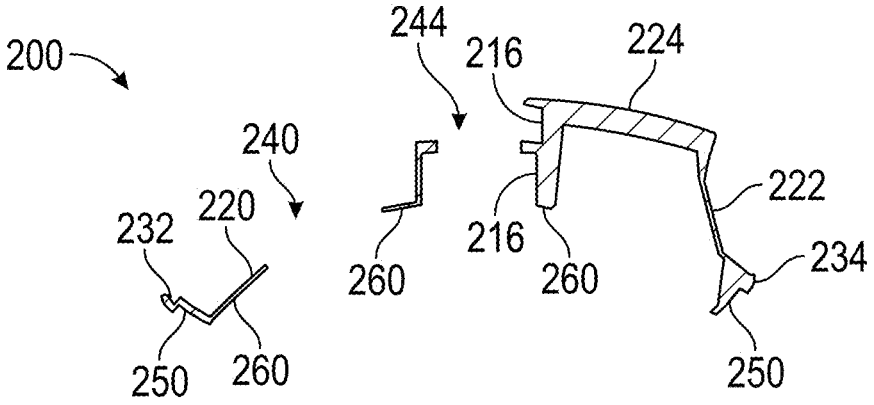
FIG. 25 is a cross-sectional view taken along line 25-25 in FIG. 24.
Figure 27:
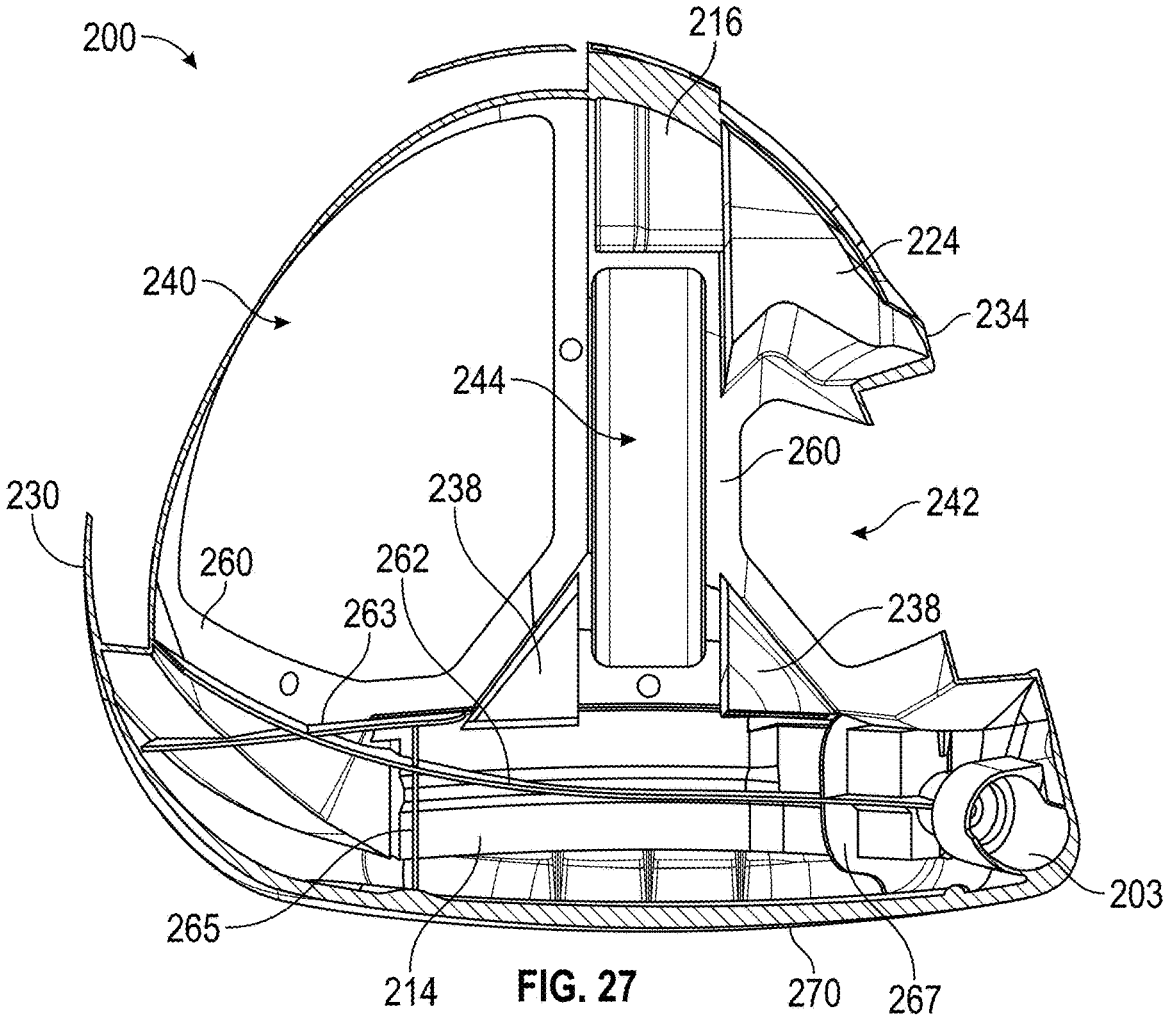
FIG. 27 is a cross-sectional top-down view of a lower portion of the body of FIG. 22.
Figure 28:
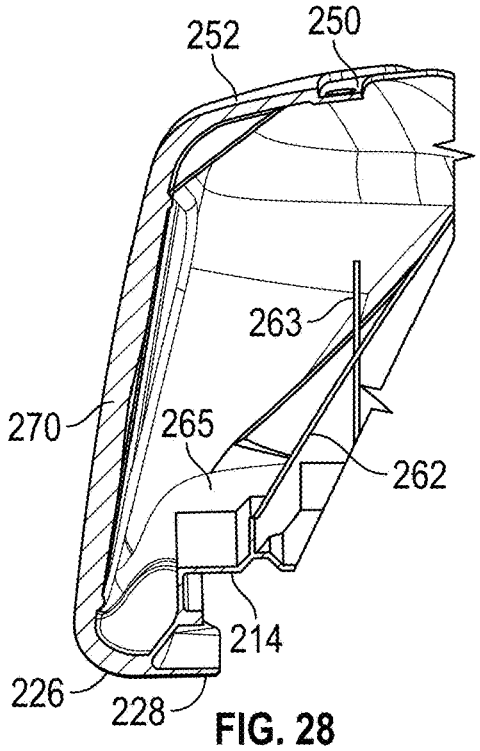
FIG. 28 is a cross-sectional side view of a toe portion of the body of FIG. 22.

The head 200 has a raised sole that is defined by a combination of the body 202 and the sole insert 208. As shown in FIGS. 22 and 27, for example, the lower portion of the body 202 include a toe-side opening 240, a heel-side opening 242, and a rear track opening 244, all of which are covered by the sole insert 208. The rear weight track 216 is positioned below the sole insert 208.

Figure 20:
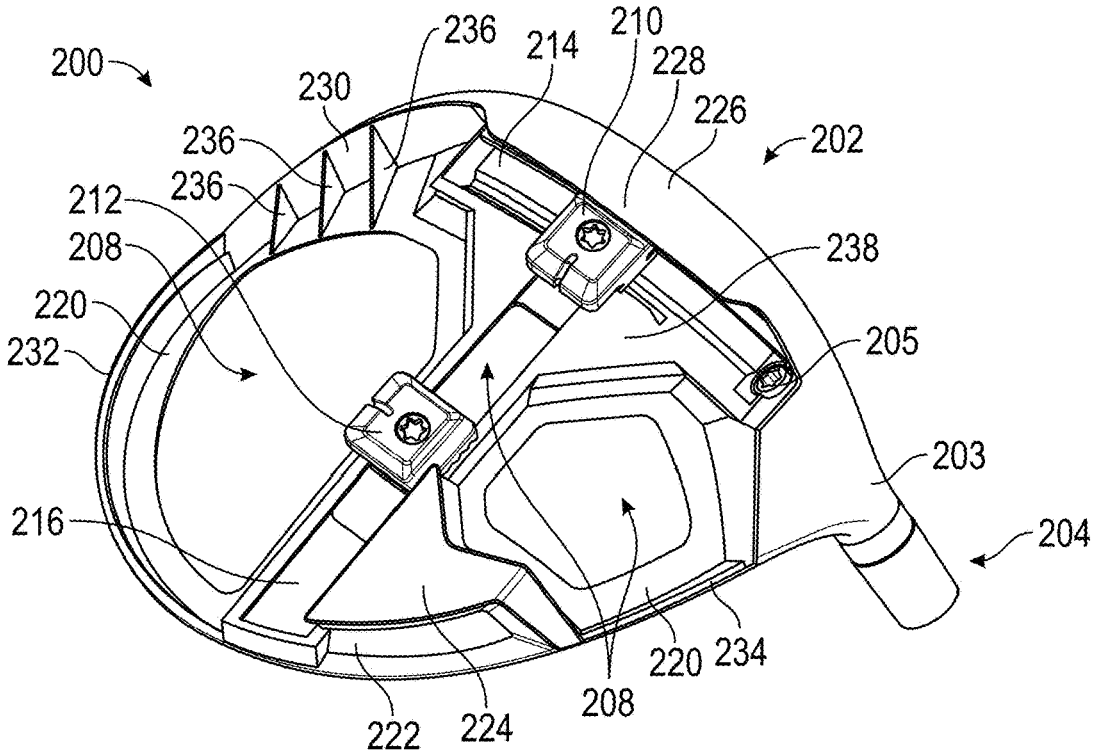
FIG. 20 is a bottom perspective view of yet another exemplary golf club head disclosed herein.
Figure 26:
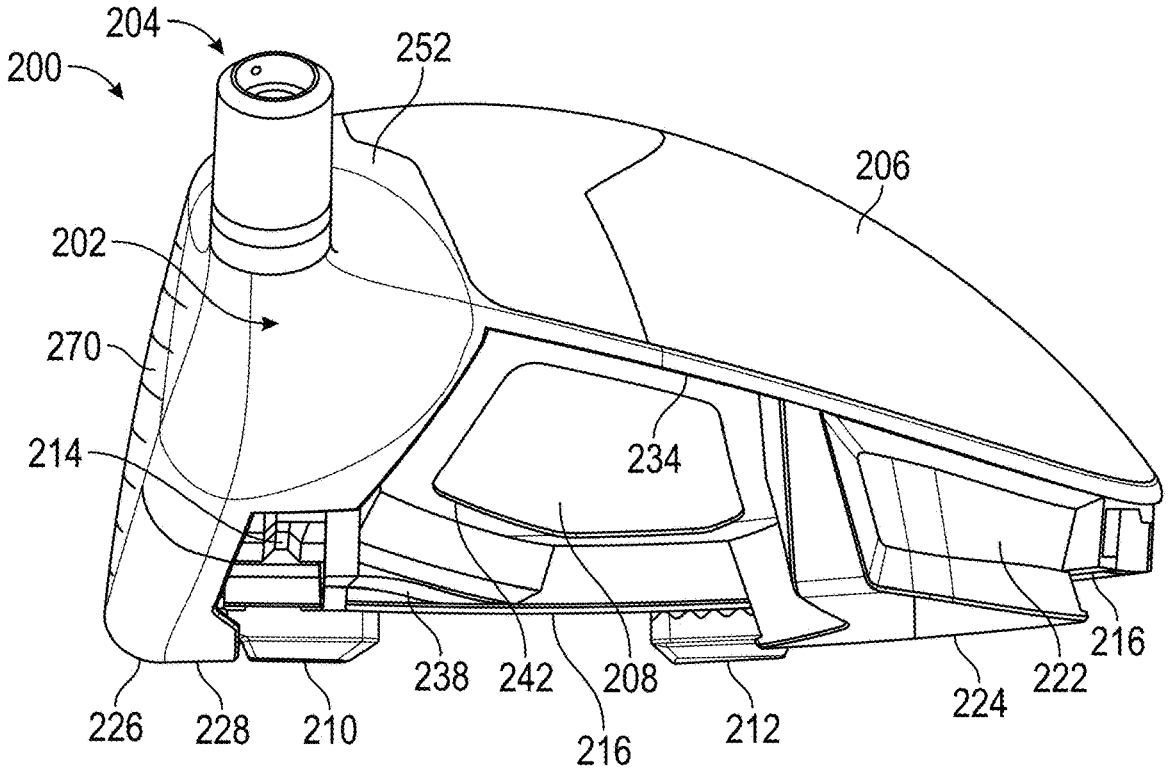
FIG. 26 is a heel side view of the golf club head of FIG. 20.
Figure 26A:
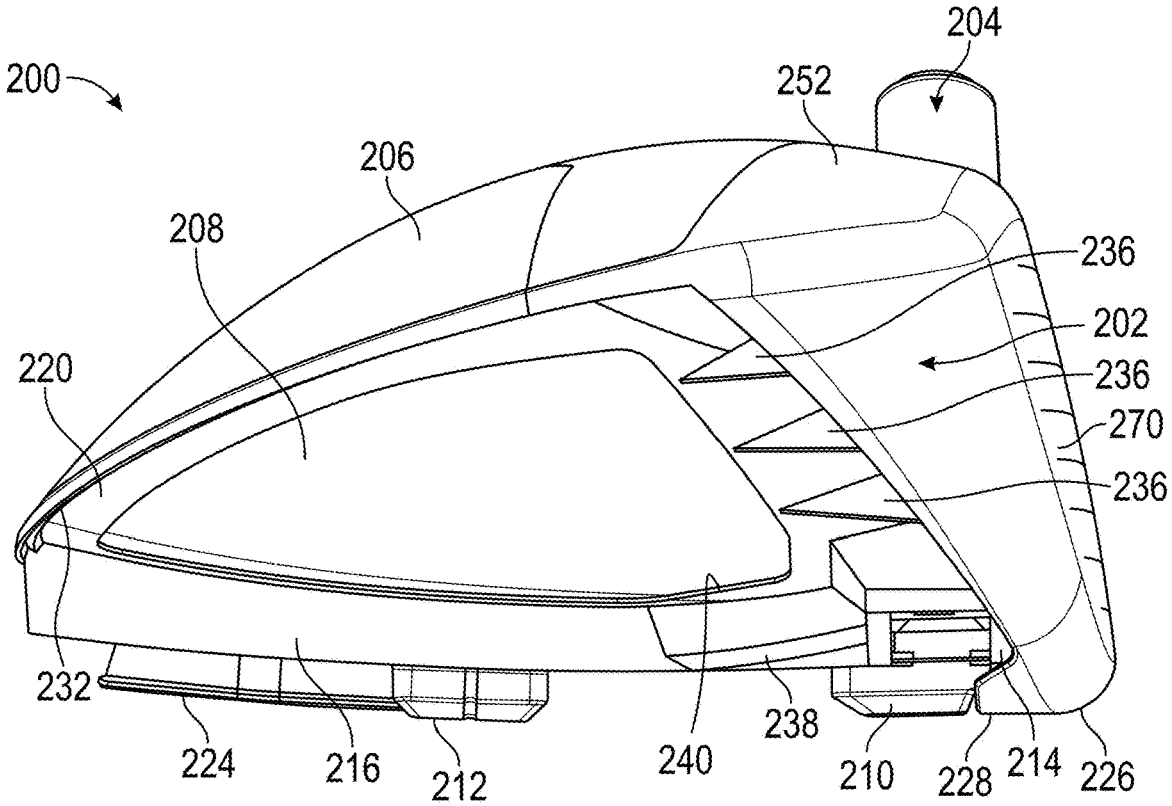
FIG. 26A is a toe side view of the golf club head of FIG. 20.

The head 200 also includes a toe-side cantilevered ledge 232 extending around the perimeter from the rear weight track 216 or rear sit pad 224 around to toe region adjacent the face, where the ledge 232 joins with a toe portion 230 of the body that extends toeward from the front sit pad 226. One or more optional ribs 236 can join the toe portion 230 to the raised sole adjacent a forward end of the toe-side opening 240 in the body. Three such triangular ribs are illustrated in FIG. 20 and FIG. 26A.

The head 200 also includes a heel-side cantilevered ledge 234 that extends from near the hosel region rearward to the rear sit pad 224 or to the rear end of the rear weight track 216. In some embodiments, the two cantilevered ledges 232 and 234 can meet and/or form a continuous ledge that extends around the rear of the head. The rear sit pad 224 can optionally include a recessed rear portion 222 (as shown in FIG. 26).

The lower portion of the body 202 that forms part of the sole can include various features, thickness variations, ribs, etc, to provide enhanced rigidity where desired and weight saving when rigidity is less desired. The body can include thicker regions 238, for example, near the intersection of the two weight tracks 214, 216. The body can also include thin ledges or seats 260 around the openings 240, 242, with the ledges 260 configured to receive and mate with sole insert 208. The lower surfaces of the body can also include various internal ribs to enhance rigidity and acoustics, such as ribs 262, 263, 265, and 267 shown in FIGS. 27 and 28.

Figure 21:
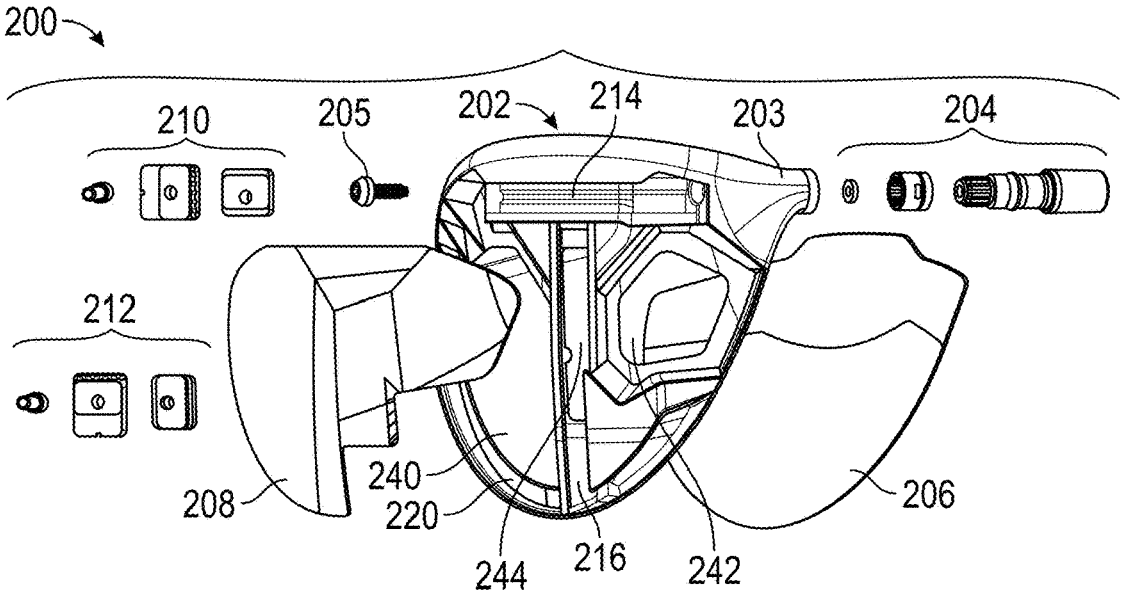
FIG. 21 is an exploded bottom perspective view of the golf club head of FIG. 20.
Figure 21A:
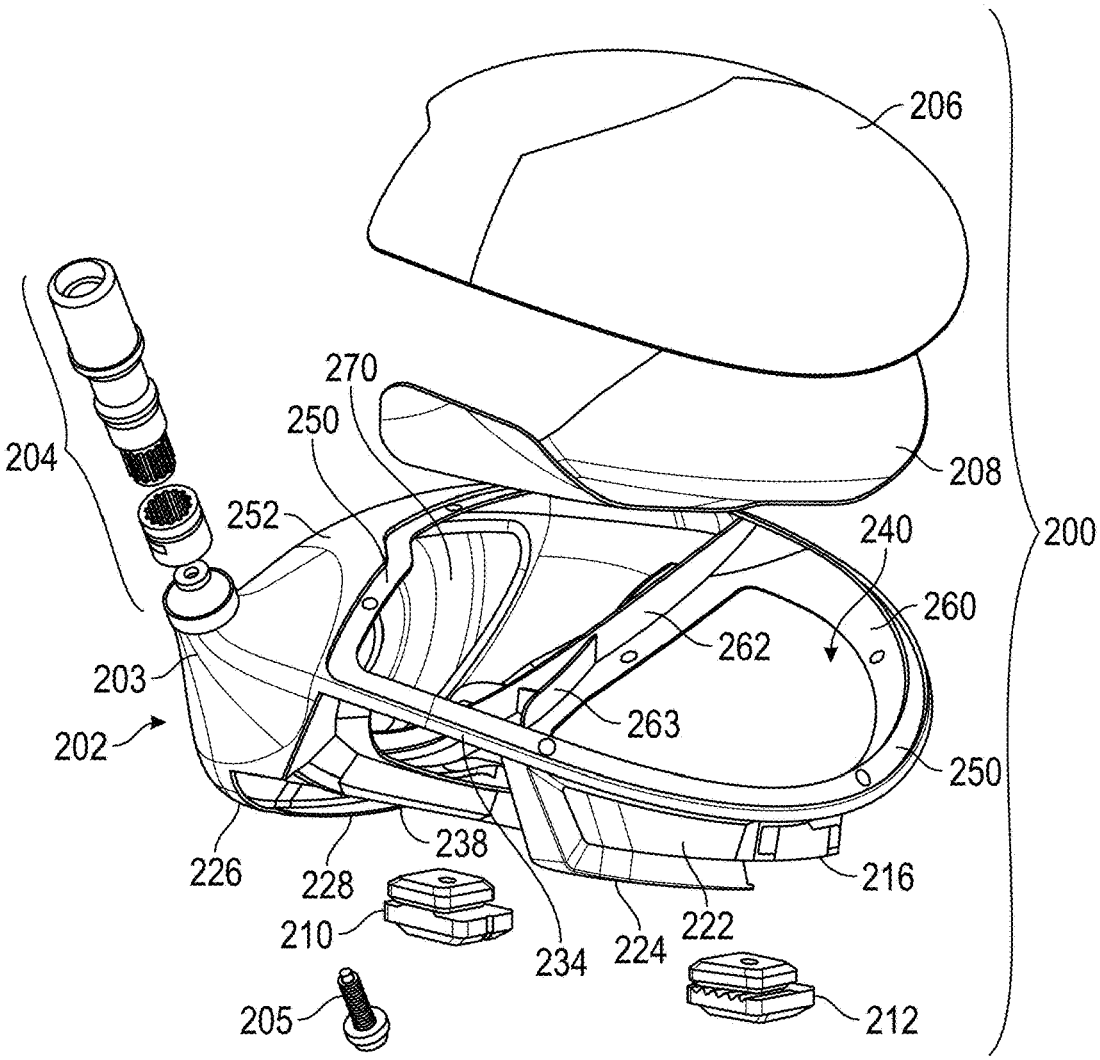
FIG. 21A is an exploded side perspective view of the golf club head of FIG. 20.

The upper portion of the body can also include various features, thickness variations, ribs, etc, to provide enhanced rigidity where desired and weight saving when rigidity is less desired. For example, the body includes a thinner seat region 250 around the upper opening to receive the crown insert 206. As shown in FIG. 21A, the seats 250 and 260 for the crown and sole inserts can be close to each other, even sharing a common edge, around the outer perimeter of the body.

Figure 36C:
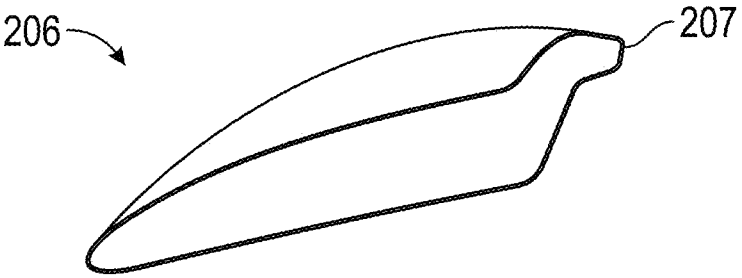
FIG. 36C is a side view of the crown portion of the golf club head of FIG. 20.
Figure 36D:
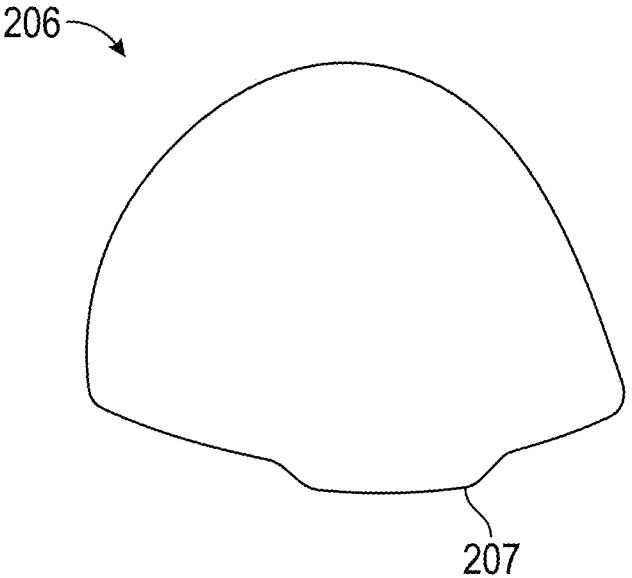
FIG. 36D is a top view of the crown portion of the golf club head of FIG. 20.
Figure 36A:
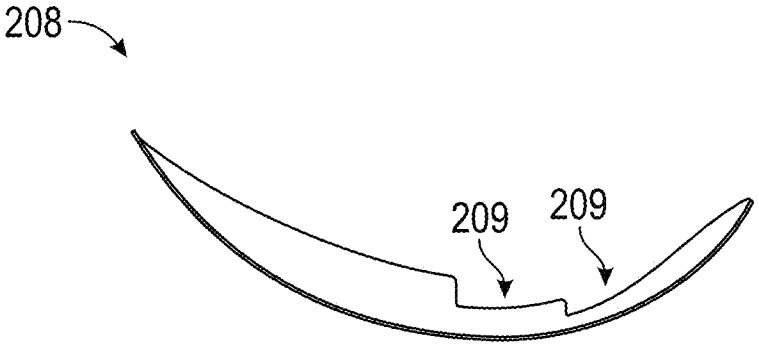
FIG. 36A is a front side view of the sole portion of the golf club head of FIG. 20.
Figure 36B:
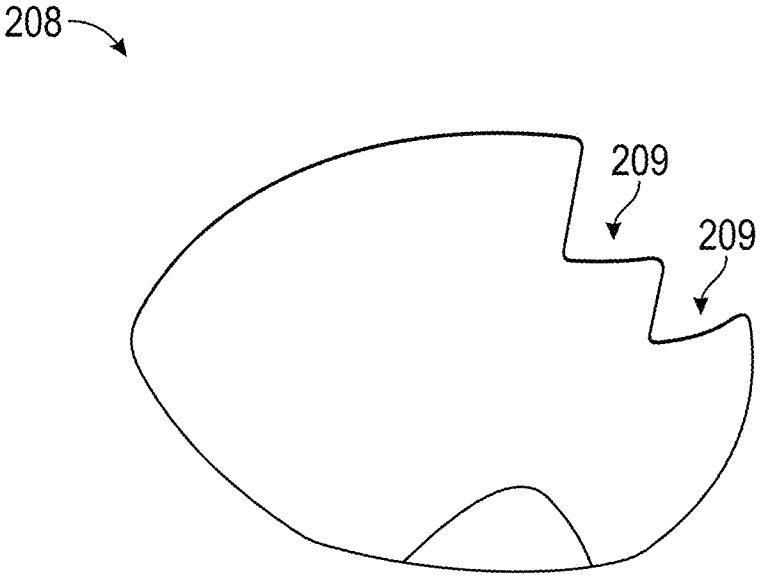
FIG. 36B is a bottom view of the sole portion of the golf club head of FIG. 20.

FIGS. 35A-D show top views of the head 200 in various states with the crown and sole inserts in place and/or removed. FIGS. 36A-D show the crown and sole inserts in more detail. As shown in FIGS. 36A and 36B, the sole insert 208 can have an irregular shape with a concave upper surface and convex lower surface. The sole insert 208 can also include notches 209 at the rear-heel end to accommodate fitting around the rear sit pad 224 area, where enhanced rigidity is needed due to ground contact forces. In various embodiments, the sole insert can cover at least about 50% of the surface area of the sole, at least about 60% of the surface area of the sole, at least about 70% of the surface area of the sole, or at least about 80% of the surface area of the sole. In another embodiment, the sole insert covers about 50% to 80% of the surface area of the sole. The sole insert contributes to a club head structure that is sufficiently strong and stiff to withstand the large dynamic loads imposed thereon, while remaining relatively lightweight to free up discretionary mass that can be allocated strategically elsewhere within the club head.

The sole insert 208 has a geometry and size selected to at least cover the openings 240, 242, 244 in the bottom of the body, and can be secured to the frame by adhesion or other secure fastening technique. In some embodiments, the ledges 260 may be provided with indentations to receive matching protrusions or bumps on the underside of the sole insert to further secure and align the sole insert on the frame.

Like the sole, the crown also has an opening 246 that reduces the mass of the body 202, and more significantly, reduces the mass of the crown, a region of the head where increased mass has the greatest impact on raising (undesirably) the CG of the head. Along the periphery of the opening 246, the frame includes a recessed ledge 250 to seat and support the crown insert 206. The crown insert 206 (see FIGS. 36C and 36D) has a geometry and size compatible with the crown opening 246 and is secured to the body by adhesion or other secure fastening technique so as to cover the opening 246. The ledge 260 may be provided with indentations along its length to receive matching protrusions or bumps on the underside of the crown insert to further secure and align the crown insert on the body. The crown insert may also include a forward projection 207 that extends into the forward crown portion 252 of the body.

In various embodiments, the ledges of the body that receive the crown and sole inserts (e.g. ledges 250 and 260) may be made from the same metal material (e.g., titanium alloy) as the body and, therefore, can add significant mass to the golf club head. In some embodiments, in order to control the mass contribution of the ledge to the golf club head, the width of the ledges can be adjusted to achieve a desired mass contribution. In some embodiments, if the ledges add too much mass to the golf club head, it can take away from the decreased weight benefits of a sole and crown inserts, which can be made from a lighter materials (e.g., carbon fiber or graphite composites and/or polymeric materials). In some embodiments, the width of the ledges may range from about 3 mm to about 8 mm, preferably from about 4 mm to about 7 mm, and more preferably from about 4.5 mm to about 5.5 mm. In some embodiments, the width of the ledges may be at least four times as wide as a thickness of the respective insert. In some embodiments, the thickness of the ledges may range from about 0.4 mm to about 1 mm, preferably from about 0.5 mm to about 0.8 mm, and more preferably from about 0.6 mm to about 0.7 mm. In some embodiments, the thickness of the ledges may range from about 0.5 mm to about 1.75 mm, preferably from about 0.7 mm to about 1.2 mm, and more preferably from about 0.8 mm to about 1.1 mm. Although the ledges may extend or run along the entire interface boundary between the respective insert and the body, in alternative embodiments, the ledges may extend only partially along the interface boundaries.

The periphery of crown opening 246 can be proximate to and closely track the periphery of the crown on the toe-, rear-, and heel-sides of the head 200. In contrast, the face-side of the crown opening 246 can be spaced farther from the face 270 region of the head. In this way, the head can have additional frame mass and reinforcement in the crown area 252 just rearward of the face 270. This area and other areas adjacent to the face along the toe, heel and sole support the face and are subject to the relatively higher impact loads and stresses due to ball strikes on the face. As described elsewhere herein, the frame may be made of a wide range of materials, including high strength titanium, titanium alloys, and/or other metals. The opening 246 can have a notch at the front side which matingly corresponds to the crown insert projection 207 to help align and seat the crown insert on the body.

The front and rear weight tracks 214, 216 are located in the sole of the club head and define tracks for mounting two-piece slidable weight assemblies 210, 212, respectively, which may be fastened to the weight tracks by fastening means such as screws. The weight assemblies can take forms other than as shown in FIG. 21A, can be mounted in other ways, and can take the form of a single piece design or multi-piece design. The weight tracks allows the weight assemblies to be loosened for slidable adjustment along the tracks and then tightened in place to adjust the effective CG and MOI characteristics of the club head. For example, by shifting the club head's CG forward or rearward via the rear weight assembly 212, or heelward or toeward via the front weight assembly 210, the performance characteristics of the club head can be modified to affect the flight of the golf ball, especially spin characteristics of the golf ball. In other embodiments, the front weight track 214 can instead be a front channel without a movable weight.

The sole of the body 202 preferably is integrally formed with the front weight track 214 extending generally parallel to and near the face of the club head and generally perpendicular to the rear weight track 216, which extends rearward from near the middle of the front track toward the rear of the head.

In the illustrated embodiments, the weight tracks each only include one weight assembly. In other embodiments, two or more weight assemblies can be mounted in either or both of the weight tracks to provide alternative mass distribution capabilities for the club head.

By adjusting the CG heelward or toeward via the front weight track 214, the performance characteristics of the club head can be modified to affect the flight of the ball, especially the ball's tendency to draw or fade and/or to counter the ball's tendency to slice or hook. By adjusting the CG forward or rearward via the rear weight track 216, the performance characteristics of the club head can be modified to affect the flight of the ball, especially the ball's tendency to move upwardly or resist falling during flight due to backspin. The use of two weights assemblies in wither track can allow for alternative adjustment and interplay between the two weights. For example, with respect to the front track 214, two independently adjustable weight assemblies can be positioned fully on the toe side, fully on the heel side, spaced apart a maximum distance with one weight fully on the toe side and the other fully on the heel side, positioned together in the middle of the weight track, or in other weight location patterns. With a single weight assembly in a track, as illustrated, the weight adjustment options are more limited but the effective CG of the head still can be adjusted along a continuum, such as heelward or toeward or in a neutral position with the weight centered in the front weight track.

Figure 29:
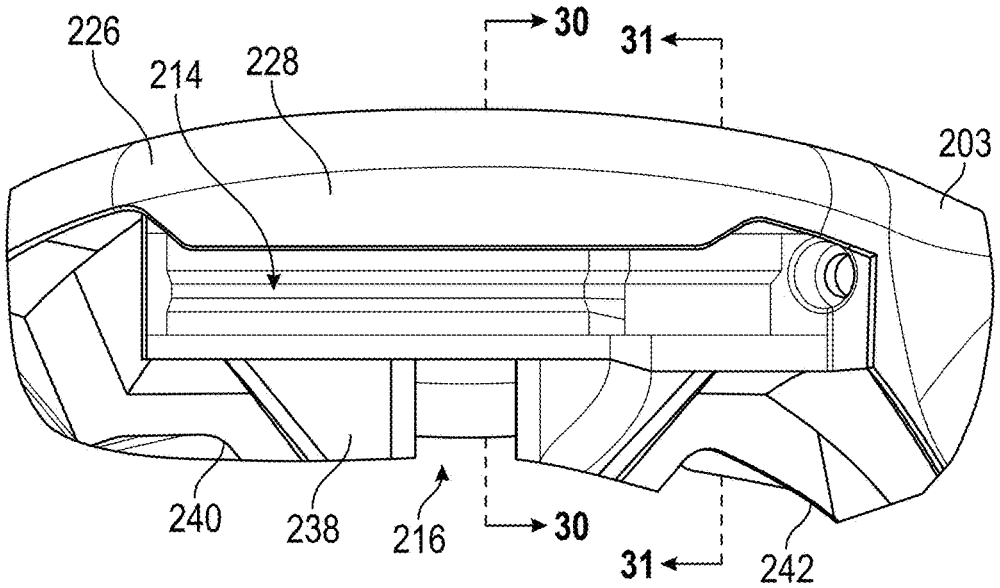
FIG. 29 is a bottom view of a front portion of the sole of the body of FIG. 22.
Figure 30:
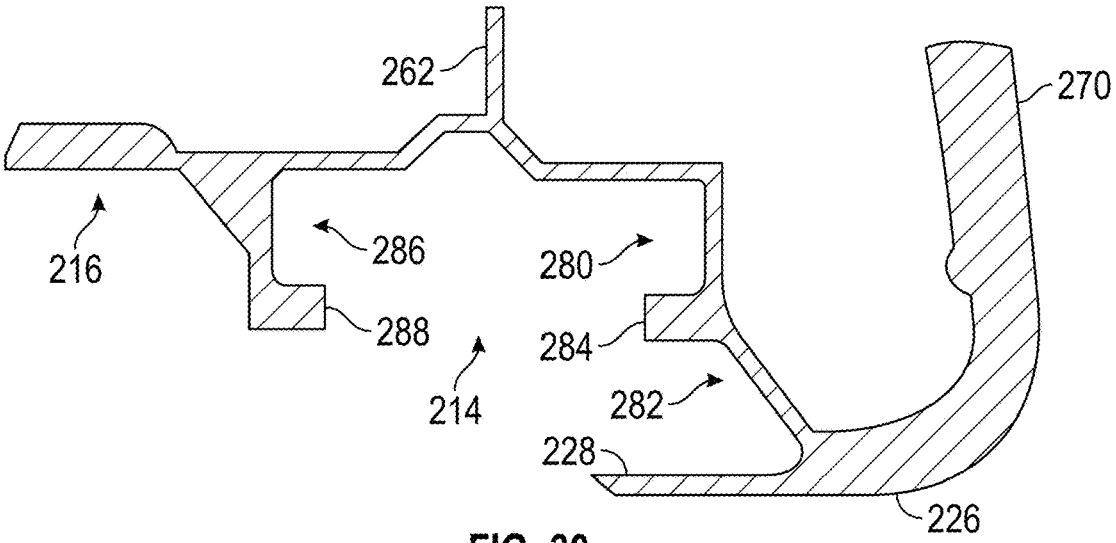
FIG. 30 is an enlarged detail cross-section view of a side-to –side weight track taken generally along line 30-30 of FIG. 29.
Figure 31:
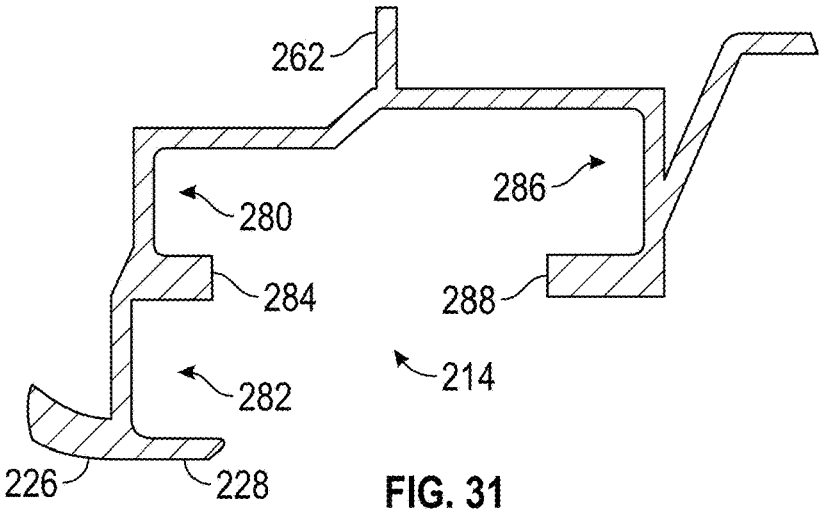
FIG. 31 is another enlarged detail cross-section view of the side-to –side weight track taken generally along line 31-31 of FIG. 29.
Figure 32:
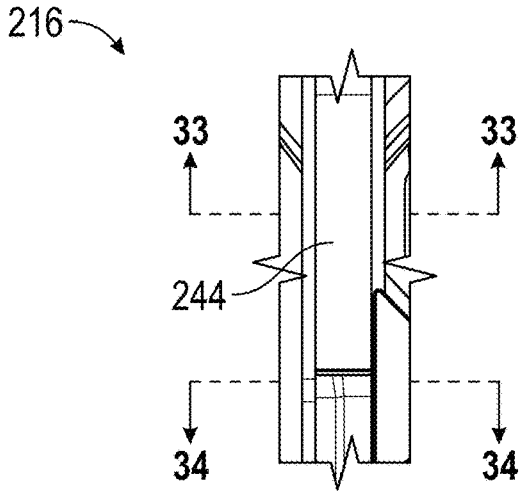
FIG. 32 is a bottom view of a portion of the sole of the body of FIG. 22 including a front-to –rear weight track.
Figure 33:
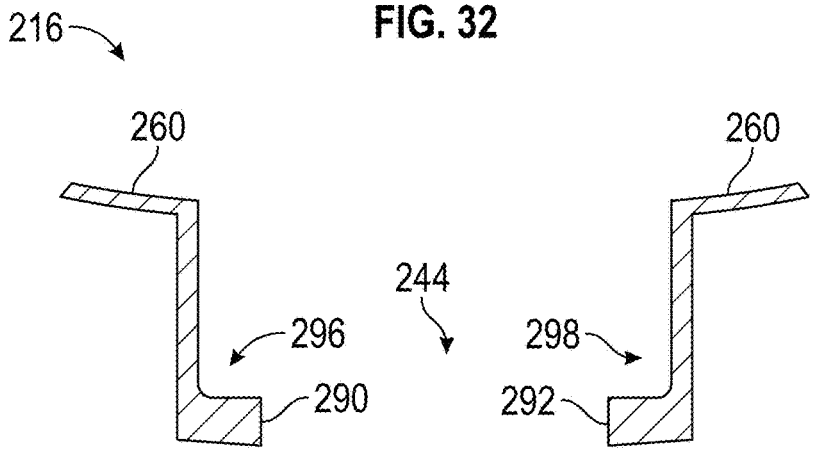
FIG. 33 is an enlarged detail cross-section view of the front-to –rear weight track taken generally along line 33-33 of FIG. 32.
Figure 34:
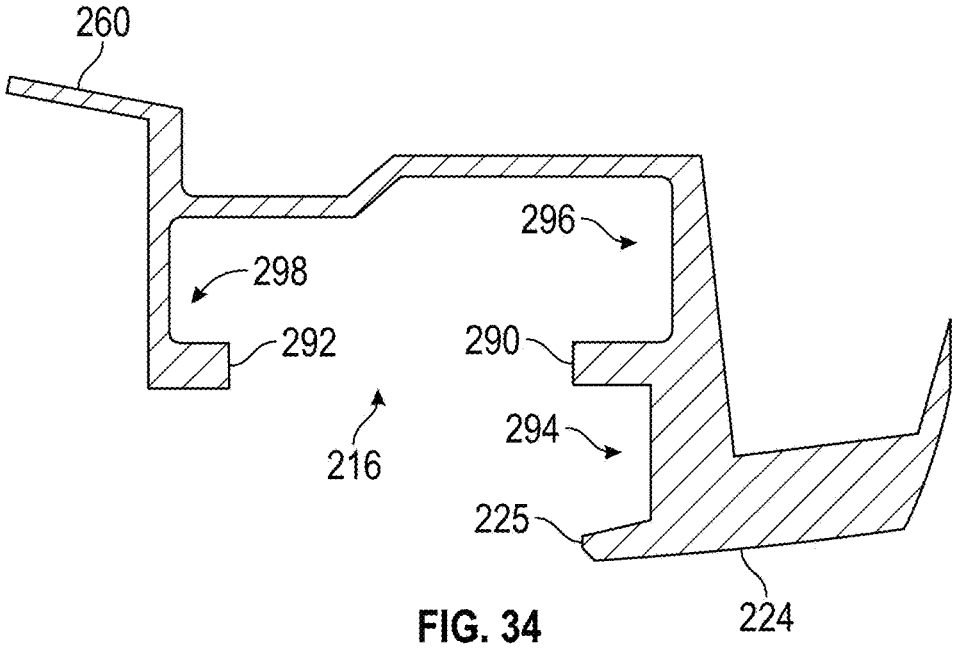
FIG. 34 is another enlarged detail cross-section view of the front-to –rear weight track taken generally along line 34-34 of FIG. 32.
Figure 35C:
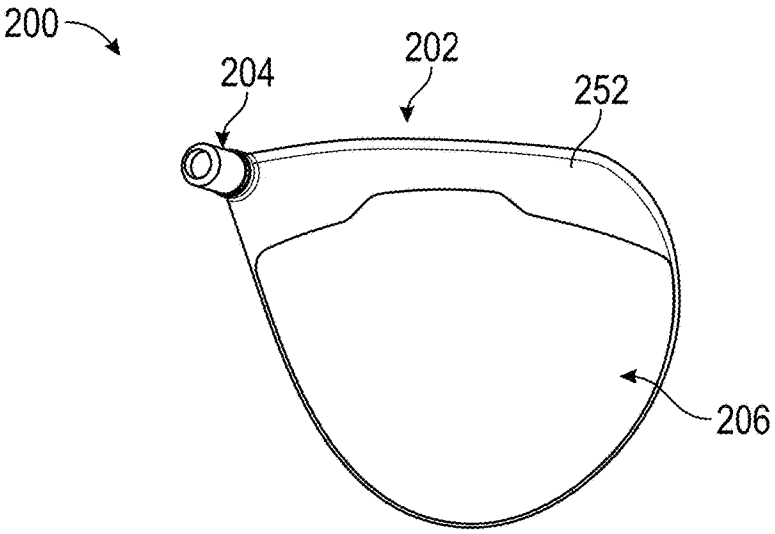
FIG. 35C is a top view of the golf club head of FIG. 20 with the crown portion in place.
Figure 35D:
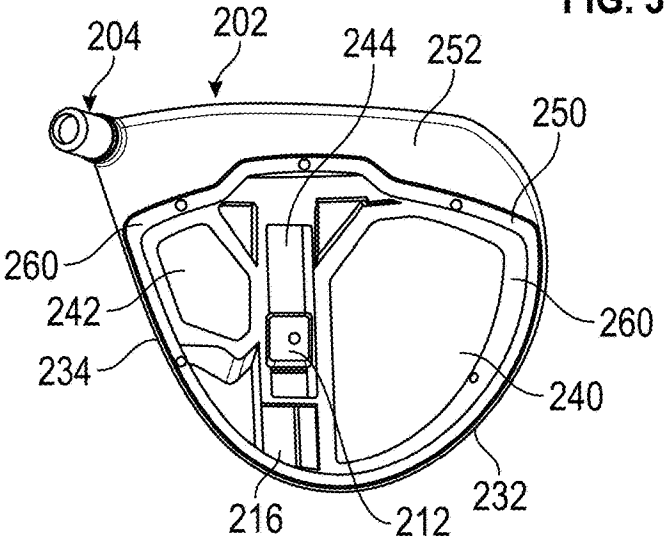
FIG. 35D is a top view of the golf club head of FIG. 20 with both the crown portion and the sole portion removed.
Figure 35A:
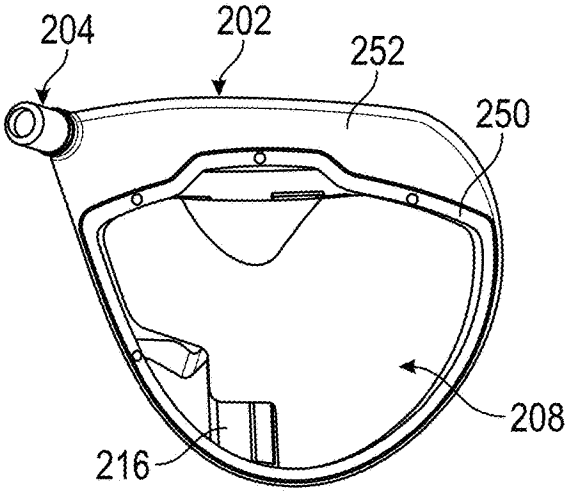
FIG. 35A is a top view of the golf club head of FIG. 20 with a crown portion removed, showing a sole portion positioned in the body.
Figure 35B:
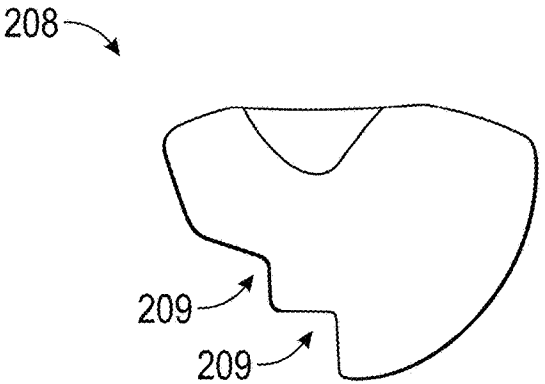
FIG. 35B is a top view of the sole portion of the golf club head of FIG. 20.

As shown in FIGS. 29-34, each of the weight tracks 214, 216 preferably has a recess, which may be generally rectangular in shape, to provide a recessed track to seat and guide the weight as it adjustably slides along the track. Each track includes one or more peripheral rails or ledges to define an elongate channel preferably having a width dimension less than the width of the weight placed in the channel. For example, as shown in FIGS. 29 and 30, the front track 214 includes opposing peripheral rails 288 and 284 and, as shown in FIGS. 33 and 34, the rear track 216 includes opposing peripheral rails 290 and 292. In this way, the weights can slide in the weight track while the rails prevent them from passing out of the tracks. At the same time, the channels between the ledges permit the screws of the weight assemblies to pass through the center of the outer weight elements, through the channels, and then into threaded engagement with the inner weight elements. The ledges serve to provide tracks or rails on which the joined weight assemblies freely slide while effectively preventing the weight assemblies from inadvertently slipping out of the tracks, even when loosened. In the front track 214, the inner weight member of the assembly 210 sits above the rails 284 and 288 in inner recesses 280 and 286, while the outer weight member is partially seated in recess 282 between the forward rail 284 and the overhanging lip 228 of the front sit pad 226 (FIGS. 30, 31). In the rear track 216, the inner weight member of the assembly 212 sits above the rails 290 and 292 in inner recesses 296 and 298, while the outer weight member can be partially seated in recess 294 between the heel-side rail 290 and an overhanding lip 225 of the rear sit pad 224.

The weight assemblies can be adjusted by loosening the screws and moving the weights to a desired location along the tracks, then the screws can be tightened to secure them in place. The weights assemblies can also be swapped out and replaced by other weight assemblies having different masses to provide further mass adjustment options. If a second or third weight is added to the weight track, many additional weight location and distribution options are available for additional fine tuning of the head's effective CG location in the heel-toe direction and the front-rear direction, and combinations thereof. This also provides great range of adjust of the club head's MOI properties.

Either or both of the weight assemblies 210, 212 can comprise a three piece assembly including an inner weight member, an outer weight member, and a fastener coupling the two weight members together. The assemblies can clamp onto front, back, or side ledges of the weight tracks by tightening the fastener such that the inner member contacts the inner side the ledge and the outer weight member contacts the outer side of the ledge, with enough clamping force to hold the assembly stationary relative to the body throughout a round of golf. The weight members and the assemblies can be shaped and/or configured to be inserted into the weight track by inserting the inner weight member into the inner channel past the ledge(s) at a usable portion of the weight track, as opposed to inserting the inner weight at an enlarged opening at one end of the weight track where the weight assembly is not configured to be secured in place. This can allow for elimination of such a wider, non-functional opening at the end of the track, and allow the track to be shorter or to have a longer functional ledge width over which the weight assembly can be secured. To allow the inner weight member to be inserted into the track in the middle of the track (for example) past the ledge, the inner weight member can be inserted at an angle that is not perpendicular to the ledge, e.g., an angled insertion. The weight member can be inserted at an angle and gradually rotated into the inner channel to allow insertion past the clamping ledge. In some embodiments, the inner weight member can have a rounded, oval, oblong, arcuate, curved, or otherwise specifically shaped structure to better allow the weight member to insert into the channel past the ledge at a useable portion of the track.

In the golf club heads of the present disclosure, the ability to adjust the relative positions and masses of the slidably adjusted weights and/or threadably adjustable weights, coupled with the weight saving achieved by titanium alloys material use and incorporation of the light-weight crown insert and/or sole insert, further coupled with the discretionary mass provided by the raised sole configurations, can allow for a large range of variation of a number properties of the club-head all of which affect the ultimate club-head performance including the position of the CG of the club-head, MOI values of the club head, acoustic properties of the club head, aesthetic appearance and subjective feel properties of the club head, and/or other properties.

In certain embodiments, the front weight track and the rear weight track have certain track widths. The track widths may be measured, for example, as the horizontal distance between a first track wall and a second track wall that are generally parallel to each other on opposite sides of the inner portion of the track that receives the inner weight member of the weight assembly. With reference to FIGS. 29-31, the width of the front track 214 can be the horizontal distance between opposing walls of the inner recesses 280 and 286. With reference to FIGS. 32-34, the width of the rear track 216 can be the horizontal distance between opposing walls of the inner recesses 296 and 298. For both the front track and the rear track, the track widths may be between about 5 mm and about 20 mm, such as between about 10 mm and about 18 mm, or such as between about 12 mm and about 16 mm. According to some embodiments, the depth of the tracks (i.e., the vertical distance between the uppermost inner wall in the track and an imaginary plane containing the regions of the sole adjacent the outermost lateral edges of the track) may be between about 6 mm and about 20 mm, such as between about 8 mm and about 18 mm, or such as between about 10 mm and about 16 mm. For the front track 214, the depth of the track can be the vertical distance from the inner surface of the overhanging lip 228 to the upper surface of the inner recess 280 (FIG. 30). For the rear track 216, the depth of the track can be the vertical distance from the inner surface of the overhanging lip 225 to the upper surface of the inner recess 296 (FIG. 34).

Additionally, both the front track and rear track have a certain track length. Track length may be measured as the horizontal distance between the opposing longitudinal end walls of the track. For both the front track and the rear track, their track lengths may be between about 30 mm and about 120 mm, such as between about 50 mm and about 100 mm, or such as between about 60 mm and about 90 mm. Additionally, or alternatively, the length of the front track may be represented as a percentage of the striking face length. For example, the front track may be between about 30% and about 100% of the striking face length, such as between about 50% and about 90%, or such as between about 60% and about 80% mm of the striking face length.

The track depth, width, and length properties described above can also analogously also be applied to the front channel 36 of the club head 10.

In FIGS. 30 and 34, it can be seen that the lips 228, 225 of the front and rear sit pads extend over or overhang the respective weight tracks, restricting the track openings and helping retain the weight(s) within the tracks.

Referring to FIG. 34, the sole area on the rear sit pad 224 on the heel side of the rear track 216 is lower than the sole area on the toe side (bottom of ledge 292) by a significant vertical distance when the head is in the address position relative to a ground plane. This can be thought of as the head having a "dropped sole" or "raised sole" construction with a portion of the sole positioned lower (e.g., on the heel side) relative to another portion of the sole (e.g., on the toe side). Put another way, a portion of the sole (e.g., most of the sole except for the rear sit pad 224) is raised relative to another portion of the sole (e.g., the rear sit pad). The same also applies at the front track 214 where the front sit pad 226 and its lip 228 are significantly lower than the rear side of the front track (as shown in FIG. 30), in the normal address position.

In one embodiment, the vertical distance between the level of the ground contact surfaces of the sit pads and the adjacent surfaces of the raised sole portions may be in the range of about 2-12 mm, preferably about 3-9 mm, more preferably about 4-7 mm, and most preferably about 4.5-6.5 mm. In one example, the vertical distance is about 5.5 mm.

FIGS. 37-48 illustrate another exemplary golf club head 400 that has a face portion integrally cast as a single unit with a forward portion of the club head body, forming a cup-shaped unit (referred to herein as cup 402) that includes the face portion, hosel, and forward portions of crown, sole, toe, and heel. However, a rear portion of the body (referred to herein as ring 404) is formed separately and later attached to the cup 402 to form the club head body. The combination of the cup 402 and ring 404 is referred to herein as the body of the club head 400. A crown insert 406 and a sole insert 408 can then be attached to the body to form the club head 400. In some embodiments, there is no sole opening or sole insert, and the rear ring fully encloses the sole. In some embodiments, the sole insert is comprised of metallic material, composite material, and/or other materials.

Figure 37:
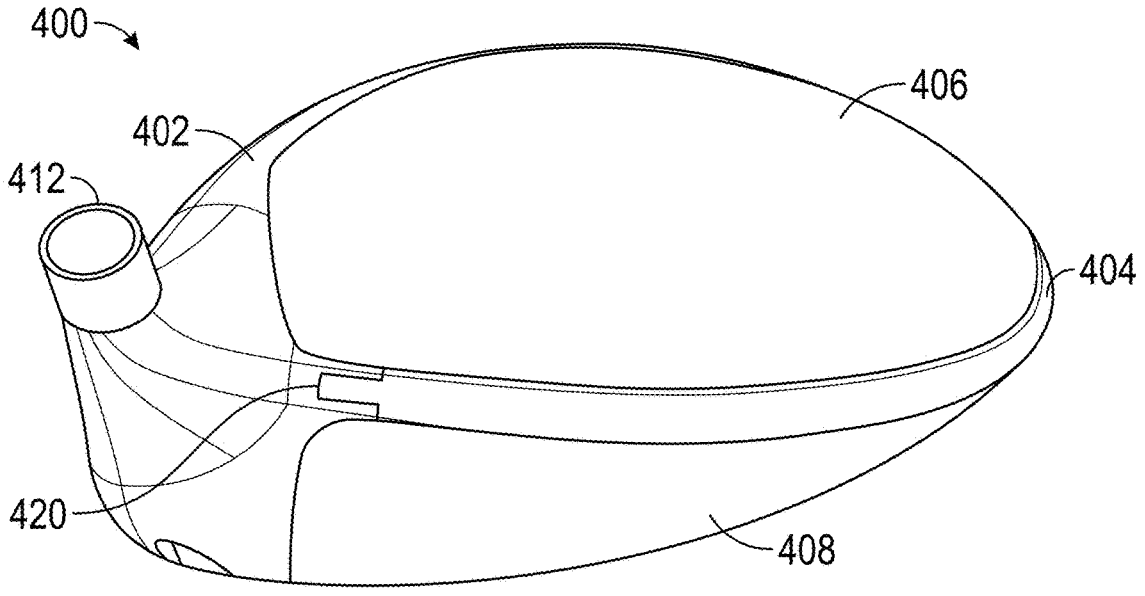
FIG. 37 is a perspective view of another exemplary golf club head.
Figure 38:
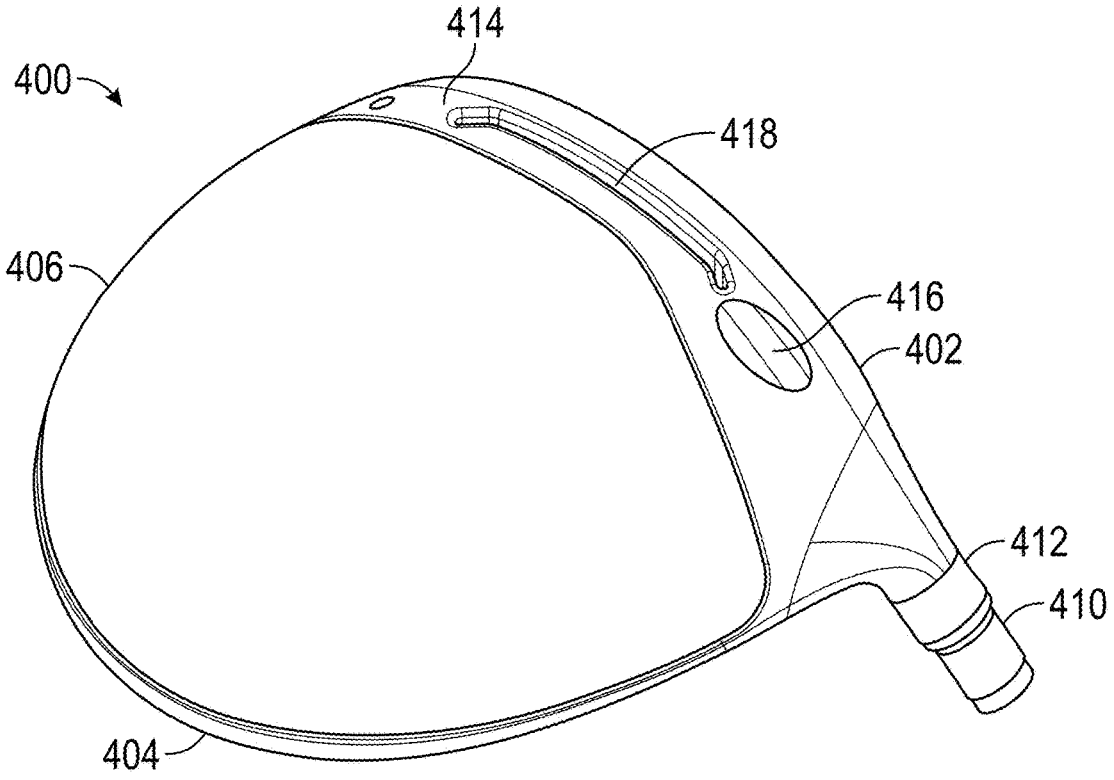
FIG. 38 is a different perspective view of the club head of FIG. 37, with a head-shaft connection assembly.

FIGS. 37 and 38 show the assembled club head 400, comprising the cup 402, ring 404, crown insert 406, and sole insert 408. A head-shaft connection assembly 410 can be coupled to the hosel 412. The cup 402 and ring 404 can comprise metallic materials, such as titanium alloys or steel, while the inserts 406 and 408 can comprise less dense materials, such as carbon fiber reinforced composite materials. Any of the other materials disclosed herein can also be used in the club head 400. The cup and ring may be comprised of the same material (e.g., the same titanium alloy), or the ring can be comprised of a different material than the cup (e.g., steel ring and titanium alloy cup, two different titanium alloys, titanium cup and aluminum ring, etc.).

Figure 39:
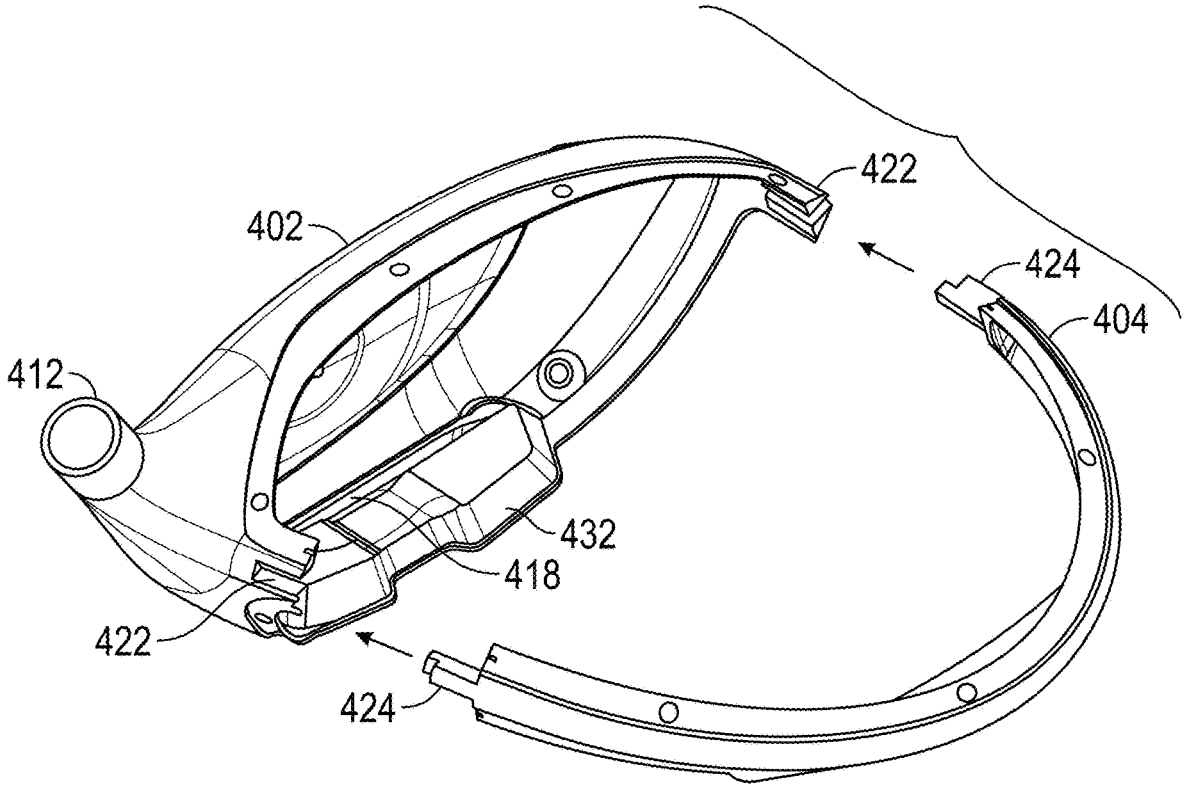
FIG. 39 shows how the body of the club head of FIG. 37 is formed from two pieces attached together.
Figure 40:
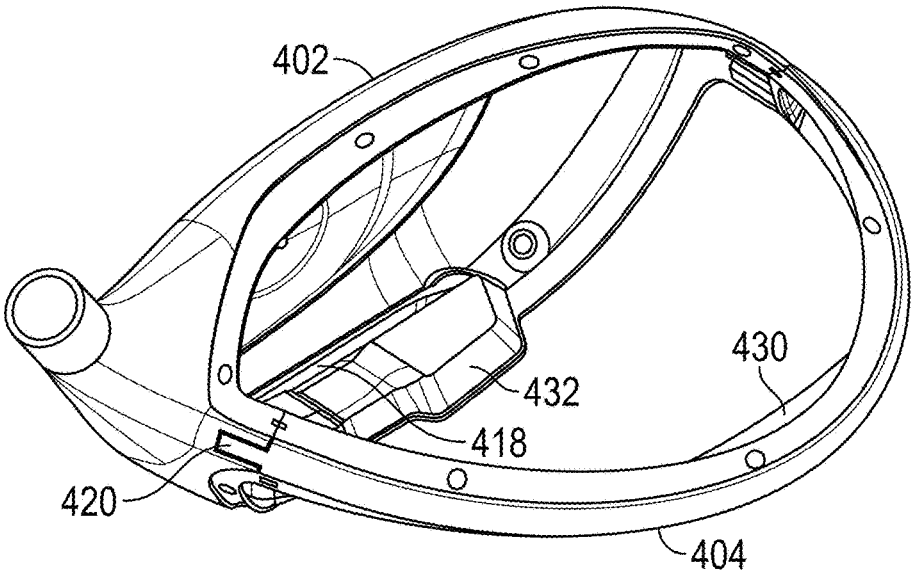
FIG. 40 shows the body of FIG. 39 in an assembled state.

FIGS. 39 and 40 illustrate how the ring 404 is coupled to the cup 402 at toe and heel joints 420, forming an annular body having an upper crown opening and a lower sole opening. The ring 404 can include forward extending toe and heel engagement ends 424 that mate with rearward extending toe and heel engagement ends 422 of the cup 402 to form the joints 420. In the example illustrated, the ring has male projections that mate with female notches in the cup. However, these joints can be reversed with male projections on the cup and female notches in the ring. In other embodiments, any other suitable engagement geometry can be used in the joints 420 to couple the ring to the cup. The joints 420 can be formed via any suitable means, such as welding, brazing, adhesives, mechanical fasteners, etc.

In some embodiments, it the joints 420 can be located a sufficient distance from the strike face to avoid potential failures due to the severe impacts undergone by the golf club when striking a golf ball. For example, in some embodiments, the joints 420 can be spaced at least 20 mm, at least 30 mm, at least 40 mm, at least 50 mm, at least 60 mm, and/or from 20 mm to 70 mm rearward of a center face of the club head as measured along a y-axis (front-to –back direction).

Figure 41:
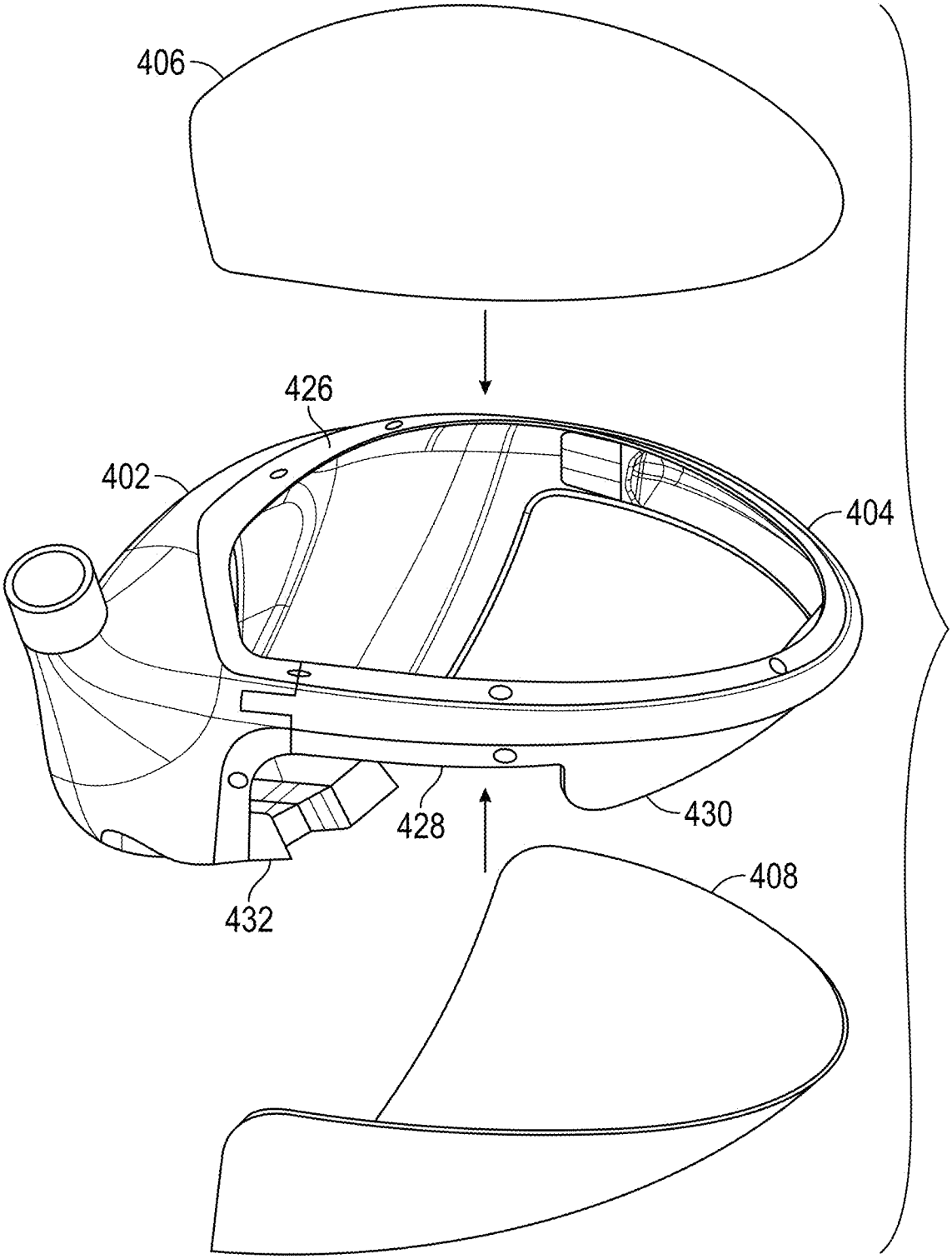
FIG. 41 shows how a crown insert and a sole insert are assembled with the body of FIG. 40.

FIG. 41 shows how the inserts 406 and 408 can be joined with the body to cover the crown opening and sole opening and enclose the internal cavity of the club head. The crown insert 406 can be coupled to a crown ledge 426 of the body extending around the crown opening, while the sole insert 408 can be coupled to a sole ledge 428 of the body extending around the sole opening. The ledges 426 and 428 can be formed from a combination of a both the cup 402 and the ring 404, with the cup including the forward portions of the ledges and the ring including the rear portions of the ledges. The ledges 426 and 428 can be offset inwardly from the surrounding outer surfaces, such that there is room to receive the inserts with the outer surfaces of the inserts being even or flush with the surrounding outer surfaces of the cup/ring body. The ring 404 can also include a projection 430 extending downwardly and forwardly from the rear of the ring and forming part of sole ledge 428 to help support the sole insert 408 and provide increased rigidity.

Figure 47:
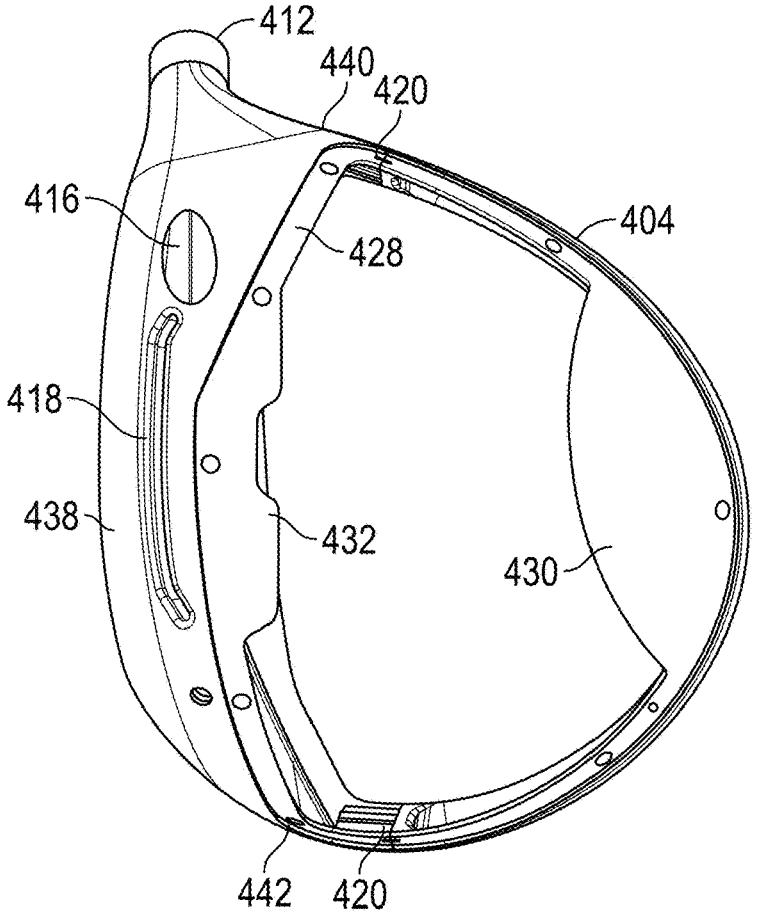
FIG. 47 is a bottom view of the body.

In some embodiments, the ring 404 can include a mass pad having increased thickness, such as in the projections 430 or elsewhere, to provide rear weighting for the golf club and move the center of mass rearward and increase MOI about the z and x axes. Such rear weighting can also be accomplished with an added weight member coupled to the rear ring, such as a removable, swappable, and/or adjustable weight member coupled to the rear part of the ring. For example, the projection 430 or other part of the ring 404 can include an opening, such as a threaded opening, a track, or other weight member receiving feature. FIG. 47 shows an example of two weight ports 431 and 433 that can receive such adjustable weight members. Two or more weight members can also be coupled to the rear ring at the same time. The mass pad or weight member(s) can comprise a relatively more dense material, such as tungsten or steel.

In some embodiments, the cup 402 can include a mass pad, such as the mass pad 432 shown in the drawings, at the bottom sole region to lower the center or mass and/or move the center of mass forward. In some embodiments, the cup 402 can include one or more added weight members coupled to the sole portion of the cup, such as in or near the mass pad 432 and/or rearward of the slot 418, such as one or more removable, swappable, and/or adjustable weight members coupled to the cup. For example, the mass pad 432 or other part of the cup 402 can include one or more openings, such as a threaded opening, a track, or other weight member receiving feature. Two or more weight members can also be coupled to the cup at the same time. The weight member(s) can comprise a relatively more dense material that the cast cup material, such as tungsten or steel. In some embodiments, the cup and the ring can have matching weight ports that can allow for swapping weight members between the rear ring locations and the lower cup locations, providing adjustability options to change the mass properties of the club head. In some such examples, a group of swappable weights can be provided with the club head, such as including a 1-3 g weight and a 8-15 g weight, which can be coupled to a weight port in the rear ring or to a weight port in the sole portion of the cup, which can allow for a higher MOI (heavier weight in rear) or lower spin (heavier weight in the low-forward location), or other combinations and mass properties.

Figure 44:
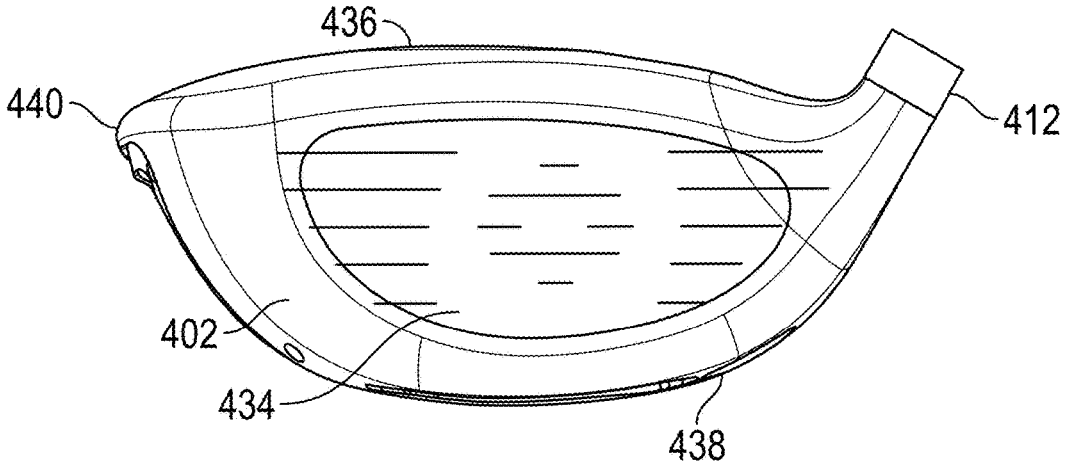
FIG. 44 is a front elevation view of the body.
Figure 45:
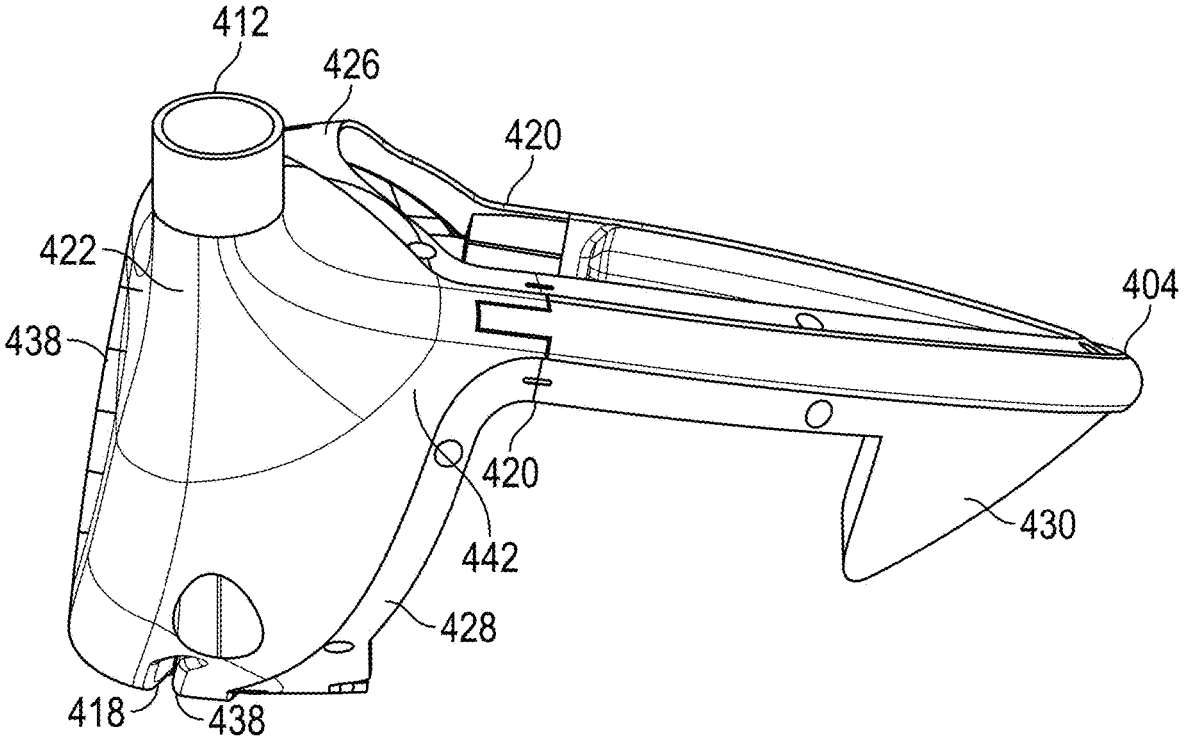
FIG. 45 is a heel side elevation view of the body.
Figure 46:
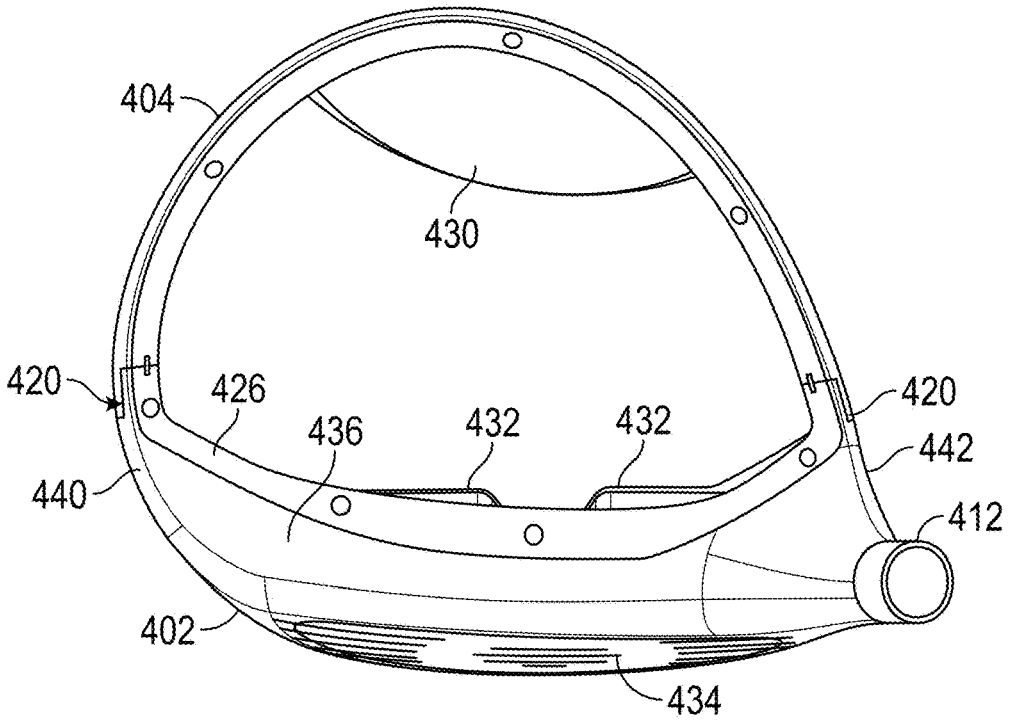
FIG. 46 is a top plan view of the body.

FIGS. 44-47 show the body formed by the joined cup 402 and 404 in more detail from several perspectives, without the inserts 406 and 408. FIG. 44 is a front elevation view, showing the integral face 434. FIG. 45 is a heel side view. FIG. 46 is a top view, showing a forward crown portion 436, forward toe portion 440, and forward heel portion 442 that are part of the cup 402, as well as the toe and heel joints 420 and the crown ledge 426 that receives the crown insert 406. FIG. 47 is a bottom view, showing a forward sole portion 438 that includes a sole slot 418 extending into the interior cavity of the club head, as well as the ledge 428 that receives the sole insert 408. Also shown in FIG. 47 are an exemplary rear weight port 431 located in the ring projection 430 and an exemplary sole weight port located in cup 402 rearward of the slot 418 in the region of the mass pad 433. In other embodiments, such weight ports can be located in other parts of the cup or ring, such as in the very rear of the ring, and there can be more than two of such weight ports. The weight ports can be threaded and can receive adjustable weight members, allowing for adjustability of the center of mass and MOI properties of the club head.

Figure 42:
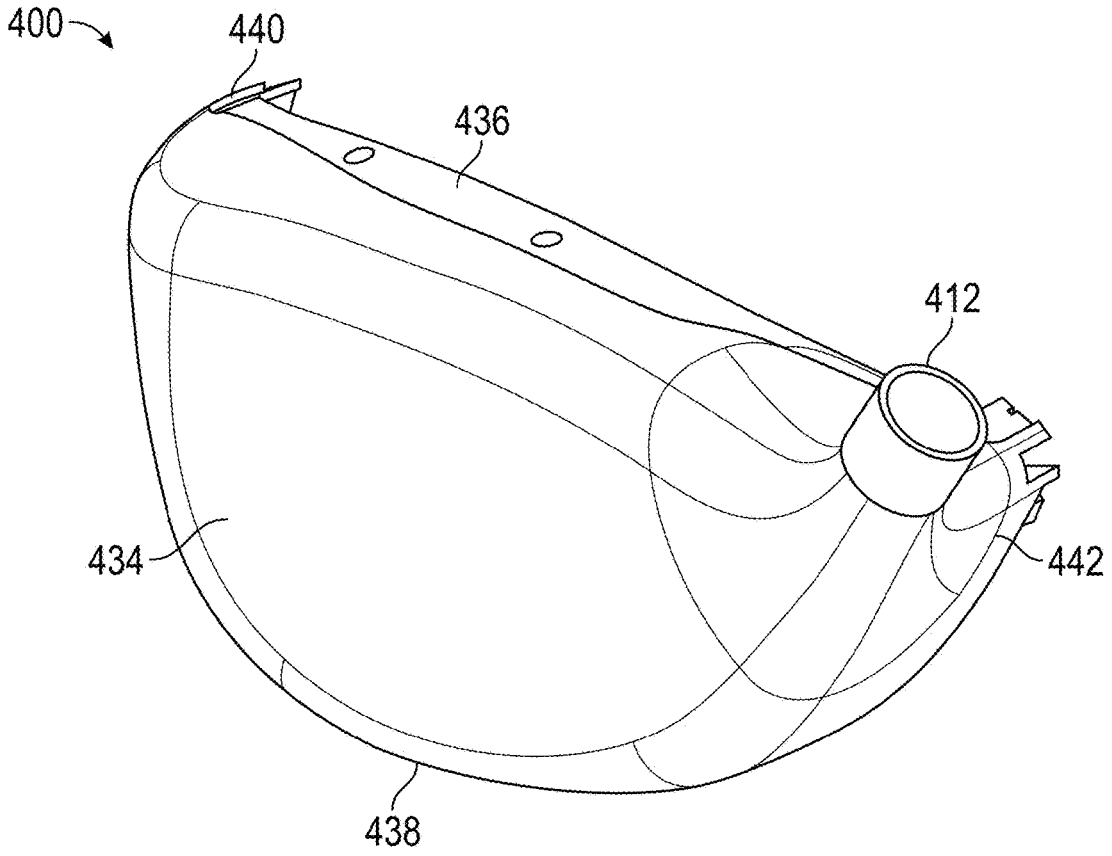
FIG. 42 shows the front of a cup face portion of the body.
Figure 43:
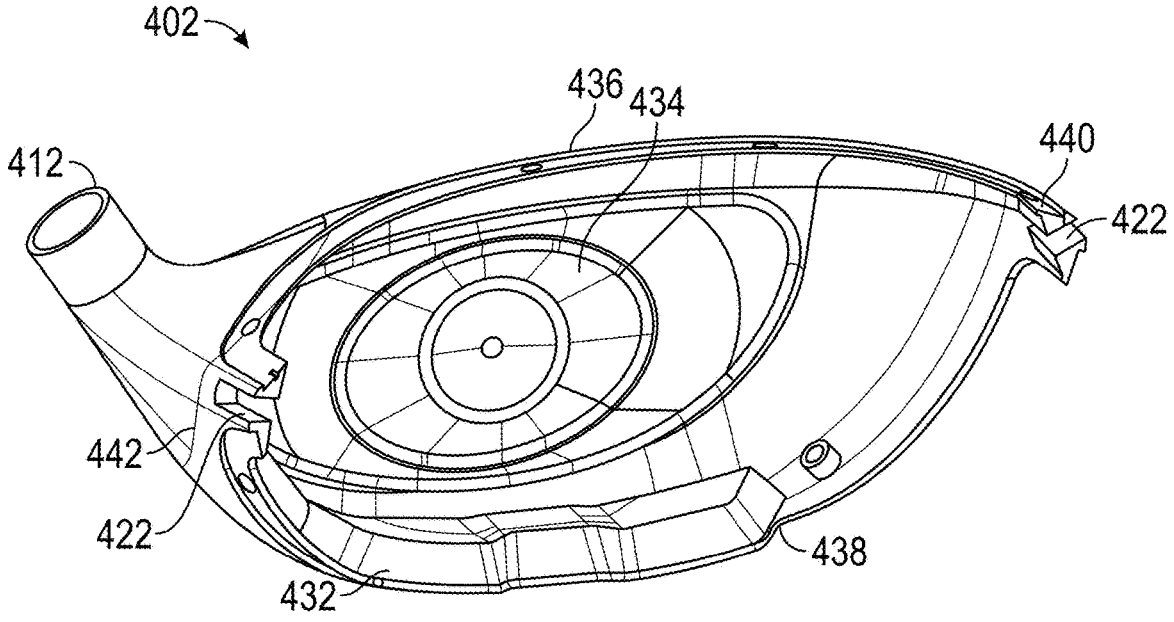
FIG. 43 shows the rear of the cup face portion of the body.

The cup 402 is illustrated in more detail in FIGS. 42 and 43. The rear surface of the face 434 is shown in FIG. 43. As described elsewhere herein, the rear of the face 434 can be formed having a variety of complex shapes and thickness profiles, and can be easily accessed from the rear for machining, etching, material removal, and/or other post-casting processing, before the ring 404 is attached to the cup 402. FIG. 43 also shows a mass pad 432 on sole portion 438 of the cup. The mass pad 432 can comprise a thickened portion of the sole having increased mass, which significantly affects the overall mass properties of the club head. The mass pad 432 can have a central notch with more mass to the toe side and heel side of the center, for enhanced mass and MOI properties. More information regarding the mass pad 432, alternative mass pads geometries and embodiments, and related properties can be found in U.S. Pub. 2018/0126228, published May 10, 2018, which is incorporated by referenced herein in its entirety.

Figure 48:
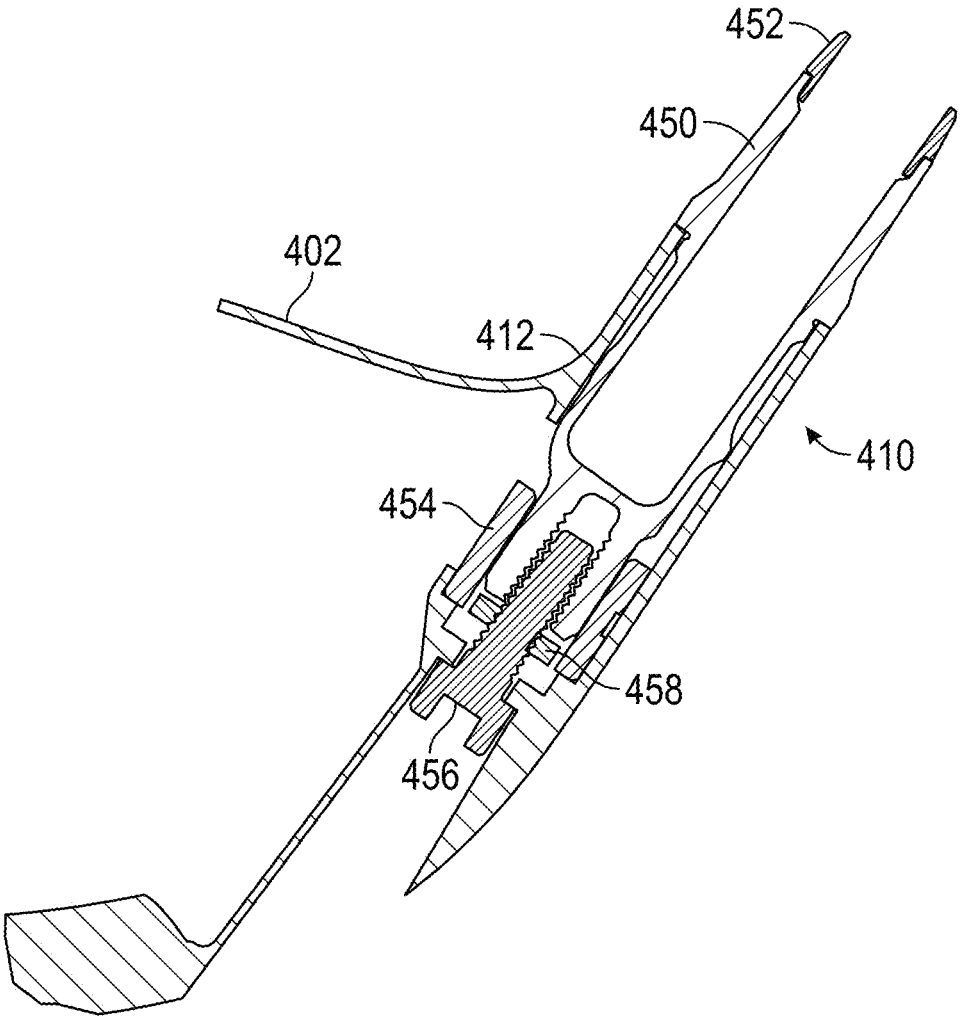
FIG. 48 is a cross-section view of the head-shaft connection assembly.

FIG. 48 illustrates the head-shaft connection assembly 410, which allows for the hosel 412 of head 400 to be coupled to a shaft in a plurality of selectable orientations, allowing for adjustment of loft angle, lie angle, and/or face angle of the assembled golf club in the normal address position. The assembly 410 can comprise various components, such as sleeve 450, ferrule 452, hosel insert 454, fastener 456, and washer 458 shown in FIG. 48. More information regarding adjustable head-shaft connection assemblies can be found in U.S. Pat. No. 9,033,821 issued May 19, 2015, which is incorporated by reference herein in its entirety.

Figure 49:
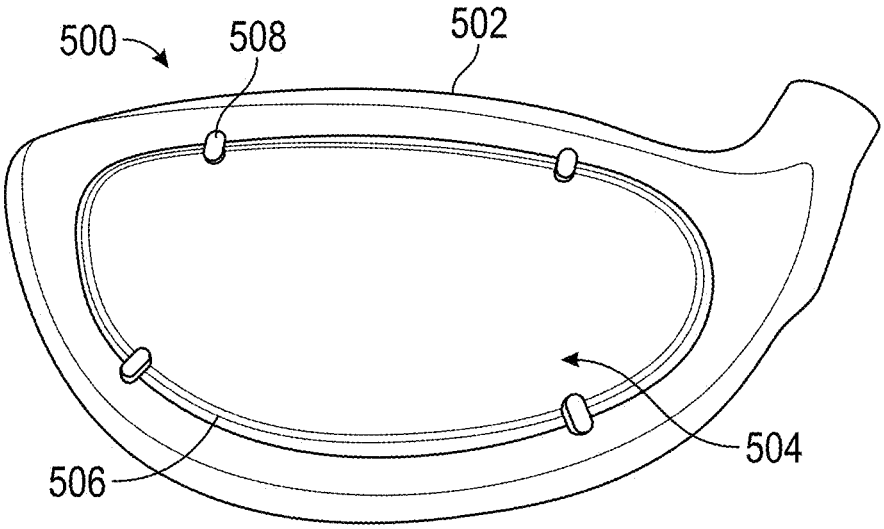
FIG. 49 illustrates a two-piece wax body with the wax face formed separately from the rest of the wax body.
Figure 50:
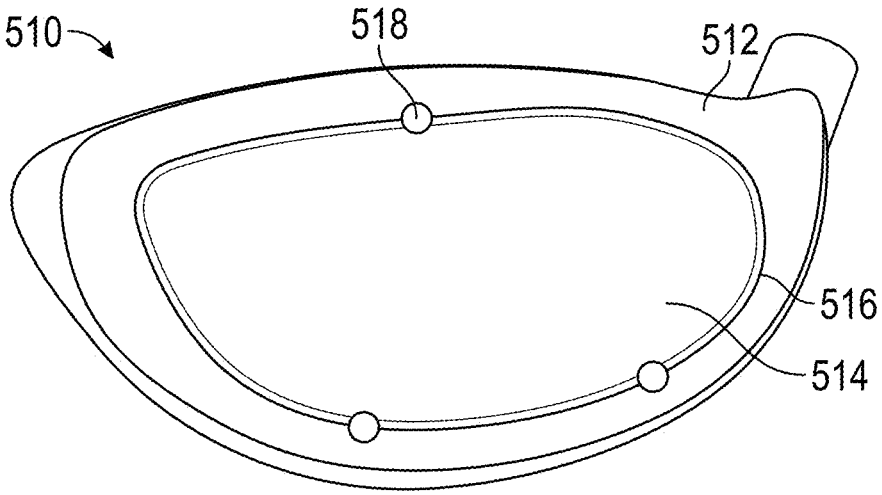
FIG. 50 shows the wax face wax welded to the rest of the wax body.

FIGS. 49 and 50 illustrate part of a method for manufacturing a golf club head, and in particular, part of a method for manufacturing a mold for casting the front cup 402 of club head 400. FIG. 49 shows a wax cup 500 that is a combination of a wax cup frame 502 and a wax face 504. The wax cup frame 502 and wax face 504 are formed separately, and then the wax face is placed into a slightly larger sized face opening in the wax cup frame 502. The two wax pieces can then be wax welded around their annular joint 506 by adding hot liquid wax into the joint and allowing it to cool and meld the face to the frame. The added hot wax fills the joint 506 and joins the wax cup frame 503 and wax face 504 into a single unitary wax cup 500. After the wax cools, excess wax can be removed from the front and rear of the weld joint 506. In some embodiments, the wax face 504 can include prongs 508 that extend radially outwardly and contact the front surface of the wax cup frame 502 to help set the depth of the wax face 504 relative to the wax cup frame, such that the front surfaces of the resultant wax cup 500 are even and smooth across the joint 506. The wax prongs 508 can be removed after the wax welding process.

FIG. 50 shows another example of a wax cup 510 form by wax welding together a wax cup frame 512 and a wax face 514 via added wax around joint 516, optionally using wax prongs 518 on the wax face to help set the depth of the wax face in the opening of the wax cup frame. In this example, the wax cup 510 includes an additional protrusion 520 that creates an additional gate in the resultant mold to help assist molten metal flowing evenly toward the face portion of the mold. Wax cups 500 and 510 also can include gate-creating portions in other locations, such as at the heel side near the hosel, as illustrated, in the rear side of the face, and/or at other locations.

Forming the wax cup from two separate wax pieces (as in FIGS. 49 and 50 for example) can facilitate creation of more intricate geometries for the wax cup and can facilitate forming several different geometry embodiments in a simplified and more rapid and cost effective manner. Starting with the two separate wax pieces causes the tooling and formation process for the wax frame to be disconnected from the tooling and formation process for the wax face. With regard to the wax cup 500, the same wax cup frame 502 (and same tooling) can be combined with any of several differently shaped wax faces 504 to create a corresponding number of different wax cups, meaning only the tooling for the wax face need be changed to produce a different wax cup. For example, a manufacturer can create two identical wax frames 502, and then can combine one wax frame with a first wax face, and can combine the second wax frame with a second wax face that has a different thickness profile than the first wax face. These two different wax cups and the resultant molds and end-product metal cups can then be measured, compared, tested, etc. See FIGS. 51-54 for various exemplary face thickness profiles, and the related discussion herein. Thus, using a two-part wax cup formation process can provide advantages in rapid prototyping and other manufacturing and development efficiencies.

Starting with two separate wax pieces also allows for efficiencies in forming large numbers of the wax pieces, as each wax piece is smaller and can be produced in greater numbers per batch on the same tree.

Once the wax cup (e.g., 500 or 510) is created, the wax cup can be used to form a mold for casting a metal cup (e.g., cup 402). The mold can comprise ceramic material and/or any other suitable material for casting a metal cup. Once the mold is formed around the wax cup, the wax can be melted and drained out of the mold. Various subsequent steps can then be applied to prepare the mold for casting, including adding gating and/or surface treatments to the mold. In addition, several cup molds can be combined into one mold tree for casting several metallic cups at the same time. After the mold is prepared, molten metal can then be introduced into the mold to cast the metal cup. The mold can then be opened/removed to access the cast metal cup. The cast metal cup can be formed of any suitable metal or metal alloy, including titanium alloys (any suitable metallic material disclosed herein can be used for the cast cup).

After the metal cup is cast, portions of the cast cup can be machined or modified to remove parts of the cast cup as desired. For one example, the front surface of the face portion of the cup can be machined to add horizontal score lines and/or to create a more precise texture, curvature, and twist. For another example, the rear surface of the face portion of the cup can be machined to modify the thickness profile across the height and width of the face portion, producing a desired variable thickness profile across the face portion. The front and/or rear surface of the face portion of the cast cup can also be machined or chemically etched (e.g., using hydrofluoric acid) to remove part or all of the alpha case layer formed during the casting process (e.g., for titanium alloys), such as to make the face portion less brittle and to increase durability of the face portion.

In anticipation of post-casting removal of material from the face portion of the cup, the face portion of the cup can be cast with extra thickness of material, such that a desired amount of material and a desired thickness profile is left after post-casting material removal.

As shown in FIGS. 39 and 40, and as discussed above, the cup 402 and ring 404 can be formed (e.g., cast) separately, and then combined together (e.g., welding, brazing, adhesive bonding, mechanical fasteners, etc.) at joints 420 to form a metallic club head body, which serves as a rigid frame that receives other components to form the golf club head 400. One advantage of this method of creating the club head body from a separate cup 402 and ring 404 is that the absence of the rear ring portion allows better access to the rear surface of the face portion of the cup 402 for post-casting machining, chemical etching, and/or other post-casting modifications to the rear surface of the face portion. For example, with the ring 404 not present, there is more room for a cutting tool, milling machine, CNC machine, drill bit, or other tool to access the entire rear surface of the face portion of the cup 402. After such post-casting modifications are performed on the cup 402, the ring 404 can be attached to the cup and the rest of the club head can be assembled.

Another advantage of casting the cup and the ring separately is that it allows for efficiencies in casting large numbers of each of the ring and cup pieces, as each cast piece is smaller than the combined body and can be produced in greater numbers per batch on the same tree. Also, the same ring piece can be used with various differently shaped cup pieces, so only the tooling for the cup piece need be changed to accommodate a change to the club head body or making several different variations of the club head with different cup/face geometries.

Figure 51:
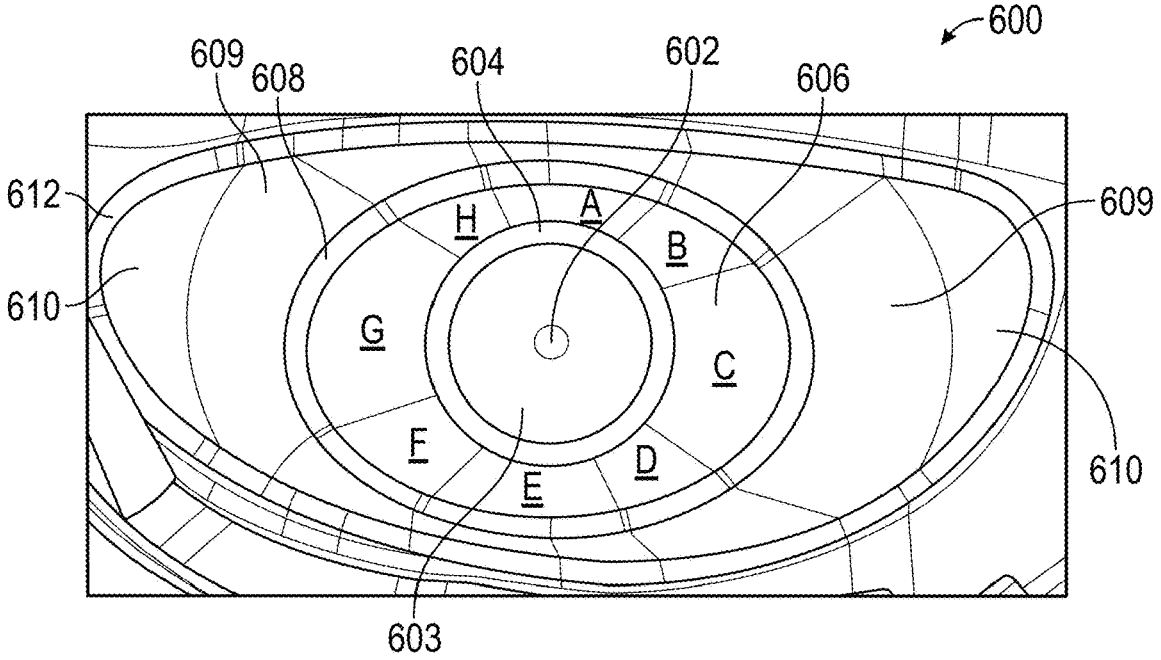
FIG. 51 shows a varying thickness profile on the rear side of the face.
Figure 52:
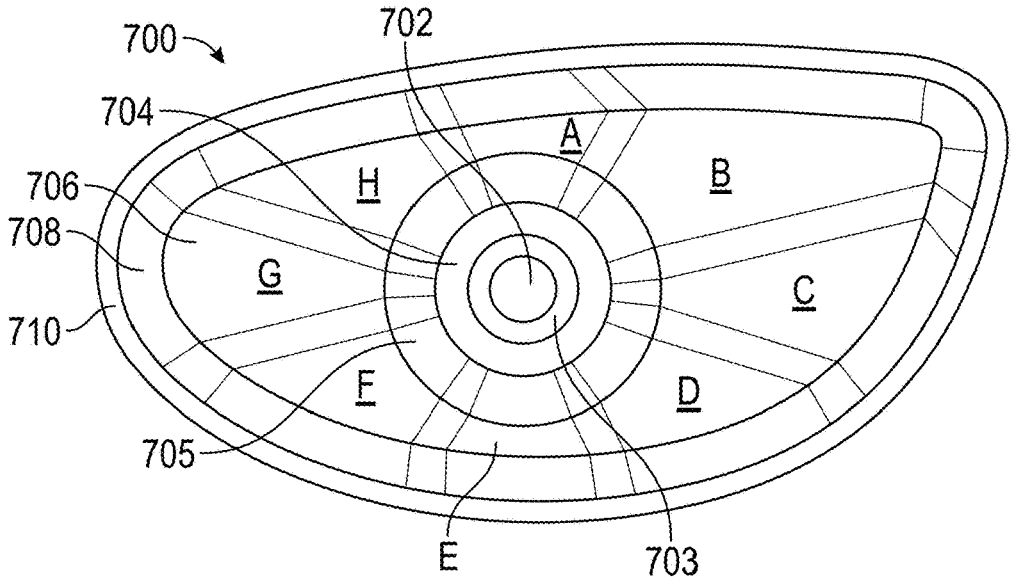
FIG. 52 shows another varying thickness profile on the rear side of a face.
Figure 53:
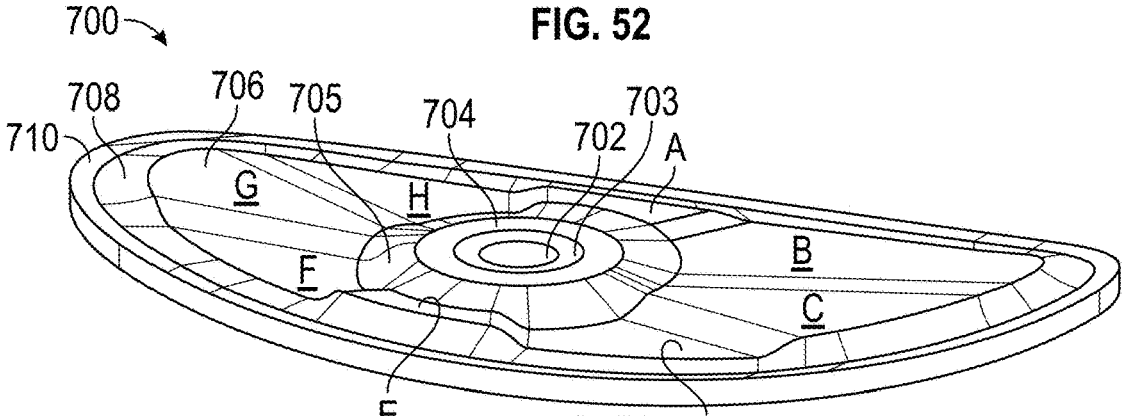
FIG. 53 is a perspective view of the face of FIG. 52.
Figure 54:
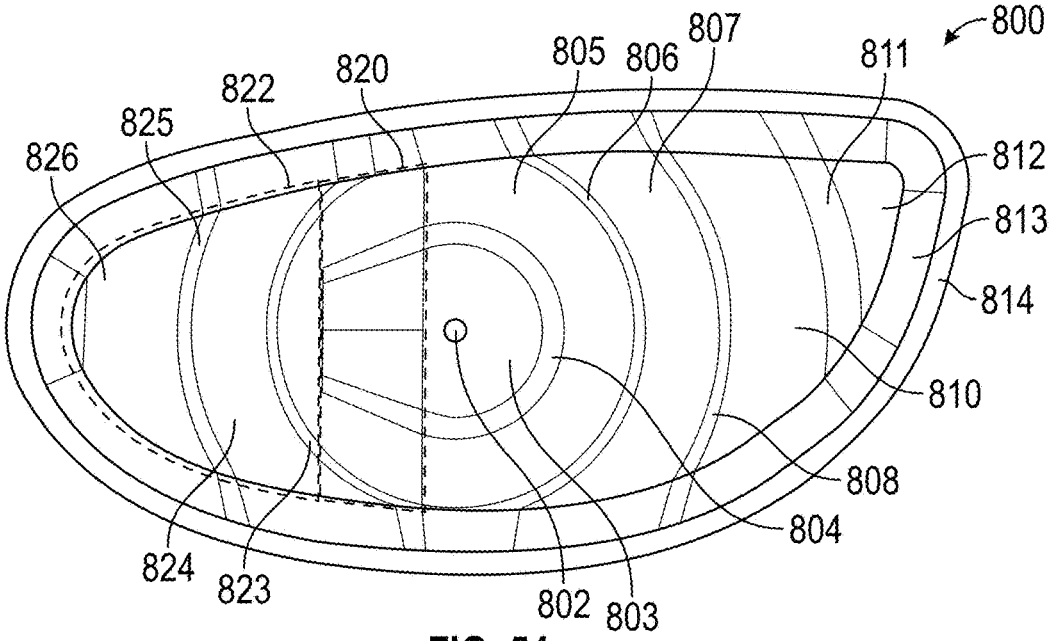
FIG. 54 shows another varying thickness profile that is offset to the heel side.

FIG. 51 illustrates an exemplary rear surface of a face portion of a cast cup 600, similar to the cup 402, as viewed from the rear with the hosel/heel to the left and the toe to the right. FIGS. 52 and 53 illustrate another exemplary face portion 700 having a variable thickness profile, and FIG. 54 illustrates yet another exemplary face portion 800 having a variable thickness profile. As a result of the casting process and optional post-casting modifications to the face portion, the face portion of the cast cup can have a great variety of novel thickness profiles. By casting the face into a desired geometry, rather than forming the face plate from a flat rolled sheet of metal in a traditional process, the face can be created with greater variety of geometries and can have different material properties, such as different grain direction and chemical impurity content, which can provide advantages for a golf performance and manufacturing.

In a sheet-based process, the face plate is formed from a flat sheet of metal having a uniform thickness. Such a sheet of metal is typically rolled along one axis to reduce the thickness to a certain uniform thickness across the sheet. This rolling process can impart a grain direction in the sheet that creates a different material properties in the rolling axis direction compared to the direction perpendicular to the rolling direction. This variation in material properties can be undesirable and can be avoided by using the disclosed casting methods instead to create face portion.

Furthermore, because a conventional face plate starts off as a flat sheet of uniform thickness, the thickness of the whole sheet has to be at least as great as the maximum thickness of the desired end product face plate, meaning much of the starting sheet material has to be removed and wasted, increasing material cost. By contrast, in the disclosed casting methods, the face portion is initially formed much closer to the final shape and mass, and much less material has to be removed and wasted. This saves time and cost.

Still further, in a conventional process, the initial flat sheet of metal has to be bent in a special process to impart a desired bulge and roll curvature to the face plate. Such a bending process is not needed when using the disclosed casting methods.

The unique thickness profiles illustrated in FIGS. 51-54 are made possible using the disclosed casting methods, and were previously not possible to achieve using the conventional process, wherein the sheet of metal having a uniform thickness is mounted in a lathe or similar machine and turned to produce a variable thickness profile across the rear of the face plate. In such a turning process, the imparted thickness profile must be symmetrical about the central turning axis, which limits the thickness profile to a composition of concentric circular ring shapes each having a uniform thickness at any given radius from the center point. In contrast, no such limitations are imposed using the disclosed casting methods, and more complex face geometries can be created.

By using the herein disclosed casting methods, large numbers of the disclosed club heads can be manufacture faster and more efficiently. For example, 50 or more of the cups 402 can be cast at the same time on a single casting tree, whereas it would take much longer and require more resources to create the novel face thickness profiles on face plates using a conventional milling methods using a lathe, one at a time.

In FIG. 51, the rear face surface of the cast cup 600 includes a non-symmetrical variable thickness profile, illustrating just one example of the wide variety of variable thickness profiles made possible using the disclosed casting methods. The center 602 of the face can have a center thickness, and the face thickness can gradually increase moving radially outwardly from the center across an inner blend zone 603 to a maximum thickness ring 604, which can be circular. The face thickness can gradually decrease moving radially outwardly from the maximum thickness ring 604 across a variable blend zone 606 to a second ring 608, which can be non-circular, such as elliptical. The face thickness can gradually decrease moving radially outwardly from the second ring 608 across an outer blend zone 609 to heel and toe zones 610 of constant thicknesses (e.g., minimum thickness of the face portion) and/or to a radial perimeter zone 612 defining the extent of the face portion where the face transitions to the rest of the cast cup 600.

The second ring 608 can itself have a variable thickness profile, such that the thickness of the second ring 608 varies as a function of the circumferential position around the center 602. Similarly, the variable blend zone 606 can have a thickness profile that varies as a function of the circumferential position around the center 602 and provides a transition in thickness from the maximum thickness ring 604 to the variable and less thicknesses of the second ring 608. For example, the variable blend zone 606 to a second ring 608 can be divided into eight sectors that are labeled A-H in FIG. 51, including top zone A, top-toe zone B, toe zone C, bottom-toe zone D, bottom zone E, bottom-heel zone F, heel zone G, and top-heel zone H. These eight zones can have differing angular widths as shown, or can each have the same angular width (e.g., one eighth of 360 degrees). Each of the eight zones can have its own thickness variance, each ranging from a common maximum thickness adjacent the ring 604 to a different minimum thickness at the second ring 608. For example, the second ring can be thicker in zones A and E, and thinner in zones C and G, with intermediate thicknesses in zones B, D, F, and H. In this example, the zones B, D, F, and H can vary in thickness both along a radial direction (thinning moving radially outwardly) and along a circumferential direction (thinning moving from zones A and E toward zones C and G).

One example of the cast cup 600 can have the following thicknesses: 3.1 mm at center 602, 3.3 mm at ring 604, the second ring 608 can vary from 2.8 mm in zone A to 2.2 mm in zone C to 2.4 mm in zone E to 2.0 mm in zone G, and 1.8 mm in the heel and toe zones 610.

FIGS. 52 and 53 show the rear face surface of another exemplary cast face portion 700 that includes a non-symmetrical variable thickness profile. The center 702 of the face can have a center thickness, and the face thickness can gradually increase moving radially outwardly from the center across an inner blend zone 703 to a maximum thickness ring 704, which can be circular. The face thickness can gradually decrease moving radially outwardly from the maximum thickness ring 704 across a variable blend zone 705 to an outer zone 706 comprised of a plurality of wedge shaped sectors A-H having varying thicknesses. As best shown in FIG. 53, sectors A, C, E, and G can be relatively thicker, while sectors B, D, F, and H can be relatively thinner. An outer blend zone 708 surrounding the outer zone 706 transitions in thickness from the variable sectors down to a perimeter ring 710 having a relatively small yet constant thickness. The outer zone 706 can also include blend zones between each of the sectors A-H that gradually transition in thickness from one sector to an adjacent sector.

One example of the face portion 700 can have the following thicknesses: 3.9 mm at center 702, 4.05 mm at ring 704, 3.6 mm in zone A, 3.2 mm in zone B, 3.25 mm in zone C, 2.05 mm in zone D, 3.35 mm in zone E, 2.05 mm in zone F, 3.00 mm in zone G, 2.65 mm in zone H, and 1.9 mm at perimeter ring 710.

FIG. 54 shows the rear face of another exemplary cast face portion 800 that includes a non-symmetrical variable thickness profile having a targeted thickness offset toward the heel side (left side). The center 802 of the face has a center thickness, and to the toe/top/bottom the thickness gradually increases across an inner blend zone 803 to inner ring 804 having a greater thickness that at the center. The thickness then decreases moving radially outwardly across a second blend zone 805 to a second ring 806 having a thickness less than that of the inner ring 804. The thickness then decreases moving radially outwardly across a third blend zone 807 to a third ring 808 having a thickness less than that of the second ring 806. The thickness then decreases moving radially outwardly across a fourth blend zone 810 to a fourth ring 811 having a thickness less than that of the third ring 808. A toe end zone 812 blends across an outer blend zone 813 to an outer perimeter 814 having a relatively small thickness.

To the heel side, the thicknesses are offset by set amount (e.g., 0.15 mm) to be slightly thicker relative to their counterpart areas on the toe side. A thickening zone 820 (dashed lines) provides a transition where all thicknesses gradually step up toward the thicker offset zone 822 (dashed lines) at the heel side. In the offset zone 822, the ring 823 is thicker than the ring 806 on the heel side by a set amount (e.g., 0.15 mm), and the ring 825 is thicker that the ring 808 by the same set amount. Blend zones 824 and 826 gradually decrease in thickness moving radially outwardly, and are each thicker than their counterpart blend zones 807 and 810 on the toe side. In the thickening zone 820, the inner ring 804 gradually increases in thickness moving toward the heel.

One example of the face portion 800 can have the following thicknesses: 3.8 mm at the center 802, 4.0 mm at the inner ring 804 and thickening to 4.15 mm across the thickening zone 820, 3.5 mm at the second ring 806 and 3.65 mm at the ring 823, 2.4 mm at the third ring 808 and 2.55 mm at the ring 825, 2.0 mm at the fourth ring 811, and 1.8 mm at the perimeter ring 814.

The targeted offset thickness profile shown in FIG. 54 can help provide a desirable characteristic time (CT) profile across the face. Thickening the heel side can help avoid having a CT spike at the heel side of the face, for example, which can help avoid having a non-conforming CT profile across the face. Such an offset thickness profile can similarly be applied to the toe side of the face, or to both the toe side and the heel side of the face to avoid CT spikes at both the heel and toe sides of the face. In other embodiments, an offset thickness profile can be applied to the upper side of the face and/or toward the bottom side of the face.

Various other varying face thickness profiles can be produced using the disclosed methods, including those disclosed in U.S. patent application Ser. No. 12/006,060 and U.S. Pat. Nos. 6,997,820; 6,800,038; 6,824,475; 7,731,603; 8,801,541; 9,943,743; and 9,975,018; the entire contents of each of which are incorporated herein by reference in their entireties. For example, U.S. Pat. No. 9,975,018 discloses examples of striking faces that include a localized stiffened region, such as an inverted cone or 'donut' shaped thickness profile that is offset from the center of the face, which alters the launch conditions of golf balls struck by the club head in a way that wholly or partially compensates for, overcomes, or prevents the occurrence of a rightward/leftward deviation. In particular, the localized stiffened region is located on the striking face such that a golf ball struck under typical conditions will not impart a left-tending and/or right-tending sidespin to the golf ball.

All of the disclosed face thickness profiles can be made possible by the casting methods disclosed herein. Such configurations would not be possible using a conventional turning process of removing material in concentric circle patterns from the rear of an originally flat face plate.

In some golf club head embodiments, the face plate can be cast individually, and then welded into a front opening in the frame of the club head. When a face plate is welded to the front opening of frame, extra material is typically produced around the weld zone, and this extra material has to be removed after the welding process to smooth out the transition between the face plate and the frame. This process can be avoided by casting the entire cup, including the face and the frontal frame, as a single cast unit, as disclosed herein.

Figure 55:
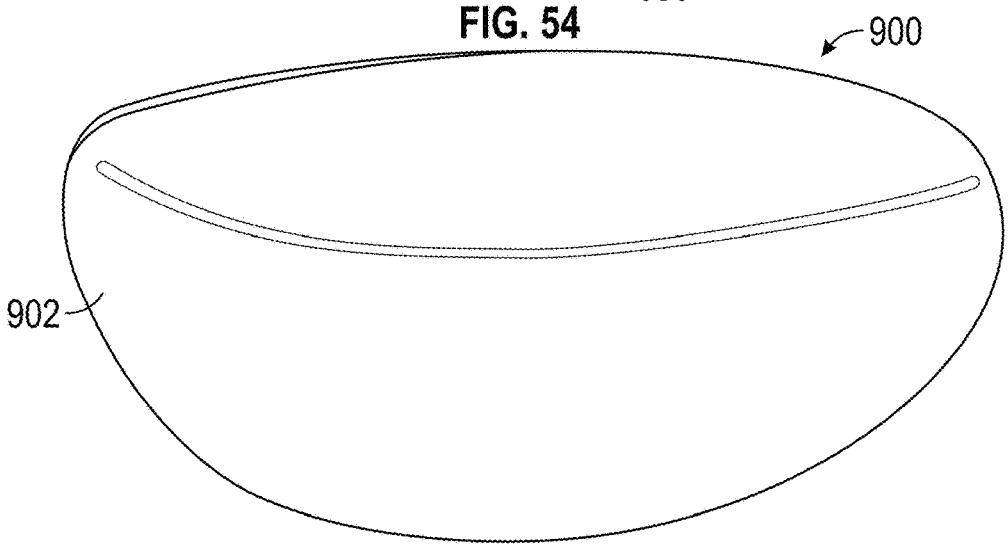
FIG. 55 shows the front side of an exemplary cast face plate.
Figure 56:
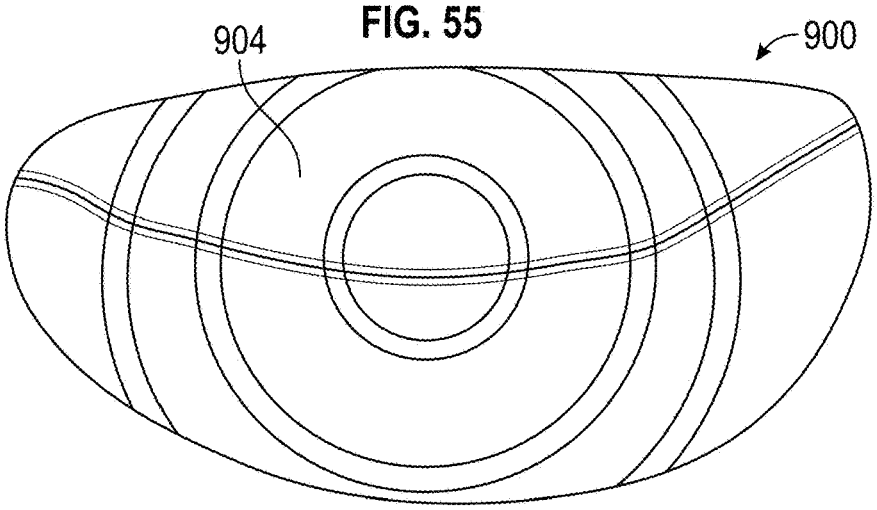
FIG. 56 shows the rear side of the cast face plate of FIG. 55.

However, casting the face plate separately can provide advantages over casting the entire cup as a unit. For example, post-processing of the cast face plate is much easier compared to post-processing the face surfaces when it is part of a cup. FIGS. 55 and 56 show the front 902 and rear 904 of an exemplary cast face plate 900. In particular, it is much easier to access to the all parts of the rear surface of a cast face plate compared to the rear face surface of a cast cup. There is unlimited room to approach the cast face plate with tooling for any desired post-casting process because there are no parts of the sole, crown, toe, heel, hosel, etc., to get in the way. Also, a cast face plate can be cast closer to the exact final shape of the face plate such that less material has to be removed and less work is required to modify the face after casting. For example, a face plate can be cast with less than 0.5 mm, less than 0.4 mm, less than 0.3 mm, and/or less than 0.2 mm of excess material on each side of the face to be removed after casting. This equates to less wasted material removed compared to machining a face plate from a flat sheet of rolled metal. The front surface of the cast face can be machined to remove some or all of the alpha case layer, achieve a precise bulge, roll, and twist curvature, and/or add scorelines. The rear of the cast face can be machined to remove part or all of the alpha case layer and/or to achieve a precise variable thickness profile across the face. As described elsewhere herein, the casting process allows for much more intricate and asymmetric thickness profiles, as opposed to the required 360 degree concentric circle symmetry required by the conventional face sheet turning process.

Golf club heads that are cast including the face as an integral part of the body (e.g., cast at the same time as a single cast object) can provide superior structural properties compared to club heads where the face is formed separately and later attached (e.g., welded or bolted) to a front opening in the club head body. However, the advantages of having an integrally cast Ti face are mitigated by the need to remove the alpha case on the surface of cast Ti faces.

With the herein disclosed club heads comprising an integrally cast titanium alloy face and body unit (e.g., cast cup), the drawback of having to remove the alpha case can be eliminated, or at least substantially reduced. For a cast 9-1-1 Ti face, using a mold pre-heat temperature of 1000 C or more, the thickness of the alpha case can be about 0.10 mm or less, 0.15 mm or less, or about 0.20 mm or less, or about 0.30 mm or less, such as between 0.10 mm and 0.30 mm in some embodiments, whereas for a cast 6-4 Ti face the thickness of the alpha case can be greater than 0.10 mm, greater than 0.15 mm, or greater than 0.20 mm, or greater than 0.30 mm, such as from about 0.25 mm to about 0.30 mm in some examples. In some embodiments, the alpha case thickness can be as low as 0.1 mm and up to 0.15 mm while providing sufficiently durable products that have a desirably high CT time across the face. In some embodiments, the alpha case on the rear of the face at the geometric center of the face can have a thickness less than 0.30 mm and/or less than 0.20 mm, and this can be accomplished without chemically etching the surface after formation.

Other titanium alloys that can be used to form any of the striking faces and/or club heads described herein can comprise titanium, aluminum, molybdenum, chromium, vanadium, and/or iron. For example, in one representative embodiment the alloy may be an alpha-beta titanium alloy comprising 6.5% to 10% Al by weight, 0.5% to 3.25% Mo by weight, 1.0% to 3.0% Cr by weight, 0.25% to 1.75% V by weight, and/or 0.25% to 1% Fe by weight, with the balance comprising Ti (one example is sometimes referred to as "1300" titanium alloy).

In another representative embodiment, the alloy may comprise 6.75% to 9.75% Al by weight, 0.75% to 3.25% or 2.75% Mo by weight, 1.0% to 3.0% Cr by weight, 0.25% to 1.75% V by weight, and/or 0.25% to 1% Fe by weight, with the balance comprising Ti.

In another representative embodiment, the alloy may comprise 7% to 9% Al by weight, 1.75% to 3.25% Mo by weight, 1.25% to 2.75% Cr by weight, 0.5% to 1.5% V by weight, and/or 0.25% to 0.75% Fe by weight, with the balance comprising Ti.

In another representative embodiment, the alloy may comprise 7.5% to 8.5% Al by weight, 2.0% to 3.0% Mo by weight, 1.5% to 2.5% Cr by weight, 0.75% to 1.25% V by weight, and/or 0.375% to 0.625% Fe by weight, with the balance comprising Ti.

In another representative embodiment, the alloy may comprise 8% Al by weight, 2.5% Mo by weight, 2% Cr by weight, 1% V by weight, and/or 0.5% Fe by weight, with the balance comprising Ti. Such titanium alloys can have the formula Ti-8Al-2.5Mo-2Cr-1V-0.5Fe. As used herein, reference to "Ti-8Al-2.5Mo-2Cr-1V-0.5Fe" refers to a titanium alloy including the referenced elements in any of the proportions given above. Certain embodiments may also comprise trace quantities of K, Mn, and/or Zr, and/or various impurities.

Ti-8Al-2.5Mo-2Cr-1V-0.5Fe can have minimum mechanical properties of 1150 MPa yield strength, 1180 MPa ultimate tensile strength, and 8% elongation. These minimum properties can be significantly superior to other cast titanium alloys, including 6-4 Ti and 9-1-1 Ti, which can have the minimum mechanical properties noted above. In some embodiments, Ti-8Al-2.5Mo-2Cr-1V-0.5Fe can have a tensile strength of from about 1180 MPa to about 1460 MPa, a yield strength of from about 1150 MPa to about 1415 MPa, an elongation of from about 8% to about 12%, a modulus of elasticity of about 110 GPa, a density of about 4.45 g/cm$^3$, and a hardness of about 43 on the Rockwell C scale (43 HRC). In particular embodiments, the Ti-8Al-2.5Mo-2Cr-1V-0.5Fe alloy can have a tensile strength of about 1320 MPa, a yield strength of about 1284 MPa, and an elongation of about 10%.

In some embodiments, striking faces and/or cups with a face portion can be cast from Ti-8Al-2.5Mo-2Cr-1V-0.5Fe. In some embodiments, striking surfaces and club head bodies can be integrally formed or cast together from Ti-8Al-2.5Mo-2Cr-1V-0.5Fe, depending upon the particular characteristics desired.

The mechanical parameters of Ti-8Al-2.5Mo-2Cr-1V-0.5Fe given above can provide surprisingly superior performance compared to other existing titanium alloys. For example, due to the relatively high tensile strength of Ti-8Al-2.5Mo-2Cr-1V-0.5Fe, cast striking faces comprising this alloy can exhibit less deflection per unit thickness compared to other alloys when striking a golf ball. This can be especially beneficial for metalwood-type clubs configured for striking a ball at high speed, as the higher tensile strength of Ti-8Al-2.5Mo-2Cr-1V-0.5Fe results in less deflection of the striking face, and reduces the tendency of the striking face to flatten with repeated use. This allows the striking face to retain its original bulge, roll, and "twist" dimensions over prolonged use, including by advanced and/or professional golfers who tend to strike the ball at particularly high club velocities.

Any of the herein disclosed embodiments can include a face portion that has a striking surface that is twisted such that an upper toe portion of the striking surface is more open than a lower toe portion of the striking surface, and such that a lower heel portion of the striking surface is more closed than an upper heel portion of the striking surface. More information regarding golf club heads with twisted striking surfaces can be found in U.S. Pat. No. 9,814,944; U.S. Provisional Patent Application No. 62/687,143 filed Jun. 19, 2018; U.S. patent application Ser. No. 16/160,884 filed Oct. 15, 2018; all of which are herein incorporated by reference in their entireties. Any of these twisted face technologies disclosed in these incorporated references can be implemented in the herein disclosed club heads, in any combination with the herein disclosed technologies.

Additional Embodiments

As shown in FIG. 47, some embodiments of the technologies disclosed herein can include weight members attached to the club head. Any number of weights can be attached at various locations on the club head, such as the front of the sole, the rear of the sole, the rear end of the club head, the face, the crown, the heel, the toe, the hosel, inside the interior of the club head, etc. Such weights can be denser than the surround material and focus mass at a local area to adjust the properties of the club head, such as the center of gravity and the moments of inertia. The weights can also affect the feel, sound, look, and adjustability of a club, among other things.

In some embodiments, a weight can simply be a screw that is screwed into an opening in the club head. In other embodiments, the weights can be secured via discrete screws or by other means such as welding or adhesive. In some embodiments, the weight can comprise a thickened mass pad that is integrated with another part of the club head. By casting the front cup portion of the club head from lighter, stronger material such as titanium alloy, by employing a rear ring, and by employing lightweight crown and sole inserts, among other things, a significant amount of discretionary mass can be saved and added back in the form of weight members in desired locations and configurations.

Figure 57:
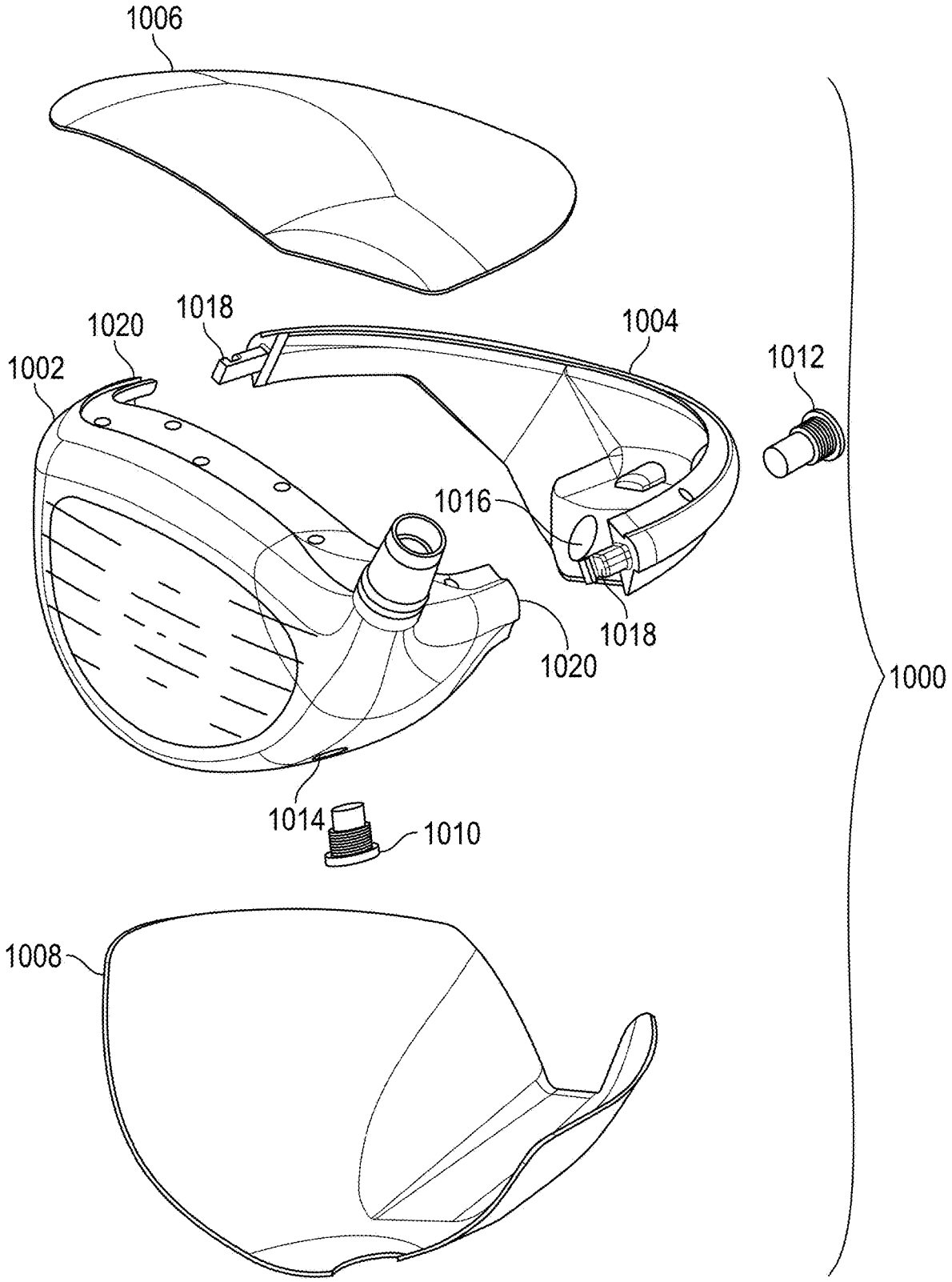
FIGS. 57 and 58 are exploded views of another exemplary golf club head.
Figure 58:
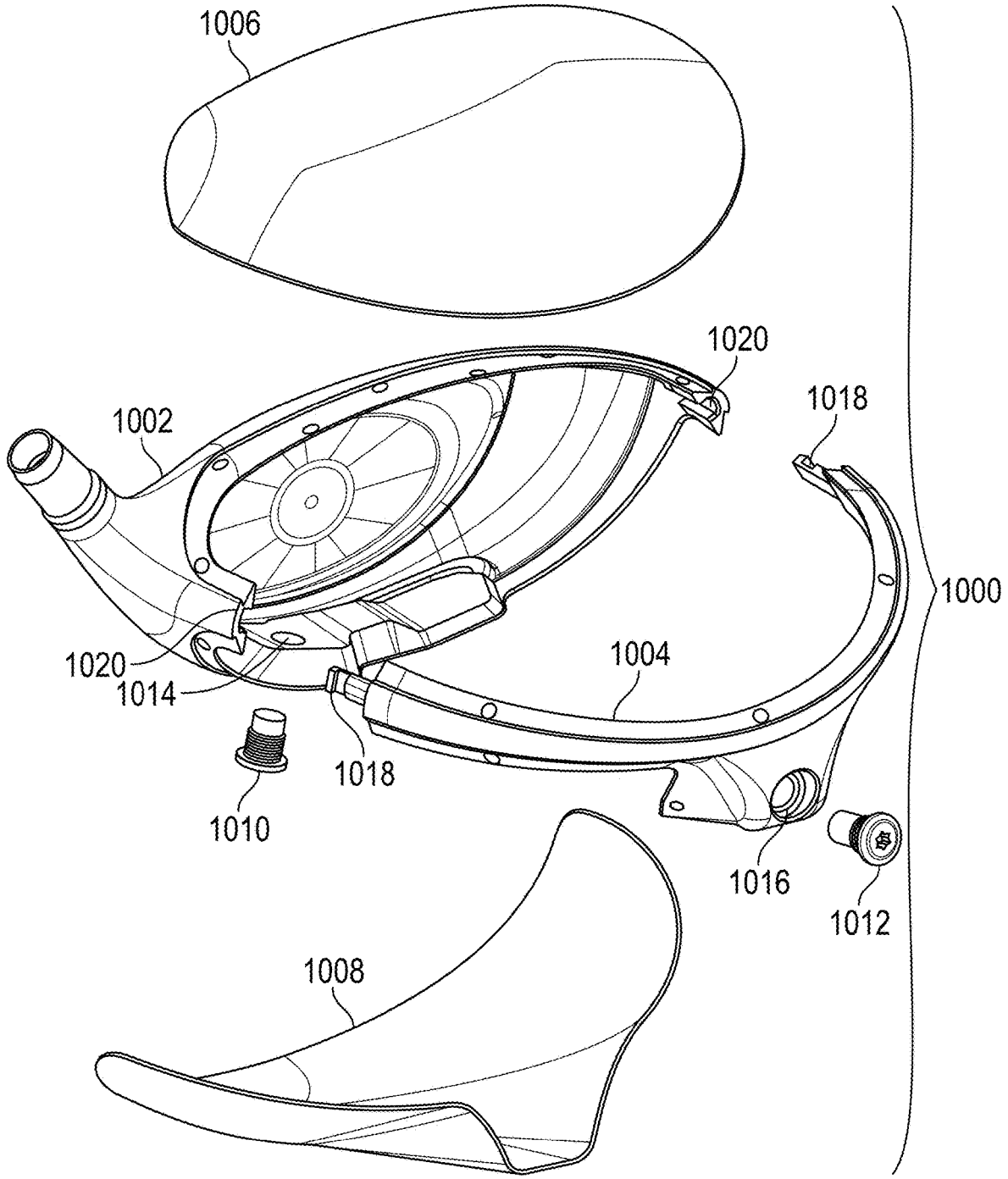

FIGS. 57 and 58 show exploded views of an exemplary club head 1000 that includes such weight members. The club head comprises a front cast cup 1002, rear ring 1004, crown insert 1006, sole insert 1008, a front weight 1010, and a rear weight 1012. The cup and ring can be mostly similar to other embodiments disclosed here, attaching together via engagement of members 1018 and 1020 at the toe and head sides to form a rigid club head body that receives the crown and sole inserts. The cup 1002 can further include a threaded opening 1014 in the sole near the hosel that receives the threaded weight member 1010, and the ring 1004 can further comprise a threaded opening 1016 at the bottom rear that receives the threaded weight member 1012. The weights 1010 and 1012 can focus the mass the club head further towards the front and rear ends of the club head, and closer toward the bottom of the club head. In addition, the cup and ring can also include mass pads or thickened regions that also add more mass to desired areas, such as the forward part of the sole and the area around the rear weight at the bottom rear of the ring. Such mass pads can be more useful in embodiments where the material of the cup and/or ring is more dense, such as where the ring comprises steel or titanium. The threaded weights, being accessible from the outside, can be removed and replaced by a user as desired, and can be swapped out for alternative weights having different masses, different materials, different appearances, and/or other differences. More than the two shown threaded weights can be included in alternative embodiments of the club head 1000, such as three, four, or more weights. Additional weights can be located anywhere on the club head, such as at the toe side of the sole.

Figure 59:
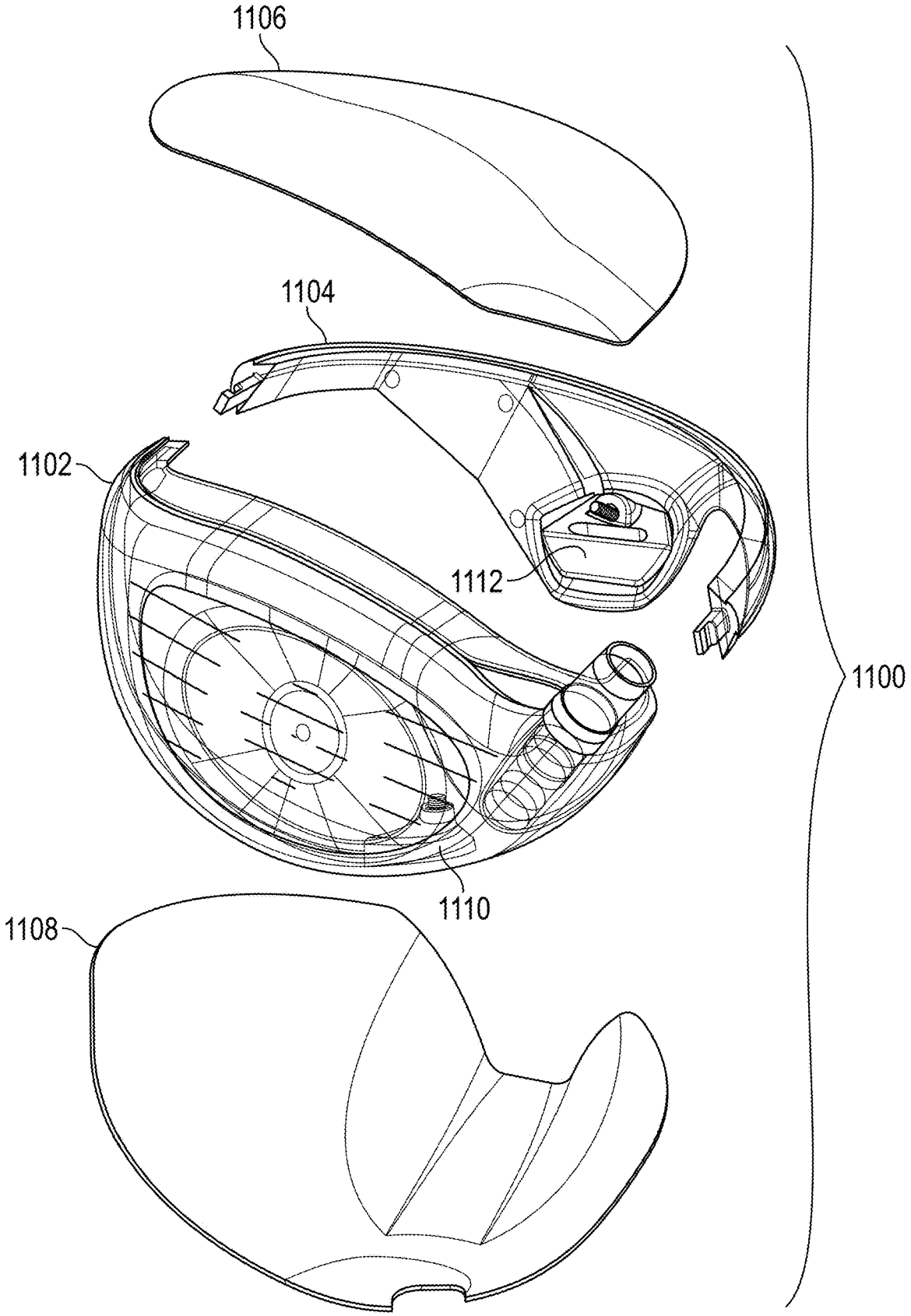
FIGS. 59 and 60 are exploded views of another exemplary golf club head.
Figure 60:
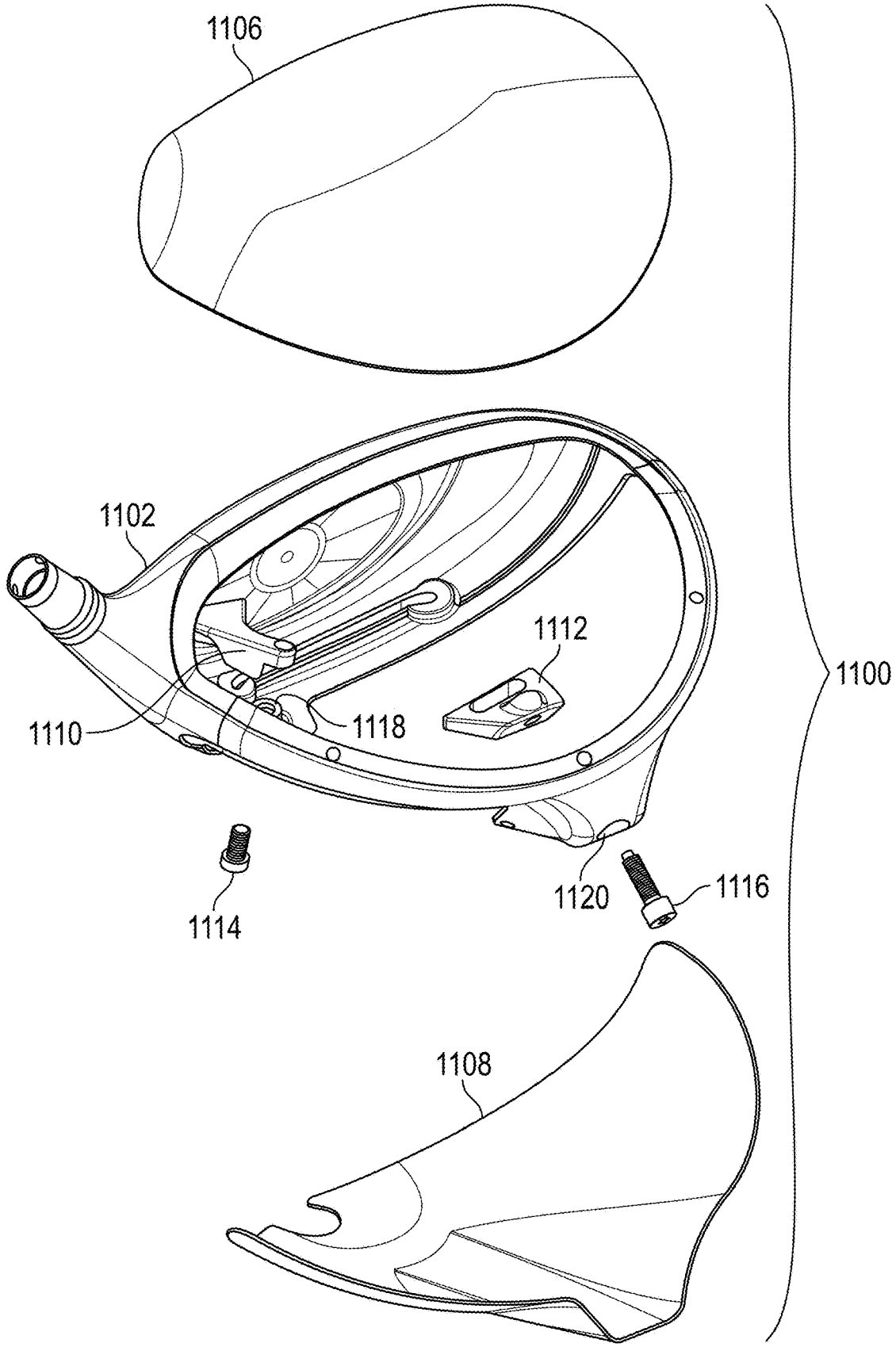
Figure 61:
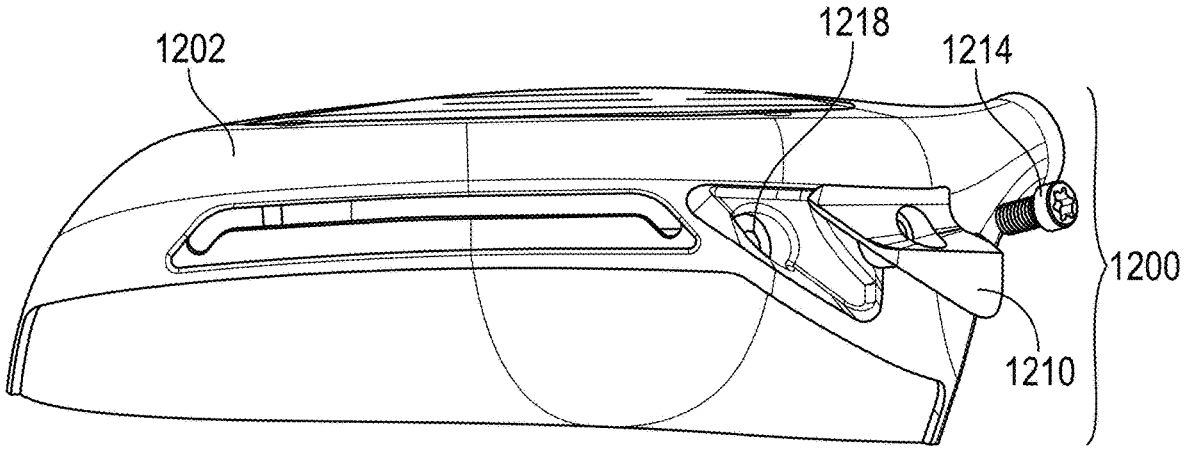
FIGS. 61 and 62 are exploded views an exemplary weight and fastener that secured to the forward outer sole of a club head adjacent the hosel.
Figure 62:
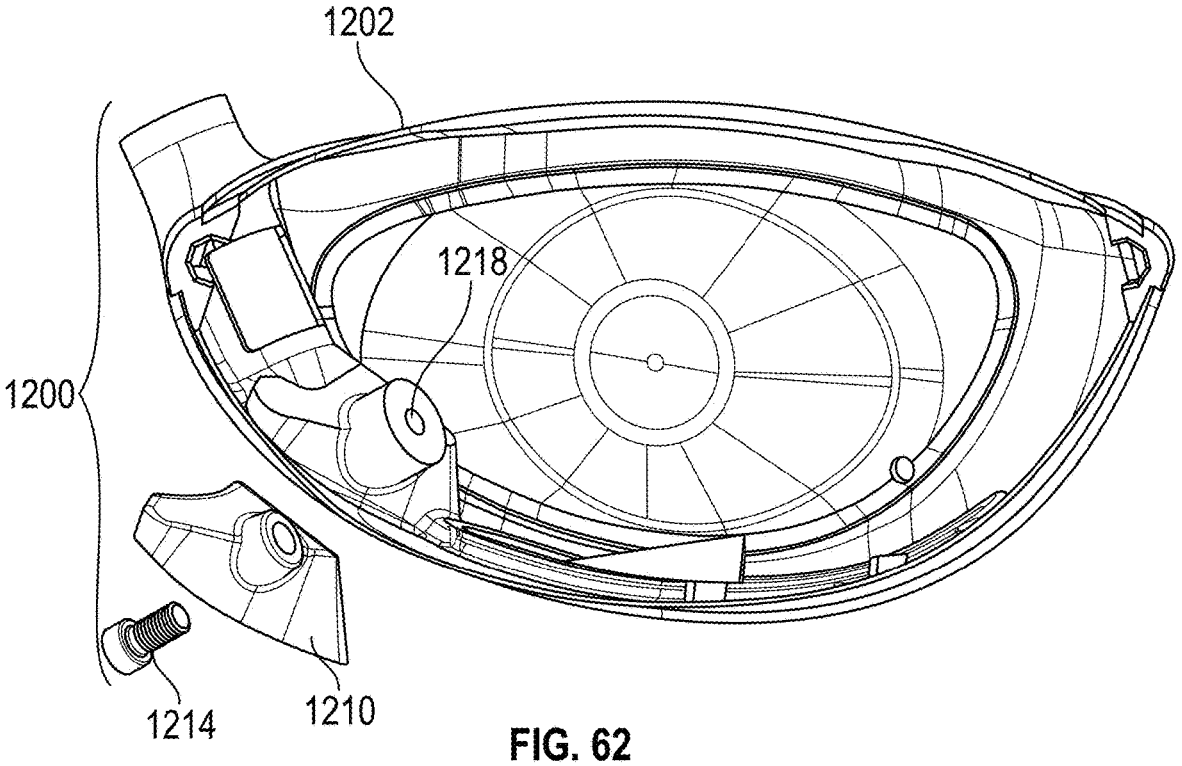

FIGS. 59 and 60 show exploded views of an exemplary club head 1100 that includes weight members that are secured to the interior of the club head with discrete screws. The club head 1100 comprises a front cast cup 1102, rear ring 1104, crown insert 1106, sole insert 1108, a front weight 1110 secured with front screw 114, and a rear weight 1112 secured with rear screw 1116. The cup and ring can be mostly similar to other embodiments disclosed here, attaching together via engagement of members at the toe and head sides to form a rigid club head body that receives the crown and sole inserts. The cup 1102 can further include an opening 1118 in the sole near the hosel that allows insertion of the front screw 1114 from the exterior to the weight member 1110, and the ring 1104 can further comprise an opening 1120 at the bottom rear that allows insertion of the rear screw 1116 from the exterior to the rear weight member 1112. The front and rear weight members can include threaded openings that receive the screws to secure the weights against the interior surfaces of the club head. Since the weights are located inside the club head, they can be permanently attached and/or inaccessible by the user. In some embodiments, the weights can be also adhesively secured to the interior surfaces of the club head. The rear ring 1104 can include a specifically shaped recess to receive the rear weight inside the body at a very low and rear location. The weights 1110 and 1112 can focus the mass the club head further towards the front and rear ends of the club head, and closer toward the bottom of the club head. In embodiments where the ring comprises a less dense material, such as aluminum, it can be more useful to reply on a larger, denser rear weight compared to a thickened region or mass pad in the ring. More than the two shown weight members and screws can be included in alternative embodiments of the club head 1000, such as three, four, or more. Additional weight members can be located anywhere on the club head, such as at the toe side of the sole.

Figure 63:
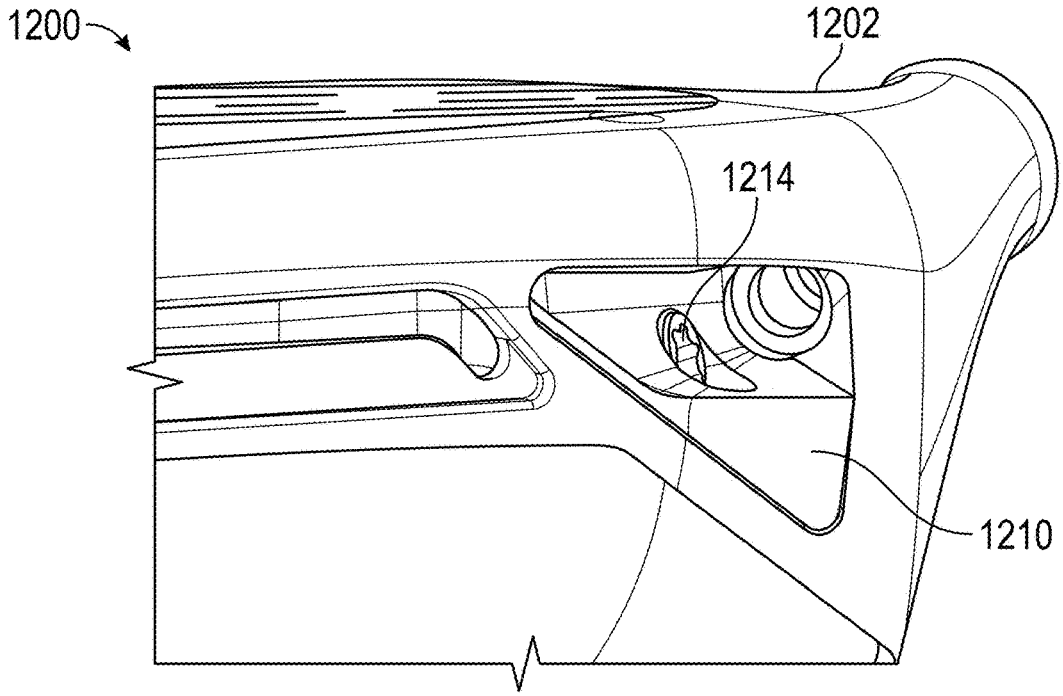
FIGS. 63 and 64 show the weight of FIG. 61 secured to the sole with the fastener.
Figure 64:
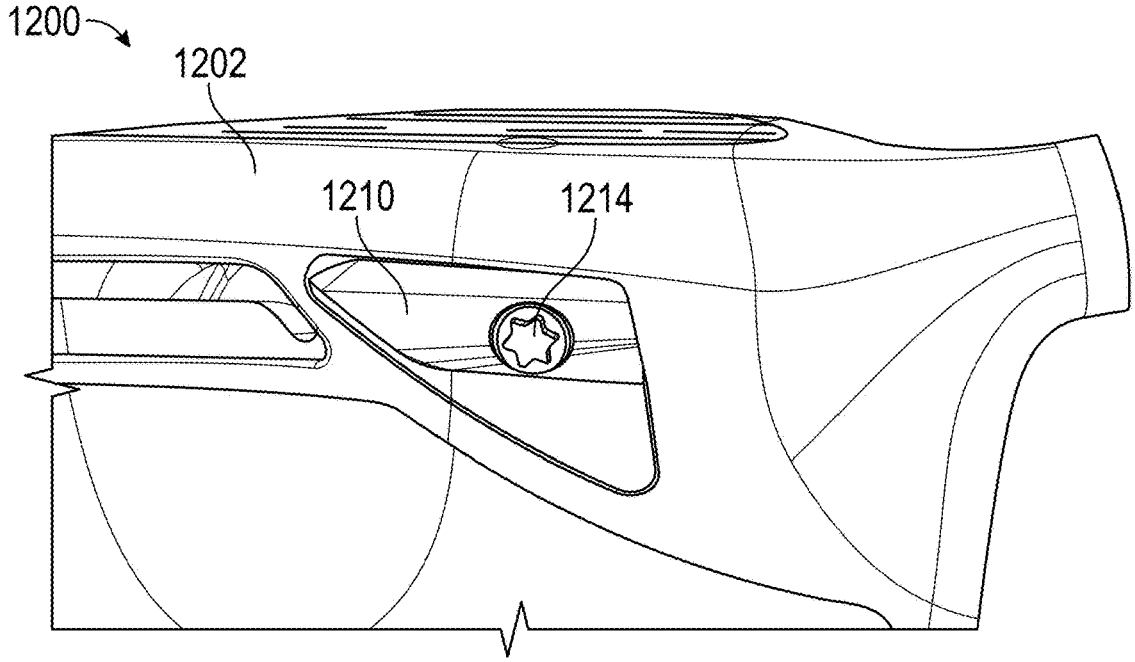
Figure 65:
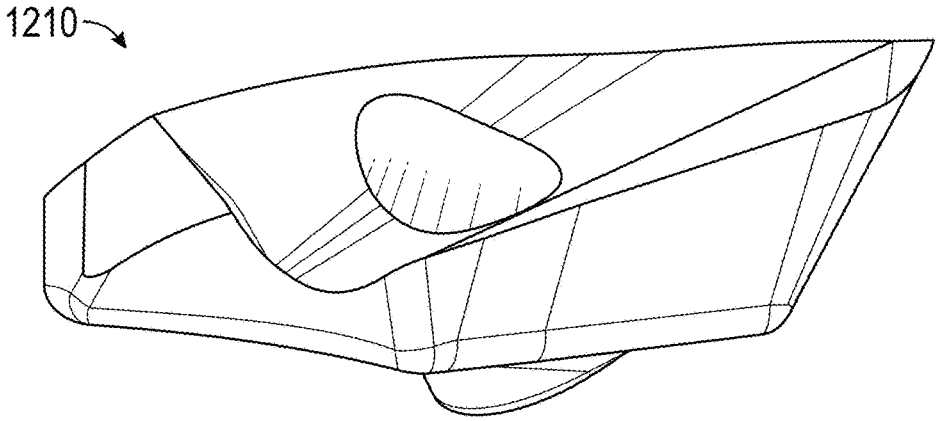
FIGS. 65-67 show various views of the weight of FIG. 61.
Figure 66:
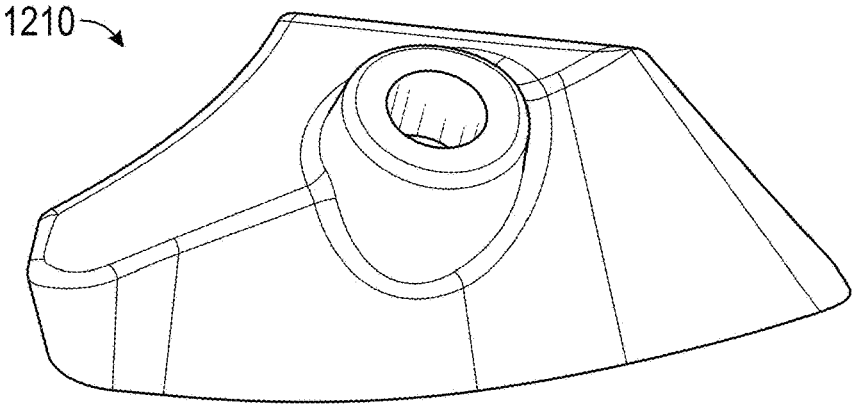
Figure 67:
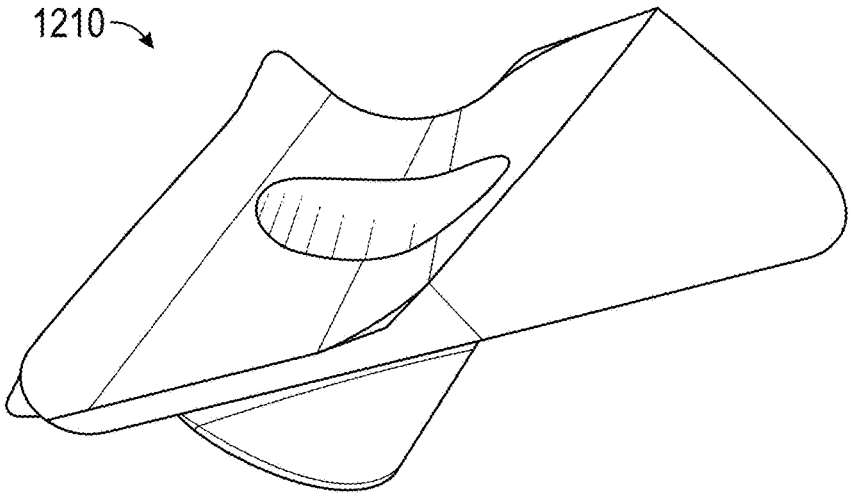
Figure 68:
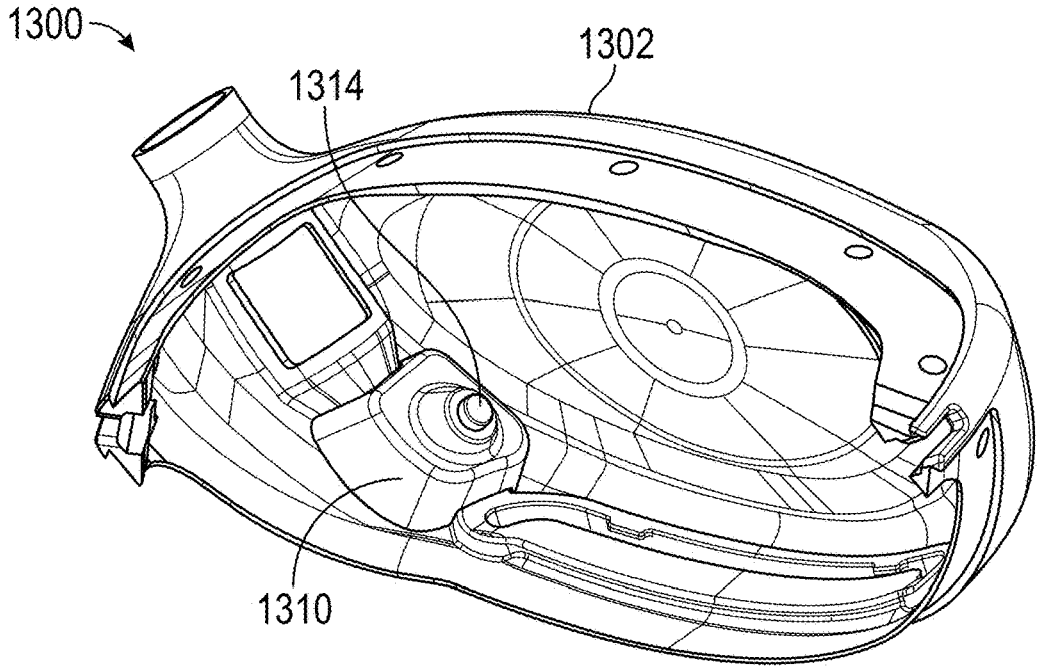
FIG. 68 shows another exemplary weight and fastener secured to the forward inner surface of a club head adjacent the hosel.
Figure 69:
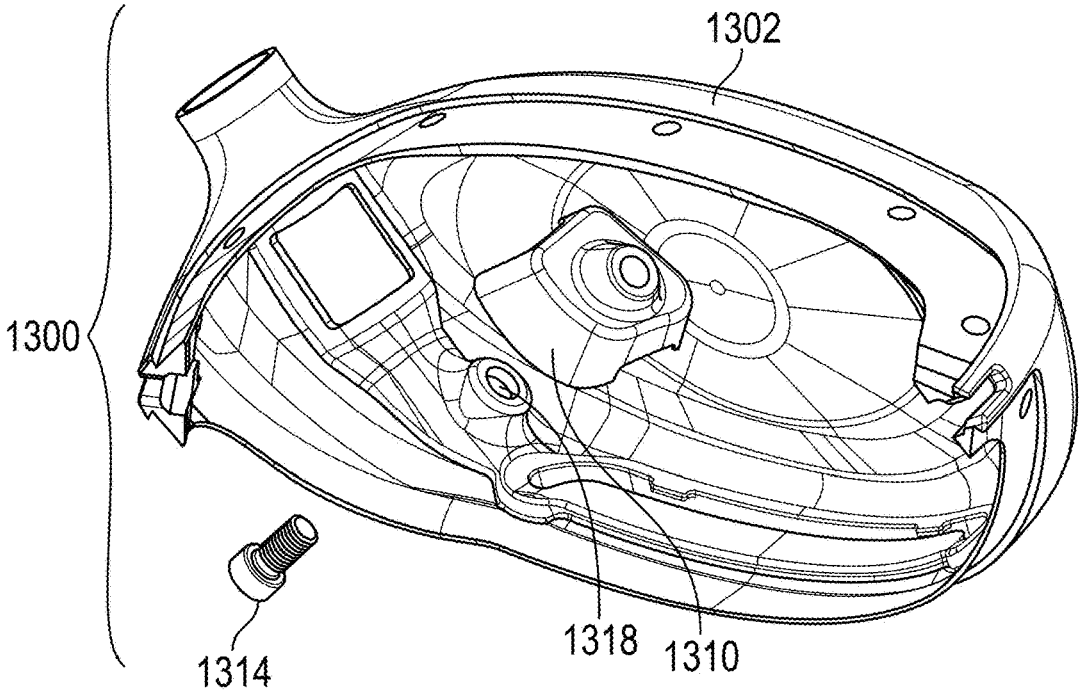
FIG. 69 is an exploded view of FIG. 68.

FIGS. 61-67 illustrate another exemplary club head 1200 where a weight is mounted on the exterior of the sole adjacent the hosel. The club head 1200 comprises a front cup 1202 and an exterior weight 1210 secured to the sole with a screw 1214 that passes through a hole in the weight and into a threaded opening 1218 in the sole. The sole can include a recessed area that receives the weight 1210 so that the lower surface of the weight is somewhat flush with the lower surface of the sole. Such a recess in the sole can double as recess that also allows access to the hosel screw that secures the shaft to the club head, as shown in FIG. 63. The sole recess can be just to the heel side of a sole channel located in the front center of the sole, as described with other embodiments herein. Being accessible from the outside, the weight 1210 can be removed and replaced by a user as desired, and can be swapped out for alternative weights having different masses, different materials, different appearances, and/or other differences.

Figure 70:
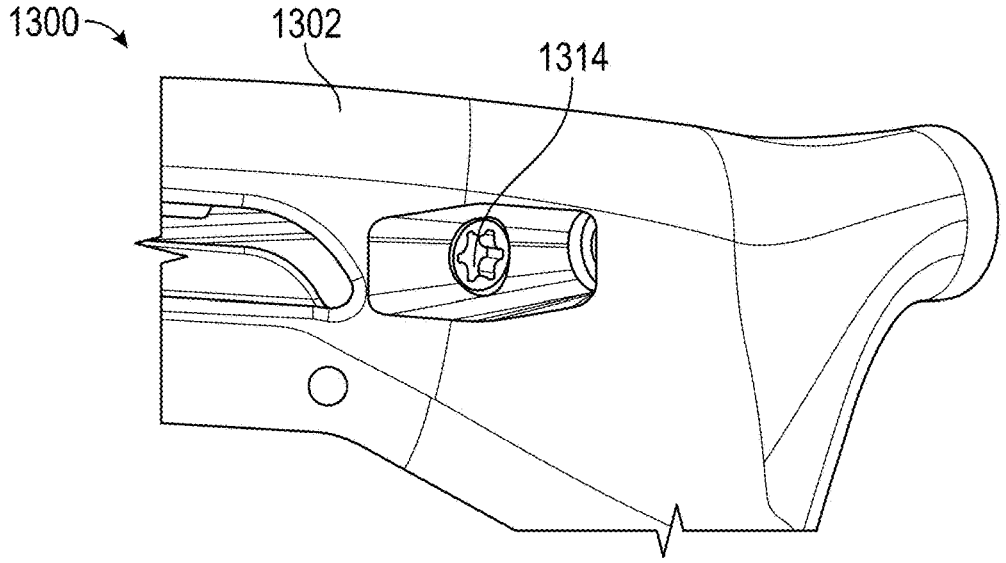
FIG. 70 is an exterior view of FIG. 70 showing the head of the fastener.
Figure 71:
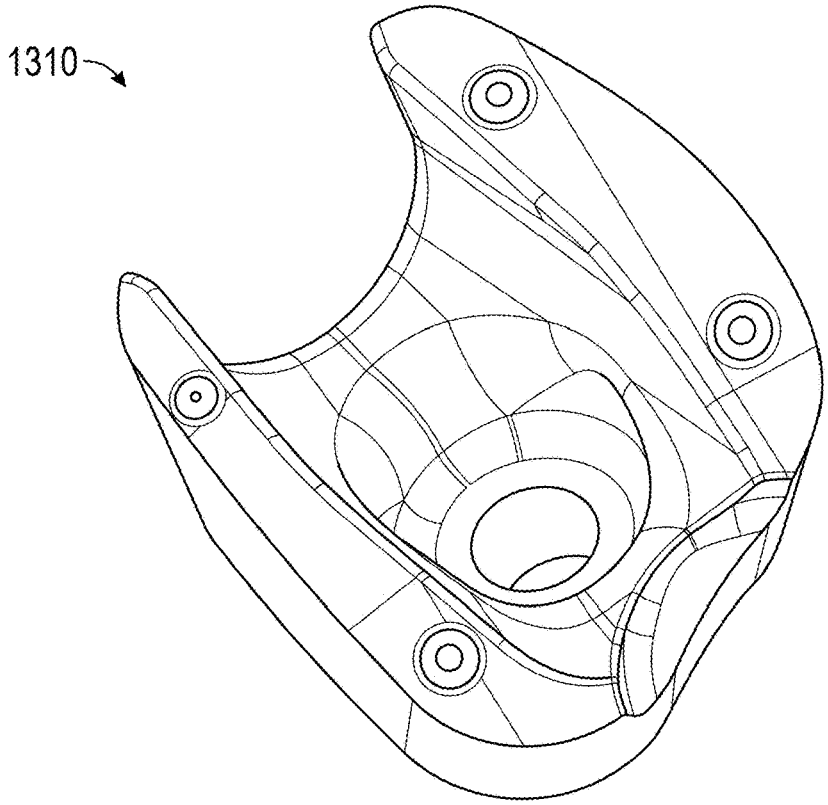
FIGS. 71-74 show various views of the weight of FIG. 68.
Figure 72:
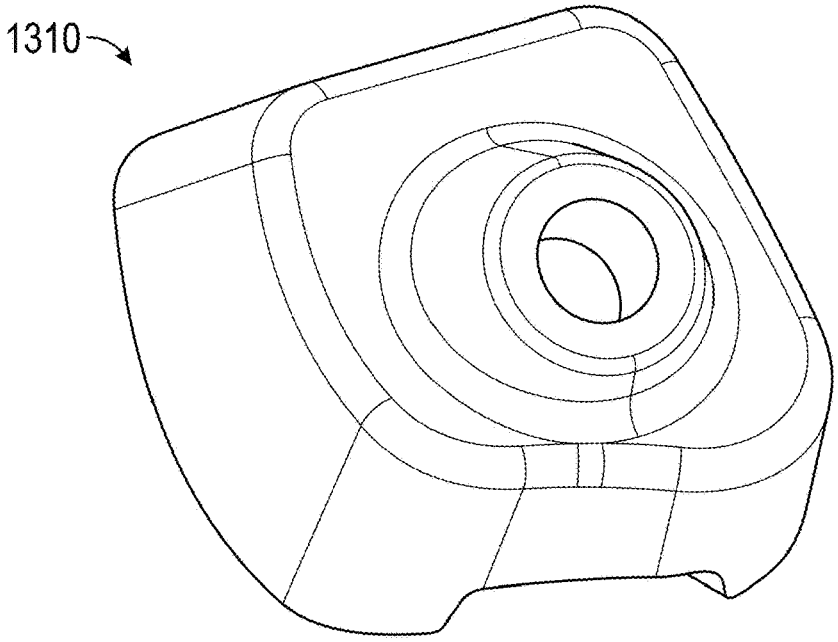
Figure 73:
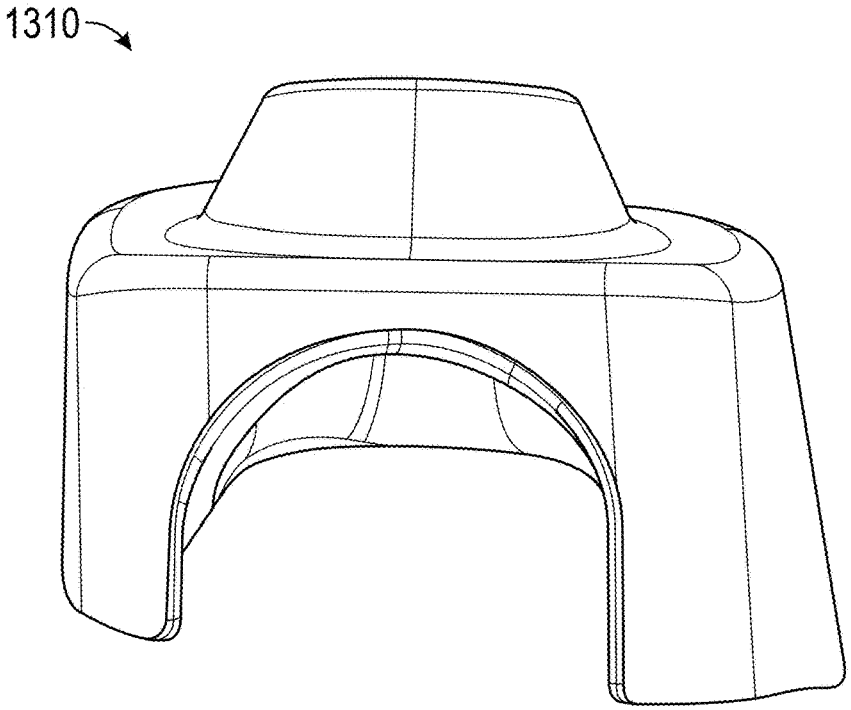
Figure 74:
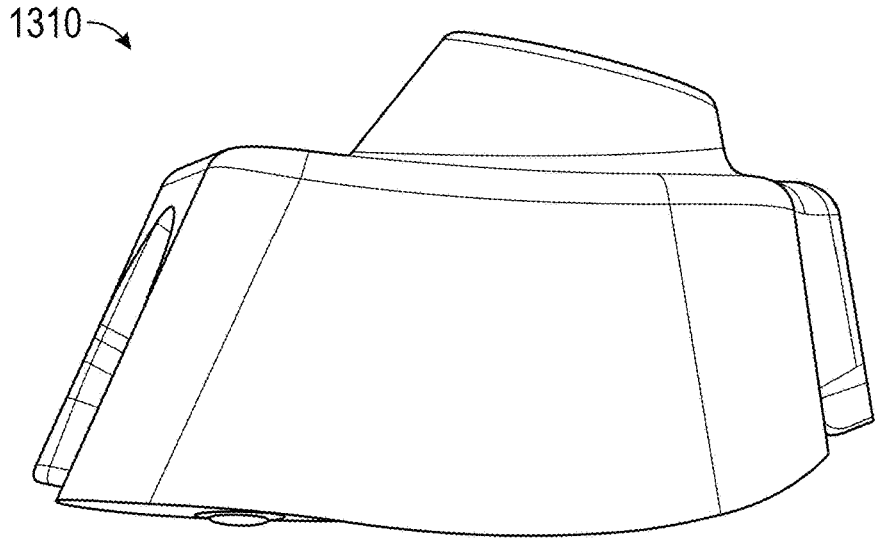

FIGS. 68-74 illustrate another exemplary club head 1300 where a weight is mounted on the interior of the sole adjacent the hosel. The club head 1300 comprises a front cup 1302 and an interior weight 1310 secured to the inside of the sole with a screw 1314 that passes through a hole 1318 in the sole and into a threaded opening in the weight. The head of the screw 1314 can be positioned in a recess that also allows access to the hosel screw that secures the shaft to the club head, as shown in FIG. 70. The interior weight can be positioned between a sole channel and the hosel, just behind the face, giving it a desirable forward and heelward location. Being located inside the club head, the weight 1310 can be permanently attached and/or inaccessible by the user. In some embodiments, the weight can be also welded, brazed, or adhesively secured to the interior surface of the club head.

Figure 75:
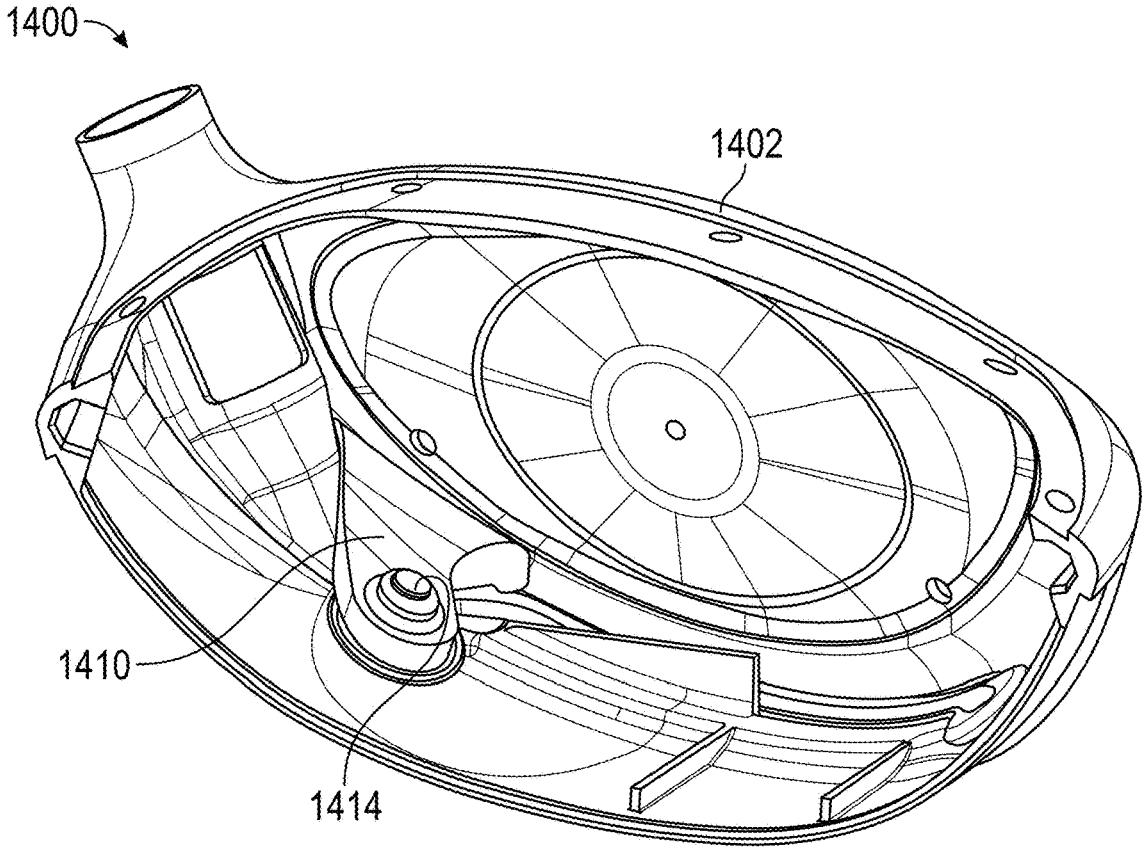
FIG. 75 shows another exemplary weight and fastener secured to the forward inner surface of a club head adjacent the hosel.
Figure 76:
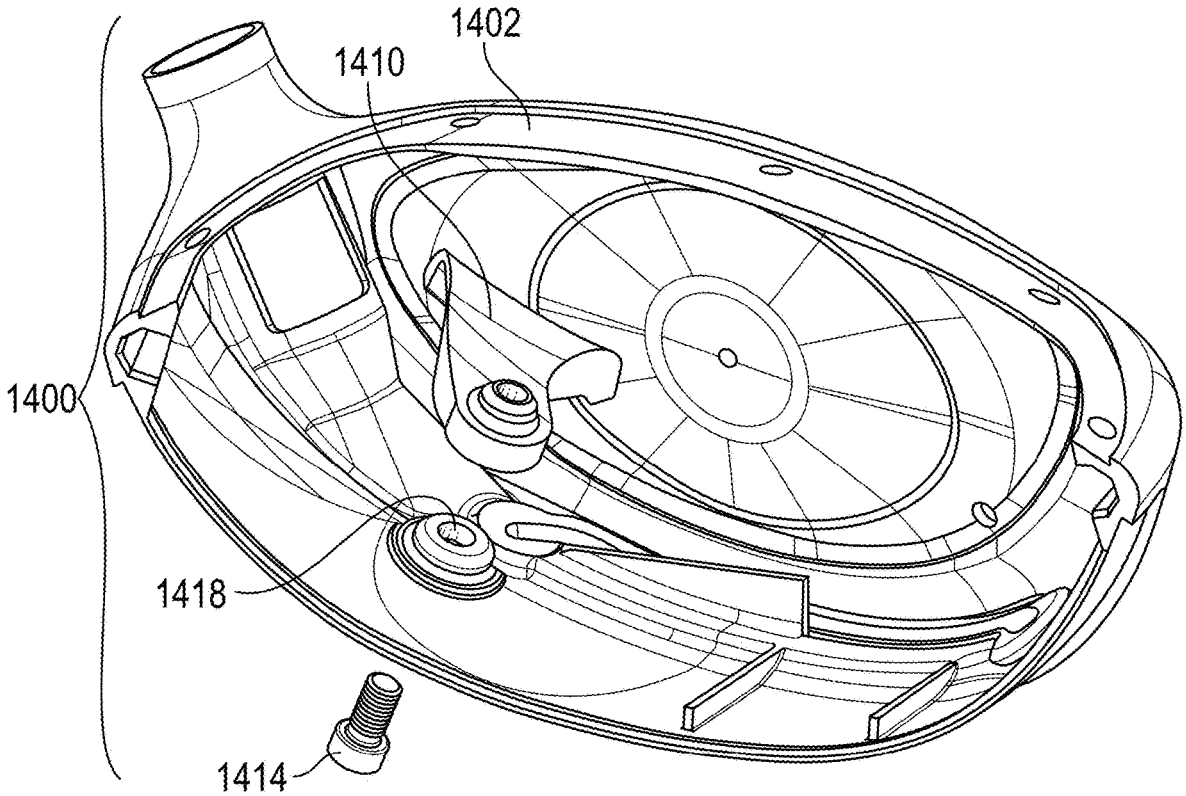
FIG. 76 is an exploded view of FIG. 75.
Figure 77:
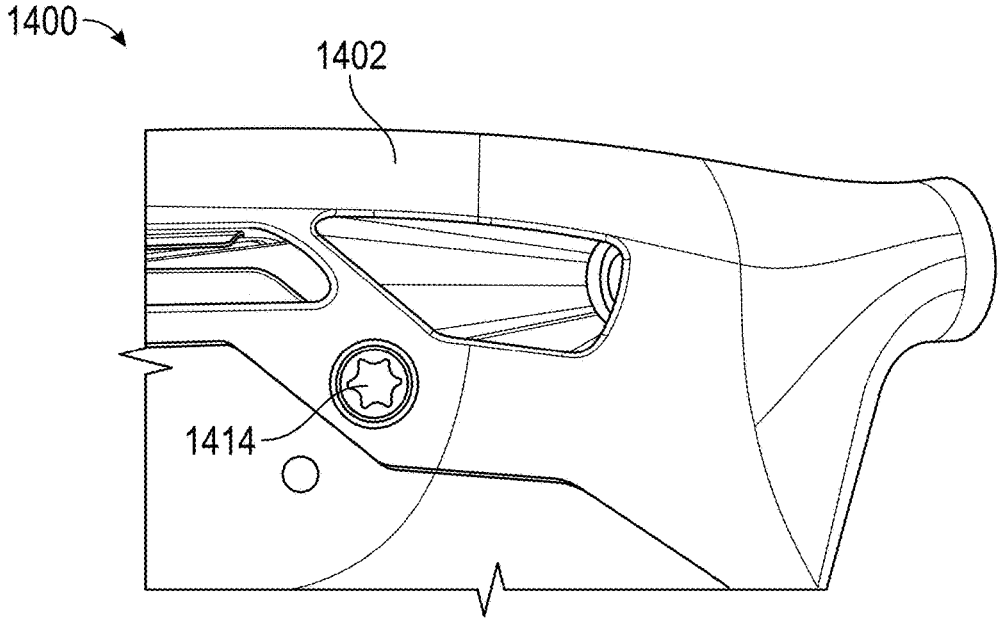
FIG. 77 is an exterior view of FIG. 75 showing the head of the fastener.
Figure 78:
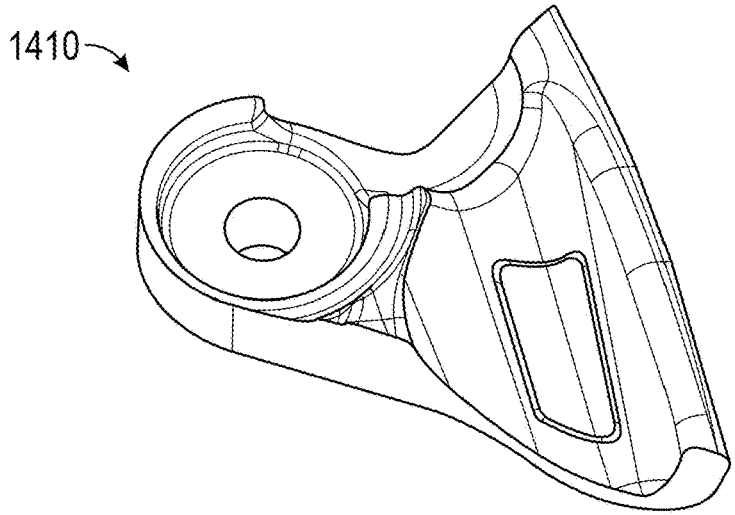
FIGS. 78-82 show various views of the weight of FIG. 75.
Figure 79:
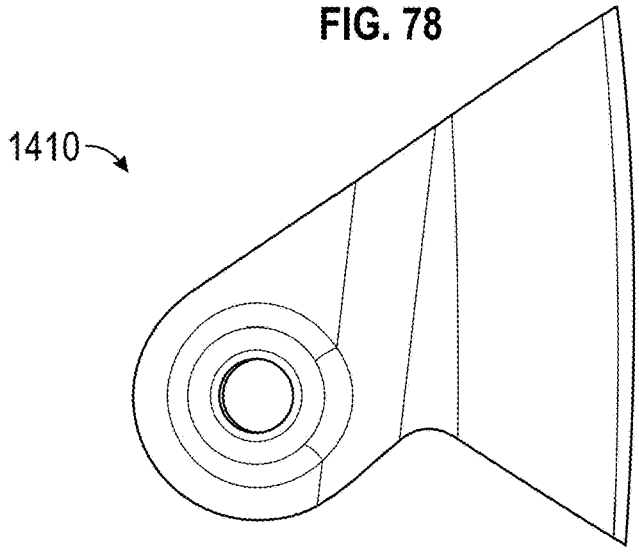
Figure 80:
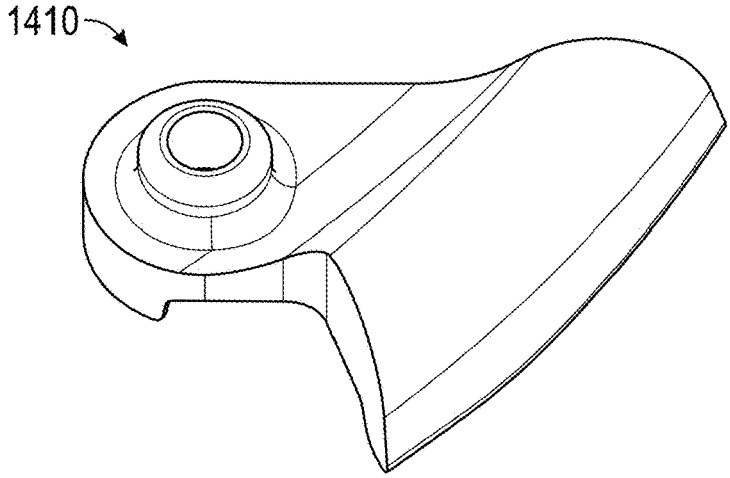
Figure 81:
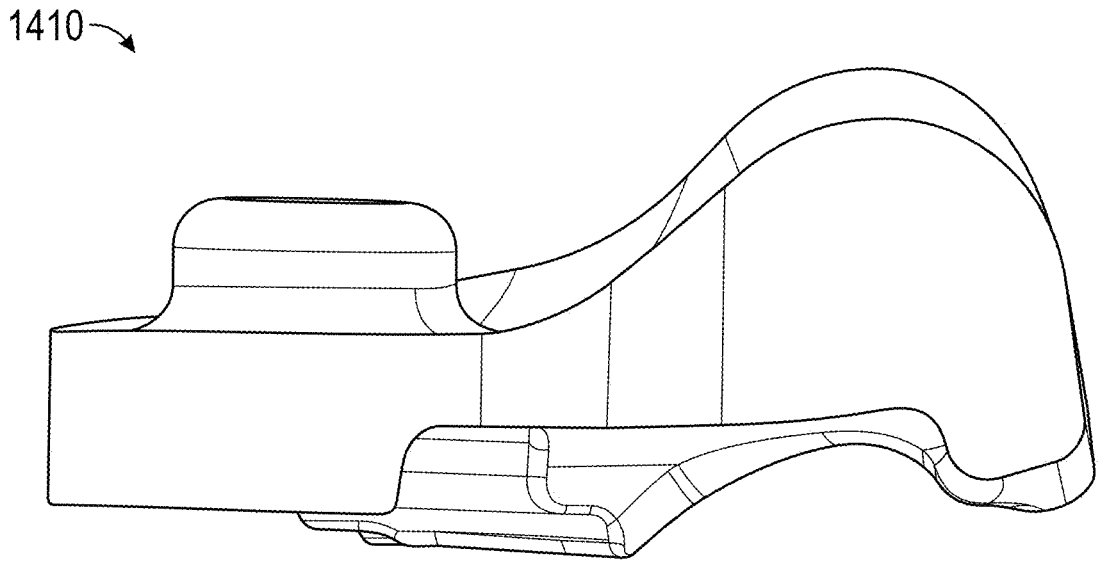
Figure 82:
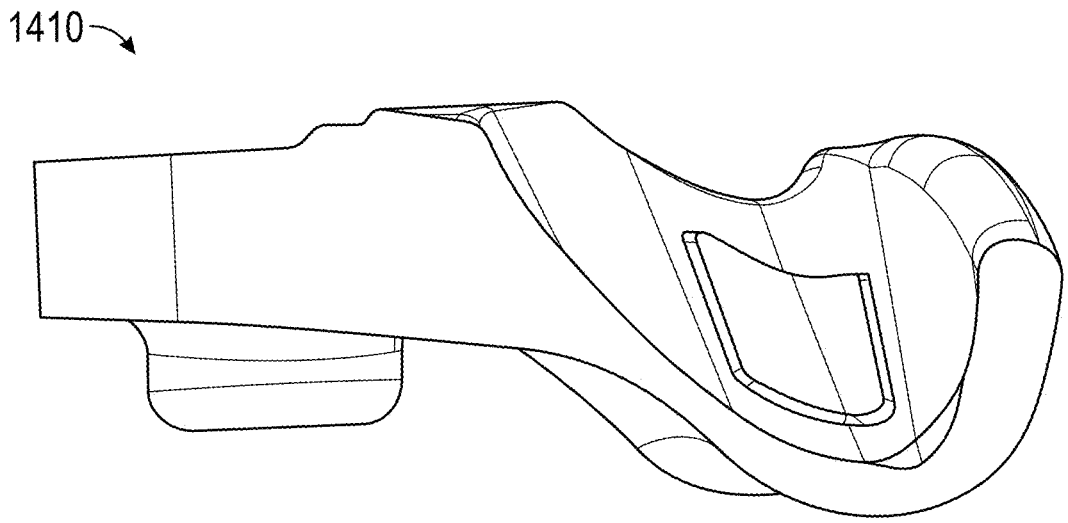

FIGS. 75-82 illustrate another exemplary club head 1400 where a weight is mounted on the interior of the sole adjacent the hosel. The club head 1400 comprises a front cup 1402 and an interior weight 1410 secured to the inside of the sole with a screw 1414 that passes through a hole 1418 in the sole and into a threaded opening in the weight. The head of the screw 1414 can be positioned adjacent to a recess that allows access to the hosel screw that secures the shaft to the club head, as shown in FIG. 77, a position that is slightly more rearward than that of the club head 1400. The interior weight can extend between the sole channel and the hosel to just behind the face, as shown in FIG. 75, giving it a desirable forward and heelward location. Being located inside the club head, the weight 1410 can be permanently attached and/or inaccessible by the user. In some embodiments, the weight can be also welded or adhesively secured to the interior surface of the club head.

Figure 83:
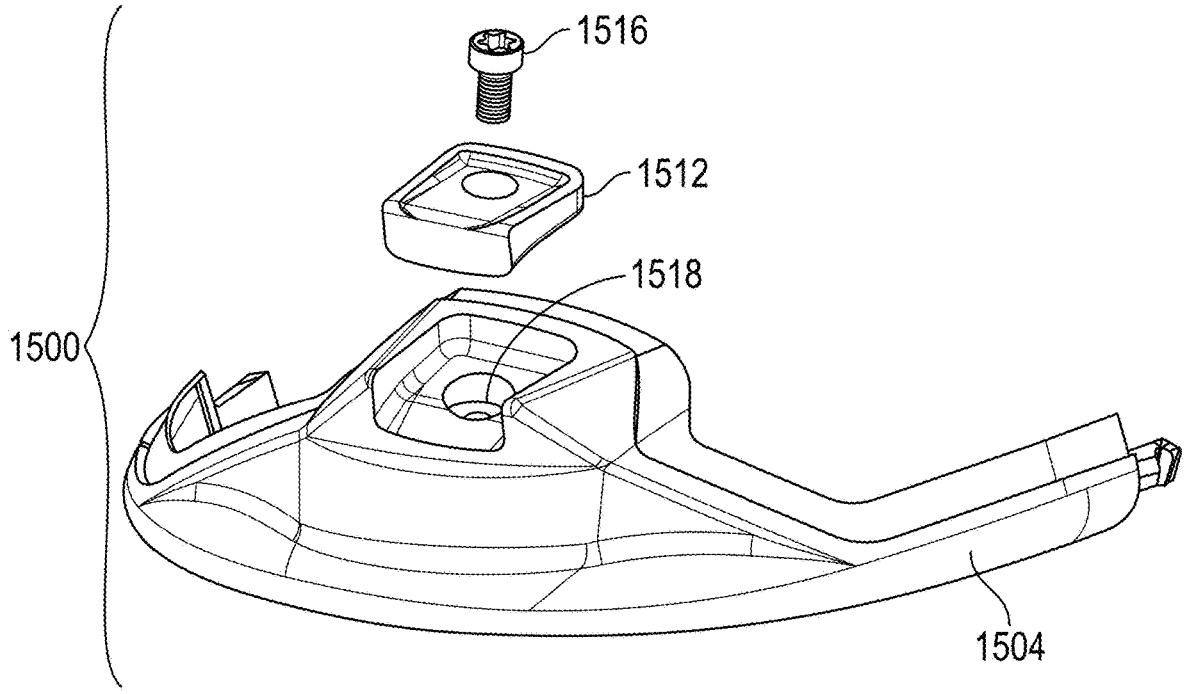
FIG. 83 shows an exemplary rear ring configured to receive a weight secured to a lower surface of the ring.

FIG. 83 shows is an exploded view of a rear assembly 1500 including a rear ring 1504, a rear weight 1512, and a screw 1516 that secures the weight to the ring. The screw passes through an opening in the weight and engages a threaded opening 1518 in the ring. In this embodiment, the rear weight is positioned in a recess at the bottom rear center of the ring, with the screw extending mostly vertical up into the ring. In this configuration, the weight 1512 is has very low position and also a rearward position. The weight is also mounted on the exterior of the club head such that it can be readily removed and replaced with other weights by the user as desired.

Figure 84:
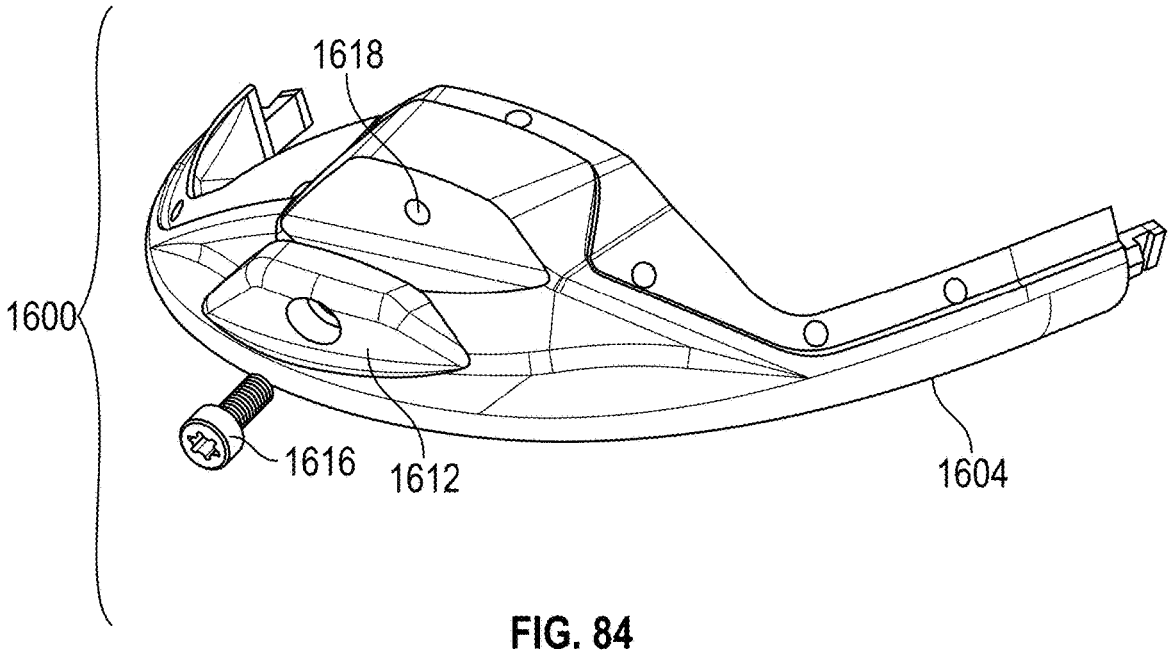
FIG. 84 shows an exemplary rear ring configured to receive a weight secured to a rear surface of the ring.

FIG. 84 shows is an exploded view of another rear assembly 1600 including a rear ring 1604, a rear weight 1612, and a screw 1616 that secures the weight to the ring. The screw passes through an opening in the weight and engages a threaded opening 1618 in the ring. In this embodiment, the rear weight is positioned against a rear surface at the low rear center of the ring, with the screw extending mostly horizontally into the ring from the rear. In this configuration, the weight 1612 has as very rearward position and also a low position. The weight is also mounted on the exterior of the club head such that it can be readily removed and replaced with other weights by the user as desired.

Figure 85:
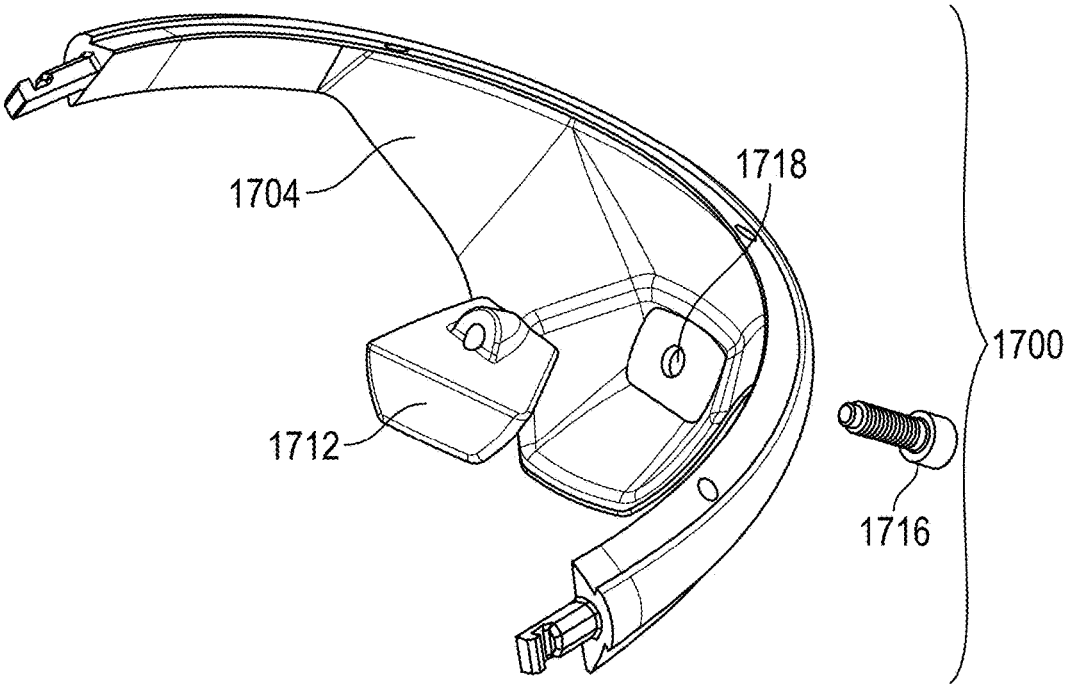
FIG. 85 shows an exemplary rear ring configured to receive a weight secured to an internal surface of the ring.
Figure 86:
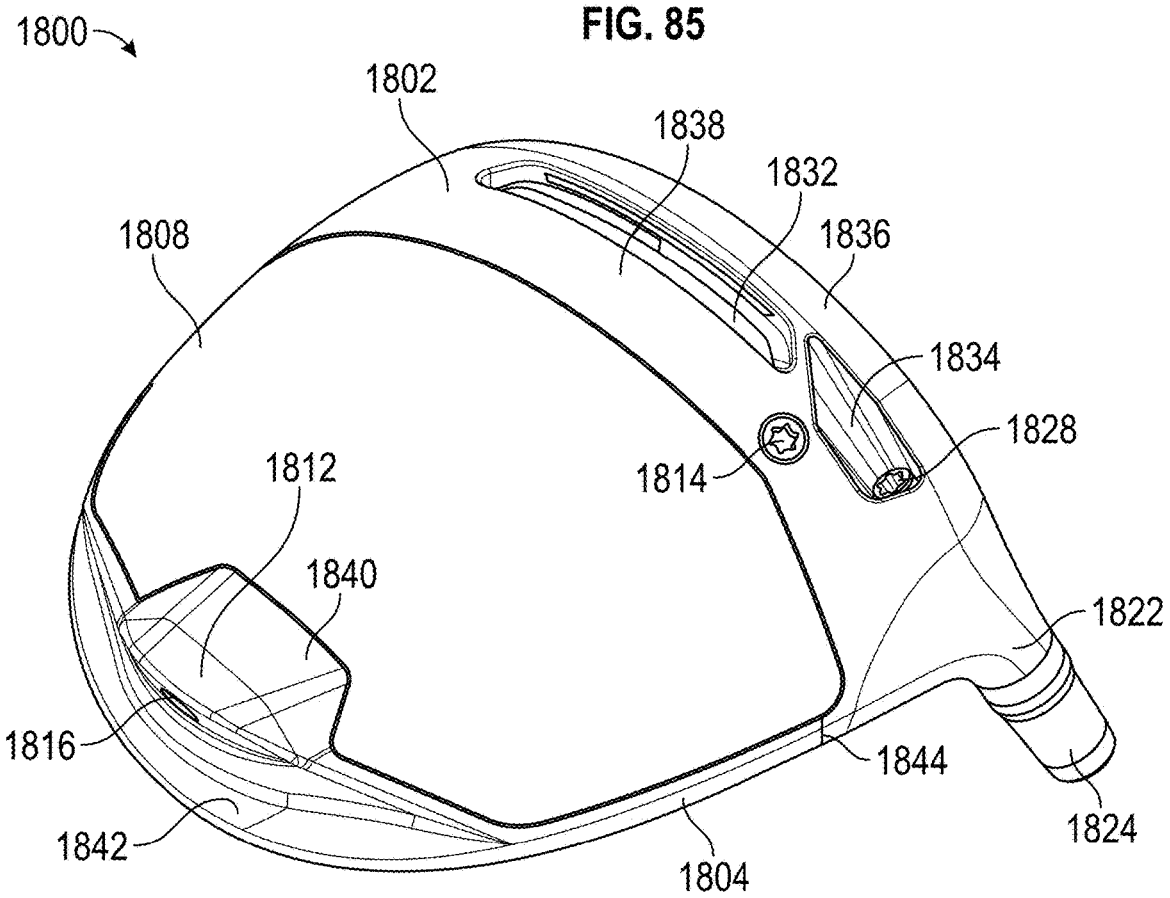
FIG. 86 is a bottom view of another exemplary golf club head.

FIG. 85 shows is an exploded view of another rear assembly 1700 including a rear ring 1704, a rear weight 1712, and a screw 1716 that secures the weight to the ring. In this embodiment, the rear weight 1712 is positioned along an interior surface of the lower rear center of the ring 1704. The screw extends from the exterior through an opening 1718 in the rear ring and engages a threaded opening in the weight. In this configuration, the weight 1712 has a rearward position and also a low position. The weight is mounted on the interior of the club head such that it cannot be readily accessed by the user, and can also be permanently secured such as via welding or adhesive.

FIGS. 86-99 illustrate another exemplary club head 1800 that includes cast cup and rear ring architecture along with front and rear weights. The club head 1800 comprises a front cast cup 1802, rear ring 1804, crown insert 1806, sole insert 1808, front weight 1810, and rear weight 1812. The front weight 1810 is positioned inside the body and secured with a screw 1814 passing through an opening 1864 in the sole, in a configuration similar to that shown with club head 1400. The rear weight 1812 is positioned against a rear exterior surface of the ring 1804 and secured with a screw 1816 that passes through the weight and engages a threaded opening 1817 in the rear of the ring 1804, in a configuration similar to that shown with rear assembly 1600 in FIG. 84.

The club head 1800 also comprises an adjustable head-shaft connection assembly including elements 1824 and 1826 secured in hosel 1822 via a screw 1828 that is inserted via a sole recess 1834 below the hosel. The cup 1802 includes a front striking face 1852, a front sole portion 1836, a rear sole portion 1838, and a sole channel 1832 positioned between the front and rear sole portions of the cup and toward of the sole recess 1834. At the top, the cup 1802 include a forward crown portion 1848.

Figure 89:
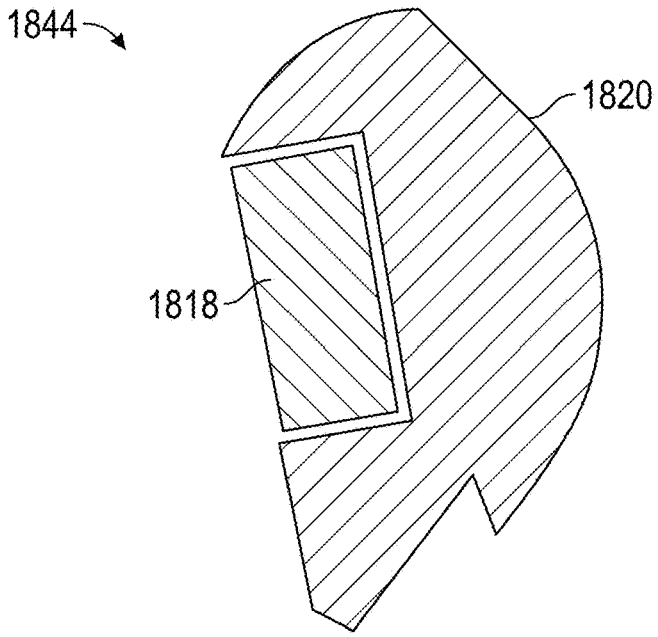
FIG. 89 is a cross-sectional view of a joint between a front cup portion of the body and rear ring of the body.
Figure 90:
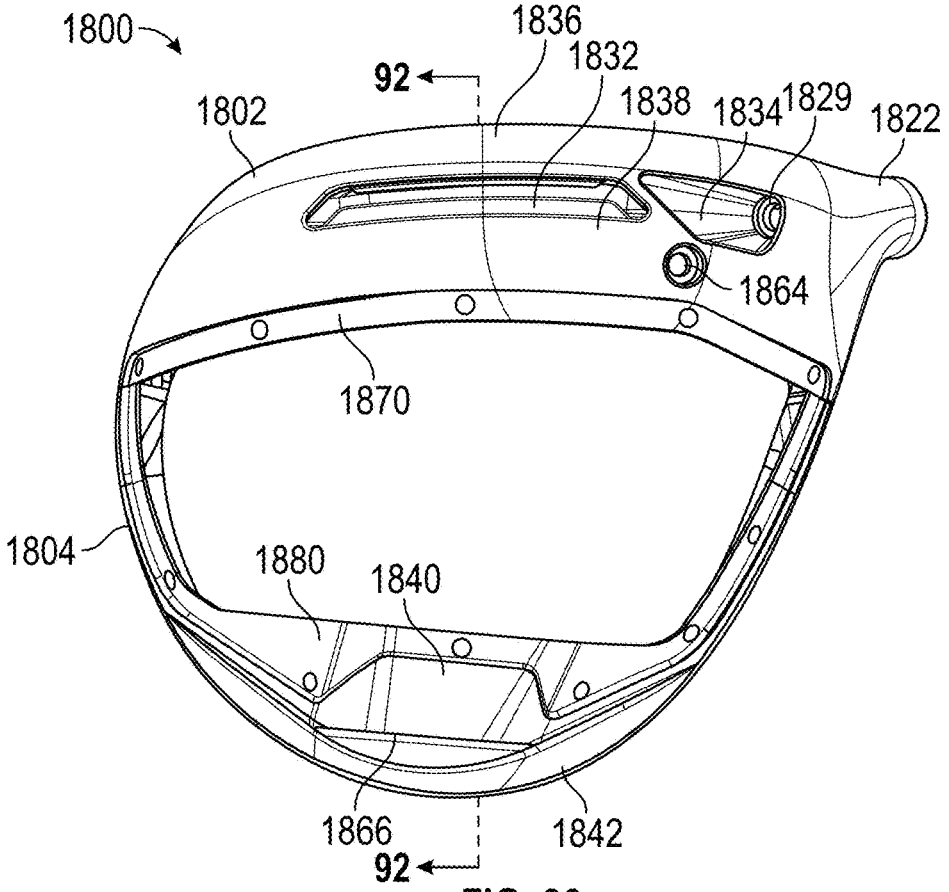
FIG. 90 is a bottom view of the body of FIG. 86.
Figure 91:
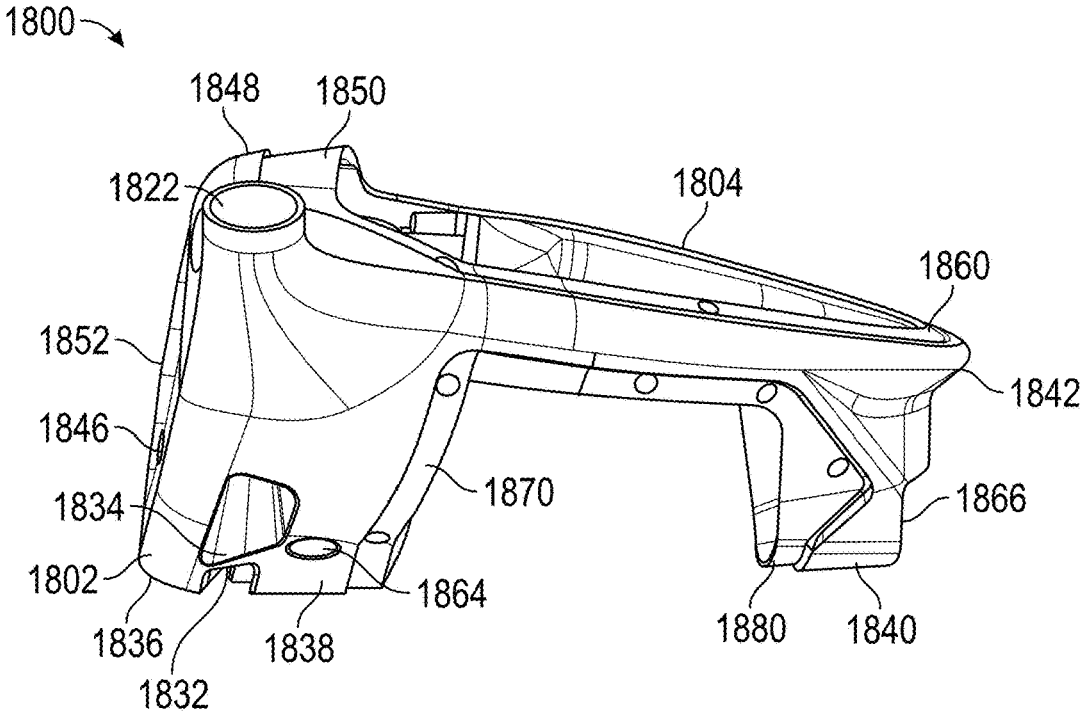
FIG. 91 is a heel side view of the body of FIG. 86.
Figure 92:
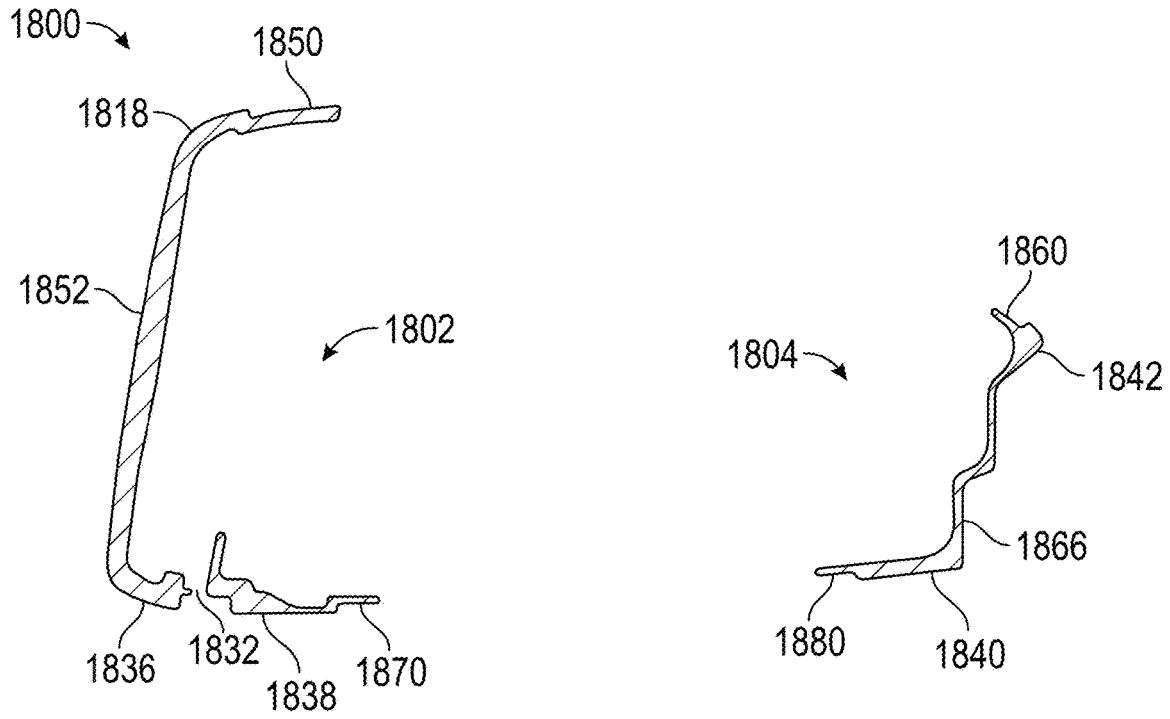
FIG. 92 is a cross-sectional view of the body of FIG. 86 taken along a vertical front-rear plane.
Figure 93:
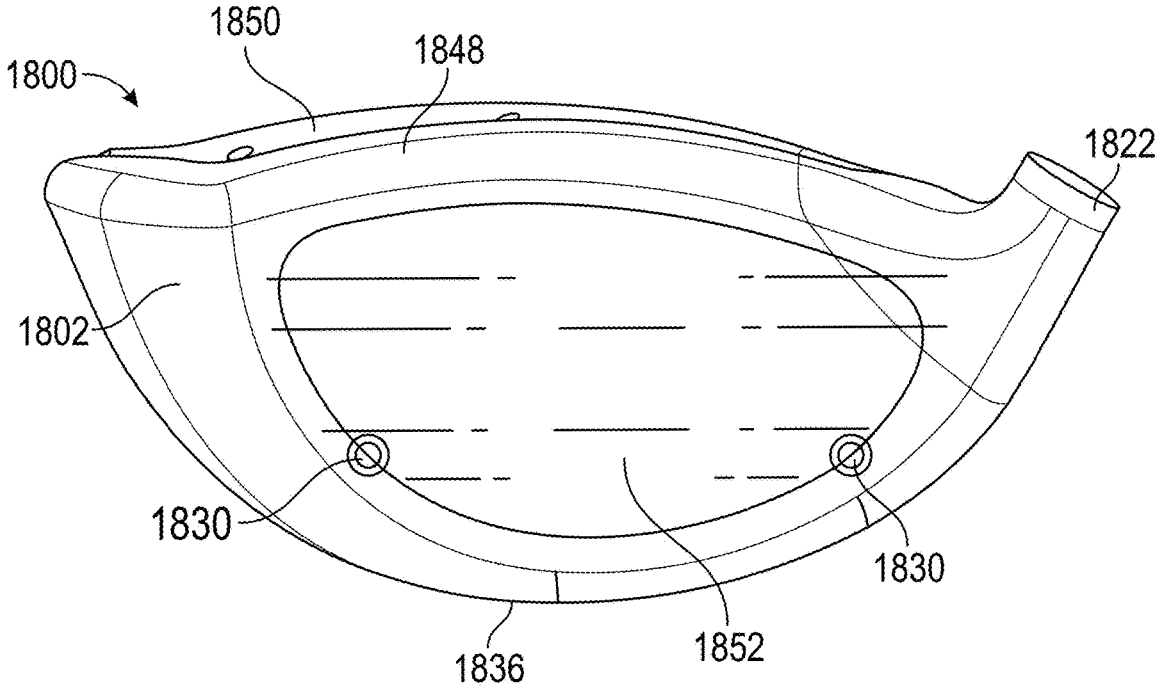
FIG. 93 is a front view of the body of FIG. 86.

The cup 1802 also includes ring engagement portions 1820 that project rearwardly from the toe and from the heel for coupling to the rear ring 1804. The rear ring includes cup engagement portions 1818 at the front ends of the heel and toe sides of the ring, and together the cup engagement portions and the ring engagement portions form joints 1844 at the toe side and heel side of the club head. The joints can be secured in various manners, include with welds, adhesives, mechanical interlocking features, frictions fits, fasteners, and/or other means. In some embodiments, the two cup engagement portions of the ring can be elastically compressed or squeeze toward each other to engage with the ring engagement portions of the cup, and then released such that they resiliently expand apart to form an interlocking or friction based joint. FIG. 89 shows an exemplary cross-sectional profile of one of the joints 1844 with the cup engagement portion 1818 positioned in a recess of the ring engagement portion 1820. This arrangement can also be reversed with the ring engagement portion 1820 being positioned within the cup engagement portion 1818.

In some embodiments, the ring can engage with the cup via a snap-fit or friction fit engagement. In some embodiments, the ring can be detachable from the cup, and reattachable. In some embodiments, different types of rings can be selected to match with a given cup. For example, ring made of steel, titanium, or aluminum can be selected from. Rings can also be selected based on the type of rear weight system they include (e.g., integral mass pad, screw weight, bolt-on weight, etc.).

The top of the cup 1802 can have a recessed lip 1850 and the top of the ring 1804 can have a recessed lip 1860 (e.g., FIG. 88), which combine to form an annular lip that receives the crown insert 1806. Similarly, the bottom of the cup can have a recessed lip 1870 and the bottom of the ring can have a recessed lip 1880 (e.g., FIG. 90), which combine to form an annular lip that receives the sole insert 1808. At the top of the club head, the crown insert 1806 forms a flush surface with the front crown portion 1848 and the rest of the surrounding surfaces of the cup and ring. At the bottom, the sole insert 1808 forms a flush surface with the rear sole portion 1838 of the cup and with a lower rear surface 1840 of the ring. Together with the cup and ring, the crown insert and the sole insert enclose the interior cavity of the club head (except for the sole channel 1832 and other small openings. The crown insert and the sole insert can be formed with a low-density material construction, such as carbon fiber composite construction, that provides mass saving as well as providing sufficient structural integrity, sound characteristics, aesthetics, and/or other desired qualities. Any of the other materials disclosed herein can also be used in the club head 1800. The cup and ring may be comprised of the same material (e.g., the same titanium alloy), or the ring can be comprised of a different material than the cup (e.g., aluminum ring and titanium alloy cup, or two different titanium alloys).

Figure 95:
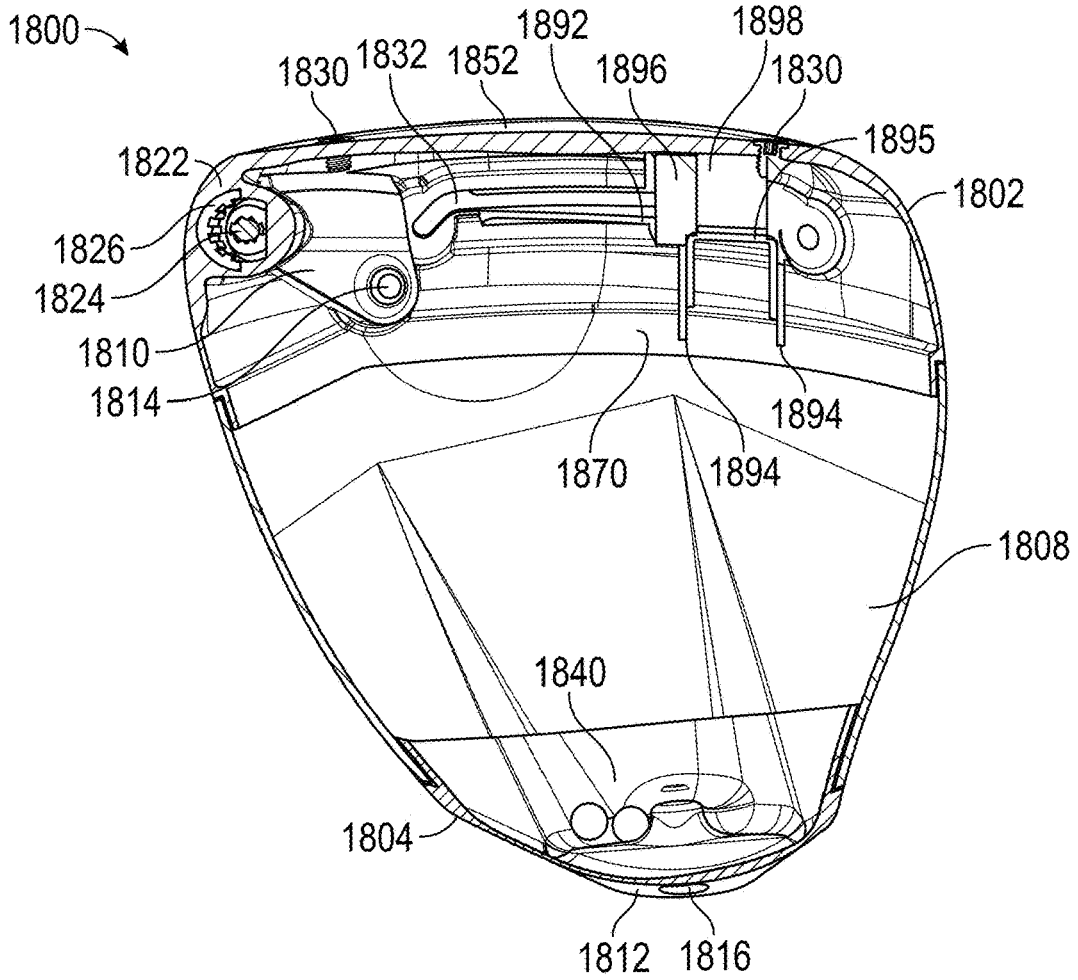
FIG. 95 is a cross-sectional top-down view of a lower half of the club head of FIG. 86.
Figure 96:
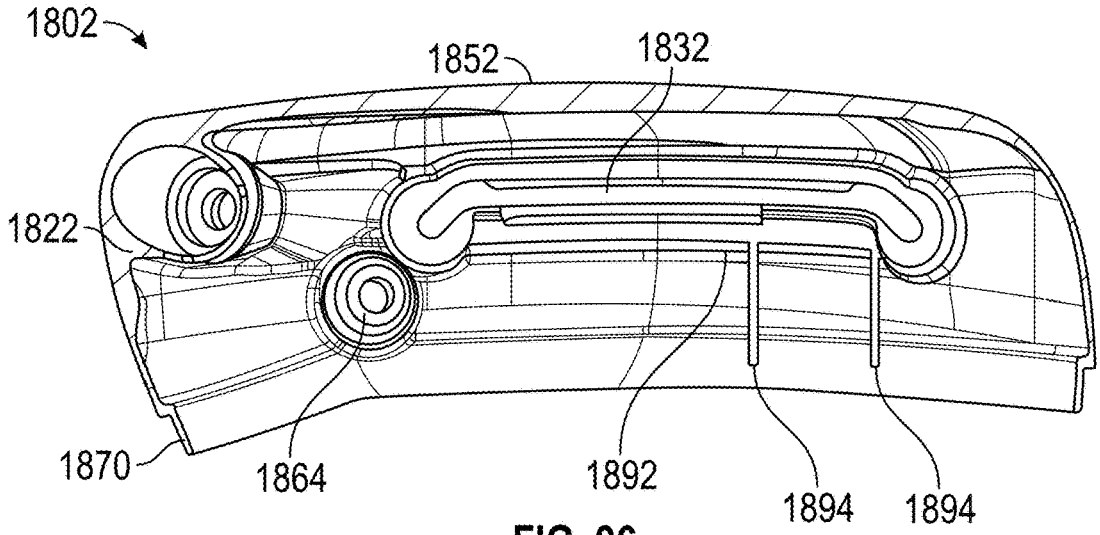
FIG. 96 is a detailed view of a front portion of the interior of the sole of the club head of FIG. 86.

FIG. 95 shows a top-down view of the inside of the club head 1800 with the top half of the club head cut away, illustrating some of the interior features. The front weight 1810 is shown having a contoured shape (see also FIG. 87) that allows it to fit snuggly around the hosel 1822 and the heel end of the channel 1832 and forward up close to the interior side of the face 1852, while a rear portion of the weight is secured to the sole via screw 1814 and/or adhesives/welds. This shape of the front weight helps position the mass of the weight more forward, heelward, and downward, without getting in the way of other adjacent features. In addition, before the forward weight 1810 is secured there is more room to access the rear of the face during manufacturing, which can make it easier to modify the rear of the face (e.g., via machining, etching, etc.) prior to attaching the ring 1804 to the cup 1802.

Figure 87:
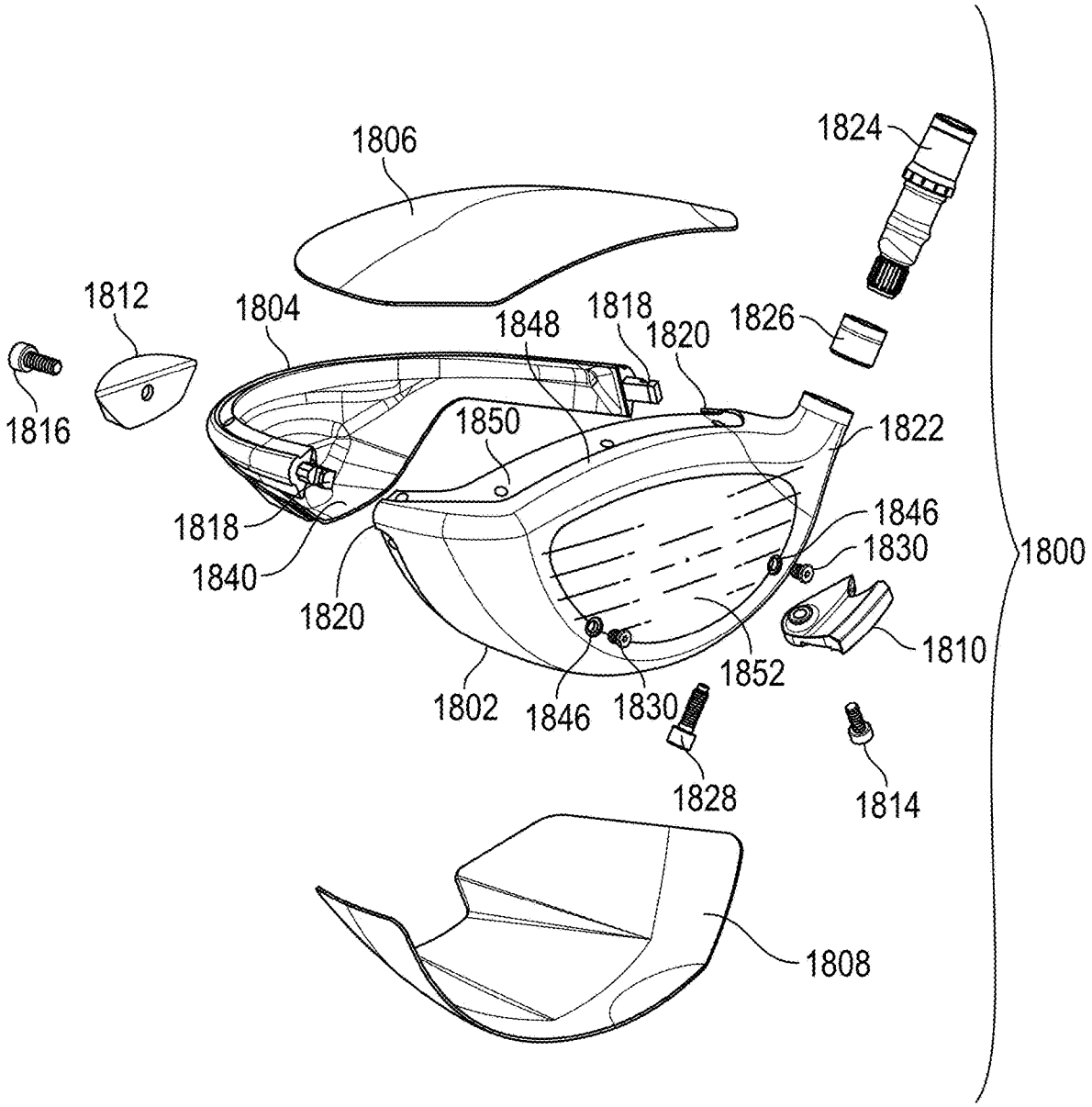
FIG. 87 is an exploded view of the club head of FIG. 86.
Figure 88:
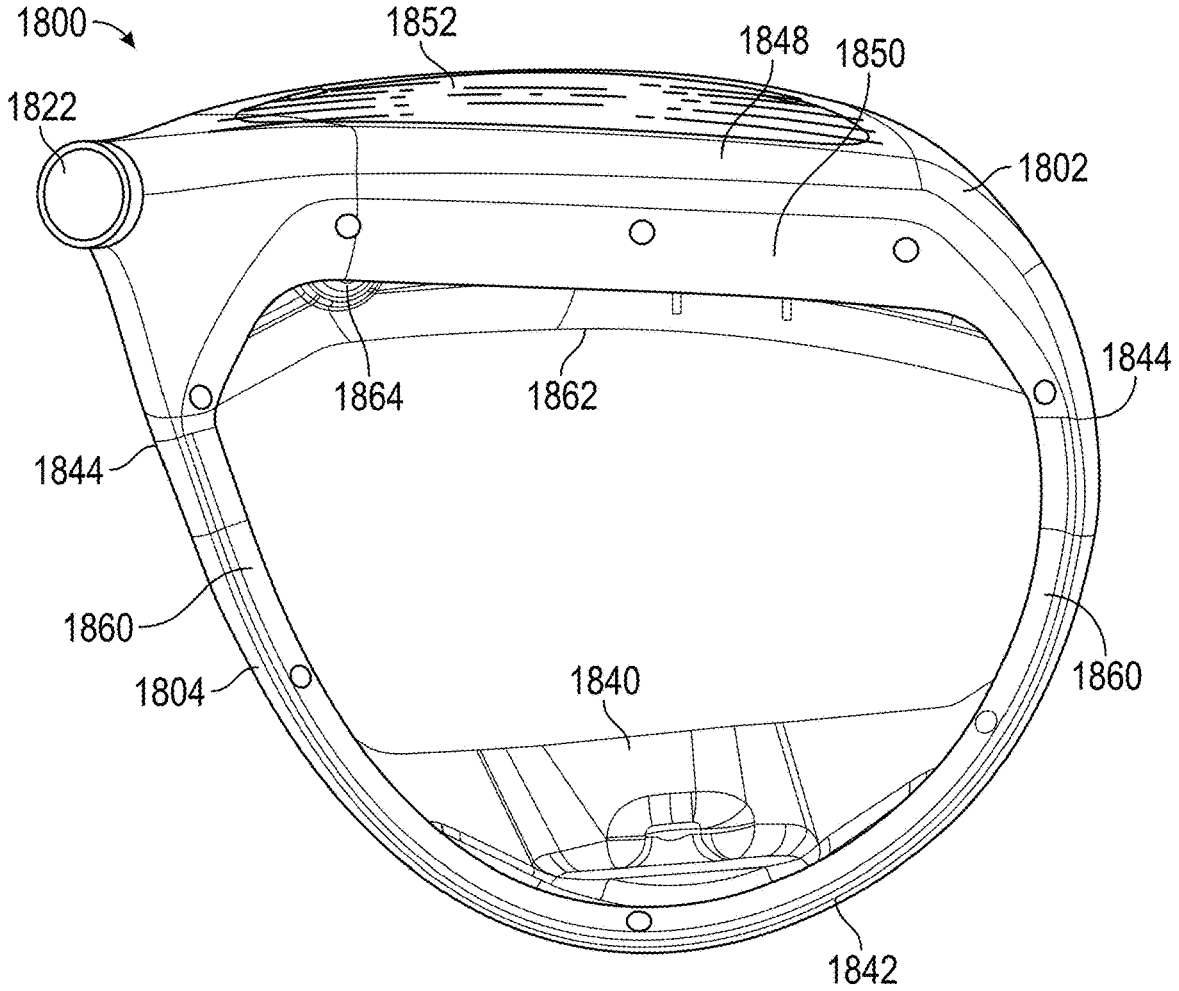
FIG. 88 is top view of the body of the club head of FIG. 86.
Figure 97:
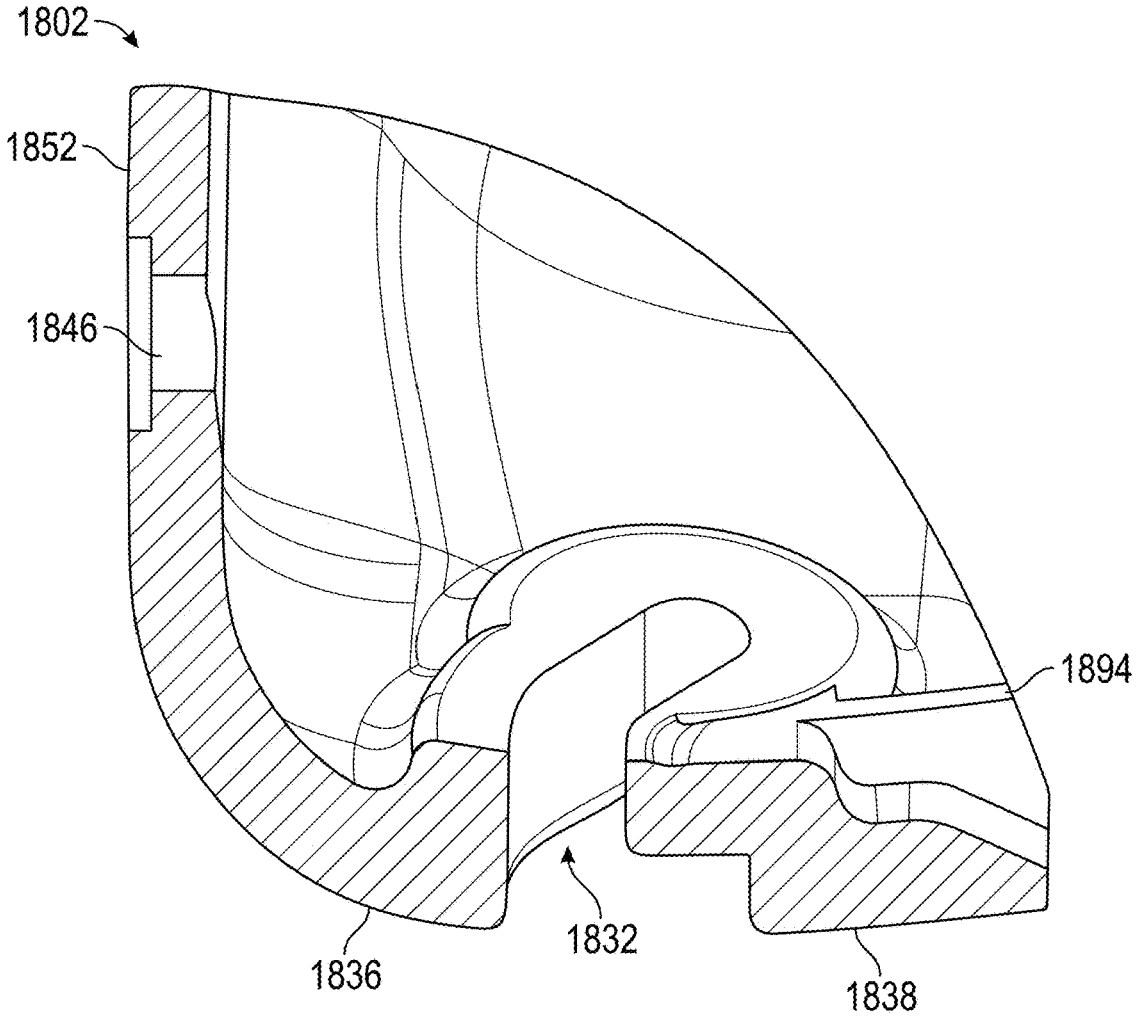
FIG. 97 is a cross-sectional view showing details of the toe side of the interior of the sole.

Also shown in FIG. 95 is a group of features that allow for injection of hot melt adhesive or other material through apertures in the face to adjust ball striking characteristics of the club head. FIG. 87 shown apertures 1846 in the toe and heel sides of the face along with screws 1830 that are securable in the apertures 1846 to close them. FIG. 97 shows a cross-sectional view of the toe side aperture 1846. In FIG. 95, the screws 1830 are shown inserted in the face. Behind the heel side screw 1830 is an area 1898 that can receive an injected material through the aperture 1846, where the injected material can solidify and bond to the adjacent surfaces. This area 1898 can be contained by wall structures such as one or two side walls 1896 and a rear wall 1895 while the material is injected and until the injected material hardens in place. Afterward, one or more of these walls can optionally be removed, leaving the hardened injected material in place behind the face. These walls can comprise metal, polymeric material, foam, etc. These walls can be coupled to other permanent structures of the sole to hold them in place, such as the rib 1892 positioned just behind the channel 1832 and heelward of the area 1898, and the ribs 1894 that extend rearward from the area 1898 (see FIGS. 94-97 for example). Some components can be welded in place, such as the rear wall 1895 can be welded to the ribs 1894, while other parts can be removed. In addition, the channel 1832 can be plugged/filled with a material to keep injected material from falling down through the channel. The injection area 1898 can have any size, such as a depth of about 5 mm behind the face. These structures to contain injected material are sometimes referred to as a "tombstone" structure. Injected material behind the face can help to modify the stiffness, coefficient of restitution, characteristic time, and/or other properties of the face at localized areas as desired.

Figure 94:
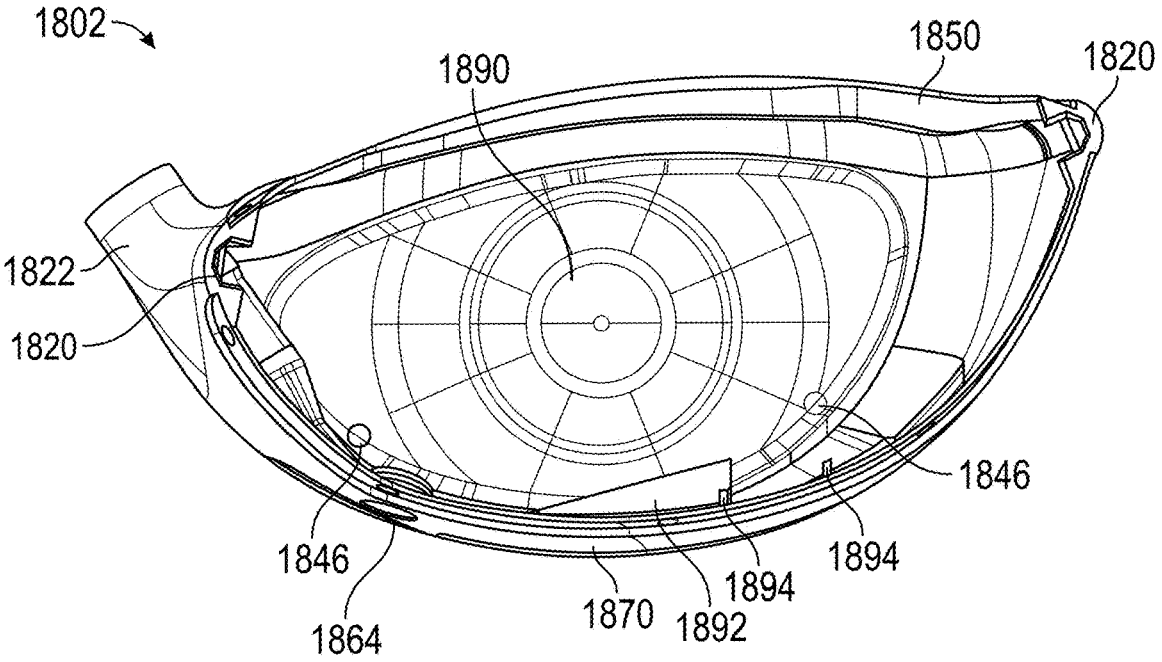
FIG. 94 shows the interior surface of the front portion of the club head of FIG. 86.

As shown in FIG. 94, the rear surface 1890 of the face can be shaped to give the face a desired variable thickness profile. Examples of variable thickness profiles and methods of creating them are discuss elsewhere herein, such as with reference to FIGS. 51-56.

Figure 98:
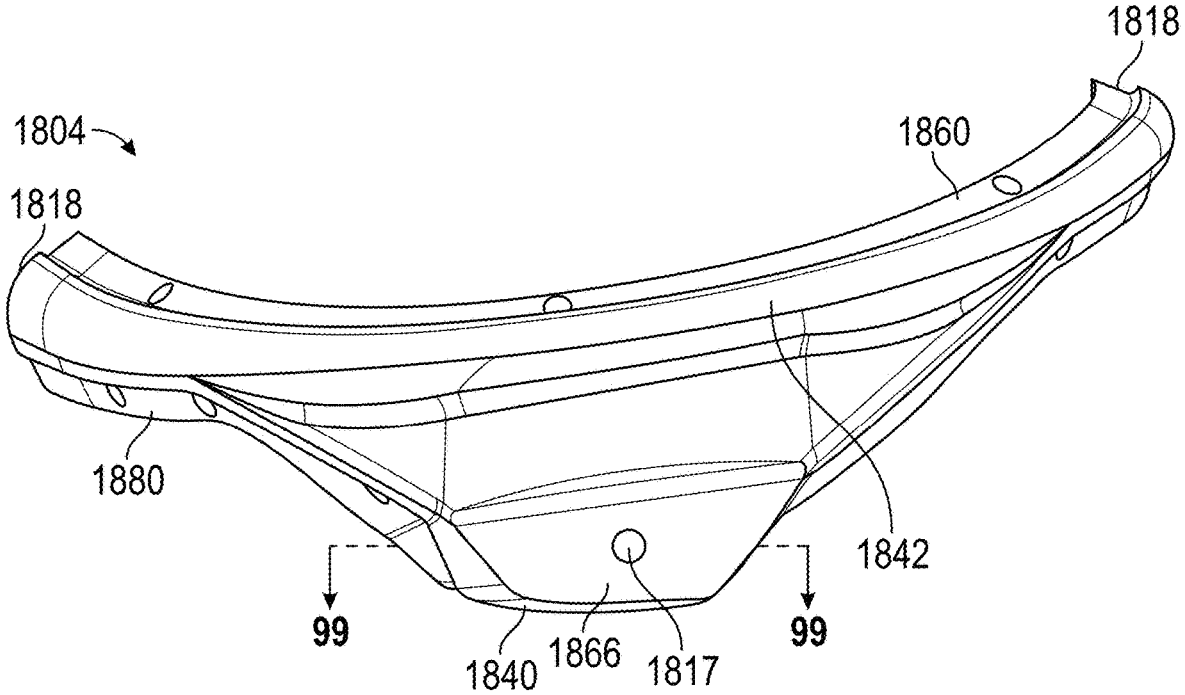
FIG. 98 is a rear view of the rear ring of the club head of FIG. 86, without the rear weight.

FIG. 98 is a rear view of the ring 1804 in isolation. When the club head 1800 is in the normal address position (e.g., on flat ground at a 60 USGA degree lie angle), the toe end of the ring (right side in FIG. 98) is positioned further above the ground compared to the heel end of the right (left side), and the ring curves and twists around the back of the club head between the two offset ends at the heel and toe. For example, at the rear center of the ring 1804, it can be seen in FIG. 98 how the skirt portion 1842 is tilted down to the heel side. FIG. 94 shows a corresponding rear view of the front cup 1802, showing how the toe side ring engagement feature 1820 is elevated higher than the toe side ring engagement feature. This curved, twisted shape of the ring can be cast into the ring, for example, or the ring being bent or shaped in a secondary process after the ring is originally formed. In some embodiments, the ring comprises an arcuate elongated member forming a generally U-shape between the toe end of the ring and the heel end of the ring, the arcuate elongated member defines a curved longitudinal axis extending along the arcuate elongated member between the toe end of the ring and the heel end of the ring, and the arcuate elongated member is twisted about the longitudinal axis.

Figure 99:
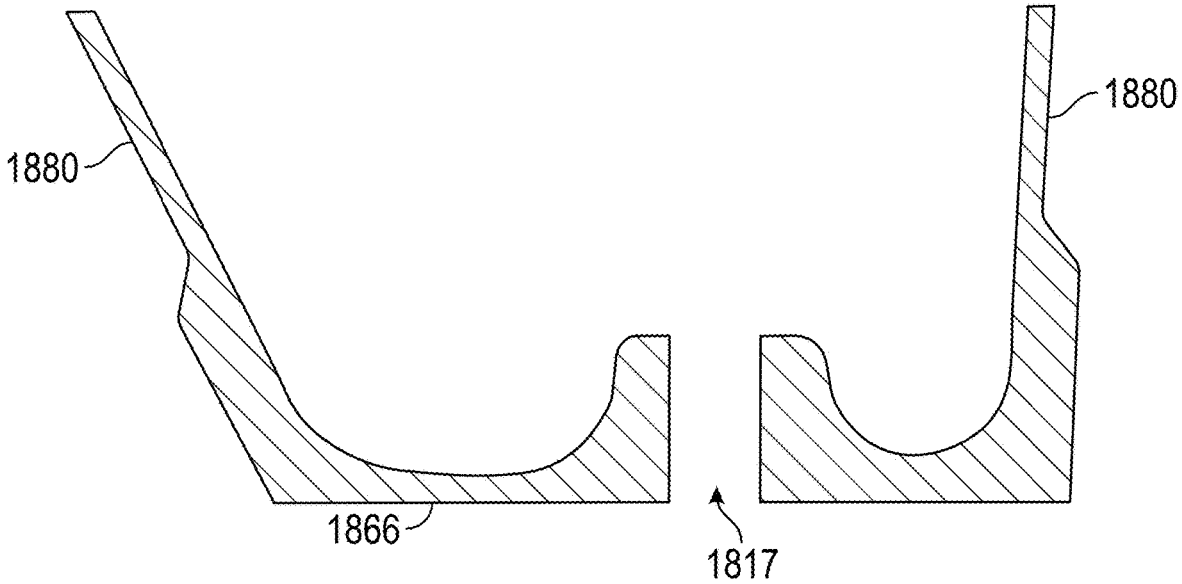
FIG. 99 is a cross-sectional view of the rear ring of FIG. 98 taken along section line 99-99.
Figure 100:
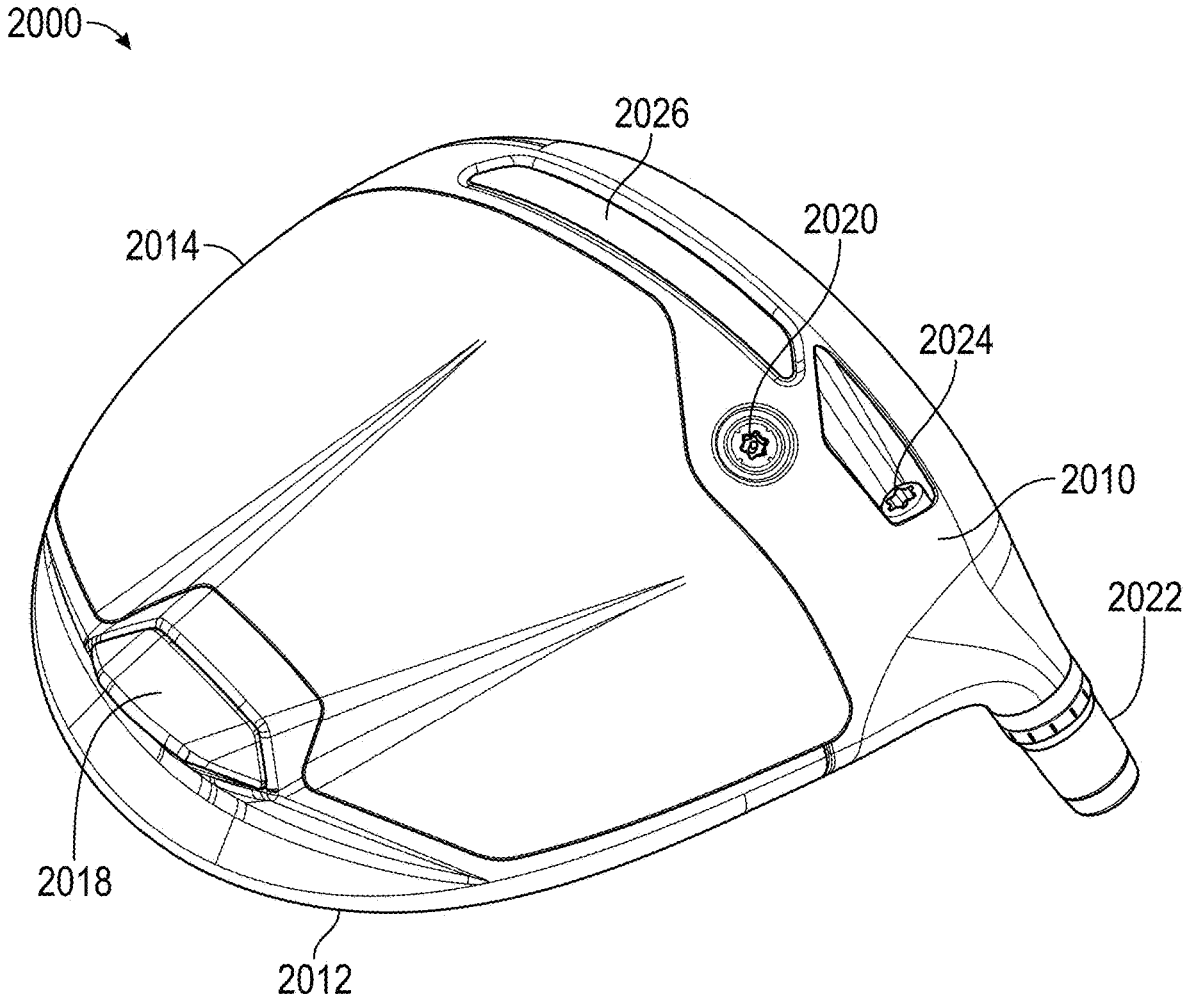
FIG. 100 is bottom perspective view of another exemplary golf club head.
Figure 101:
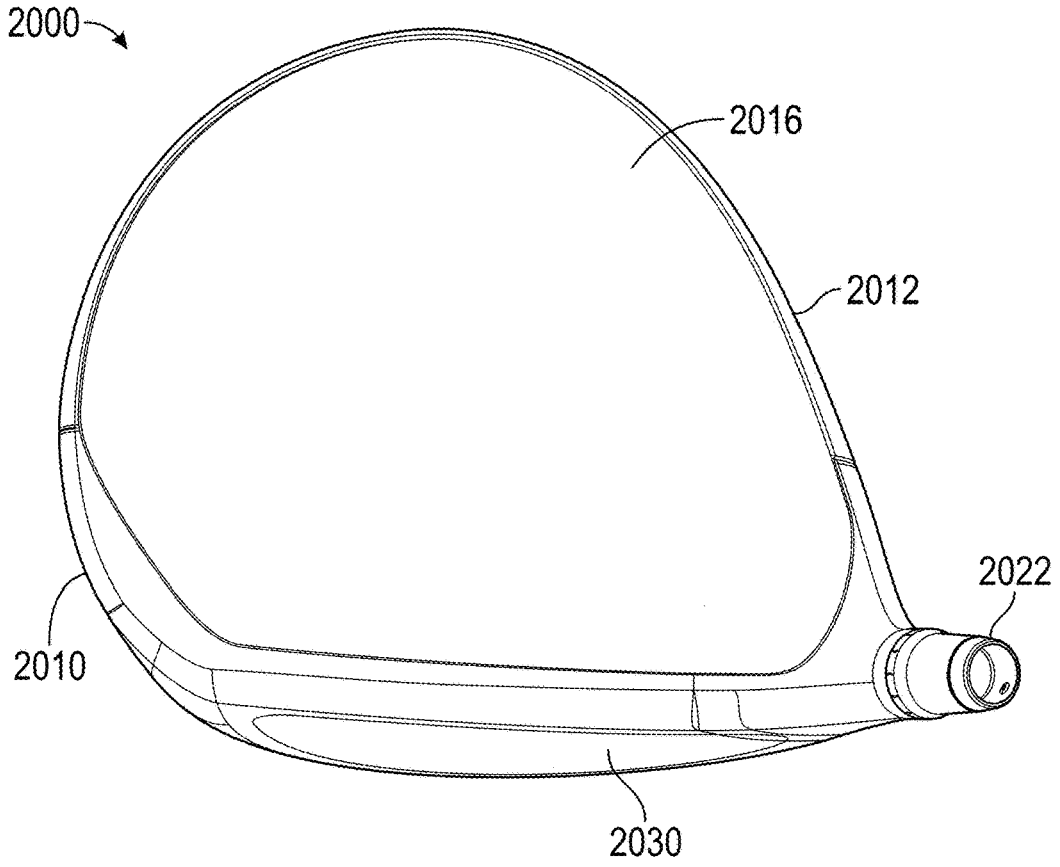
FIG. 101 is a top view of the club head of FIG. 100.
Figure 102:
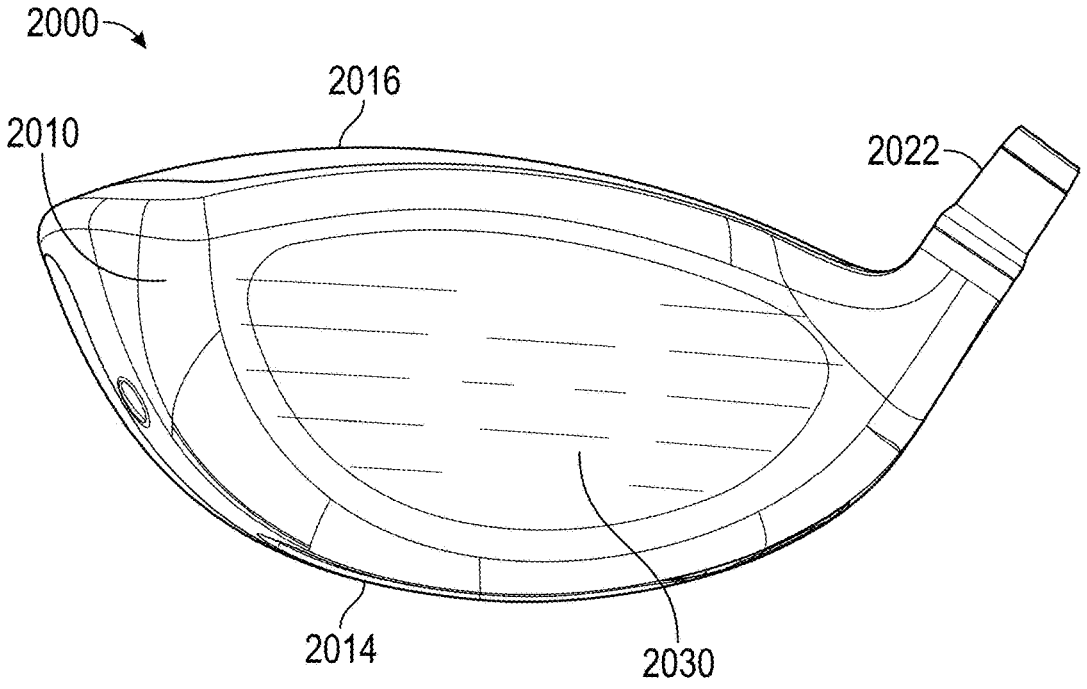
FIG. 102 is a front view of the club head of FIG. 100.
Figure 103:
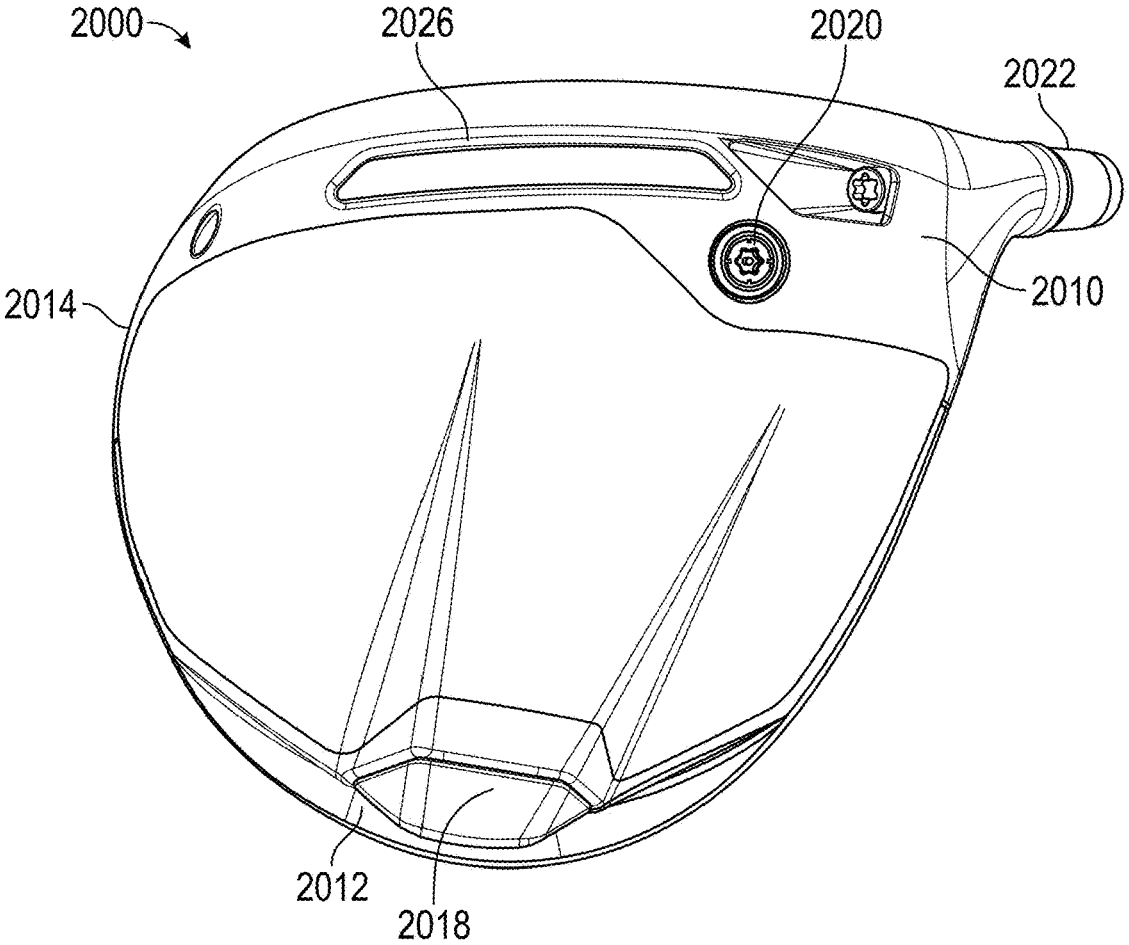
FIG. 103 is a bottom view of the club head of FIG. 100.
Figure 104:
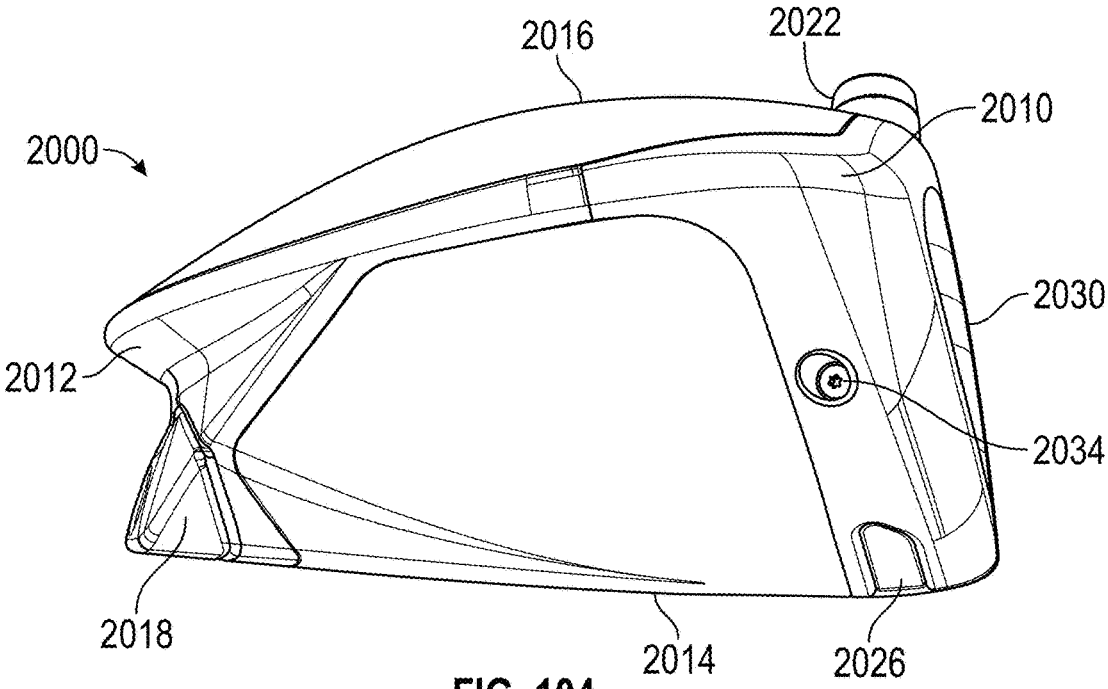
FIG. 104 is a toe side view of the club head of FIG. 100.
Figure 105:
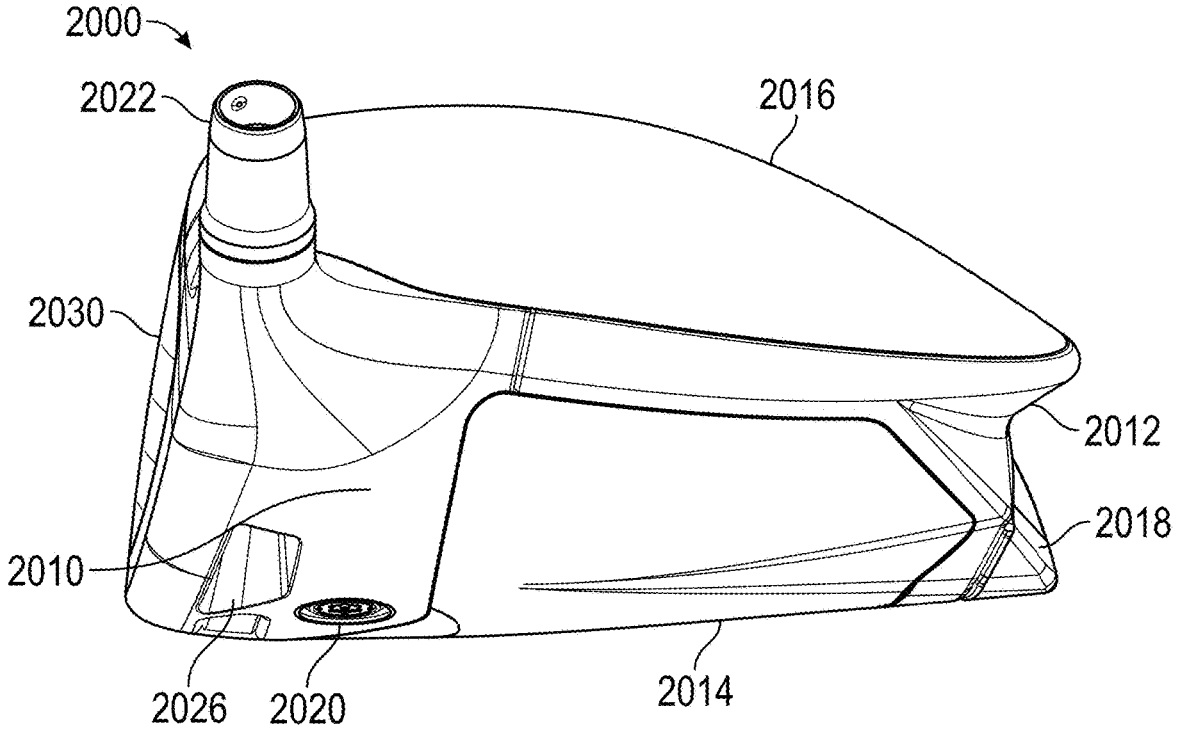
FIG. 105 is a heel side view of the club head of FIG. 100.

At the lower side of FIG. 98, the rear surface 1866 and threaded opening 1817 are shown without the rear weight 1812. FIG. 99 is a cross-sectional profile of the ring cutting horizontally through the opening 1817. As shown in FIGS. 98 and 99, the recessed lips 1860 and 1880 for the crown and sole inserts extend around the top and bottom edges of the ring, following the curved and twisted contours of the ring. The lower part of the ring combines with the sole insert to create a sole shape that includes prominent rear sole mass center that projects downward and rearward from the rest of the sole, and the inclusion of the rear weight 1812 and the lower part of the ring help to located more mass further to the rear and bottom of the club head while reducing mass in the center of the sole and sides of the club head. This rear sole configuration can increase inertial properties, such as Izz and Ixx, and can also improve aerodynamic and acoustic properties of the club head.

For any of the club heads disclosed herein, any of the front and/or rear weights, as well as any of the screws or other additional elements used to attach a weight to the club head, can be formed form dense material (e.g., tungsten, steel, nickel, cobalt, lead, gold, silver, titanium, platinum, etc.), which can be relatively more dense than the material of the club head part to which they are attached (e.g., the cup or ring), and can have any mass. The weight member and its screw can be comprised of the same or different materials, and can be combined to provide a desired total mass. Each of the front and rear weights, for example, can have a mass of from 0.5 gram to 50 grams, from 1 gram to 40 grams, from 1 gram to 30 grams, from 1 gram to 25 grams, less than 50 grams, less than 40 grams, less than 30 grams, less than 25 grams, from 2 grams to 7 grams, from 2 grams to 15 grams, from 2 grams to 25 grams, from 5 grams to 10 grams, from 5 grams to 15 grams, from 5 grams to 20 grams, from 5 grams to 25 grams, from 5 grams to 30 grams, from 7 grams to 10 grams, from 7 grams to 30 grams, from 10 grams to 20 grams, from 10 grams to 30 grams, from 15 grams to 25 grams, or from 15 grams to 50 grams. In one particular example of the club head 1800, the front weight comprises tungsten and has a mass of 18.7 grams and the rear weight comprises steel and has a mass of 8.62 grams, while the overall club head has a mass of 200.5 grams, the cup comprises 9-1-1 titanium and has a mass of 110.01 grams, and the ring comprises aluminum 7075 and has a mass of 22.36 grams. Additional mass can be added via hot melt adhesive or other similar material to any part of the body, such as behind the face and in the rear part of the ring, which can be less than 10 grams for example.

For any of the club heads disclosed herein, the entire rear ring assembly, include the rear weight and any screw and hot melt added, can have any mass, such as a mass of from 1 gram to 60 grams, from 5 grams to 50 grams, from 10 grams to 45 grams, from 10 grams to 40 grams, and/or from 15 grams to 35 grams. The ring itself can have a mass of from 1 gram to 50 grams, from 5 grams to 40 grams, from 8 grams to 30 grams, from 10 grams to 28 grams, and/or from 12 grams to 25 grams. Rings made of aluminum can have less mass, for example, compared to rings made of steel or titanium.

For any of the club heads disclosed herein, the front cup can have any mass, such as from 75 grams to 150 grams, from 80 grams to 140 grams, from 90 grams to 130 grams, and/or from 100 grams to 120 grams.

For any of the club heads disclosed herein, a ratio of the mass of the cup to the mass of the ring (without any added weights or other objects) can be greater than 1:1, greater than 2:1, greater than 3:1, greater than 4:1, greater than 5:1, greater than 6:1, and/or greater than 8:1.

By moving the mass of the club head further toward the front and rear ends of the club head, and toward the sole, the club head can achieve unique mass distribution and inertial properties. For example, the constriction of club head 1800 can free up a very high mass of discretion weight, and that discretionary weight be reapplied to desired locations primarily via the front and rear weights, and to a lesser extent via other added materials such as hot melt adhesive additions. In a given example of the club head 1800, where 30 grams of mass are freed up and redistributed via the front and rear weights, that discretionary mass can be divided in any desired way between the two weights, such as evenly (15 gram front weight and 15 gram rear weight), more in the front (e.g., 20 gram front weight and 10 gram rear weight), more in the rear (10 gram front weight and 10 gram rear weight), and even more extreme distributions like 5 g/25 g or 1 g/29 g.

Some embodiments of the club heads disclosed herein (including the club head 1800 and the other club heads disclosed herein) can have an Izz greater than 450 kg/mm$^2$, greater than 475 kg/mm$^2$, greater than 500 kg/mm$^2$, greater than 510 kg/mm$^2$, and/or greater than 525 kg/mm$^2$. Some embodiments can have an Ixx greater than 300 kg/mm$^2$, greater than 350 kg/mm$^2$, greater than 375 kg/mm$^2$, greater than 400 kg/mm$^2$, and/or greater than 425 kg/mm$^2$. Some embodiments of the club heads can have a combined Izz+Ixx of greater than 750 kg/mm$^2$, greater than 800 kg/mm$^2$, greater than 850 kg/mm$^2$, greater than 875 kg/mm$^2$, and/or greater than 900 kg/mm$^2$. Some embodiments of the club heads can have an Iyy greater than 250 kg/mm$^2$, greater than 275 kg/mm$^2$, greater than 300 kg/mm$^2$, greater than 310 kg/mm$^2$, and/or greater than 325 kg/mm$^2$.

The center of gravity is also affected by the configuration of the weights. Some embodiments of the club heads described herein (including the club head 1800 and any of the other club heads described herein) can have a CGx greater than 0, less than 0, from −1 mm to 1 mm, from −1 mm to 0, from −2 mm to 0, from −3 mm to −1 mm, from −3 mm to −2 mm. Some embodiments of the club heads described herein can have a CGz less than −2 mm, less than −2.5 mm, less than −3 mm, less than −3.5 mm, less than −4 mm, less than −4.5 mm, and/or less than −5 mm.

The golf club heads described herein can have a Delta 1, which is a measure of how far rearward in the golf club head the CG is located. More specifically, Delta 1 is the distance between the CG and the hosel axis along the y axis. Some embodiments of the club heads described herein can have a Delta 1 of at least 15 mm, at least 17 mm, at least 18 mm, at least 19 mm, at least 20 mm, at least 21 mm, at least 22 mm, at least 23 mm, at least 24 mm, at least 25 mm, and/or at least 26 mm. Some club heads can have a Delta 1 between about 15 mm and about 30 mm and/or between 21 mm and 26 mm.

These mass distribution and inertia properties can provide advantages and benefits over other club heads, such as more forgiveness on mishit shots, less back spin, more distance, higher launch angle, better acoustic properties when striking a ball, more adjustability for a user, etc. In some embodiments, the club head 1800 can have a desirable first mode frequency above 3000 Hz when striking a ball. Part of this is due to shapes and constructions of the lightweight crown and sole inserts. In some embodiments, for example, the inserts can comprise strong carbon fiber reinforces composites built up with at least 5 layers, such as 5-10 layers of composite carbon layers. The increased curvature in the sole around the transition between the sole insert 1808 and the rear sole surface 1840 can also help with strength and acoustics.

A ratio of the mass of the crown insert 1806 to the mass of the sole insert 1808 can be about even, less than 1:1, or greater than 1:1. In some embodiments, the crown insert can be thinner and/or have a lower average areal weight than the sole insert.

For any of the embodiments disclosed herein that include a cast cup and a rear ring attached to the cup, with a front weight element coupled to the cup and a rear weight element coupled to the ring, the location of each mass element on the golf club head can be defined as the location of the center of gravity of the mass element relative to the club head origin coordinate system. For example, in some implementations, the front mass element has an origin x-axis coordinate between approximately 15 mm and approximately 35 mm, an origin y-axis coordinate between approximately 10 mm and approximately 30 mm, and an origin z-axis coordinate between approximately −20 mm −30 mm and approximately −10 mm. In one specific implementation, the front mass element has an origin x-axis coordinate of approximately 22 mm, an origin y-axis coordinate of approximately 23 mm, and an origin z-axis coordinate of approximately −21 mm.

Similarly, in some implementations, the rear mass element has an origin x-axis coordinate between approximately −20 mm and approximately 10 mm, an origin y-axis coordinate between approximately 90 mm and approximately 120 mm, and an origin z-axis coordinate between approximately −30 mm and approximately 10 mm. In one specific implementation, the rear mass element has an origin x-axis coordinate of approximately −7 mm, an origin y-axis coordinate of approximately 110 mm, and an origin z-axis coordinate of approximately −11 mm.

Due to the cup and ring configuration with light-weight crown and sole inserts, and due the placement and mass of the front and rear weights, along with other structural features, the balance point (BP) of golf club heads described herein can be shifted toeward of the geometric center of the golf club head.

The configuration of the golf club head, including the locations and masses of the front and rear mass elements, can result in the club head having a moment of inertia about the CG z-axis (Izz) between about 450 kg·mm$^2$ and about 600 kg·mm$^2$, and a moment of inertia about the CG x-axis (Ixx) between about 280 kg mm$^2$ and about 400 kg·mm$^2$. In one specific implementation, the club head has a moment of inertia about the CG z-axis (Izz) of approximately 528 kg·mm$^2$ and a moment of inertia about the CG x-axis (Ixx) of approximately 339 kg·mm$^2$. In this implementation, then, the ratio of Ixx/Izz is approximately 0.64. However, in other implementations, the ratio of Ixx/Izz is between about 0.5 kg·mm$^2$ and about 0.9 kg·mm$^2$. In some embodiments, golf club heads as described herein can have a combined Izz+Ixx that is less than 1100 kg·mm$^2$ and greater than 780 kg mm$^2$, greater than 800 kg mm$^2$, greater than 820 kg mm$^2$, greater than 840 kg mm$^2$, greater than 860 kg mm$^2$, greater than 880 kg mm$^2$, and/or greater than 900 kg mm$^2$.

As described herein, the rear ring of any of the club heads disclosed herein can comprise various different materials and features, and be made of different materials and have different properties than the cast cup, which is formed separately and later coupled to the ring. In addition to or alternative to other materials described herein, the rear ring can comprise metallic materials, polymeric materials, and/or composite materials, and can include various external coatings.

Separately forming the ring not only allows for greater access to the rear portion of the face for milling operations to remove unwanted alpha case and allows for machining in various face patterns, but also allows the use of lower density materials having a density between 1 g/cc to 4 g/cc, or between 1 g/cc and 3 g/cc, or between 1 g/cc and 2 g/cc, such as aluminum or plastic or composite materials, which yields additional discretionary mass that can be redistributed throughout the club head to achieve desirable CG characteristics and a variety of launch conditions. For example, an aluminum ring may save 8 to 15 grams over a titanium ring, and a plastic ring may offer up to 3 to 7 grams of mass savings over an aluminum ring. For embodiments that include a composite crown insert and/or a composite sole insert a ledge will often be necessary to provide desirable fit and finish and sufficient bonding area to ensure the adhesive glue bond is durable and avoids premature failure. The cast cup can comprise titanium or titanium alloy and has a density greater than 4 g/cc, such as about 4.5 g/cc for example. Thus, when this ledge is formed of titanium alloy having a density of about 4.5 g/cc it reduces the amount of discretionary mas compared to an aluminum ring that has a density of about 2.7 g/cc or a plastic ring that has a density of about 1.5 g/cc. The added mass due to the bonding ledges greatly reduces the benefit of a composite crown insert because the ledges generally are a minimum of 4 mm and up to 10 mm, which diminishes any mass savings from the composite crown. Accordingly, by separately forming the ring out of a lower density material e.g. a material with a density between 1 g/cc and 4 g/cc, or between 1 g/cc and 3 g/cc, more discretionary mass can be freed up to strategically place elsewhere in the club head and the mass savings can range from 8 grams to 22 grams compared to a titanium rear ring. In some instances, the forward cup formed of a first material (e.g. titanium alloy) forms a first portion of a crown ledge having a first bond area, and the rear ring formed of a second lower density material (e.g. aluminum alloy or fiber reinforced polycarbonate) forms a second portion of the crown ledge having a second bond area, and the second bond area of the rear ring makes up between 25-60% of the total crown ledge bond area, preferably the rear ring makes up between 30-65% of the total crown ledge bond area. Similarly, in some instances, the forward cup formed of a first material (e.g. titanium alloy) forms a first portion of a sole ledge having a third bond area, and the rear ring formed of a second lower density material (e.g. aluminum alloy or fiber reinforced polycarbonate) forms a second portion of the sole ledge having a fourth bond area, and the fourth bond area of the rear ring makes up between 25-65% of the total sole ledge bond area, preferably the rear ring makes up between 40-60% of the total sole ledge bond area. Increasing the percentage of bond area made up by the lower density rear ring increases the overall discretionary mass i.e. mass savings. In some embodiments, the first bond area may be larger than the third bond area, and the fourth bond area may be larger than the second bond area, the fourth bond area may be larger than the third bond area, and the second bond area may be larger than the first bond area.

In some embodiments, the ring comprises anodized aluminum, such as 6000, 7000, and 8000 series aluminum. In one specific example, the ring comprises 7075 grade aluminum. The anodized aluminum can be colored, such as red, green, blue, gray, white, orange, purple, pink, fuchsia, black, clear, yellow, gold, silver, or metallic colors. In some embodiments, the ring can have a color that contrasts from a majority color located on other parts of the club head (e.g., the crown insert, the sole insert, the cup, the rear weight, etc.).

In some embodiments, the rear ring can comprise any combination of metals, metal alloys (e.g., Ti alloys, steel, boron infused steel, aluminum, copper, beryllium), composite materials (e.g., carbon fiber reinforced polymer, with short or long fibers), hard plastics, resilient elastomers, other polymeric materials, and/or other suitable materials. Any material selection for the ring can also be combined with any of various formation methods, such as any combination of the following: casting, injection molding, sintering, machining, milling, extruding, forging, stamping, and rolling.

A plastic ring (e.g., fiber reinforced polycarbonate ring) may offer mass savings (e.g. about 5 grams compared to an aluminum ring), cost savings, give greater design flexibility due to processes used to form the ring (e.g. injection molded thermoplastic), and/or perform similarly to an aluminum ring in abuse testing (e.g. slamming the club head into a concrete cart path (extreme abuse) or shaking it in a bag where other metal clubs can repeatedly impact it (normal abuse)).

In some embodiments, the ring can comprise a polymeric material (e.g., plastic) with a non-conductive vacuum metallizing (NCVM) coating. For example, in some embodiments, the ring can include a primer layer having an average thickness of about 5-11 micrometers (μm) or about 8.5 μm, an under coating layer on top of the primer layer having an average thickness of about 5-11 μm or about 8.5 μm, a NCVM layer on top of under coating layer having an average thickness of about 1.1-3.5 μm or about 2.5 μm, a color coating layer on top of the NCVM layer having an average thickness of about 25-35 μm or about 29 μm, and a top coating (e.g., UV protection coat) outer layer on top of the color coating layer having an average thickness of about 20-35 μm or about 26 μm. In general, for a NCVM coated part or ring the NCVM layer will be the thinnest and the color coating layer and the top coating layers will be the thickest, for example about 8-15 times thicker than NCVM layer. Generally, all the layers can combine to have a total average thickness of about 60-90 μm or about 75 μm. The described layers and NCVM coating can be applied to other parts of the club head other than the ring, such as the crown, sole, forward cup, and removable weights, and it can be applied prior to assembly.

In some embodiments, the ring can comprise a physical vapor deposition (PVD) coating or film layer. In some embodiments, the ring can include a paint layer, or other outer coloring layer. Conventionally, painting a golf club heads is all done by hand and requires masking various components to prevent unwanted spray on unwanted surfaces. Hand painting, however, can lead to great inconsistency from club to club. Separately forming the ring not only allows for greater access to the rear portion of the face for milling operations to remove unwanted alpha case and allows for machining in various face patterns, but it also eliminates the need for masking off various components. The ring can be painted in isolation prior to assembly. Or in the case of anodized aluminum, no painting may be necessary, eliminating a step in the process such that the ring can simply be bonded or attached to a cup that may also be fully finished. Similarly if the ring is coated using PVD or NCVM, this coating can be applied to the ring prior to assembly, again eliminating several steps. This also allows for attachment of various color rings that may be selectable by an end user to provide an alignment or aesthetic benefit to the user. Whether the ring is a NCVM coated ring or a PVD coated ring, it can be colored any of an array of colors, such as red, green, blue, gray, white, orange, purple, pink, fuchsia, black, clear, yellow, gold, silver, or metallic colors.

FIGS. 100-116 illustrate another exemplary golf club head 2000 that embodies many of the novel features disclosed herein. The head 2000 comprises a cast cup 2010 coupled to a rear ring 2012 that forms a structural body of the head. The cup and the ring can be formed of any materials and by any methods as described elsewhere herein. The cup and the ring are joined at a toe end joint 2040 and at a heel end joint 2042, which joints can be formed in various manners, such a mechanical interlocking, fasteners, adhesives, welding, and/or other manners as described elsewhere herein.

A sole insert 2014 and crown insert 2016 are coupled to the body to enclose a hollow interior cavity. The crown insert can be bonded to a crown ledge portion of the cup 2044 and a crown ledge portion of the ring 2046, which together encircle the crown opening of the body. The sole insert 2014 can be bonded to a sole ledge portion of the cup 2048 and a sole ledge portion of the ring 2050, which together encircle the sole opening of the body. The crown and sole inserts can be formed of any materials and by any methods as described elsewhere herein, and coupled to the cup/ring structure by any means.

Figure 106:
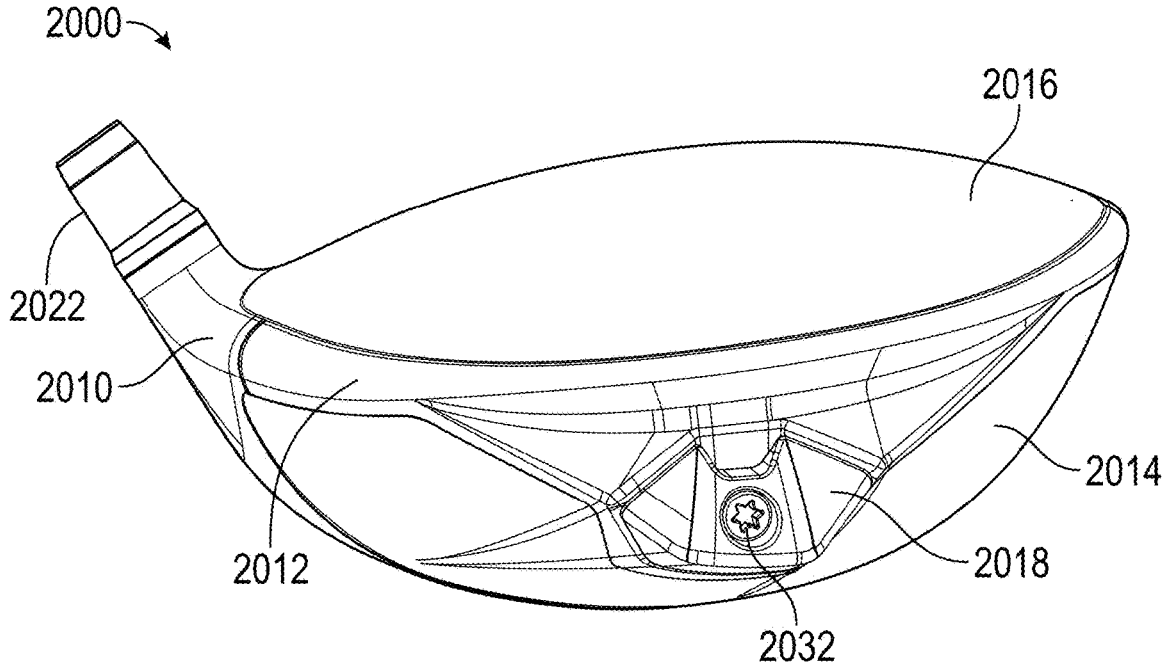
FIG. 106 is a rear view of the club head of FIG. 100.
Figure 107:
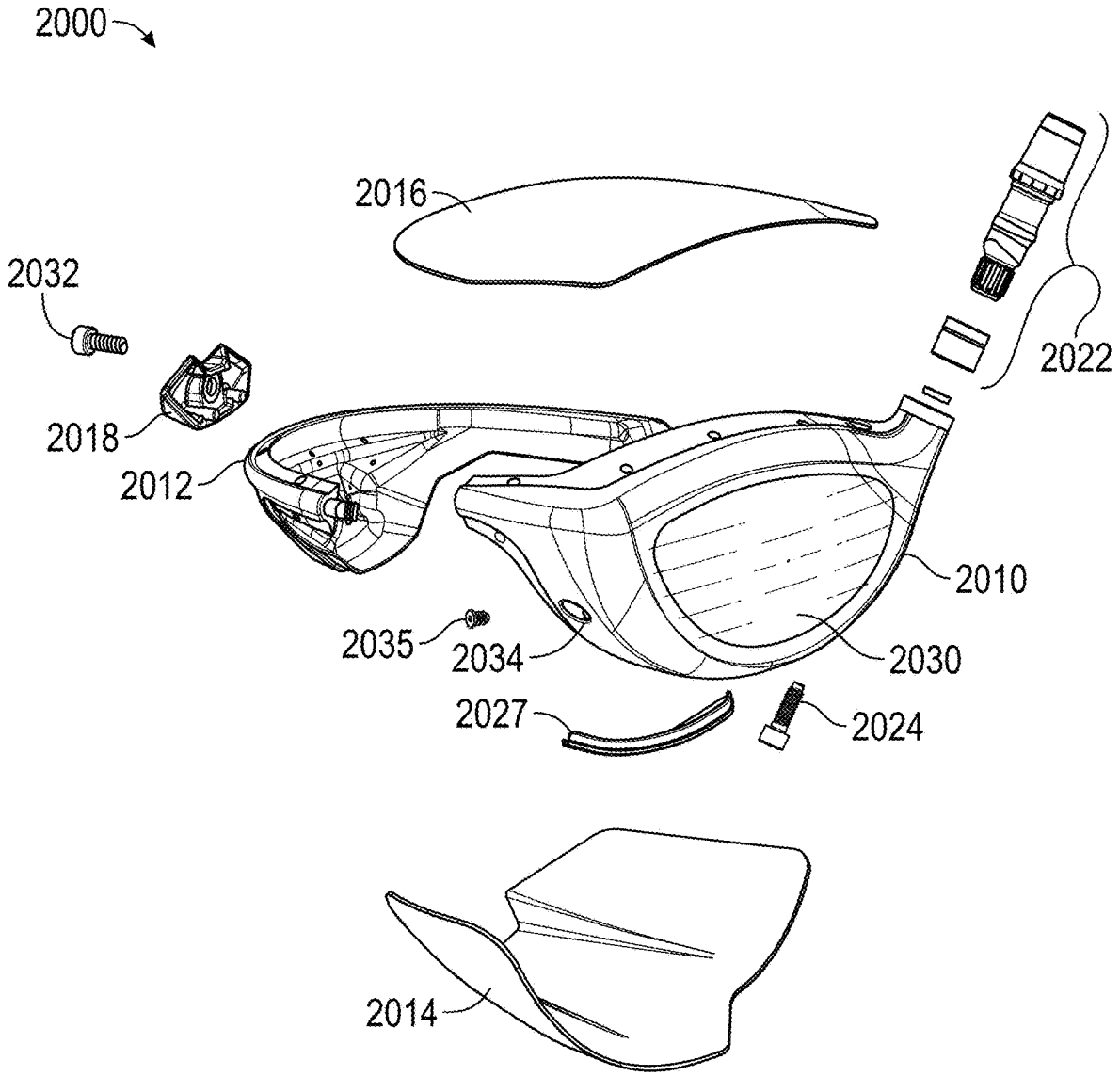
FIG. 107 is an exploded view of the club head of FIG. 100.
Figure 108:
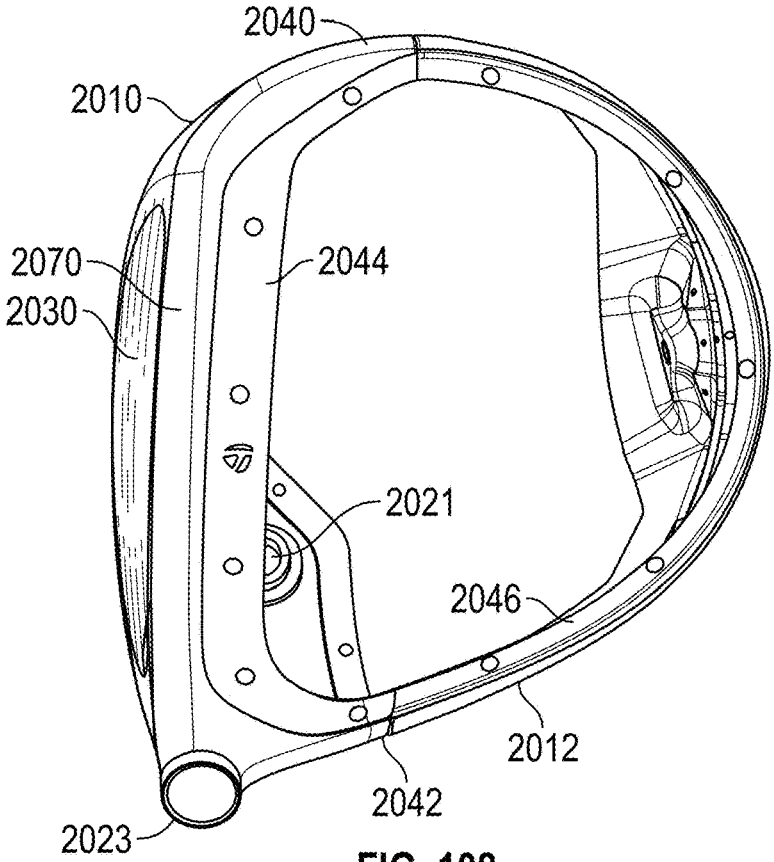
FIG. 108 is a top view of the body of the club head of FIG. 100 without the sole and crown inserts.
Figure 109:
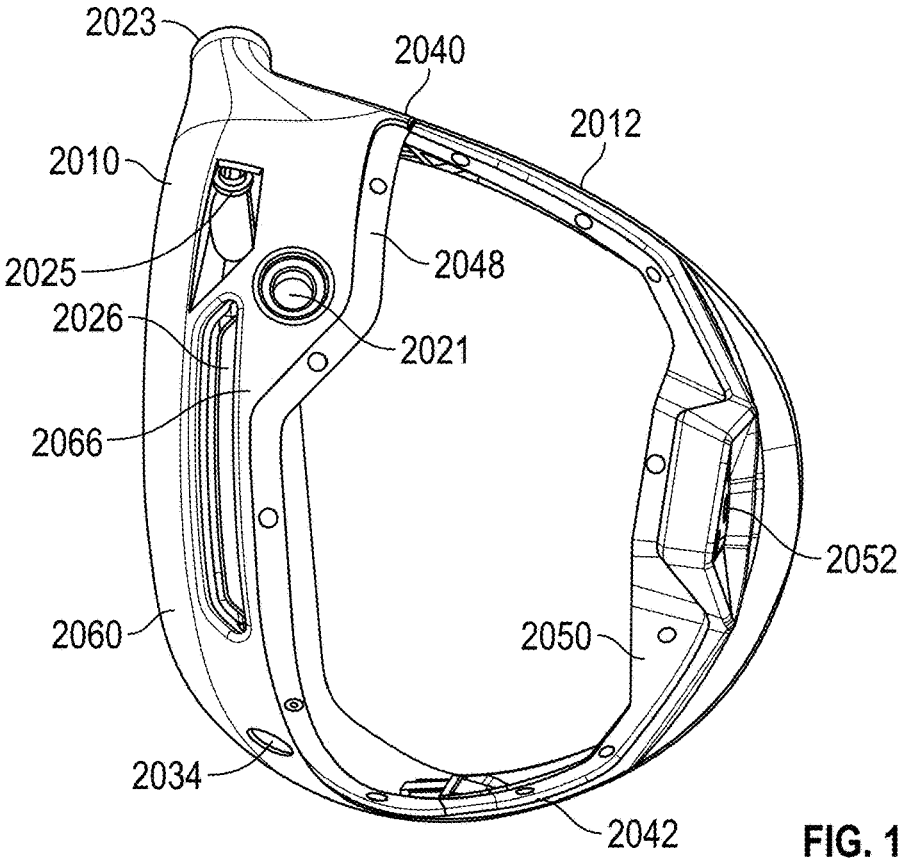
FIG. 109 is a bottom view of the body of the club head of FIG. 100 without the sole and crown inserts.
Figure 110:
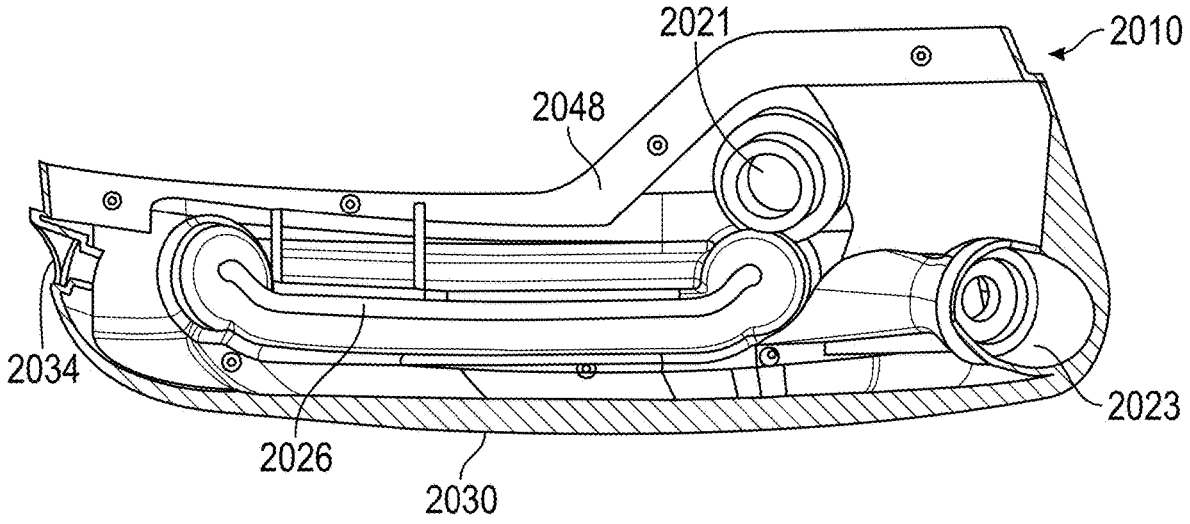
FIG. 110 is a cross-sectional top view of the interior sole portion of the cast cup of the club head of FIG. 100.
Figure 111:
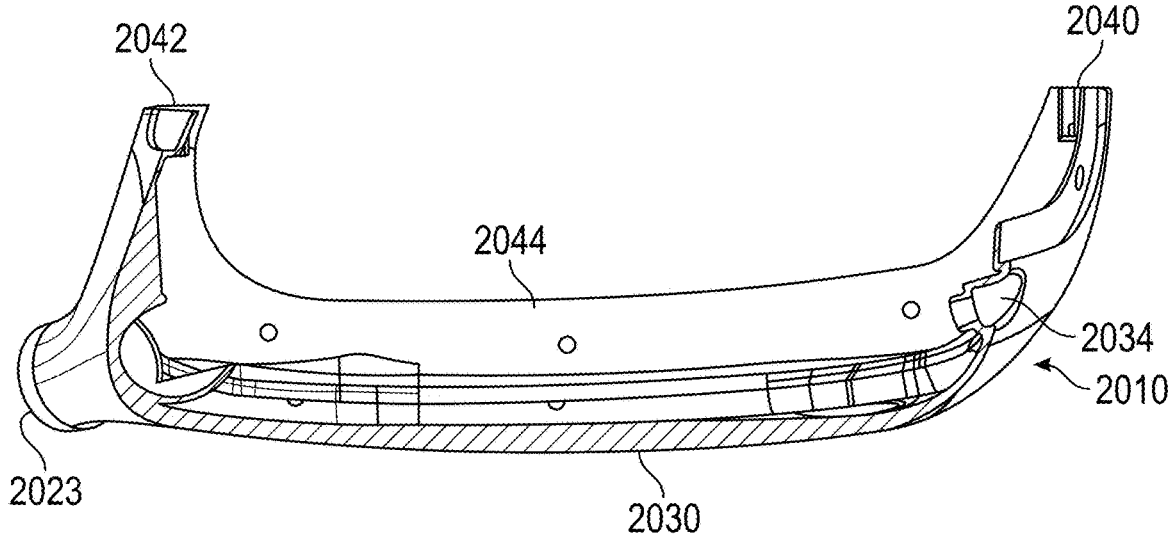
FIG. 111 is a cross-sectional bottom view of the interior crown portion of the cast cup of the club head of FIG. 100.
Figure 112:
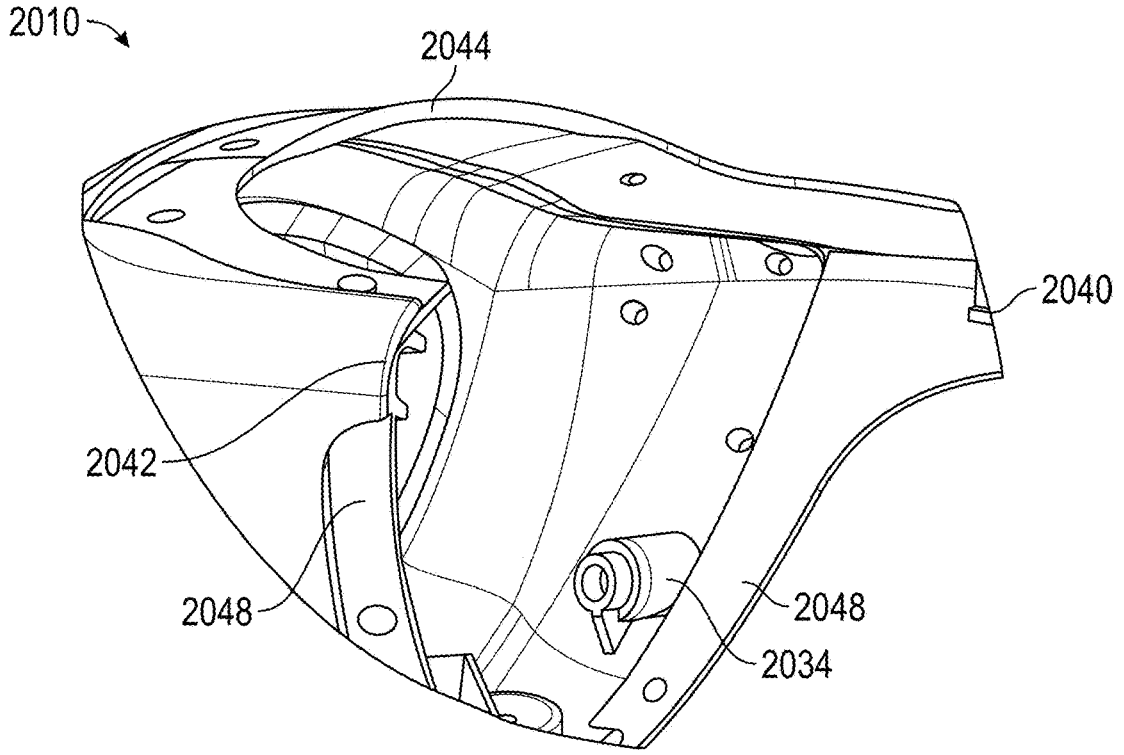
FIG. 112 is a perspective view showing the rear and interior portions of the cast cup of the club head of FIG. 100.
Figure 113:
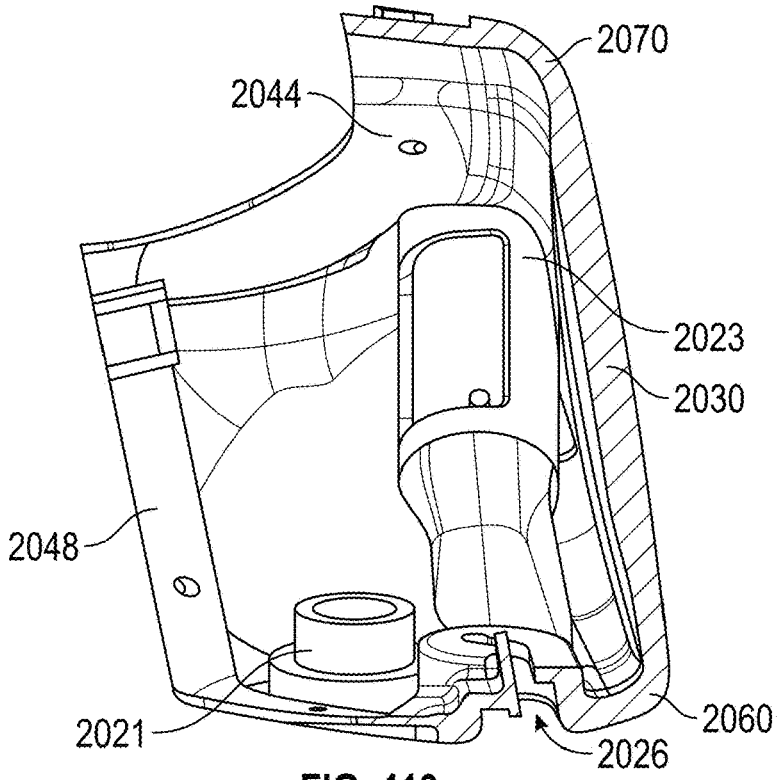
FIG. 113 is a cross-sectional side view of the interior of the heel side of the cast cup of the club head of FIG. 100.

A rear weight 2018 is coupled to the rear of the ring via fastener 2032 that secures the weight to a receiving portion of the ring 2052. A sole weight 2020 can threaded into a receptacle 2021 in the bottom of the cast cup. The rear weight 2018 and sole weight 2020 are analogous to the front and rear weight combinations described elsewhere herein, and can have any of the properties, attachment means, and locations described in connection with other front and rear weight embodiments. For example, the rear weight and sole weight can be formed of any material and have any masses as described elsewhere herein. As shown in FIG. 106, the rear weight 2018 can have an irregular shape with a notch formed in its upper side, which can help prevent the weight from rotating relative to the rear ring or coming loose.

Figure 114:
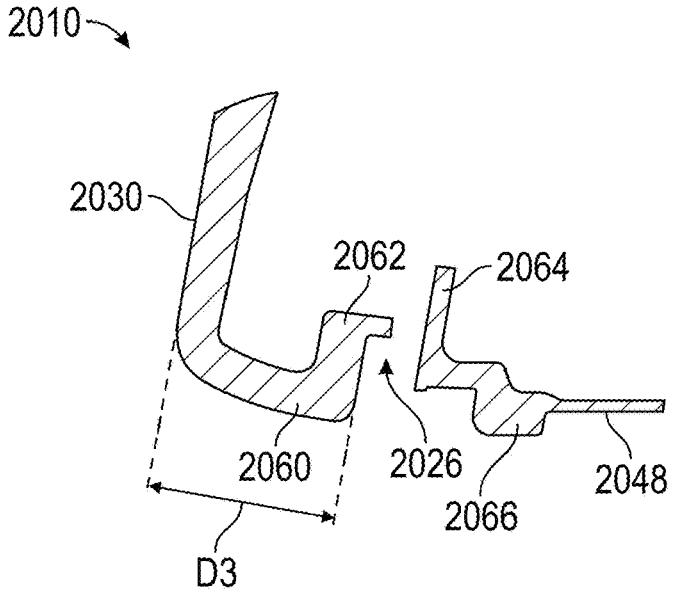
FIG. 114 is a cross-sectional side view of the sole portion of the cast cup of the club head of FIG. 100, taken at the center of the sole channel.

The cast cup 2010 includes the striking face 2030 of the club head, which can be cast integrally with the rest of the cup. Alternatively, a face plate can be formed separately and attached to an opening formed in the cast cup. The cast cup 2010 also includes a sole channel 2026 at a forward portion of the sole just behind the bottom of the striking face, and a plug 2027 can be positioned in the channel. As shown in FIG. 114, the cup 2010 can include a forward sole portion 2060 between the bottom of the face 2030 and the channel 2026, and a rear sole portion 2066 behind the channel 2026, which includes part of the ledge 2048. A front wall 2062 of the channel can extend from the forward sole portion upwardly into the internal cavity and can also include a rearward projecting lip at the top of the front wall. A rear wall 2064 of the channel can extend from the rear sole portion upwards into the cavity as well. The forward sole portion 2060 can have a front-rear dimension D3 from the face 2030 to the channel 2026. D3 can range from 5 mm to 15 mm, such as from 7 mm to 12 mm, and/or from 8 mm to 11 mm. If D3 is too large, the channel 2026 loses its effectiveness at modifying the stiffness and other properties of the lower face. However, if D3 is too small, the forward sole portion 2060 can be too weak and prone to failure.

The cast cup also includes a hosel 2023 that receives an adjustable head-shaft connection assembly 2022, which is secured with a fastener 2024 inserted through a sole recess 2025 below the hosel. The adjustable head-shaft connection assembly 2022 can be similar to others described herein. In some embodiments, the hosel 2023 can include an opening in a wall that faces the internal cavity of the club head, as shown for example in FIG. 113, which can help reduce mass for redistribution elsewhere, and can increase access to the inner portions of the hosel and the components of the adjustable head-shaft connection assembly 2022.

The cast cup can also include a port or opening 2034 at the toe end that allows for material, such as hot melt, to be injected into the interior of the club head to adjust the performance properties of the club head. A screw 2035 can fill the port 2034. The port 2034 can be functionally similar to the toe side aperture 1846 of the club head 1800. In addition, the club head 2000 can also include structures analogous to ribs 1894, walls 1895 and 1896, and area 1898. Locating the port 2034 toward the toe side of the cup avoid forming an opening in the face, which can improve the consistency and integrity of the face.

Figure 115:
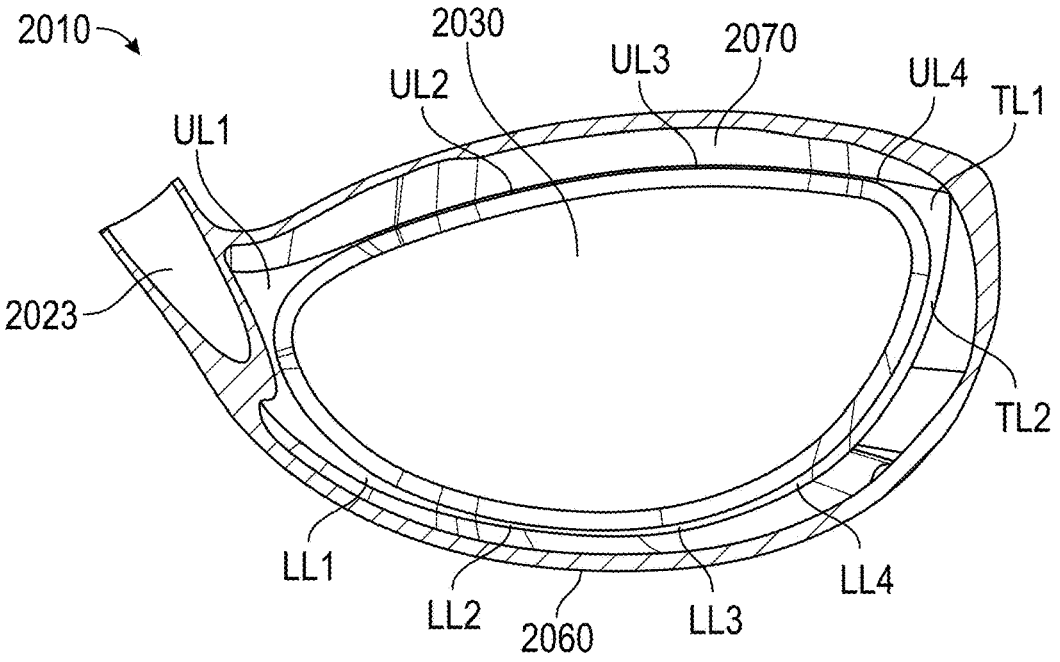
FIG. 115 is a cross-sectional rear view of the front portion of cast cup, showing the rear of the face and surrounding parts of the cast cup of FIG. 100.

FIG. 115 is a cross-sectional view of the cast cup 2010 showing rear facing surfaces of the face 2030 and surrounding portions of the forward portion of the cup. The thickness of the cup material that surrounds the face at the front of the club head can vary from point to point. The local thicknesses around the face can affect how the club head performs when striking a ball at different points across the face, for example affecting local stiffnesses, coefficients of restitution, contact times, imparted spin rates, etc., as well as affect the durability of the club head. For example, where the thicknesses are greater, the adjacent portion of the face can exhibit less flexibility and shorter contact times. FIG. 115 indicates several exemplary points on the lip of the cup around the face. Point UL1 can have a thickness that ranges from 2 mm to 2.5 mm. Point UL2 can have a thickness that ranges from 1.8 mm to 2.7 mm. Point UL3 can have a thickness that ranges from 1.8 mm to 2.7 mm. Point UL4 can have a thickness that ranges from 2 mm to 2.8 mm. Point TL1 can have a thickness that ranges from 2 mm to 2.8 mm. Point TL2 can have a thickness that ranges from 2 mm to 2.8 mm. Point LL1 can have a thickness that ranges from 2 mm to 2.5 mm. Point LL2 can have a thickness that ranges from 2 mm to 2.4 mm. Point LL3 can have a thickness that ranges from 2 mm to 2.4 mm. Point LL4 can have a thickness that ranges from 2 mm to 2.4 mm.

Figure 116:
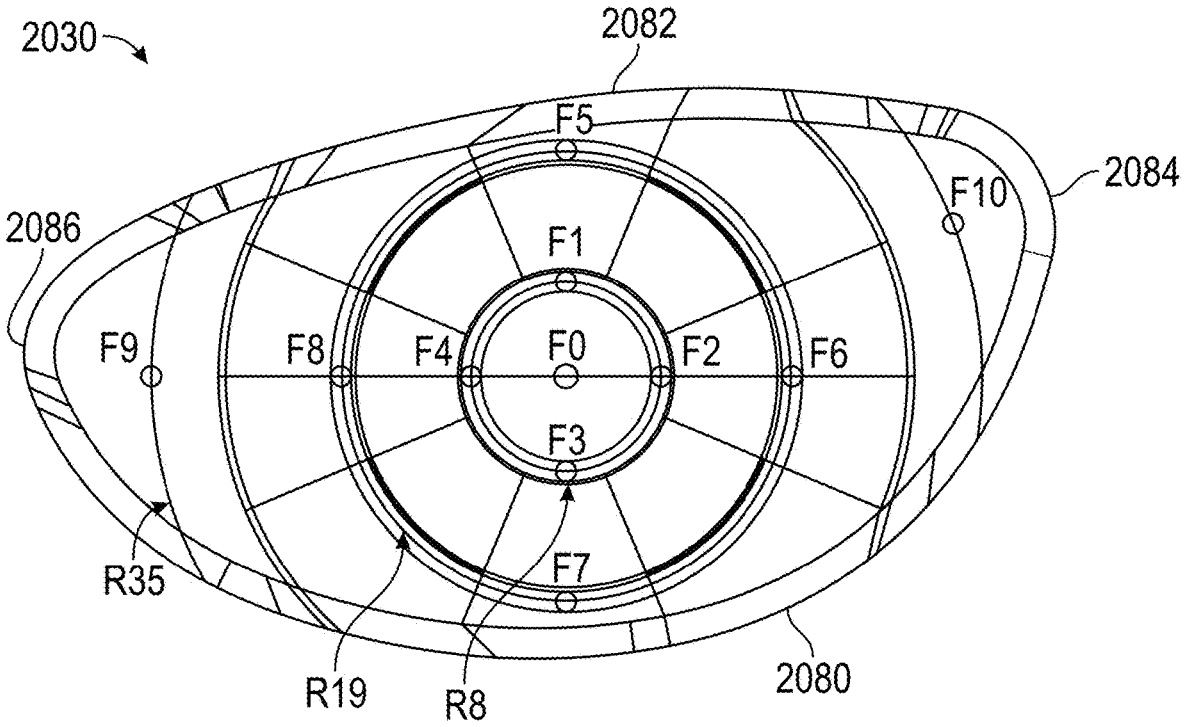
FIG. 116 is a rear view of a face portion of the cast cup of the club head of FIG. 100.

FIG. 116 is a rear view of the face 2030 isolated from the rest of the cup. The thickness of the face can vary locally across the face, as described elsewhere herein, such as in reference to FIGS. 51-54. The thickness profile across the face can vary by radius, by angular position, or otherwise, and can in some embodiment form an inverted cone shape. In FIG. 116, several exemplary reference points are indicated as F0 through F10 for thickness measurement. F1-F4 are located at a radius of 8 mm (R8) from the reference point F0. F5-F8 are located at a radius of 19 mm (R19) from F0. F9 and F10 are located at a radius of 35 mm (F35) from F0. The perimeter of the face includes a lower side 2080, and upper side 2082, a toe side 2084, and a heel side 2086. The center reference point F0 can be positioned anywhere on the face, and not necessarily at the geometric center of the face. When F0 is offset from the geometric center of the face, the thickness profile can be asymmetric relative to the geometric center of the face. F0 (and also the entire face thickness profile) may be offset from the geometric center of the face toward the toe, toward the heel, toward the top, toward the bottom, or some combination of these. For example, F0 and the overall thickness profile of the face can be shifted toeward and upward from the geometric center of the face (e.g., 3 mm toward the toe and 1 mm up, or 4 mm toeward and 2 mm upward) to better accommodate a user's ball striking tendency where a higher percentage of ball strikes occur above and toeward of the geometric center of the face. Toeward and heelward shifting can range from 0 mm to 6 mm in either direction, such as 2 mm to 5 mm toeward. Vertical shifting can range from 0 mm to 4 mm in either direction, such as 1 mm to 3 mm upward. In some embodiments, the thickness at F6 may be greater than F5 and F7, and/or the thickness at F2 may be greater than F1 and F3. In some embodiments, at a given radial distance from F0 between 8 mm and 26 mm a toe thickness (e.g., F6) is greater than an upper and/or lower thickness (e.g., F5 and/or F7). For example, at a location having an x-coordinate of −22 mm and a z-axis coordinate of 0 mm (near F6) the toe thickness is greater than a lower face thickness having a x-coordinate of −3 mm and a z-axis coordinate of −19 mm (near F7), and may be greater than at a point having a x-coordinate of −3 mm and a z-axis coordinate of +19 mm 9near F5). In some embodiments F8 has a greater thickness than F6, or vice versa.

The thickness at F0 can range from 2.8 mm to 3.2 mm.

The thickness at F1 can range from 2.9 mm to 3.3 mm.

The thickness at F2 can range from 2.9 mm to 3.3 mm.

The thickness at F3 can range from 2.9 mm to 3.3 mm.

The thickness at F4 can range from 2.9 mm to 3.3 mm.

The thickness at F5 can range from 2.35 mm to 2.65 mm.

The thickness at F6 can range from 2.3 mm to 2.8 mm.

The thickness at F7 can range from 2.1 mm to 2.3 mm.

The thickness at F8 can range from 2.6 mm to 2.9 mm.

The thickness at F9 can range from 1.7 mm to 2.0 mm.

The thickness at F10 can range from 1.7 mm to 2.0 mm.

The thickness around the edges of the face can range from 1.7 mm to 2.6 mm.

These face thickness values can be applied to a face that integrally cast as part of the cast cup, or to a separately formed face that is later coupled to an opening in the cast cup. Any post-casting process as described herein can be used to modify the face after it is initially cast or otherwise formed to achieve the final desired face thickness profile. For example, the rear of the face can be machined (e.g., CNC milling) to remove material from the rear of the face after casting the face. Many methods of machining can be used. In some methods, continuous path milling can be used, where the milling tool does not leave the work piece (e.g., the face) until the final thickness profile is complete. In this method, the tool moves side to side parallel to the face in a pattern that covers the whole portion of the face that is to be machined without separating the tool from the face.

In some milling methods, a ball end mill can be used having a given diameter (e.g., ½ inch). A ball end mill has a rounded tip that leaves a curved walled groove in the face. At the mill takes each pass across the face, the mill is shifted or stepped a certain distance so that the next pass is parallel but slightly offset from the previous pass. For each adjacent pair of passes with a ball end mill, a ridge or cusp of material is left behind between the two passes, which is sometimes called a scallop. The smaller the step or offset between passes, the shorted the scallop is. Similarly, the greater the radius of curvature of the ball end mill, the shorter the scallop is. Also, the larger the diameter/radius of the ball end mill, the more material is removed with each pass. Accordingly, there can be a desirable mill diameter range that is large enough that not too many passes and steps (and precision) are needed to complete the whole process, but small enough that the scallops left behind between the passes are not too tall. For example, the mill can have a diameter between ⅛ inch and 1 inch, such as between ¼ inch and ¾ inch, for example ½ inch. Similarly, the step distance between milling passes can range from 0.5 mm to 2 mm, such as about 1 mm. Smaller step distances can produce shorter scallop heights, enabling a more precise variable face thickness profile. One benefit of the ball end mill is that it can leave a rounded edge adjacent to the passes, as opposed to a sharp 90 degree edge if the mill has a squared end. Rounded edges can be less susceptible to stress concentrations and resulting cracking and failure. In some milling processes, the mill can move in a spiral pattern around the face, such as from a center point spiraling outward, or from an edge point spiraling inward. The mill can move clockwise or counterclockwise around the face. One factor that can guide the selection of the size of the mill, the step distance, and the milling pattern, is the desired amount of material to be removed from the face and the acceptable amount of undesired material (e.g., alpha case material) that can be left on the face. Where the thickness of material to be removed is large, a larger mill and/or a larger step size may be used. Where the thickness of the material to be removed is very thin, then a smaller mill and/or smaller step size can be used.

In some embodiments, the as-cast face has the following thickness values, and the after-milling final thickness values listed above can be achieved via post-casting milling, such as with a ball end mill.

The as-cast thickness at F0 can range from 3.3 mm to 3.5 mm.

The as-cast thickness at F1 can range from 3.4 mm to 3.6 mm.

The as-cast thickness at F2 can range from 3.4 mm to 3.6 mm.

The as-cast thickness at F3 can range from 3.4 mm to 3.6 mm.

The as-cast thickness at F4 can range from 3.4 mm to 3.6 mm.

The as-cast thickness at F5 can range from 2.75 mm to 2.95 mm.

The as-cast thickness at F6 can range from 3.0 mm to 3.2 mm.

The as-cast thickness at F7 can range from 2.1 mm to 2.3 mm.

The as-cast thickness at F8 can range from 3.0 mm to 3.2 mm.

The as-cast thickness at F9 can range from 2.2 mm to 2.4 mm.

The as-cast thickness at F10 can range from 2.2 mm to 2.4 mm.

The as-cast thickness around the edges of the face can range from 1.7 mm to 3.2 mm.

The post-cast milling processes can move from 0 mm to 1 mm, such as from 0 mm to 0.5 mm, from the rear of the face, depending on the position and the desired final profile.

Variable thickness face features are described in more detail in U.S. patent application Ser. No. 12/006,060 and U.S. Pat. Nos. 6,997,820, 6,800,038, and 6,824,475, which are incorporated herein by reference in their entirety.

FIGS. 117-133 illustrate club head embodiments that include a face insert that is separately formed that coupled to the cast cup. In some embodiments, the cast cup may include a face opening configured to receive a face insert, such as a titanium face insert or a composite face insert (e.g., carbon fiber reinforced polymer composite).

Figure 117:
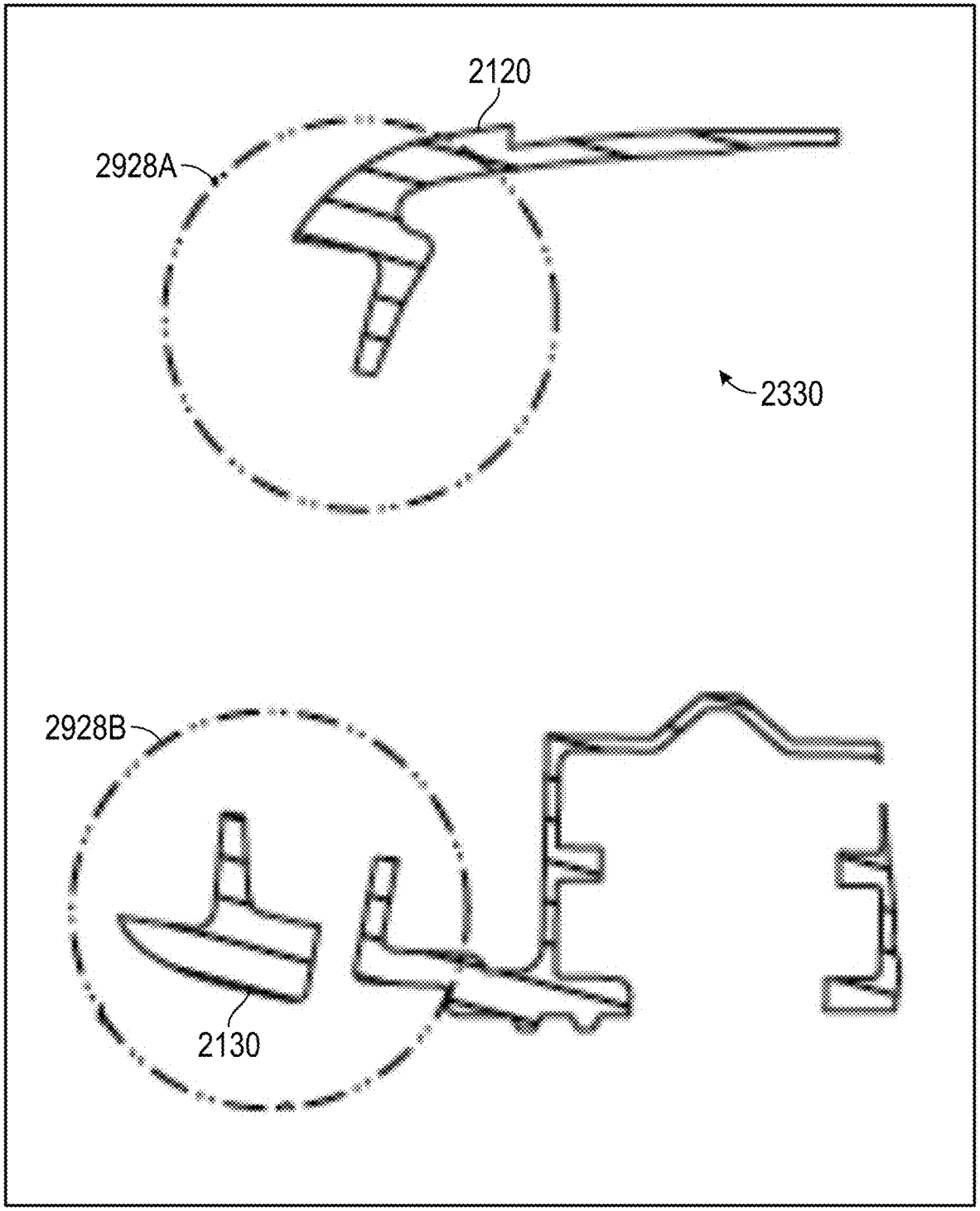
FIG. 117 is a section view of a golf club head in accord with one embodiment of the current disclosure, without a face insert installed.

FIG. 117 is a section view of a golf club head in accord with one embodiment of the current disclosure, without a face insert installed. In some embodiments, the transition from a portion of the crown 2120 to the face insert (not depicted in FIG. 117) provides for a primary alignment feature. For example, FIG. 117 shows a front portion 2330 of a golf club head. The front portion 2330 is configured to receive a face insert (not depicted in FIG. 117). The front portion 2330 includes a face insert support structures 2928A, 2928B. An upper face insert support structure 2928A is adjacent or immediately next to the crown 2120. A lower face insert support structure 2928B is adjacent or immediately next to the sole 2130.

In some instances, a bond area for the composite face insert will range from 850 $mm^2$ to 1800 $mm^2$, preferably between 1,300 $mm^2$ to 1,500 $mm^2$. In some instances, a ratio of the composite face insert bond area to the inner surface area of the composite face insert e.g. strike plate (rear surface area of the composite face insert) will range from 21% to 45%. In some instances, a total bond area of the composite face insert will be less than a total bond area of the crown insert. Further details on composite face inserts, composite face insert support structure, bond area, and multi-material and multi-component club head construction similar to that disclosed herein can be found in U.S. patent application Ser. No. 17/124,134, filed Dec. 16, 2020 and incorporated by reference herein in its entirety.

In some embodiments, when installed to the face insert support structures 2928A, 2928B, the face insert forms a part of the transition region from the face to the crown 2120 and/or the sole 2130. For example, at least a portion of the transition region may be painted the same color or shade as at least a portion of the crown prior to installing the face insert, which when installed provides a contrasting color or shade of the face insert with respect to the painted portion of the transition region and/or crown. In other embodiments, the face insert eliminates the need for a transition region from the face to the crown 2120 and/or the sole 2130. In some embodiments, the face insert includes at least a portion of the radius of the transition from the face insert to the crown. By forming part of the radius of the transition from the face to the crown, aerodynamics of the club head may be improved by decreasing turbulence of the air passing from the face to the crown and increasing annular flow.

Figure 118A:
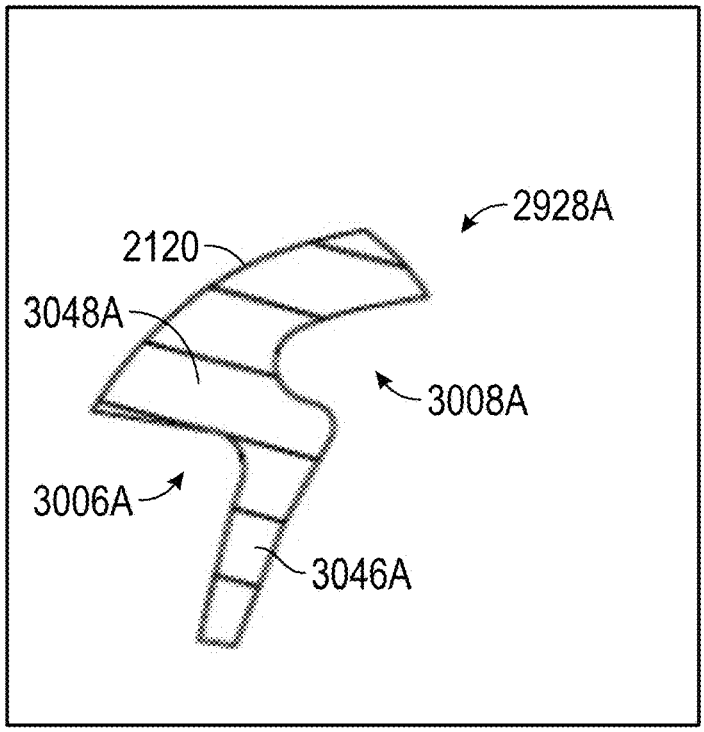
FIG. 118A is a section view of an upper lip of a golf club head in accord with one embodiment of the current disclosure, without a face insert installed.

FIG. 118A is a section view of an upper lip of a golf club head in accord with one embodiment of the current disclosure, without a face insert installed. FIG. 118 depicts an upper face insert support structure 2928A that is adjacent or immediately next to the crown 2120. The upper face insert support structure 2928A includes an upper rear support member 3046A and an upper peripheral member 3048A. The upper rear support member 3046A and the upper peripheral member 3048A create an upper undercut recess 3006A forming a lip for receiving the face insert and connecting a portion of the crown 2120 to the upper face insert support structure 2928A.

In some embodiments, the upper face insert support structure 2928A is provided in a shape that flexes in a similar manner as the face insert when the golf club head strikes a golf ball. For example, in some golf club head designs, the face insert material, such as a composite material, is more flexible or compliant than the golf club body material, such as an aluminum or titanium alloy. In this example, a slot or recess 3008A may be provided within the upper peripheral member 3048A to increase flexibility or compliance of the upper face insert support structure 2928A, allowing the face to flex more uniformly. Additional and different shapes may be provided to increase or decrease flexibility and compliance of one or more components of the golf club body. By flexing in a similar manner, the golf club head may be more durable, substantially preventing the face insert from decoupling, or de-bonding, from the golf club body.

Figure 118B:
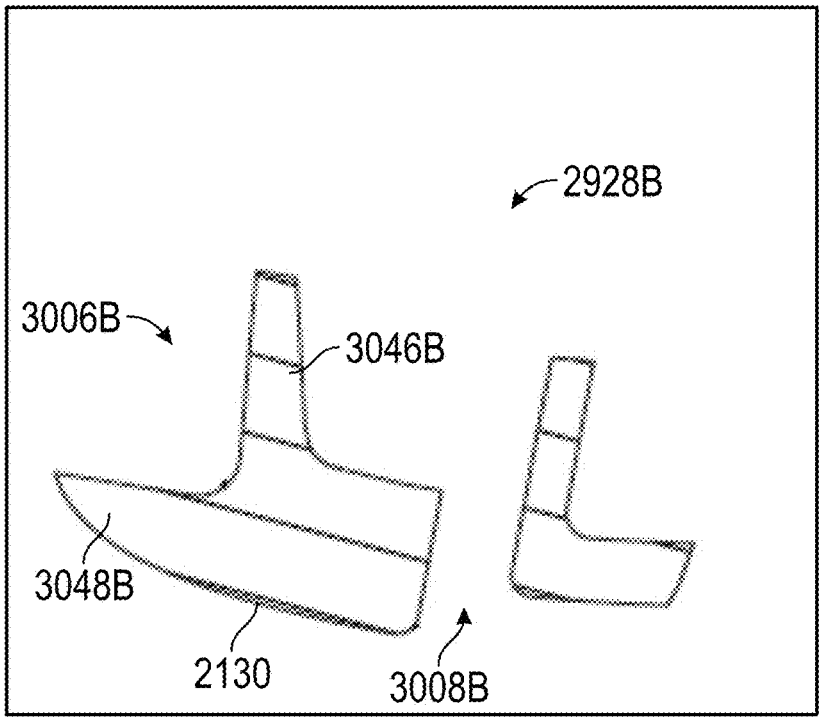
FIG. 118B is a section view of a lower lip of a golf club head in accord with one embodiment of the current disclosure, without a face insert installed.

FIG. 118B is a section view of a lower lip of a golf club head in accord with one embodiment of the current disclosure, without a face insert installed. FIG. 118B depicts a lower face insert support structure 2928B that is adjacent or immediately next to the sole 2130. The lower face insert support structure 2928B includes a lower rear support member 3046B and a lower peripheral member 3048B. The lower rear support member 3046B and the lower peripheral member 3048B create a lower undercut recess 3006B forming a lip for receiving the face insert and connecting a portion of the sole 130 to the lower face insert support structure 2928B.

In some embodiments, the lower face insert support structure 2928B is provided in a shape that flexes in a similar manner as the face insert when the golf club head strikes a golf ball. In the example discussed above, the face insert material is more flexible or compliant than the golf club body material. In this example, a slot or recess 3008B may be provided within the lower peripheral member 3048B to increase flexibility or compliance of the upper face insert support structure 2928B, allowing the face to flex more uniformly. Additional and different shapes may be provided to increase or decrease flexibility and compliance of one or more components of the golf club body. By flexing in a similar manner, the golf club head may be more durable, substantially preventing the face insert from decoupling, or de-bonding, from the golf club body.

Figure 119:
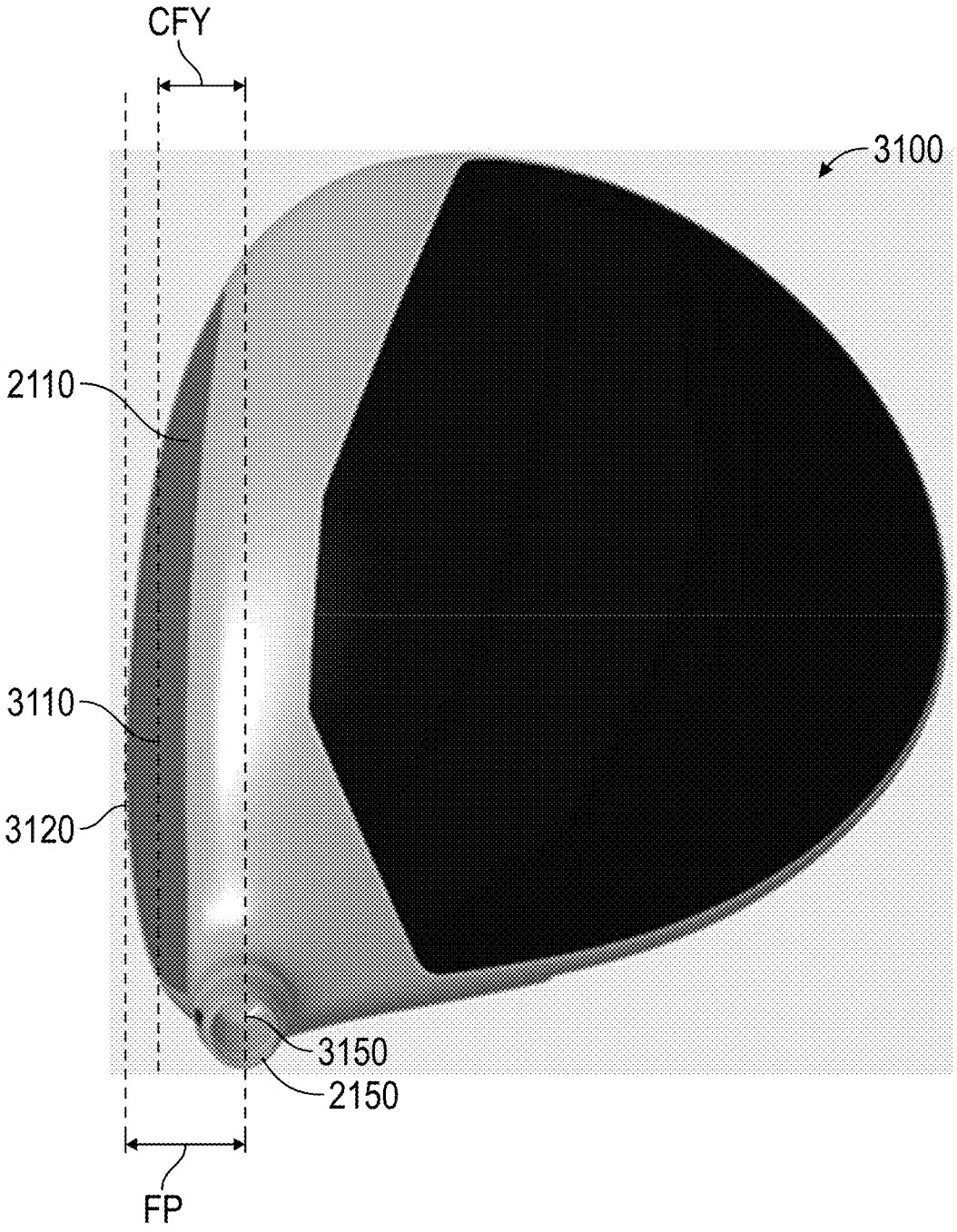
FIG. 119 is a top view of a golf club head in accord with one embodiment of the current disclosure.

FIG. 119 is a top view of a golf club head in accord with one embodiment of the current disclosure. FIG. 119 depicts club head 3100 with hosel 2150, face 2110 and a center-face location 3110. A center-face y-axis location (CFY) is defined using the center-face location 3110 of face 2110 and a center point location 3150 of the hosel 2150. A positive CFY produces onset of the golf club head and extends from center point location 3150 of hosel 2150 toward the front portion of the golf club head to the center-face location 3110. For example, onset may cause lateral dispersion and the face to appear too far forward of the hosel. A negative CFY produces offset of the golf club head and extends from center point location 3150 of hosel 2150 toward the rear portion of the golf club head to the center-face location 3110. A face progression (FP) is defined using the leading-edge location 3120 of face 2110 and a center point location 3150 of the hosel 2150. Face progression is related to face location, loft and face height. CFY, face progression, and alignment features all influence performance of a golf club head, such as lateral dispersion. For example, if the CFY and/or face progression of the golf club head is changed, one or more alignment features may be provided to counteract the lateral dispersion created or reduced by the CFY and/or face progression.

In some embodiments, a high CFY (e.g., greater than about 15 mm, 14 mm, 13 mm, or another CFY) may produce lateral dispersion right of the intended target line. In other embodiments, a low CFY (e.g., less than about 15 mm, 14 mm, 13 mm, or another CFY) may produce lateral dispersion left of the intended target line. In some embodiments, CFY is between about 13 mm and about 15 mm.

In some embodiments, a high face progression (e.g., greater than about 20 mm, 19 mm, 18 mm, or another face progression) may produce lateral dispersion right of the intended target line. In other embodiments, a low face progression (e.g., less than about 19 mm, 18 mm, 17 mm, or another face progression) may produce lateral dispersion left of the intended target line. In some embodiments, face progression is between about 15 mm and about 20 mm.

In some embodiments, a golf club head is provided with at least one of: CFY no more than 15.5 mm; CFY no more than 15 mm; CFY no more than 14.5 mm; CFY no more than 14 mm; CFY no more than 13.5; CFY no more than 13 mm; face progression no more than 20 mm; face progression no more than 19 mm; face progression no more than 18 mm; face progression no more than 17 mm; and face progression no more than 16 mm. In some embodiments, a golf club head is provided with a CFY no more than 17.5 mm.

Figure 120:
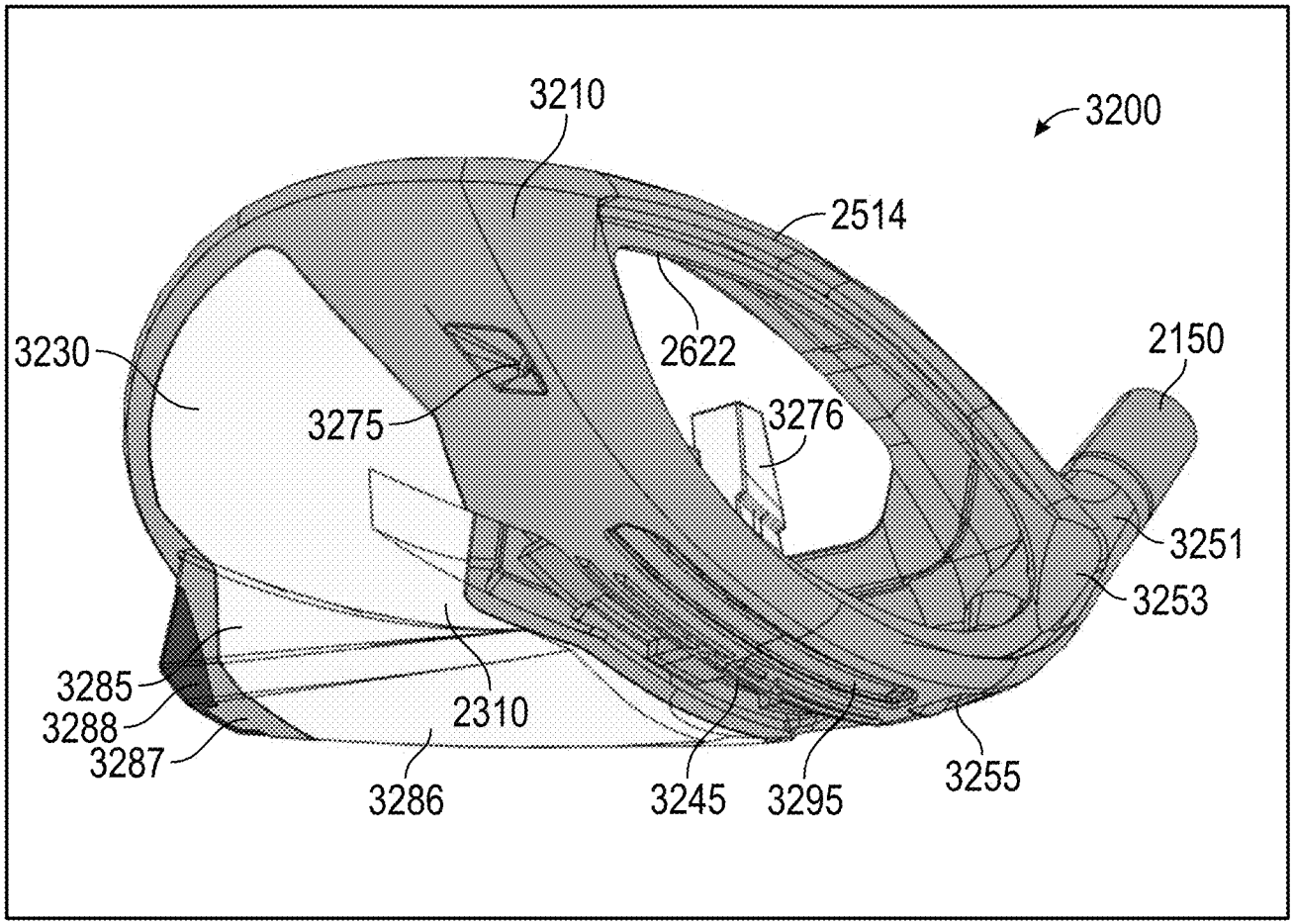
FIG. 120 is a perspective view from a toe side of a golf club head in accord with one embodiment of the current disclosure, without a face insert installed.

FIG. 120 is a perspective view from a toe side of a golf club head 3200. In this embodiment, the golf club head 3200 includes a hollow body 3210. The hollow body 3210 includes a hosel 2150, a crown 2120 (not depicted), and a sole 2130. In some embodiments, the hollow body 3210 has openings to receive the face insert 2110 (not depicted), a crown insert 3220, and/or a sole insert 3230. In some embodiments, the hollow body is a metal or composite material frame, and the face insert 2110 (not depicted), a crown insert 3220, and/or a sole insert 3230 are at least in part composite materials. The hollow body 3210 is cast with a ledge 2622 for receiving a face insert 2110 (not depicted). By bonding the face insert 2110 to the ledge 2622, the transition between the face 2110 and the crown 2120 provide for a primary alignment feature 2514, such as a topline or another alignment feature. For example, the hollow body 3210 may be cast from a titanium alloy, an aluminum alloy, another alloy, or a combination thereof. The hollow body 3210 is painted prior to bonding a face insert 2110 (not depicted), a crown insert 3220 (not depicted), and/or a sole insert 3230. By bonding the face insert and/or the crown insert, one or more alignment features are hard tooled into the golf club head 3200. The face insert 2110, a crown insert 3220, and/or a sole insert 3230 may be bonded to the hollow body 3210 after the hollow body 3210 is painted, such as by bonding the face insert 2110 first, then boding the crown insert 3220. Alternatively, the crown insert 3220 is bonded first, followed by the face insert 2110. By bonding the inserts after the hollow body 3210 is painted, the one or more alignment features are hard tooled into the golf club head during casting and bonding. In some embodiments, at least a portion of the crown and sole inserts 3220, 3230 are manufactured from a composite material.

In other embodiments, one or more alignment features are hard tooled into the golf club head by casting one or more witness lines into the golf club head. For example, one or more positive witness lines may be cast into the hollow body 3210, such as by casting a protrusion, ridge, or other raised feature in the hollow body 3210. In another example, one or more negative witness lines may be cast into the hollow body 3210, such as an indentation, valley, or other depressed feature into the hollow body 3210. In some embodiments, a combination of positive and negative witness lines may be provided. The one or more witness line may be painted with the hollow body 3210 to provide one or more alignment features. Alternatively or additionally, the witness lines may be used as a guide for painting one or more alignment features on the golf club head. By casting the witness lines in the golf club head during manufacturing, the subsequent painting of the one or more alignment features may be more accurate from part to part.

Referring to FIG. 120, in some embodiments, the hosel 2150 may be adjustable, such as using flight control technology (FCT) in the hosel 2150. For example, FCT may include a loft and lie connection sleeve to adjust, inter alia, face angle. The FCT may be adjustable with a screw 3255 or another connector. The hosel 2150 also includes an external hosel surface 3251 and an internal hosel surface 3253. The internal hosel surface 3253 may occupy at least a portion of the face opening or region for receiving the face insert 2110 (not depicted). To accommodate the internal hosel surface 3253, a notch or other feature is provided in face insert 2110 for accepting at least a portion of the hosel within the face insert 110. As discussed herein, the notch may reduce CFY and accommodates at least a portion of the hosel within the face insert. Further, by accommodating for a portion of the hosel within the face insert, a portion of the face insert may extend high on the heel and follow the natural shape of the crown and/or other features of the club head. In some embodiments, the face insert 2110 ties directly into the hosel 2150. By accommodating at least a portion of the internal hosel surface 3253 within the face insert 2110, a center-face location 3110 (not depicted) of the face insert 2110 may be located closer to a center point location 3150 (not depicted) of the hosel 2150, reducing CFY and increasing performance of the golf club head.

In some embodiments, the golf club head 3200 includes a slot 3295 and a weight track 3245. For example, the slot 3295 and/or the weight track 3245 may be cast into the hollow body 3210. As will be discussed below, the slot 3295 may increase the durability of the golf club head by allowing at least a portion of the hollow body 3210 to flex similarly to the face insert 2110, increasing performance of the golf club head and increasing the durability of the golf club head by preventing the face insert 2110 from decoupling from the hollow body 3210. In some embodiments, the golf club head 3200 includes one or more characteristic time (CT) tuning ports. Referring to FIG. 120, a CT tuning port 3275 is provided in the toe portion of the hollow body 3210. Another CT tuning port (not depicted) may be provided in the heel portion of the hollow body 3210. The one or more CT tuning ports may be provided in additional and different locations on the golf club head 3200, such in the face insert 2110 or in another location. Using the CT tuning port(s), an adhesive or another material may be injected into the golf club head 3200 to reduce or increase the CT of the golf club head. For example, the golf club head 3200 may be manufactured with a CT that does not conform to the United States Golf Association (USGA) regulations that constrain CT of golf club heads. By injecting an adhesive into the CT tuning port 3275, the CT of the golf club head is detuned to conform to the USGA regulations.

In some embodiments, the golf club head includes one or more foam inserts. For example, a foam insert 3276 is positioned within the hollow body 3210. An additional foam insert is also provided proximate to the toe portion (not depicted). The one or more foam inserts aid in CT tuning the golf club head by restraining the adhesive or other material to locations within the golf club head while the material solidifies. Additionally, a rear wall may also be provided to further restrain the material while it solidifies. Accordingly, the foam inserts and the rear wall prevent the adhesive injected into the tuning port 3275 from moving too far toeward, heelward, and backward, allowing the golf club head to be CT tuned more precisely. Additional and different structures may be provided to restrain the injected materials during CT tuning. Further information related to CT tuning is discussed is U.S. patent application Ser. No. 16/223,108 filed Dec. 17, 2018 which is hereby incorporated by reference in its entirety.

In some embodiments, the golf club head includes a multi-material inertia generator. An inertia generator, as discussed herein, may also be referred to as an aft winglet and a center of gravity (CG) lowering platform. The inertia generator 3285 moves discretionary mass rearward to increase inertia and to move the CG projection lower on the face of the golf club head. For example, the golf club head 3200 includes an inertia generator 3285 extending rearwardly and angled toewardly from the front portion of the golf club head 3200 to the rear portion of the golf club head 3200. A multi-material inertia generator may include two or more materials of different densities. For example, the inertia generator 3285 includes one or more of a low density portion 3286, a medium density portion 3287, and a high density portion 3288.

The low density portion 3286 may be a composite or another material, such as a portion of the composite sole panel 3230 or as another component. The low density portion 3286 has a density of less than about 2 g/cc, such as between about 1 g/cc and about 2 g/cc. The medium density portion 3287 may be an aluminum alloy, a titanium alloy, another alloy, another material, or a combination of multiple alloys or materials, such as a portion of the hollow body 3210 or as another component. The medium density portion 3287 has a density greater than about 2.7 g/cc, such as between about 1 g/cc and about 5 g/cc, between about 2.0 g/cc and about 5.0 g/cc, and between about 2.5 g/cc and about 4.5 g/cc. The high density portion 3288 may be a steel alloy, a tungsten alloy, another alloy, another material, or a combination of multiple alloys or materials, such as a rear weight affixed to the inertia generator 3285 or as another component. The high density portion 3288 has a density greater than about 7 g/cc. For example, an aluminum alloy is often about 2.7 g/cc, a titanium alloy is often about 4.5 g/cc, a steel alloy is often about 7.8 g/cc, and tungsten alloy a tungsten alloy is often about 19 g/cc.

Figure 121:
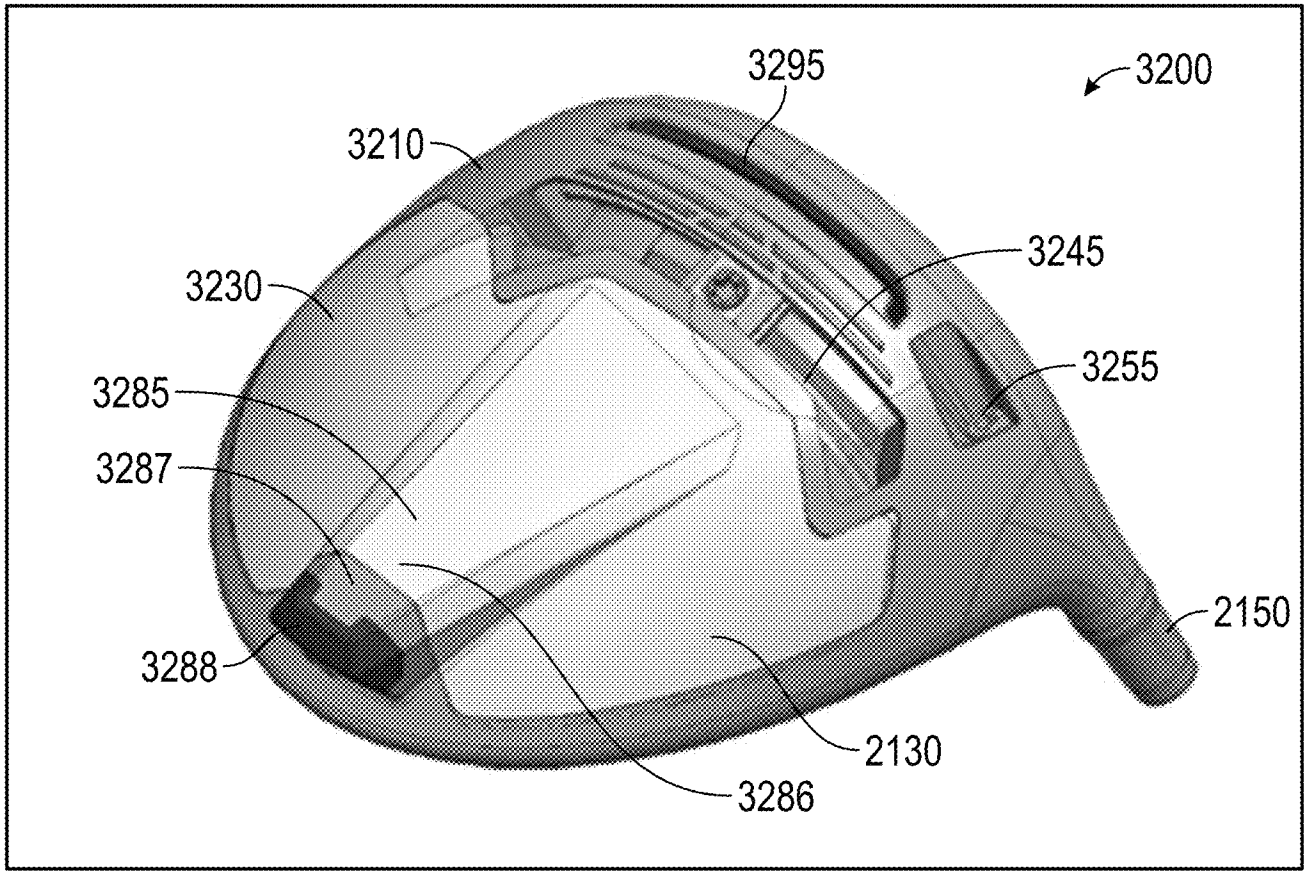
FIG. 121 is a perspective view from heel side of a golf club head in accord with one embodiment of the current disclosure.

FIG. 121 is a perspective view from a toe side of a golf club head 3200. FIG. 121 provides another view of the sole 2130 with the insert 3230, the inertia generator 3285, the slot 3295, the weight track 3245 and the screw 3255. The inertia generator 3285 is provided as a multi-material inertia generator, with a low density portion 3286, medium density portion 3287, and high density portion 3288.

Figure 122:
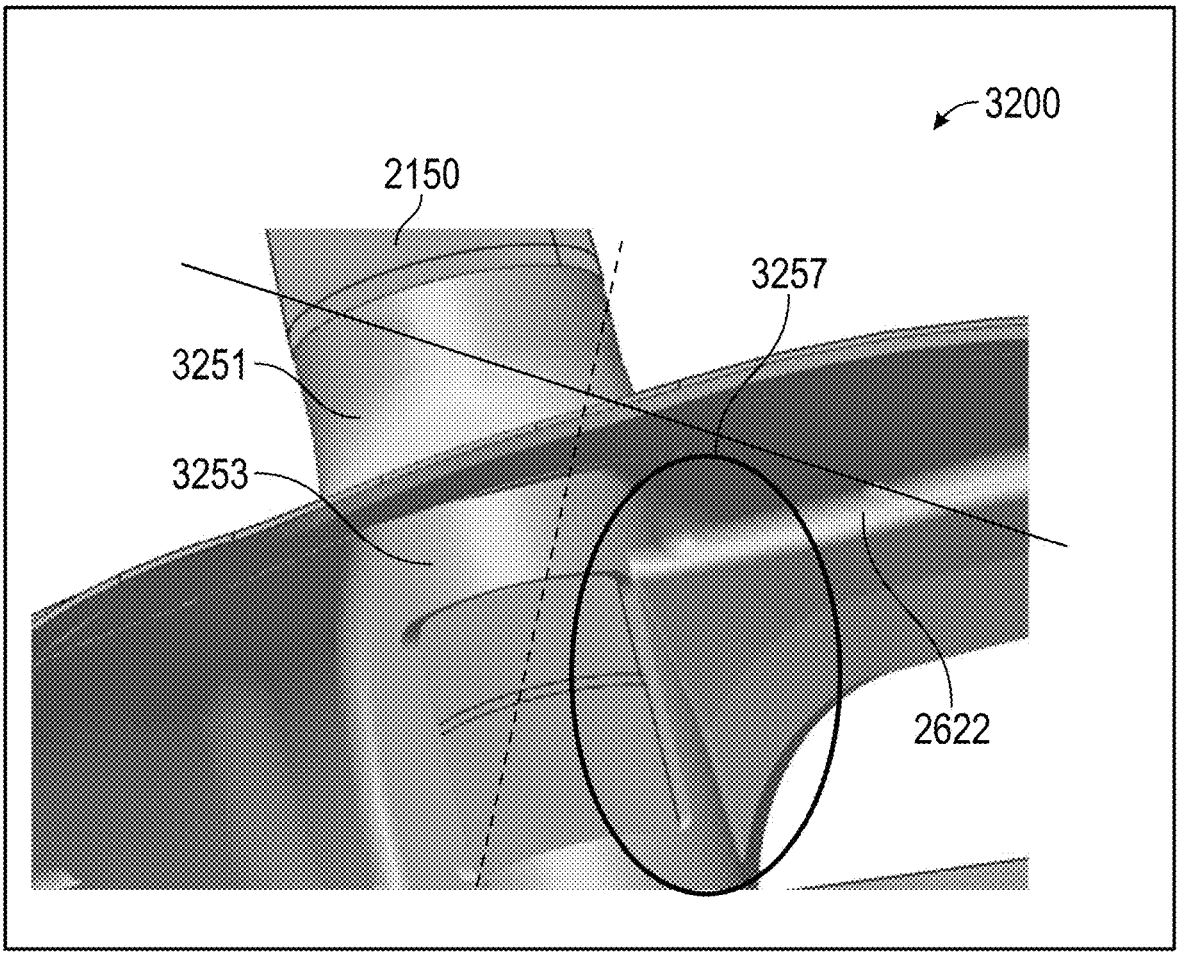
FIG. 122 is a perspective view of a portion of a golf club head in accord with one embodiment of the current disclosure.

FIG. 122 is a perspective view of a portion of a golf club head 3200. FIG. 122 shows the hosel 2150 with the external hosel surface 3251 and the internal hosel surface 3253. As depicted in FIG. 122, the ledge 2622 for receiving a face insert 2110 (not depicted) is joined to the internal hosel surface 3253 within an intersection region 3257. The face support, such as including ledge 2622, intersects and joins with the internal hosel surface 3253 allowing the internal hosel surface 3253 to interact with and/or be at least partially within the face insert 2110. The face support may intersect and/or join the internal hosel surface 3253 proximate to the crown, proximate to the sole, or proximate to the crown and the sole.

Figure 123:
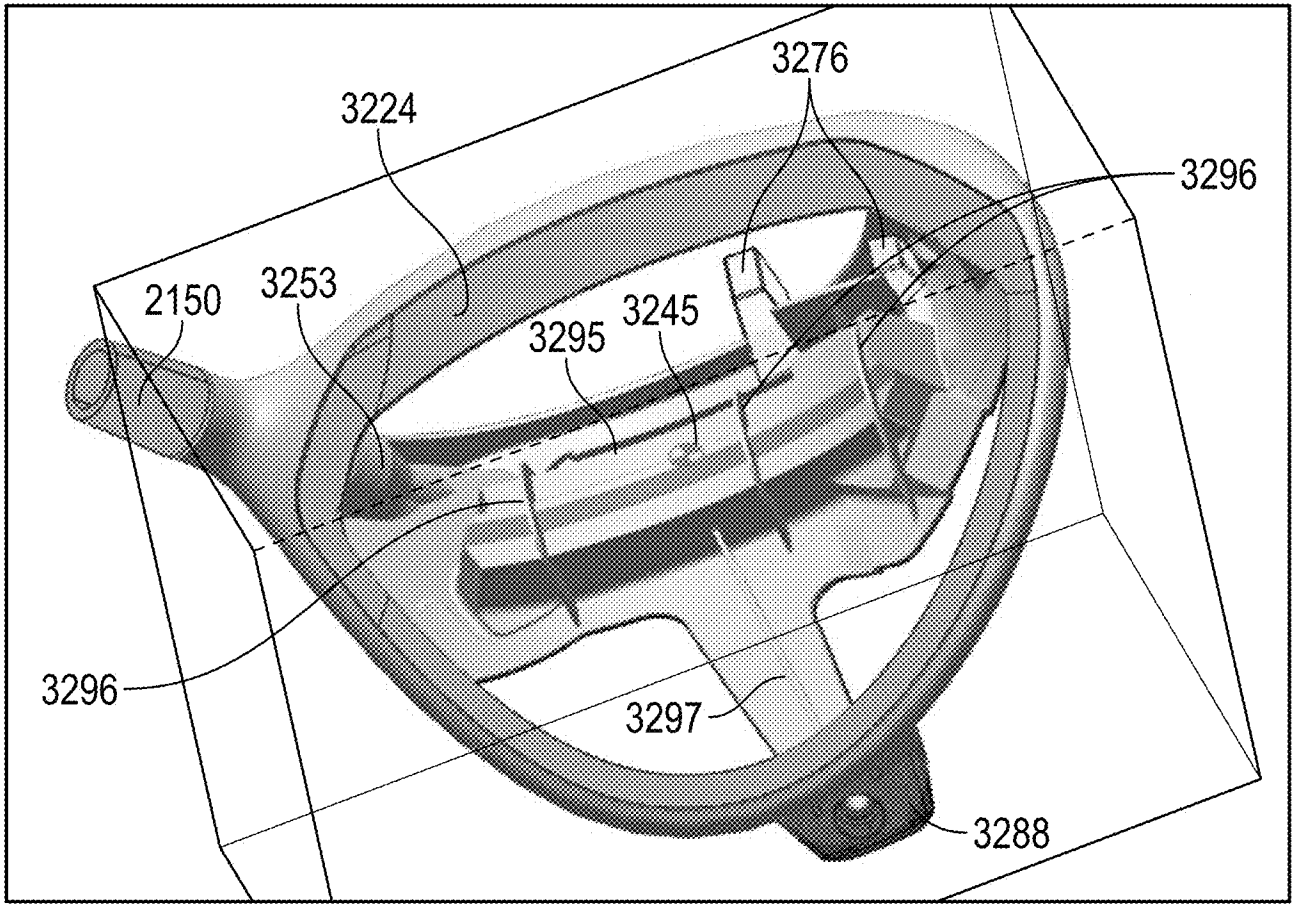
FIG. 123 is a perspective view from the rear portion of a golf club head in accord with one embodiment of the current disclosure, without a crown insert installed.

FIG. 123 is a perspective view from the rear portion of a golf club head 3200, without a crown insert 3220 installed. FIG. 123 shows a club head 3200 with hosel 2150, internal hosel surface 3253, foam inserts 3276, and high density portion 3288. A ledge 3224 is provided for bonding a crown insert 3220 (not depicted). The ledge 3224 is wider proximate to the front portion and the face of the club head to provide for additional CT tuning. For example, in addition to supporting the crown insert 3220, a width of the ledge 3224 is increased to decrease the CT of the club head. In an embodiment, the ledge 3224 width is increased from about 10 mm to about 15 mm proximate the face. During or after manufacture, material can be removed from the ledge 3224 to increase the CT of the club head, such as increasing the CT by about 8 to about 10 points. As discussed above, CT tuning is typically used to reduce CT of a club head to meet the USGA constraints. If the CT of a club head is determined to be too far under the USGA constraints, the club head can be tuned using the ledge 3224 to increase CT to approach or exceed the USGA constraints.

In some embodiments, the golf club head 3200 includes support ribs 3296, 3297. For example, support ribs 3296 provide for additional support for the hollow body 3210, the weight track 3245 and/or slot 3295. The support ribs 3296 may be provided over the weight track 3245 and in other areas within the hollow body 3210. Support rib 3297 may be provided to support supports the hollow body 3210 and inertia generator 3285. As depicted in FIG. 123, the hollow body 3210 includes a platform of material extending in the direction of the inertia generator 3285 that includes the support rib 3297. Additional and different support ribs may be provided.

Figure 124:
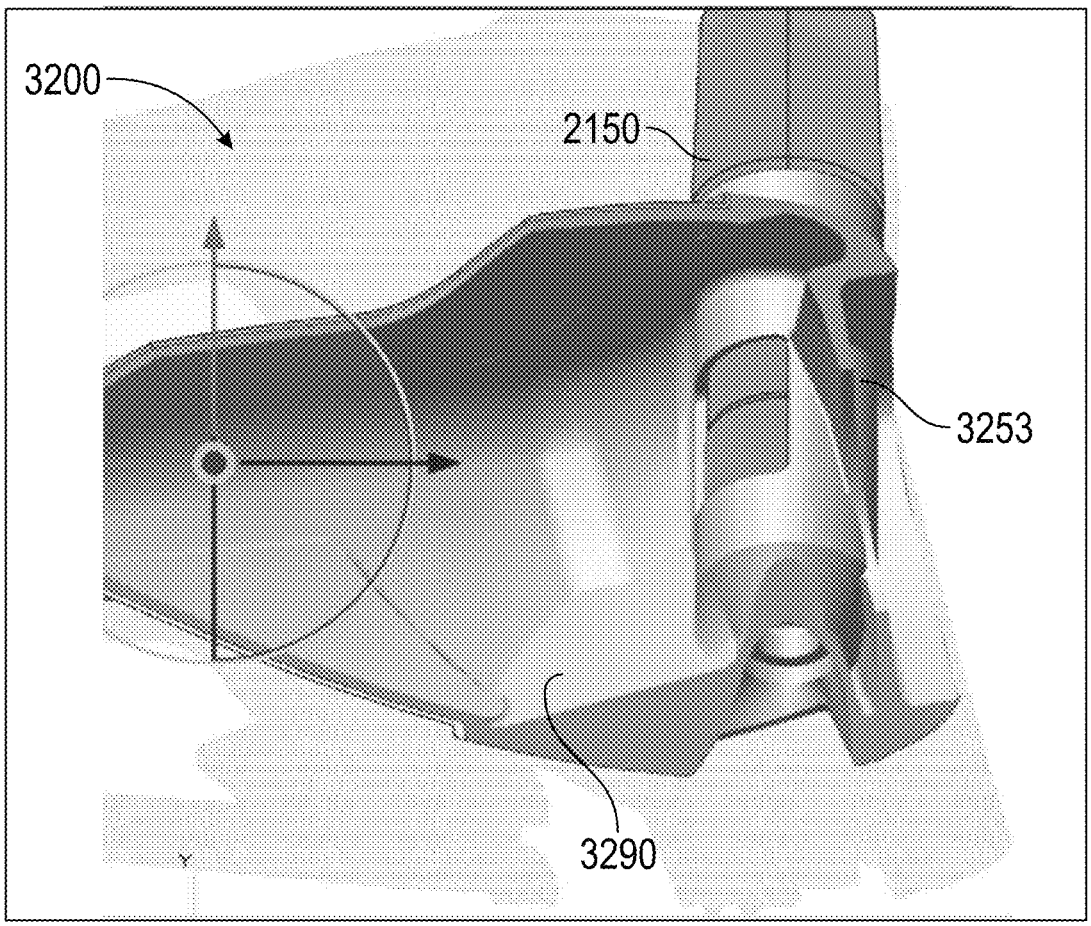
Figure 125:
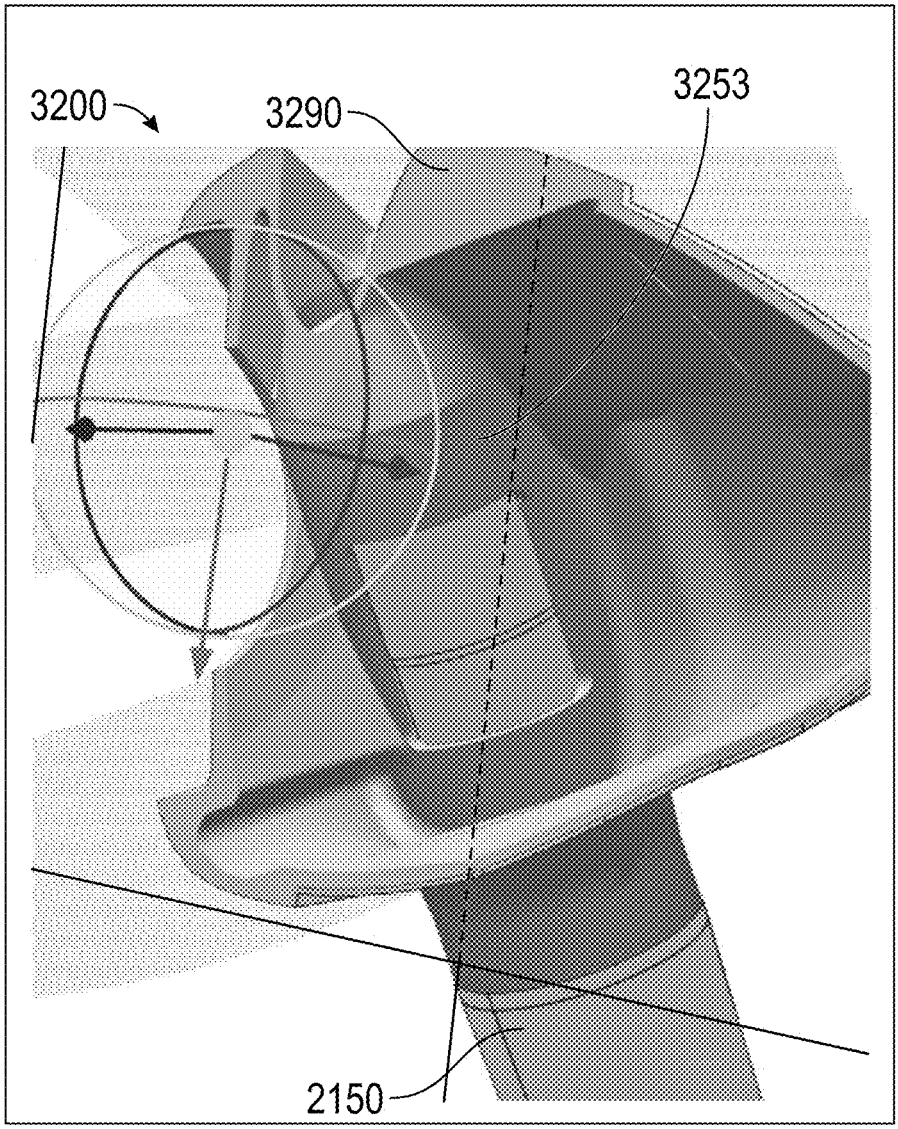

FIGS. 124-125 are views of portions of a golf club head 3200. FIG. 124 shows internal hosel surface 3253 occupying at least a portion of the face opening or region for receiving the face insert 2110 (not depicted). By occupying at least a portion of the face opening or region for receiving the face insert 2110, face progression and onset may be reduced, increasing performance of the golf club head 3200.

In some embodiments, the golf club head 3200 includes a mass pad 3290 in the heel portion of the golf club head. Mass pad 3290 positions discretionary mass of the golf club head 3200 heelward, and may lower the CG and move CG forward to modify the CG projection onto the face. In some embodiments, a removable and/or adjustable weight may be provided in the heel portion in lieu of or in addition to the mass pad 3290.

Figure 126:
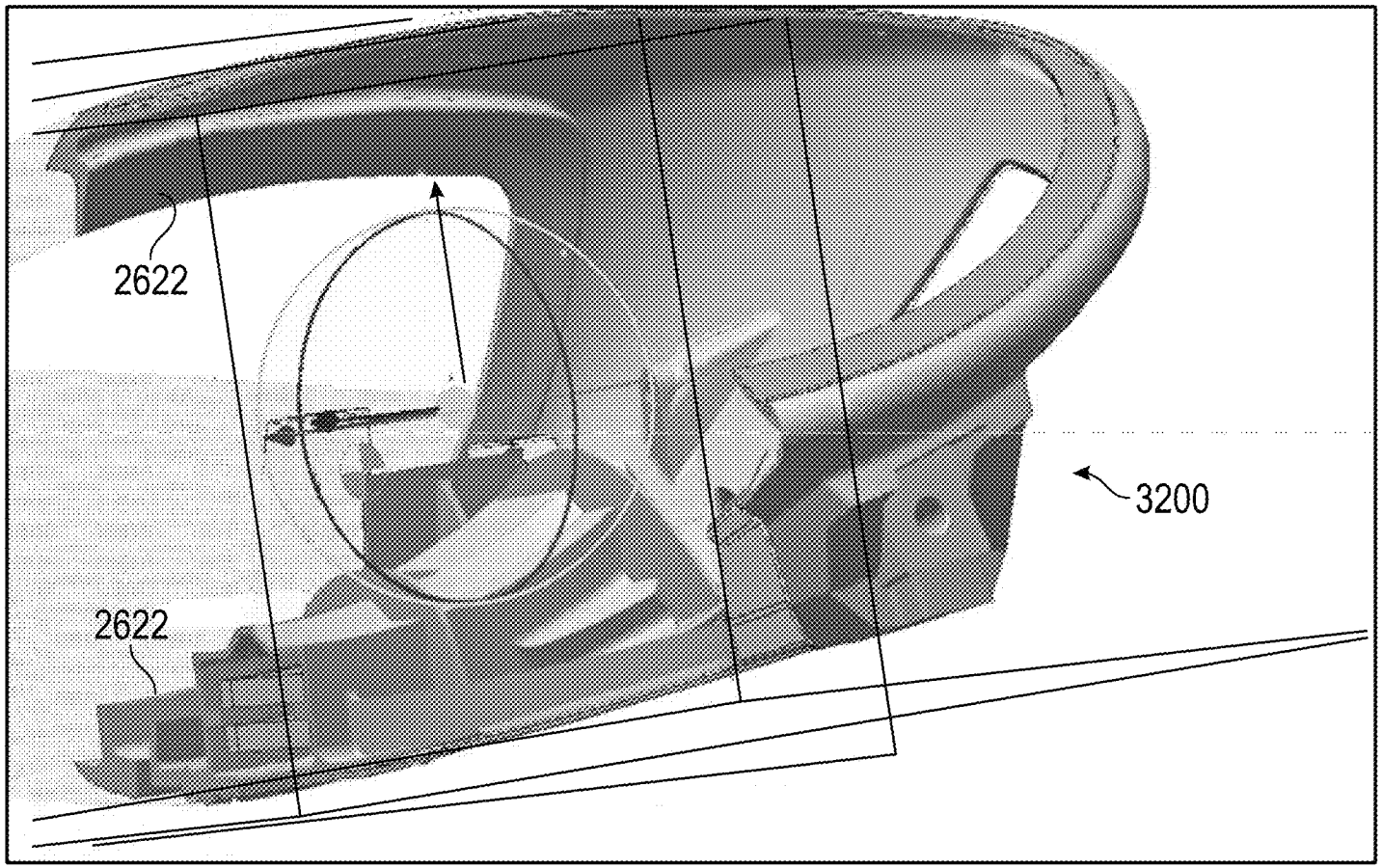
Figure 127:
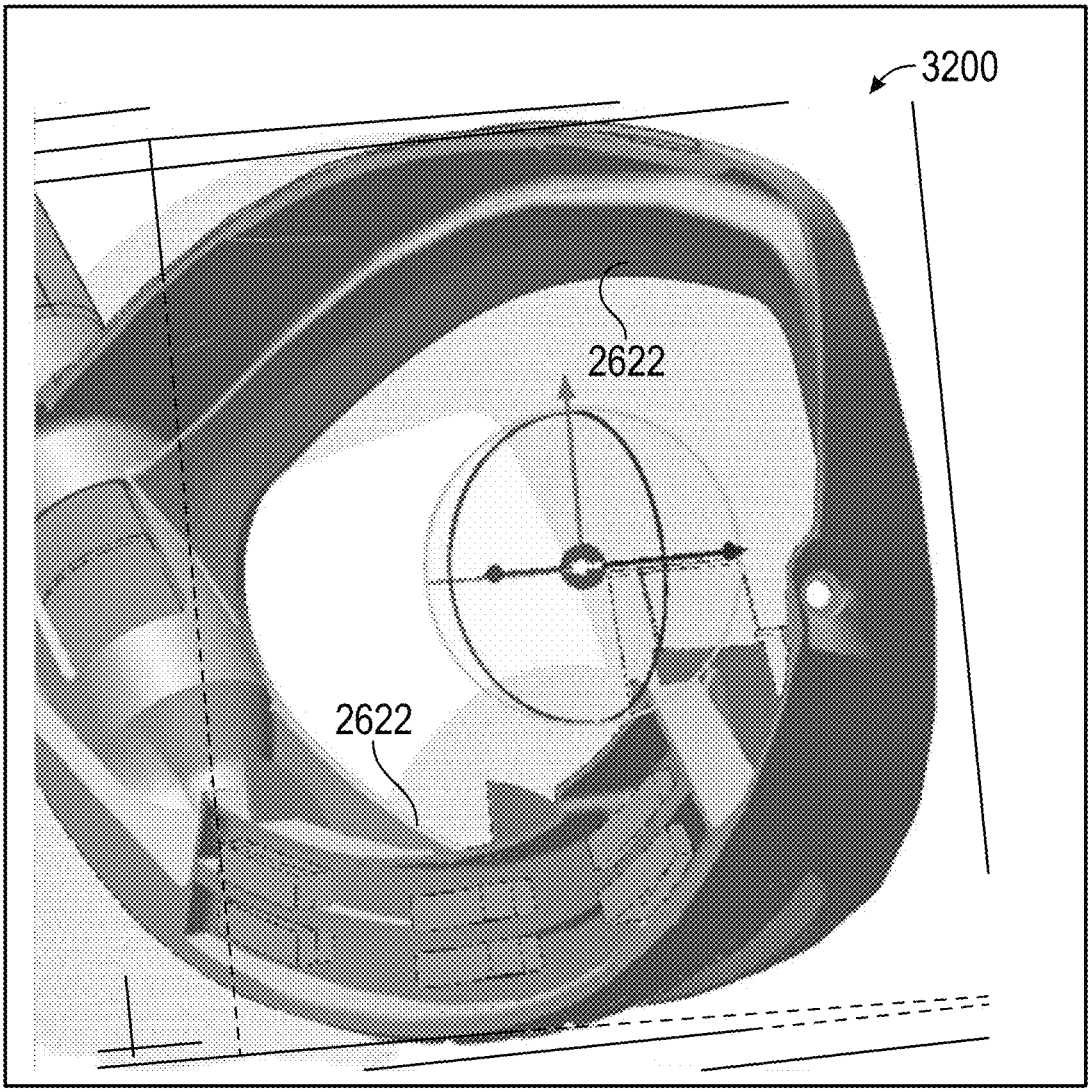

FIGS. 126-127 are views of portions of a golf club head 3200. As depicted in FIGS. 126-127, the ledge 2622 extends around the entire periphery of the face opening to support the face insert 2110 (not depicted). By extending around the entire periphery, the ledge 2622 supports the entire face insert 2110. In other embodiments, the ledge 3224 supports the face insert 2110 in the heel portion, toe portion, crown portion and sole portion. For example, the ledge 2622 supports the face insert 2110 in a region defined by about a 10 mm band about the geometric center of the face insert 2110. Other bands about the geometric center of the face insert may be used, such as about 15 mm and about 20 mm. Additional and different structures may be used to support the face around the entire periphery of the face or in regions about the geometric center of the face.

Figure 128:
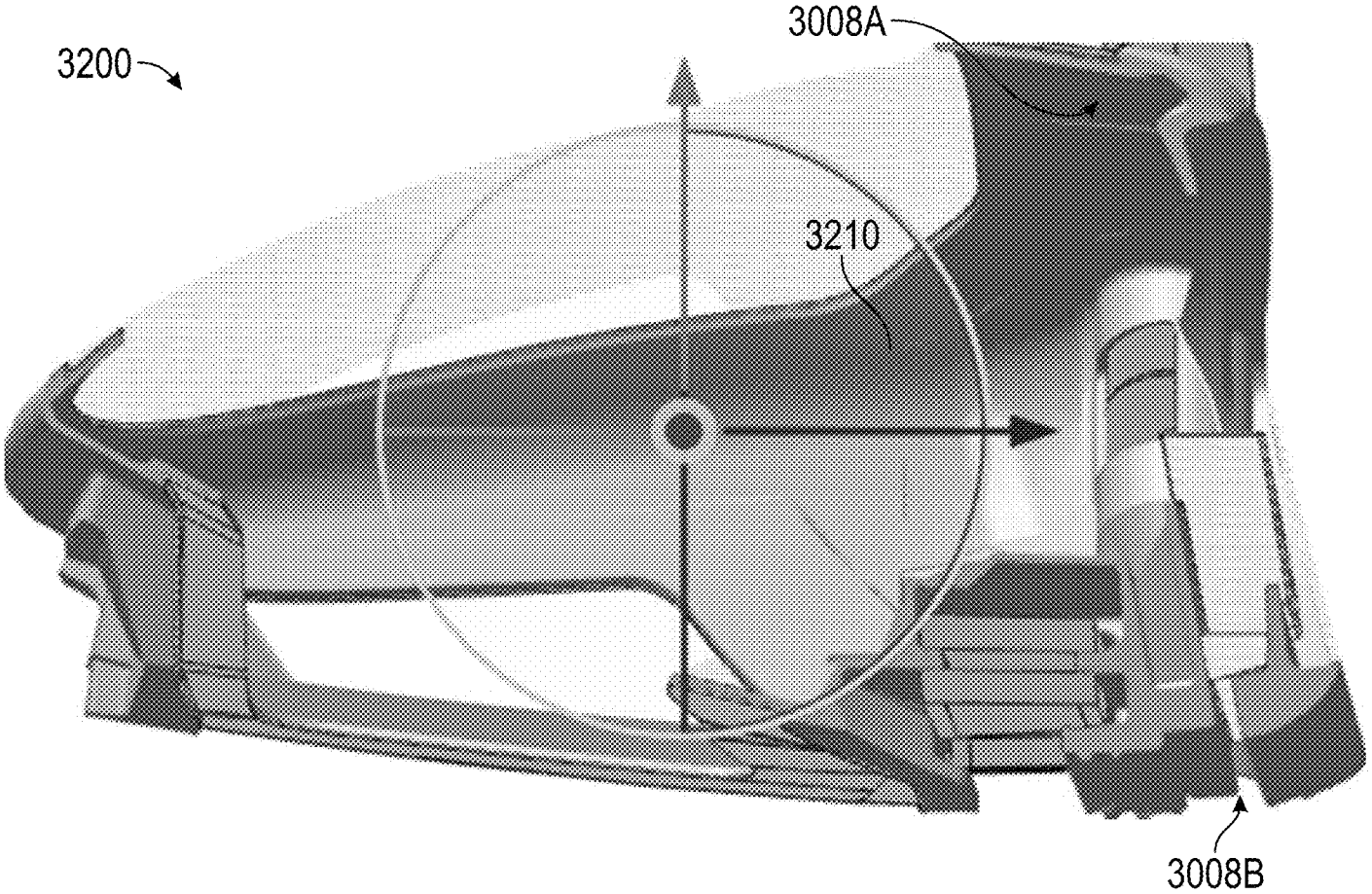

FIG. 128 is a view of a portion of a golf club head 3200. FIG. 128 shows the upper face insert support structure 2928A and the lower face insert support structure 2928B provided so that at least a portion of the hollow body 3210 flexes in a similar manner as the face insert 2110 (not depicted) when the golf club head strikes a golf ball. Different materials (e.g., metal alloys and composites) have different flex characteristics and typically flex differently from each other. For example, the slot or recess 3008A and the slot or recess 3008B allow a composite face to flex more uniformly with the cast hollow body 3210. Additional and different geometries within the hollow body 3210 may be provided. By flexing in a similar manner, the golf club head may be more durable, substantially preventing the face insert from decoupling, or de-bonding, from the golf club body.

Figure 129:
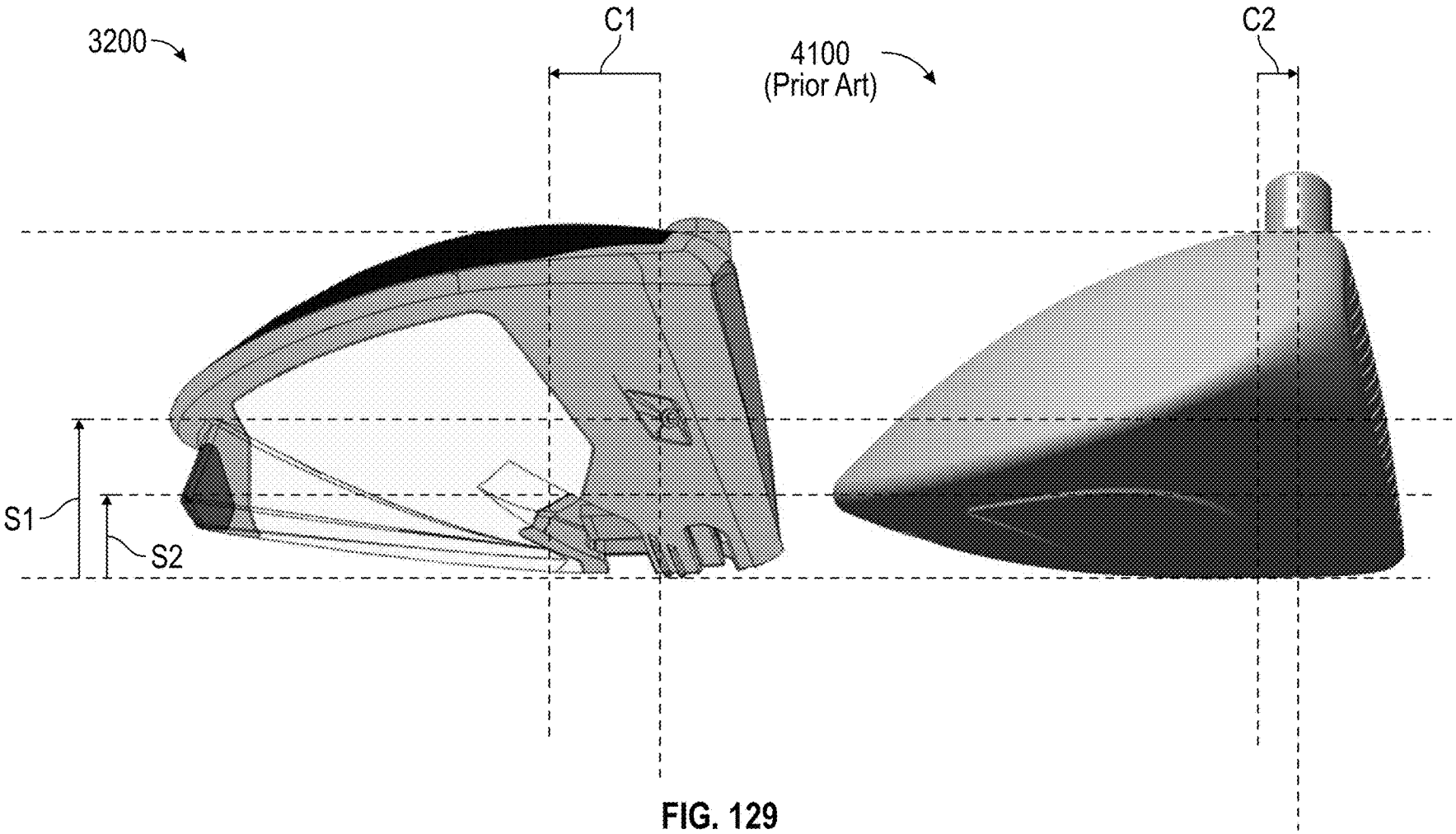

FIG. 129 is a perspective view from a toe side of two golf club heads 3200, 4100. The golf club head 3200 is an embodiment of the present disclosures and golf club head 4100 is an embodiment of a prior art club head design. The golf club head 3200 includes features that improve the aerodynamic features of the club head. For example, the prior art club head 4100 has a peak crown height that is located approximately in line with a center shaft axis of the hosel, referred to as an acute crown. To promote better aerodynamic properties of the golf club head 3200, the peak crown height is located rearward of the hosel, referred to as an obtuse crown. Referring to FIG. 129, the peak crown height of the golf club head 4100 is located a distance C2 forward of the rear-most edge of the hosel. To promote better aerodynamics, the peak crown height of the golf club head 3200 is located a distance C1 rearward of the rear-most edge of the hosel. In an embodiment, the peak crown height of the golf club head 3200 is located at least about 15 mm rearward of the rear-most edge of the hosel. Moving the peak crown height rearward allows aero flow to be attached to the club head longer, promoting better aerodynamic properties.

The skirt height of golf club 3200 may also improve aerodynamic features of the golf club head. Golf club head 3200 has a skirt height S1, which may measure the lowest point above the ground plane at which the skirt meets the crown. Golf club head 4100 has a skirt height S2. In some embodiments, the skirt height S1 is at least 20 mm, and in some embodiments may be between about 25 mm and about 40 mm, such as between 30 mm and 40 mm, or between 30 mm and 35 mm. Increasing the skirt height S1 of golf club head 3200 likewise improves the aerodynamic properties of the golf club head. The golf club body has a total body height from defined from a bottom most portion of the golf club body, or the ground plane, to a top-most portion of the crown, or the peak crown height, such as vertically or along a z-axis. In some embodiments, the total body height is no less than 48 mm, no less than 42 mm, or no less than 53 mm. The golf club body also has a body length defined from a leading edge of the golf club body, or the leading-edge location, to a rearward most portion of golf club head, or the rearward most portion of the skirt, such as horizontally or along a y-axis. In some embodiments, the body length is no less than 98 mm, no less than 93 mm, or no less than 103 mm.

Figure 130:
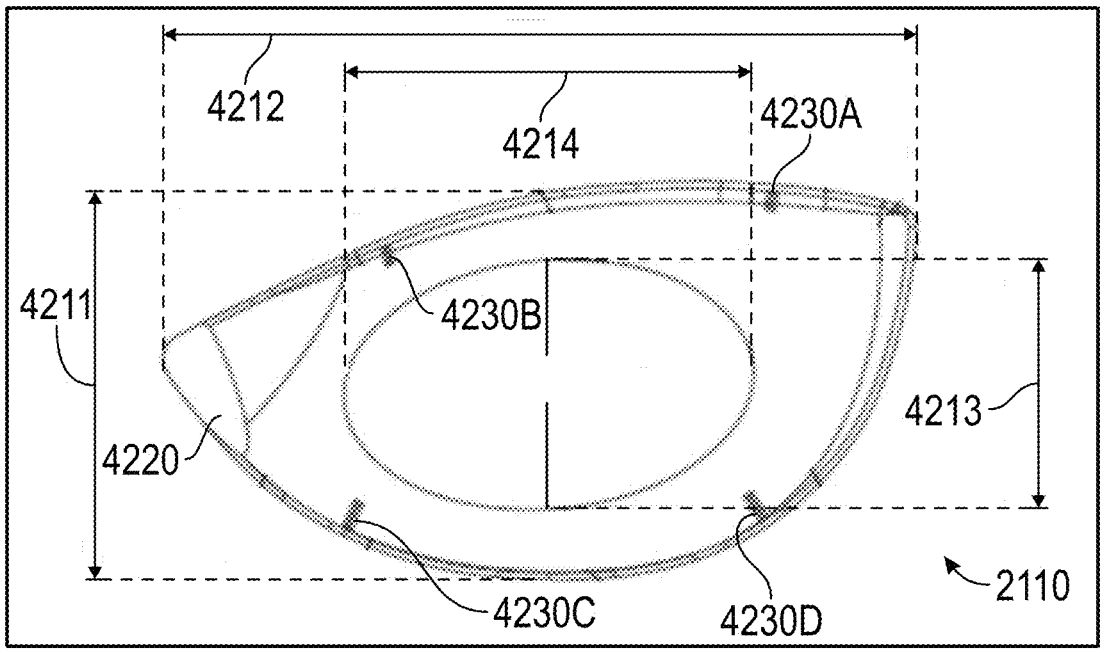

FIG. 130 is a front elevation view of a face insert 2110. Further details concerning the construction and manufacturing processes for the composite face plate are described in U.S. Pat. No. 7,871,340 and U.S. Published Patent Application Nos. 2011/0275451, 2012/0083361, and 2012/0199282. The composite face plate is attached to an insert support structure located at the opening at the front portion of the club head. Further details concerning the insert support structure are described in U.S. Pat. No. RE43,801.

In some embodiments, the face insert 2110 can be machined from a composite plaque. In an example, the composite plaque can be substantially rectangular with a length between about 90 mm and about 130 mm or between about 100 mm and about 120 mm, preferably about 110 mm±1.0 mm, and a width between about 50 mm and about 90 mm or between about 6 mm and about 80 mm, preferably about 70 mm±1.0 mm plaque size and dimensions. The face insert 2110 is then machined from the plaque to create a desired face profile. For example, the face profile length 4212 can be between about 80 mm and about 120 mm or between about 90 mm and about 110 mm, preferably about 102 mm. The face profile width 4211 can be between about 40 mm and about 65 mm or between about 45 mm and about 60 mm, preferably about 53 mm. The ideal striking location width 4213 can be between about 25 mm and about 50 mm or between about 30 mm and about 40 mm, preferably about 34 mm. The ideal striking location length 4214 can be between about 40 mm and about 70 mm or between about 45 mm and about 65 mm, preferably about 55.5 mm. Alternatively, the face insert 2110 can be molded to provide the desired face dimensions and profile.

In embodiments where the face insert 2110 is machined from a composite plaque, the face insert 2110 can be machined in one or more operations, such as computer numerical control (CNC) or other operations. For example, starting with the composite plaque, a notch 4220 can be first machined from the plaque. Next, a perimeter chamfer can be machined around the perimeter of the face insert 2110. Finally, a face profile can be machined from the plaque. In some embodiments, each of the notch 4220, perimeter chamfer, and face profile can be machined in a single operation, such as a single CNC operation without removing the plaque from the CNC fixture. In other embodiments, multiple operations can be performed, such as machining one or more of the notch 4220, perimeter chamfer, or face profile being machined separately from the other features of the face. Other orders of machining features can be provided, such as machining the notch after the face profile and chamfer, as well as machining additional features into the face insert 2110, such as bond gap bumps and other features.

Additional features can be machined or molded into face the insert 2110 to create the desired face profile. 2For example, a notch 4220 can be machined or molded into the backside of a heel portion of the face insert 110. For example, the notch 4220 in the back of the face insert 2110 allows for the golf club head 2500 to utilize flight control technology (FCT) in the hosel 2150. The notch 4220 can be configured to accept at least a portion of the hosel within the face insert 2110. Alternatively or additionally, the notch 4220 can be configured to accept at least a portion of the club head body within the face insert 2110.

In some embodiments, the notch 4220, or another relief portion, defines a transition region on the face insert. For example, the notch 4220 or relief portion is proximate to a heel portion of the face and can have an area of at least about 50 $mm^2$ and no more than about 300 $mm^2$, preferably less than about 200 $mm^2$, more preferably between about 75 $mm^2$ and about 150 $mm^2$. Preferably, the notch area is about 1.5% to about 6% of the external area of the face insert (e.g., the outward facing portion of the face configured for striking the golf ball), more preferably the notch area is about 2% to about 3% of the external face insert.

The notch may allow for the reduction of CFY by accommodating at least a portion of the hosel and/or at least a portion of the club body within the face insert, allowing the ideal striking location of the face insert to be closer to a plane passing through a center point location of the hosel. The face insert 2110 can be configured to provide a CFY no more than about 18 mm and no less than about 9 mm, preferably between about 11.0 mm and about 16.0 mm, and more preferably no more than about 15.5 mm and no less than about 11.5 mm. The face insert 2110 can be configured to provide face progression no more than about 21 mm and no less than about 12 mm, preferably no more than about 19.5 mm and no less than about 13 mm and more preferably no more than about 18 mm and no less than about 14.5 mm. In some embodiments, a difference between CFY and face progression is at least 2 mm and no more than 12 mm, preferably between at least 3 mm and 8 mm. In other embodiments, a difference between CFY and face progression is at least 2 mm and no more than 4 mm.

In another example, backside bumps 4230A, 4230B, 4230C, 4230D may be machined or molded into the backside of the face insert. The backside bumps 4230A, 4230B, 4230C, 4230D can be configured to provide for a bond gap. A bond gap is an empty space between the club head body and the face insert that is filled with adhesive during manufacturing. The backside bumps 4230A, 4230B, 4230C, 4230D protrude to separate the face from the club head body when bonding the face insert to the club head body during manufacturing. In some instances, too large or too small of a bond gap may lead to durability issues of the club head, the face insert, or both. Further, too large of a bond gap can allow too much adhesive to be used during manufacturing, adding unwanted additional mass to the club head. The backside bumps 4230A, 4230B, 4230C, 4230D can protrude between about 0.1 mm and 0.5 mm, preferably about 0.25 mm. In some embodiments, the backside bumps are configured to provide for a minimum bond gap, such as a minimum bond gap of about 0.25 mm and a maximum bond gap of about 0.45 mm.

Further, one or more of the edges of the face insert 2110 can be machined or molded with a chamfer. In an example, the face insert 2110 includes a chamfer substantially around the inside perimeter edge of the face insert, such as a chamfer between about 0.5 mm and about 1.1 mm, preferably 0.8 mm. In some embodiments, the perimeter chamfer is provided to avoid the face insert 2110 bottoming out on an internal radius of the recessed face opening of the golf club head configured to receive the face insert 2110. By providing the perimeter chamfer, the face insert 2110 can fit properly within recessed face opening despite manufacturing variances and other characteristics of the golf club head created during the casting process.

Figure 131:
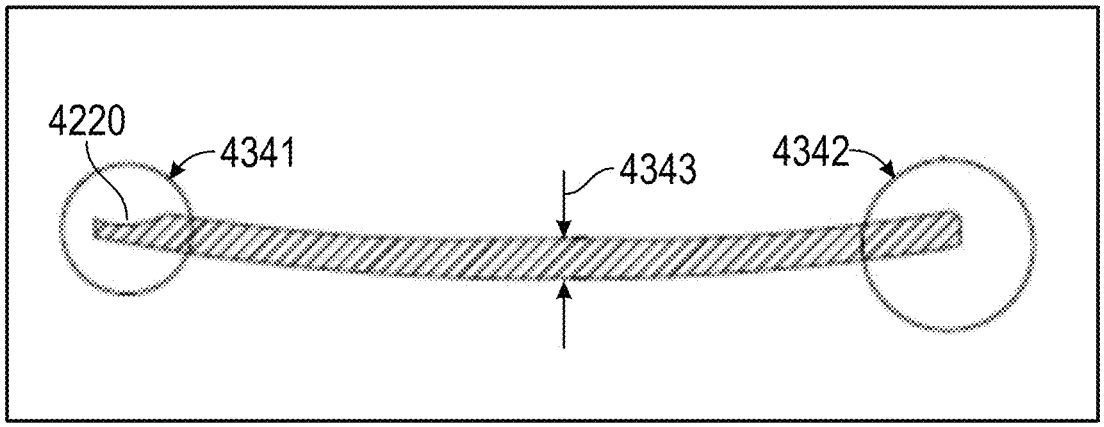

FIG. 131 is a is a bottom perspective view of a face insert 2110. The face insert has a heel portion 4341 and a toe portion 4342. The notch 4220 is machined or molded into the heel portion 4341. In this example, the face insert 110 has a variable thickness, such as with a peak thickness 4343. The peak thickness 4343 can be between about 2 mm and about 7.5 mm or between about 3.8 mm and about 4.8 mm, preferably 4.1 mm±0.1 mm, 4.25 mm±0.1 mm, or 4.5 mm±0.1 mm.

In some embodiments, the face insert 2110 is manufactured from multiple layers of composite materials. Exemplary composite materials and methods for making the same are described in U.S. patent application Ser. No. 13/452,370 (published as U.S. Pat. App. Pub. No. 2012/0199282), which is incorporated by reference. In some embodiments, an inner and outer surface of the composite face can include a scrim layer, such as to reinforce the face insert 2110 with glass fibers making up a scrim weave. Multiple quasi-isotropic panels (Q's) can also be included, with each Q panel using multiple plies of unidirectional composite panels offset from each other. In an exemplary four-ply Q panel, the unidirectional composite panels are oriented at 90°, −45°, 0°, and 45°, which provide for structural stability in each direction. Clusters of unidirectional strips (C's) can also be included, with each C using multiple unidirectional composite strips. In an exemplary four-strip C, four 27 mm strips are oriented at 0°, 125°, 90°, and 55°. C's can be provided to increase thickness of the face insert 2110 in a localized area, such as in the center face at the ideal striking location. Some Q's and C's can have additional or fewer plies (e.g., three-ply rather than four-ply), such as to fine tune the thickness, mass, localized thickness, and provide for other properties of the face insert 2110, such as to increase or decrease COR of the face insert 2110.

Additional composite materials and methods for making the same are described in U.S. Pat. Nos. 8,163,119 and 10,046,212, which is incorporated by reference. For example, the usual number of layers for a striking plate is substantial, e.g., fifty or more. However, improvements have been made in the art such that the layers may be decreased to between 30 and 50 layers.

The tables below provide examples of possible layups. These layups show possible unidirectional plies unless noted as woven plies. The construction shown is for a quasi-isotropic layup. A single layer ply has a thickness of ranging from about 0.065 mm to about 0.080 mm for a standard FAW of 70 gsm with about 36% to about 40% resin content. The thickness of each individual ply may be altered by adjusting either the FAW or the resin content, and therefore the thickness of the entire layup may be altered by adjusting these parameters.

In addition to the unidirectional composite panels oriented at 90°, −45°, 0°, and 45°, additional Q panels can be provided according to table 1.

The Area Weight (AW) is calculated by multiplying the density times the thickness. For the plies shown above made from composite material the density is about 1.5 g/cm$^3$ and for titanium the density is about 4.5 g/cm$^3$.

In an example, a first face insert can have a peak thickness of 4.1 mm and an edge thickness of 3.65 mm, including 12 Q's and 2 C's, resulting in a mass of 24.7 g. In another example, a second face insert can have a peak thickness of 4.25 mm and an edge thickness of 3.8 mm, including 12 Q's and 2 C's, resulting in a mass of 25.6 g. The additional thickness and mass is provided by including additional plies in one or more of the Q's or C's, such as by using two 4-ply Q's instead of two 3-ply Q's. In yet another example, a third face insert can have a peak thickness of 4.5 mm and an edge thickness of 3.9 mm, including 12 Q's and 3 C's, resulting in a mass of 26.2 g. Additional and different combinations of Q's and C's can be provided for a face insert 2110 with a mass between about 20 g and about 30 g, or between about 15 g and about 35 g.

TABLE 1

| ply 1 | ply 2 | ply 3 | ply 4 | ply 5 | ply 6 | ply 7 | ply 8 | AW g/m$^2$ |
|---|---|---|---|---|---|---|---|---|
| 0 | −60 | +60 | | | | | | 290-360 |
| 0 | −45 | +45 | 90 | | | | | 390-480 |
| 0 | +60 | 90 | −60 | 0 | | | | 490-600 |
| 0 | +45 | 90 | −45 | 0 | | | | 490-600 |
| 90 | +45 | 0 | −45 | 90 | | | | 490-600 |
| +45 | 90 | 0 | 90 | −45 | | | | 490-600 |
| +45 | 0 | 90 | 0 | −45 | | | | 490-600 |
| −60 | −30 | 0 | +30 | 60 | 90 | | | 590-720 |
| 0 | 90 | +45 | −45 | 90 | 0 | | | 590-720 |
| 90 | 0 | +45 | −45 | 0 | 90 | | | 590-720 |
| 0 | 90 | 45 | −45 | −45 | 45 | 0/90 woven | | 680-840 |
| 90 | 0 | 45 | −45 | −45 | 45 | 90/0 woven | | 680-840 |
| +45 | −45 | 90 | 0 | 0 | 90 | −45/45 woven | | 680-840 |

TABLE 1-continued

| | | | | | | | | |
|---|---|---|---|---|---|---|---|---|
| 0 | 90 | 45 | −45 | −45 | 45 | 90 UD | | 680-840 |
| 0 | 90 | 45 | −45 | 0 | −45 | 45 | 0/90 woven | 780-960 |
| 90 | 0 | 45 | −45 | 0 | −45 | 45 | 90/0 woven | 780-960 |

Figure 132A:
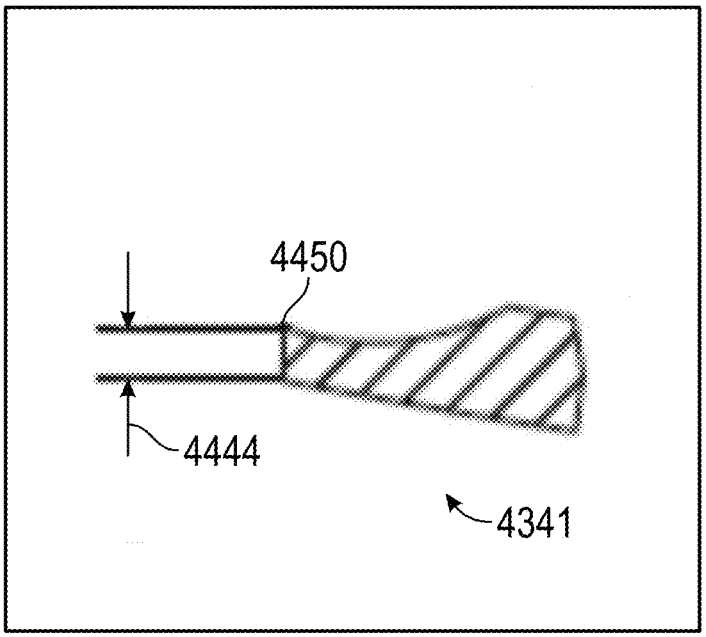

FIG. 132A is a section view of a heel portion 4341 of a face insert 2110. The heel portion 4341 can include a notch 4220. In embodiments with a chamfer on an inside edge of the face insert 2 110, no chamfer 4450 can be provided on the notch 4220. The notch 4420 can have a notch edge thickness 4444 less than the edge thickness 4345 of the face insert 2110. For example, the notch edge thickness 4444 can be between 1.5 mm and 2.1 mm, preferably 1.8 mm.

Figure 132B:
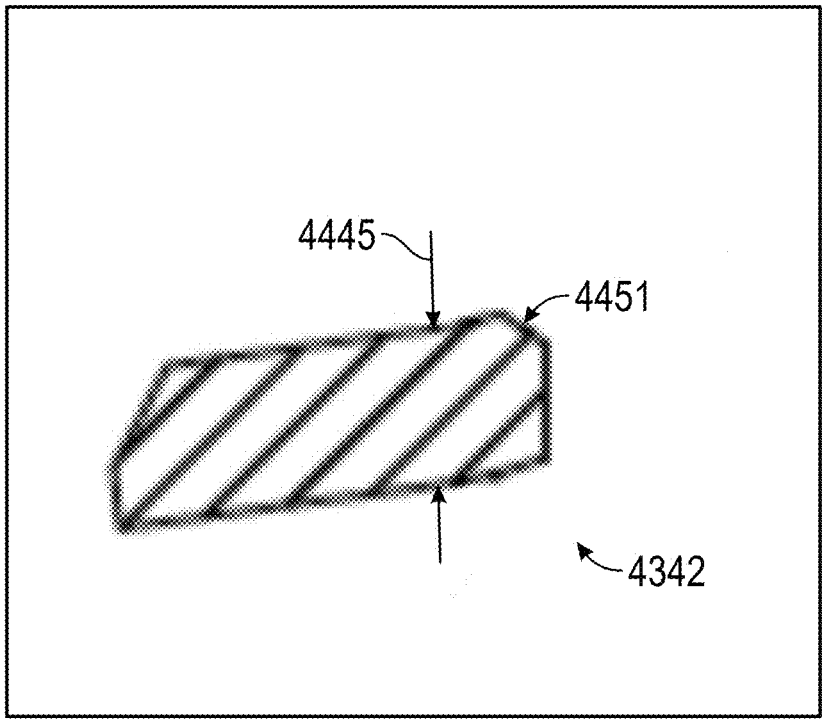

FIG. 132B is a section view of a toe portion 4342 of a face insert 2110. The toe portion 4342 includes a chamfer 4451 on the inside edge of the face insert 2110. In some embodiments, the edge thickness 4345 can be between about 3.35 mm and about 4.2 mm, preferably 3.65 mm±0.1 mm, 3.8 mm±0.1 mm, or 3.9 mm±0.1 mm.

Figure 133:
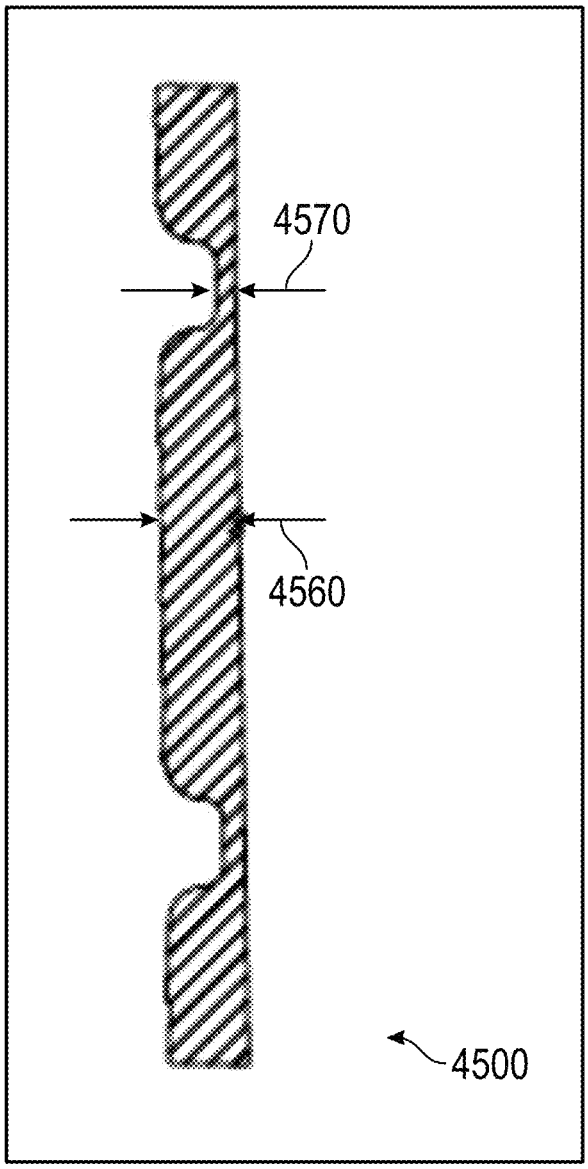

FIG. 133 is a section view of a polymer layer 4500 of a face insert 2110. The polymer layer 4500 can be provided on the outer surface of the face insert 2110 to provide for better performance of the face insert 2110, such as in wet conditions. Exemplary polymer layers are described in U.S. patent application Ser. No. 13/330,486 (patented as U.S. Pat. No. 8,979,669), which is incorporated by reference. The polymer layer 4500 may include polyurethane and/or other polymer materials. The polymer layer may have a polymer maximum thickness 4560 between about 0.2 mm and 0.7 mm or about 0.3 mm and about 0.5 mm, preferably 0.40 mm±0.05 mm. The polymer layer may have a polymer minimum thickness 4570 between about 0.05 mm and 0.15 mm, preferably 0.09 mm±0.02 mm. The polymer layer can be configured with alternating maximum thicknesses 4560 and minimum thicknesses 4570 to create score lines on the face insert 2110. Further, in some embodiments, teeth and/or another texture may be provided on the thicker areas of the polymer layer 4500 between the score lines.

In some embodiments, a method of assembling a golf club is provided. For example, the method includes providing a golf club head having a face opening with an internal hosel surface intruding into the face opening (e.g., forming a portion of the face opening). The golf club head can also include at least one of a crown opening and/or a sole opening. The method also includes attaching a composite face insert to the golf club body, where the face insert is machined from a composite plaque with a larger area than the finished face insert. For example, the composite face insert includes a machined perimeter chamfer and a machined in notch. The method further includes enclosing the face opening with the face insert, such as by attaching the face insert to the club head. In some embodiments, the internal hosel surface is received by the notch in the face insert. The method also includes enclosing one or more of the crown opening and/or sole opening with a crown insert and/or a sole insert. The method may further include attaching a golf club shaft having a shaft sleeve, and tightening a screw to attach the golf club shaft to the golf club head to form a golf club assembly. In some examples, the golf club head has a face progression less between 10 and 20 mm and a CFY between 9 and 18 mm, preferably less than 16 mm.

In some embodiments, the x-axis of the golf club head is tangential to the face and parallel to a ground plane, negative locations on the x-axis extend from the center face to the toe portion, and positive locations on the x-axis extend from the center face to the heel portion. In these embodiments, a center of gravity of the golf club body with respect to the x-axis (CGx) can be oriented from about 0 mm to about −10 mm.

In some embodiments, a method of counteracting a lateral dispersion tendency of a golf club head is provided. For example, the golf club head can have a face, a crown and a sole together defining an interior cavity, a body of the golf club head including a heel and a toe portion and having x, y and z axes which are orthogonal to each other and have their origin at the USGA center face (e.g., the z, y, and z origin axes as defined herein). The method can include providing a primary alignment feature comprising a line delineating a transition between at least a first portion of the crown having an area of contrasting shade or color with a shade or color of the face. The primary alignment feature can be hard tooled into the golf club head with the face of the golf club body, and the golf club head can have a first Sight Adjusted Perceived Face Angle (SAPFA) with respect to the primary alignment feature. The method also includes measuring the lateral dispersion tendency of the golf club head. The lateral dispersion tendency indicates an average dispersion from a center target line, where a positive lateral dispersion tendency is the average dispersion right of the center target line and a negative lateral dispersion tendency is the average dispersion left of the center target line. The method further includes adjusting the primary alignment feature to provide an adjusted primary alignment feature to counteract the lateral dispersion tendency of the golf club head and incorporating the adjusted primary alignment feature into the golf club head. The adjusted primary alignment feature can have a second Sight Adjusted Perceived Face Angle (SAPFA) of from about −2 to about 10 degrees and a second Radius of Curvature (circle fit) of from about 300 to about 1000 mm.

In some embodiments, the method can also include incorporating the adjusted primary alignment feature into the golf club head comprises retooling the golf club head. In some embodiments, adjusting the primary alignment feature counteracts the lateral dispersion tendency of the golf club head by providing for a positive lateral dispersion tendency for the golf club head. In some embodiments, adjusting the primary alignment feature counteracts the lateral dispersion tendency of the golf club head by providing for a negative lateral dispersion tendency for the golf club head. In some embodiments, adjusting the primary alignment feature counteracts the lateral dispersion tendency of the golf club head by reducing average dispersion from the center target line. In some embodiments, the primary alignment feature is hard tooled into the golf club head by bonding the face to the golf club body. In some embodiments, the golf club body is painted prior to bonding the face to the golf club body. In some embodiments, the adjusted primary alignment feature includes: a second Sight Adjusted Perceived Face Angle 25 mm Heelward (SAPFA25H) of from about −5 to about 2 degrees; a second Sight Adjusted Perceived Face Angle 25 mm Toeward (SAPFA25T) of from 0 to about 9 degrees; and a second Sight Adjusted Perceived Face Angle 50 mm Toeward (SAPFA50T) of from about 2 to about 9 degrees.

Composite face plate features are described in more detail in U.S. patent application Ser. Nos. 11/998,435, 11/642,310, 11/825,138, 11/823,638, 12/004,386, 12/004,387, 11/960,609, 11/960,610 and U.S. Pat. No. 7,267,620, which are herein incorporated by reference in their entirety.

FIGS. 134-144 illustrate another exemplary golf club head 5000. Similar to other club heads disclosed herein, the club head 5000 comprises a cast cup 5010 coupled to a separately formed rear ring 5012, along with a crown insert 5014, a sole insert 5016, an adjustable head-shaft connection assembly 5022, a sole channel 5024, a sole weight 5026, and a rear weight 5028. In the club head 5000, the cast cup 5010 includes a front opening 5040 and a separately formed face insert 5020 inserted into the front opening and coupled to the cast cup. In addition, the rear ring 5012 comprises a moldable material and the rear weight 5028 is co-molded with the rear ring, such that the rear weight is partially enclosed within the material of the rear ring.

The construction of the front opening 5040 of the cast cup 5010 and the face insert 5020, and how they are coupled together, can be similar to that described with regard to the embodiments described above with reference to FIGS. 117-133. The face plate 5020 can comprise a different material than the cast cup, and can be formed separately from the cast cup. The face plate 5020 can comprise any material suitable for striking a golf ball. In some embodiment, the face place comprises composite materials, as described with reference to FIGS. 117-133. The face plate 5020 can also comprise metallic materials, such as titanium alloys, and/or other materials described herein. The face plate 5020 can also comprise a cover layer (e.g., polyurethane) that covers and protects the front striking surface of the face plate, as described with reference to FIGS. 117-133.

The rear ring 5012 can be molded using polymeric materials, composite materials, reinforcing fibers, metallic materials, coatings, or combinations of these materials. The rear ring 5012 can be injection molded, for example. Fibers or other reinforcing materials can be added to the primarily polymeric material prior to molding, and external coatings can be added after molding. The molded rear ring can have sufficient rigidity and strength to resist substantial deformation or fracturing when in use, while providing a lightweight and highly shapable and customizable structure. For example, the rear ring can comprise a carbon or glass fiber reinforced polymeric material, which can have a density between 1 g/cc and 2 g/cc. The rear ring can be made with any external colors, textures, or patterns. The molded rear ring 5012 can be coupled to the cast cup 5010 via any suitable means, such as mechanical interlocking, adhesive bonding, RF welding, and/or other manners disclosed elsewhere herein. Molding the rear ring allows for the rear weight 5028 to be co-molded with the rear ring, such that the rear weight is fully or partially enclosed within the molding material of the rear ring. As shown in FIGS. 136 and 137, the rear weight 5028 is mostly surrounded by the molding material of the rear ring 5012, though parts of the rear weight are exposed. As shown in FIGS. 139 and 140, a rear surface of the rear weight 5028 is exposed through the rear ring 5012. This can provide a visual reminder that the rear weight is present. Also, as shown in FIGS. 142 and 144, the rear weight 5028 can comprise two forward prongs 5030. The prongs 5030 can project into and/or through the rear ring and help fix the rear weight and prevent the rear weight from rotating or otherwise moving relative to the rear ring. The prongs 5030 and the exposed rear surface of the rear weight 5028 can also help provide surfaces to retain the rear weigh to suspend it in place while the rear ring is molded around the rear weight. No separate fastener is required to secure the rear weight to the rear ring, reducing the total number of parts. Because the rear weight is co-molded within the rear ring, the rear weight may not be removable, adjustable, or interchangeable, as is the case with other rear weight embodiments disclosed herein that are fastened to the rear ring with a screw or similar fastener. The rear weight 5028 and the sole weight 5026 can otherwise have any of the material, mass, and location properties described elsewhere herein for other front/sole weights and rear weights (e.g., the sole weight 5026 can still be removable, adjustable, or interchangeable).

Using the cross-sectional side view of the club head 5000 in FIG. 137 for reference, each of the golf club heads described herein can have a peak face height 5050, a peak crown height 5052, a skirt height 5054, a center face height 5056, and a Z-up value 5058, all of which are measured from a ground plane (lower dashed line) when the club head is in the normal address position. The skirt height 5054 is measured from the ground plane to the point at the rearward most portion of the skirt where the upper portion (crown) transitions to the lower portion (sole). Further, a ratio of peak crown height to peak face height can range from 1.05 to 1.20, preferably between 1.10 and 1.18. The peak face height is located at the transition from the face to the crown, which typically transitions from a relatively flat surface into a more rounded surface having a significant change in curvature. In the embodiments described herein, the peak crown height or crown apex is located on the crown insert, which can be formed from a low density material, such as having a density range of 1 g/cc to 2 g/cc (e.g. carbon fiber reinforced polymeric material). Notably, the point of peak crown height can be located toeward of a geometric center of the striking face.

In some instances, a ratio of the skirt height to the peak crown height ranges between about 0.45 to 0.59, preferably 0.49-0.55, and in one embodiment the skirt height is about 34 mm and the peak crown height is about 65 mm, resulting in a ratio of skirt height to peak crown height of about 0.52. A skirt height typically ranges between 28 mm and 38 mm, preferably between 31 mm and 36 mm. In some instances, the skirt height can be greater than Z-up as measured along a z-axis relative to the ground plane. Additionally, in some instances, the peak skirt height can be greater than a distance to the geometric center of the strike face as measured along a z-axis relative to the ground plane. A peak crown height typically ranges between 60 mm and 70 mm, preferably between 62 mm and 67 mm. It can be desirable to limit a difference between the peak crown height and the skirt height to no more than 40 mm, preferably between 27 mm and 35 mm. It can be desirable for the skirt height to be the same as or greater than a Z-up value for the golf club head (defined as the vertical distance along a z-axis from the ground plane to the center of gravity). It can be desirable for the peak crown height to be at least two times (2×) larger than the Z-up value for the golf club head. A greater skirt height can help with better aerodynamics and better air flow attachment, especially for faster swing speeds. Likewise, if the difference between the peak crown height and skirt height is too great there can be a greater likelihood of the flow separating early from the golf club head (i.e., increased likelihood of turbulent flow). The ratios just described are applicable to all the embodiments disclosed herein, especially those shown in FIGS. 37-149 and examples of the embodiments having these features are shown in FIGS. 128 and 129 (club head 3200), FIG. 104 (club head 2000), FIG. 137 (club head 5000), FIGS. 146 and 149 (club head 6000), FIG. 58 (club head 1000), FIG. 59 (club head 1100), FIG. 87 (club head 1800), and club heads 1200, 1300, 1400, 1500, 1600, and 1700.

The construction and material diversity of the golf club heads described herein enables a desirable center-of –gravity (CG) location and peak crown height location (PCH location). In one example, a y-axis coordinate, on the y-axis of the club head origin coordinate system, of the PCH location is between about 26 mm and about 42 mm. In the same or a different example, a distance parallel to the z-axis of the club head origin coordinate system, from the ground plane 181, when the golf club head 100 is in the normal address position, of the PCH location ranges between 60 mm and 70 mm, preferably between 62 mm and 67 mm as described above. According to some examples, a y-axis coordinate, on the y-axis of the head origin coordinate system 185, of the center-of –gravity (CG) of the golf club head 100 ranges between 30 mm and 50 mm, preferably between 32 mm and 38 mm, more preferably between 36.5 mm and 42 mm, an x-axis coordinate, on the x-axis of the head origin coordinate system 185, of the center-of –gravity (CG) of the golf club head 100 ranges between –10 mm and 10 mm, preferably between –6 mm and 6 mm, and a z-axis coordinate, on the z-axis of the head origin coordinate system 185, of the center-of –gravity (CG) of the golf club head 100 ranges between –10 mm and 2 mm, preferably between –7 mm and –2 mm.

FIGS. 145-149 illustrate another exemplary golf club head 6000. Similar to other club heads disclosed herein, the club head 6000 comprises a cast cup 6010 coupled to a separately formed rear ring 6012, along with a crown insert 6014, a sole insert 6016, a face insert 6020, an adjustable head-shaft connection assembly 6022 including screw 6021, a sole channel 6024 and plug 6070, and a rear weight 6028 with screw 6029 and nut 6027. The club head 6000 can comprise any combination of the variations disclosed herein for the cast cup, face insert, rear ring, rear weight, etc. The club head 6000 also includes a weight assembly 6050 that is adjustably positionable along a weight track 6060 formed in the sole of the cast cup 6010. Any of the other club heads disclosed herein can alternatively include such a weight assembly and weight track, such as instead of a non-sliding front weight/sole weight like the weight 5026.

The weight track 6060 can be positioned in the sole of the cast cup 6010 just rearward of the sole channel 6024, as shown in FIG. 145. FIG. 147 shows interior surfaces of the weight track, including various reinforcing ribs to provide structural support. The weight track 6060 can be oriented to extend in a heel-toe direction, and can extend from adjacent the hosel at the heel end to adjacent the CT tuning port 6025 at the toe end. The internal surface of the weight track 6060 can include plural heel-toe extending reinforcing ribs 6062, which can extend between the hosel region at the heel and the toe end of the cup 6010, as well as plural front-to –rear extending reinforcing ribs 6064, which can extend between the sole channel 6024 and the rear ledge of the cup that receives the sole insert.

Generally, the weight track 6060 and weight assembly 6050 can be similar to the weight tracks 214, 216 and two-piece slidable weight assemblies 210, 212 described elsewhere herein. As shown in FIG. 146, the weight track 6060 can include one or more ledges running along the front and/or rear sides of the weight track to provide surfaces for the weight assembly 6050 to clamp on to, and to help retain the weight assembly within the track. As shown in FIG. 145, one or more ledges can terminate short of the toe end of the track to provide an enlarged opening in the track for inserting and removing the weight assembly.

The weight assembly can comprise two pieces, an inner piece and an outer piece, that are threadably coupled together, such that rotating the inner piece (e.g., using an wrench) relative to the outer piece moves the two pieces closer together to clamp them onto the ledge(s) of the weight track or moves the two pieces apart to loosen the weight assembly. The inner piece can have a rounded shape to allow it to rotate freely within the track, while the outer piece can have a polygonal (or otherwise non-circular) shape that fits between the walls of the track and doesn't allow the outer piece to rotate within the track. Thus, the outer piece is held stationary while the user rotates the inner piece to tighten or loosen the assembly in the track.

As shown in FIG. 145, the sole insert 6014 can be reduced in size and the sole of the cast cup 6010 increased in size (especially in the front-rear direction) to accommodate the weight track 6060, compared to the sole geometry of the club head 5000, which includes the stationary sole weight 5026 and associated weight port instead. While adding a weight track can comparatively add mass to the cast cup, the range of positions for the weight assembly 6050 along the track can add substantial adjustability and customizability for the mass distribution and inertial properties of the club head.

Club heads having a weight track and sliding weight assembly as in the club head 6000 can have any type of rear ring and rear weight, such as any of the rear ring and rear weight combinations disclosed elsewhere herein. In the illustrated example, the club head 6000 comprises an externally attachable rear weight 6028 that is coupled to the rear ring 6012 with an external screw 6029 (see FIGS. 147 and 148), such that the rear weight is removable and interchangeable with other rear weights having different masses, colors, etc. The club head 6000 can also include an anti-rotation nut 6027 that fits between the weight 6028 and the ring 6012 and receives the screw 6029. The nut 6027 includes non-circular surfaces, such as flat indentions on its sides as illustrated, that mate with complimentary surfaces of the ring and/or weight and prevent the weight from rotating relative to the ring when secured together with the screw.

The rear ring 6012 can comprise metallic materials (e.g., Ti alloy, steel, aluminum, etc.), polymeric materials, composite materials, and/or any other materials and coatings disclosed herein, and any method of formation and attachment disclosed herein. The face insert 6020 can comprise any materials (e.g., metallic or composite materials), have any geometry, and have any method of formation and attachment disclosed herein. The face insert 6020 can also comprise an external coating layer 6021 on the front striking surface, which can comprise polyurethane or other materials disclosed herein.

Additional Embodiments of the Disclosed Technology

A. A wood-type golf club head comprising:

a cast cup comprising a forward portion of the club head, including a hosel, a forward portion of a crown, and a forward portion of a sole, wherein the cast cup comprises titanium or titanium alloy;

a rear ring formed separately from the cast cup and coupled to heel and toe portions of the cast cup to form a club head body, the club head body defining a hollow interior region, a crown opening, and a sole opening, wherein the rear ring has a density between 1 g/cc and 4 g/cc;

a crown insert covering the crown opening; and a sole insert covering the sole opening;

wherein the rear ring comprises a heel engagement portion at a heel end of the rear ring and a toe engagement portion at a toe end of the rear ring, and wherein the heel engagement portion of the rear ring mechanically interlocks with the heel portion of the cast cup and the toe engagement portion of the rear ring mechanically interlocks with the toe portion of the cast cup.

B. The club head of embodiment A, wherein the heel engagement portion of the rear ring is also adhesively bonded or welded to the heel portion of the cast cup and the toe engagement portion of the rear ring is also adhesively bonded or welded to the toe portion of the cast cup.

C. The club head of embodiment A, wherein the heel engagement portion and the toe engagement portions of the rear ring are squeezed toward each other to engage the rear ring with the cast cup.

D. The club head of embodiment A, wherein the heel engagement portion and the toe engagement portions of the rear ring include projections or notches that mechanically interlock with corresponding features on the heel and toe portions of the cast cup.

E. The club head of embodiment A, wherein the heel end of the rear ring is lower than the toe end of the rear ring along a vertical z-axis.

F. The club head of embodiment A, wherein the rear ring comprises an arcuate elongated member forming a generally U-shape between the toe end of the rear ring and the heel end of the rear ring, the arcuate elongated member defines a curved longitudinal axis extending along the arcuate elongated member between the toe end of the rear ring and the heel end of the rear ring, and the arcuate elongated member is twisted about the longitudinal axis.

G. A wood-type golf club head comprising:

a cast cup comprising a forward portion of the club head, including a hosel, a forward portion of a crown, and a forward portion of a sole, wherein the cast cup comprises titanium or titanium alloy;

a rear ring formed separately from the cast cup and coupled to heel and toe portions of the cast cup to form a club head body, the club head body defining a hollow interior region, a crown opening, and a sole opening, wherein the rear ring has a density between 1 g/cc and 4 g/cc;

a crown insert coupled to the crown opening;

a sole insert coupled to the sole opening;

a first weight coupled to the forward portion of the sole, the first weight comprising a material that has greater density than the cast cup; and a second weight coupled to a rearward portion of the rear ring, the second weight comprising a material that has greater density than the rear ring.

H. The club head of embodiment G, wherein the first weight is positioned at a heel side of the cast cup adjacent the hosel.

I. The club head of embodiment G, wherein the first weight is detachable from the forward portion of the sole.

J. The club head of embodiment G, wherein the second weight is co-molded with the rear ring and at least partially surrounded by the rear ring.

K. The club head of embodiment G, wherein the forward portion of the sole comprises a weight track that extends in a heal-toe direction, and the first weight is positioned in the weight track and is adjustably positionable in a heal-toe direction along the weight track.

L. A wood-type golf club head comprising:

a cast cup comprising a forward portion of the club head, including a hosel, a forward portion of a crown, and a forward portion of a sole, wherein the cast cup comprises titanium or titanium alloy and has a density greater than 4 g/cc;

a rear ring formed separately from the cast cup and coupled to heel and toe portions of the cast cup to form a club head body, the club head body defining a hollow interior region, a crown opening, and a sole opening, wherein the rear ring has a density between 1 g/cc and 3 g/cc;

a crown insert coupled to the crown opening;

a sole insert coupled to the sole opening; and a rear weight coupled to a rearward portion of the rear ring, the rear weight comprising a material that has greater density than the rear ring;

wherein the club head has an $I_{zz}$ greater than 450 kg*mm$^2$, an $I_{xx}$ greater than 300 kg*mm$^2$, and a Delta 1 between 21 mm and 26 mm.

M. The club head of embodiment L, wherein the club head body comprises a crown ledge with a crown ledge bond area that bonds to the crown insert, and wherein the rear ring forms 25% to 65% of the crown ledge bond area.

N. The club head of embodiment L, wherein the club head body comprises a sole ledge with a sole ledge bond area that bonds to the sole insert, and wherein the rear ring forms 25% to 65% of the sole ledge bond area.

O. The club head of embodiment L, wherein the sole insert has a greater mass than the crown insert.

P. The club head of embodiment L, wherein the sole insert has a greater thickness than the crown insert.

Q. The club head of embodiment L, wherein the sole insert and the crown insert are both formed from plural plies of material, and the sole insert comprises more plies than the crown insert.

R. The club head of embodiment L, wherein the club head comprises a strike surface and the crown insert forms a peak crown height of the club head, and the peak crown height is located toeward of a geometric center of the strike surface.

S. The club head of embodiment L, wherein the club head comprises a strike surface and the crown insert forms a peak crown height of the club head, the peak crown height is located toeward of a geometric center of the strike surface, and a ratio of a skirt height to the peak crown height of the club head ranges between about 0.45 to 0.59.

T. The club head of embodiment L, wherein the club head comprises a strike surface and the crown insert forms a peak crown height of the club head, the peak crown height is located toeward of a geometric center of the strike surface, and the peak crown height is at least two times (2*x*) larger than a Z-up value of the club head.

U. The club head of embodiment L, wherein a ratio of a mass of the cast cup divided by a mass of the rear ring is between 3.5 to 7.5.

V. The club head of embodiment L, wherein a ratio of a mass of the rear weight divided by a mass of the rear ring is between 0.60 to 1.9.

W. The club head of embodiment L, wherein the rear ring has a mass of between 12 g and 24 g.

X. The club head of embodiment L, wherein the rear ring comprises anodized aluminum.

Y. The club head of embodiment L, wherein the rear ring comprises a polymeric material.

Z. The club head of embodiment Y, wherein the rear weight is co-molded with the rear ring and at least partially surrounded by rear ring.

AA. The club head of embodiment L, wherein the cast cup further comprises a face portion that has a variable thickness profile, the face portion being integrally formed with the hosel, the forward portion of a crown, and the forward portion of a sole.

BB. The club head of embodiment L, wherein the cast cup defines a face opening at a front side of the cast cup, and wherein the club head further comprises a face insert that is coupled to the face opening.

CC. The club head of embodiment V, wherein the face insert comprises a composite material.

DD. The club head of embodiment L, wherein the rear ring comprises a fiber reinforced polymeric material having a density between 1 g/cc and 2 g/cc.

EE. The club head of embodiment L, wherein the rear ring comprises a heel engagement portion at a heel end of the rear ring and a toe engagement portion at a toe end of the rear ring, and wherein the heel engagement portion of the rear ring mechanically interlocks with a heel portion of the cast cup and the toe engagement portion of the rear ring mechanically interlocks with the toe portion of the cast cup.

General Considerations

For purposes of this description, certain aspects, advantages, and novel features of the embodiments of this disclosure are described herein. The described methods, systems, and apparatus should not be construed as limiting in any way. Instead, the present disclosure is directed toward all novel and non-obvious features and aspects of the various disclosed embodiments, alone and in various combinations and sub-combinations with one another. The disclosed methods, systems, and apparatus are not limited to any specific aspect, feature, or combination thereof, nor do the disclosed methods, systems, and apparatus require that any one or more specific advantages be present, or problems be solved.

Features, properties, characteristics, materials, values, ranges, or groups described in conjunction with a particular aspect, embodiment or example of the disclosure are to be understood to be applicable to any other aspect, embodiment or example described herein unless incompatible therewith. All of the features disclosed in this specification (including any accompanying claims, abstract, and drawings), and/or all of the steps of any method or process so disclosed, may be combined in any combination, except combinations where at least some of such features and/or steps are mutually exclusive. The disclosure is not restricted to the details of any foregoing embodiments. The disclosure extends to any novel one, or any novel combination, of the features disclosed in this specification (including any accompanying claims, abstract, and drawings), or to any novel one, or any novel combination, of the steps of any method or process so disclosed.

Although the operations of some of the disclosed methods are described in a particular, sequential order for convenient presentation, this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods, systems, and apparatus can be used in conjunction with other systems, methods, and apparatus.

As used herein, the terms "a," "an," and "at least one" encompass one or more of the specified element. That is, if two of a particular element are present, one of these elements is also present and thus "an" element is present. The terms "a plurality of" and "plural" mean two or more of the specified element. As used herein, the term "and/or" used between the last two of a list of elements means any one or more of the listed elements. For example, the phrase "A, B, and/or C" means "A," "B," "C," "A and B," "A and C," "B and C," or "A, B, and C." As used herein, the term "coupled" generally means physically coupled or linked and does not exclude the presence of intermediate elements between the coupled items absent specific contrary language.

Directions and other relative references (e.g., inner, outer, upper, lower, etc.) may be used to facilitate discussion of the drawings and principles herein, but are not intended to be limiting. For example, certain terms may be used such as "inside," "outside,", "top," "down," "interior," "exterior," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" part can become a "lower" part simply by turning the object over. Nevertheless, it is still the same part and the object remains the same. As used herein, "and/or" means "and" or "or," as well as "and" and "or."

In view of the many possible embodiments to which the principles of the disclosure may be applied, it should be recognized that the illustrated embodiments are only preferred examples and should not be taken as limiting the scope of the disclosure. Various modifications may be made thereto without departing from the broader spirit and scope of the disclosure as set forth. The specification and drawings are, accordingly, to be regarded in an illustrative sense rather than a restrictive sense. Accordingly, the scope of the disclosure is at least as broad as the following claims. We therefore claim all that comes within the scope of these claims and their equivalents.

The invention claimed is:

1. A wood-type golf club head comprising:

a cup comprising a forward portion of the club head, including a hosel, a forward portion of a crown, and a forward portion of a sole, wherein the cup comprises a cup material and has a cup mass of at least 75 grams;

a face portion that is either integrally formed with the cup or formed separately from the cup and joined to the cup, wherein the face portion is positioned at a front end of the cup, the face portion including a geometric center defining an origin of a coordinate system when the club head is ideally positioned, the coordinate system including an x-axis being tangent to the face portion at the origin and parallel to a ground plane, a y-axis intersecting the origin being parallel to the ground plane and orthogonal to the x-axis, and a z-axis intersecting the origin being orthogonal to both the x-axis and the y-axis;

a rear ring formed separately from the cup and coupled to heel and toe portions of the cup to form a club head body, the club head body defining a hollow interior region, a crown opening, and a sole opening, wherein the rear ring comprises a ring material having a density between 1 g/cc and 3 g/cc and a rear ring mass of no more than 50 grams, and defines a rearward most point of the club head having a skirt height of at least 20 mm, and the ring material is different than the cup material;

a crown insert coupled to the crown opening;

a sole insert coupled to the sole opening; and a rear weight coupled to a rearward portion of the rear ring, the rear weight comprising a material that has greater density than the rear ring, the rear weight having a rear weight mass of no more than 40 grams, having a rear weight origin y-axis coordinate of 90 mm to 120 mm, and a rear weight origin z-axis coordinate of −30 mm to 10 mm;

wherein the club head defining a center of gravity (CG), the CG being a distance $CG_Y$ from the origin as measured along the y-axis of 30-50 mm, a distance $CG_Z$ from the origin as measured along the z-axis of less than 2 mm, and an elevation $Z_{up}$ measured vertically from the ground plane;

wherein the club head has a center-face y-axis (CFY) distance of 9-18 mm and a face progression (FP) distance of 12-21 mm, and a difference between the FP distance and the CFY distance is 2-12 mm;

wherein the club head has an $I_{zz}$ greater than 450 kg*mm$^2$, an $I_{xx}$ greater than 300 kg*mm$^2$, and a combined sum of $I_{zz}$ and $I_{xx}$ of no more than 1100 kg*mm$^2$;

wherein the sole opening has a forward boundary defined by the cup and a rear boundary defined by the rear ring, and the sole insert has a forward portion that is coupled to the cup and a rear portion that is coupled to the rear ring;

wherein the sole insert extends from the heel portion of the cup, across the sole opening, and to the toe portion of the cup;

wherein a ratio of the cup mass to the rear ring mass is greater than 3; and wherein the combined sum of $I_{zz}$ and $I_{xx}$ is at least 820 kg*mm$^2$, the rear ring mass is 10-40 grams, and the crown insert forms a peak crown height of at least 2 times $Z_{up}$.

2. The club head of claim 1, wherein the ratio of the cup mass to the rear ring mass is between 3.5 to 7.5.

3. The club head of claim 1, wherein a ratio of the rear weight mass to the rear ring mass is between 0.60 to 1.9.

4. The club head of claim 1, wherein the rear weight is mechanically attached to the rear ring with a screw having a screw mass, and a combined mass of the rear ring mass, the rear weight mass, and the screw mass is no more than 60 grams.

5. The club head of claim 1, wherein a peak crown height is located toeward of the origin and at least 26 mm from the origin when measured along the y-axis.

6. The club head of claim 5, wherein the peak crown height is located no more than 42 mm from the origin when measured along the y-axis.

7. The club head of claim 6, further including a front mass element coupled to the cup and having a front mass element mass of 2-25 grams.

8. The club head of claim 7, wherein the front mass element is attached to a weight track formed in the cup and extending from the heel portion of the cup to the toe portion of the cup.

9. The club head of claim 7, wherein the front mass element has a front mass element origin y-axis coordinate of no more than 30 mm.

10. The club head of claim 9, wherein the front mass element has a front mass element origin z-axis coordinate of −20 mm to −30 mm, and the front mass element mass is no more than 20 grams.

11. The club head of claim 9, wherein the rear weight is mechanically attached to the rear ring with a screw having a screw mass, and a combined mass of the rear ring mass, the rear weight mass, and the screw mass is no more than 50 grams.

12. The club head of claim 9, wherein the sole insert and the crown insert are both formed from a plurality of plies of material, and the sole insert comprises more plies than the crown insert.

13. The club head of claim 1, wherein the rear ring comprises a polymeric material.

14. The club head of claim 13, wherein the rear ring comprises a fiber reinforced polymeric material having a density between 1 g/cc and 2 g/cc.

15. The club head of claim 1, wherein a location where the rear ring is coupled to the heel portion or the toe portion of the cup is spaced at least 20 mm rearward of a center face of the club head as measured along the y-axis.

16. The club head of claim 1, wherein the skirt height is at least 25 mm.

17. The club head of claim 16, wherein the combined sum of $I_{zz}$ and $I_{xx}$ is at least 840 kg*mm$^2$, the rear ring mass is no more than 30 grams, and the skirt height is no more than 40 mm.

18. The club head of claim 17, wherein the skirt height is greater than $Z_{up}$, the center-face y-axis (CFY) distance is 11-16 mm and the face progression (FP) distance is 13-19.5, the distance $CG_Z$ is less than 3 mm, the cup mass is at least 80 grams, the rear weight mass is no more than 30 grams, and the peak crown height is 60-70 mm.

19. The club head of claim 18, wherein the skirt height is greater than an elevation of the origin measured vertically from the ground plane, and a ratio of the skirt height to the peak crown height is between about 0.45 to 0.59.

20. The club head of claim 19, wherein the ratio of the skirt height to the peak crown height is less than 0.55.

21. The club head of claim 20, wherein the ratio of the skirt height to the peak crown height is at least 0.49.

22. The club head of claim 18, wherein the rear ring mass is no more than 25 grams, the ratio of the cup mass to the rear ring mass is greater than 4.

23. The club head of claim 18, wherein:

the cup defines a face opening at a front side of the cup, the face portion comprises a face insert that is coupled to the face opening, and the face insert comprises a composite material.

24. The club head of claim 1, wherein:

the cup defines a face opening at a front side of the cup, the face portion comprises a face insert that is coupled to the face opening, and the face insert comprises a composite material.

25. The club head of claim 6, wherein:

the cup defines a face opening at a front side of the cup, the face portion comprises a face insert that is coupled to the face opening, and the face insert comprises a composite material.

26. The club head of claim 17, wherein:

the cup defines a face opening at a front side of the cup, the face portion comprises a face insert that is coupled to the face opening, and the face insert comprises a composite material.

* * * * *